US011619105B2

(12) United States Patent
Comeaux et al.

(10) Patent No.: US 11,619,105 B2
(45) **Date of Patent: *Apr. 4, 2023**

(54) APPARATUS AND METHODS FOR PISTON-STYLE DRILLING MUD SCREEN SYSTEM

(71) Applicant: Black Diamond Oilfield Rentals LLC, Houston, TX (US)

(72) Inventors: Don A. Comeaux, Houston, TX (US); Charles G. Kibbe, New Iberia, LA (US)

(73) Assignee: Black Diamond Oilfield Rentals LLC, Houston, TX (US)

( * ) Notice: Subject to any disclaimer, the term of this patent is extended or adjusted under 35 U.S.C. 154(b) by 166 days.

This patent is subject to a terminal disclaimer.

(21) Appl. No.: 17/123,401

(22) Filed: Dec. 16, 2020

(65) Prior Publication Data

US 2021/0102432 A1 Apr. 8, 2021

Related U.S. Application Data

(63) Continuation-in-part of application No. 16/677,084, filed on Nov. 7, 2019, now Pat. No. 11,156,042, which is a continuation-in-part of application No. 16/230,597, filed on Dec. 21, 2018, now Pat. No. 11,021,917, which is a continuation-in-part of (Continued)

(51) Int. Cl.

| | |
|---|---|
| ***E21B 21/06*** | (2006.01) |
| ***E21B 21/10*** | (2006.01) |
| ***E21B 21/08*** | (2006.01) |

(52) U.S. Cl.
CPC ..... *E21B 21/065* (2013.01); *E21B 21/08* (2013.01); *E21B 21/10* (2013.01)

(58) Field of Classification Search
CPC ..... E21B 21/065; E21B 21/08; E21B 21/10; E21B 21/12
See application file for complete search history.

(56) References Cited

U.S. PATENT DOCUMENTS

| | | | |
|---|---|---|---|
| 4,226,726 | A | 10/1980 | Rehm |
| 4,421,170 | A | 12/1983 | Swift et al. |
| 6,263,969 | B1 | 7/2001 | Stoesz et al. |

(Continued)

OTHER PUBLICATIONS

International Search Report and Written Opinion corresponding to PCT/US2020/059416, dated Feb. 4, 2021, 12 pages.

(Continued)

*Primary Examiner* — Nicole Coy
(74) *Attorney, Agent, or Firm* — Foley & Lardner LLP

(57) ABSTRACT

A drilling mud screen comprising a first body having a first end and a second end and a first centerline, a filter having a first end, a second end, and openings, wherein the second end of the filter is fluidly connected to the first end of the first body via a first connection and/or an optional first end retaining ring, a first end cap fluidly connected at the first end of the filter via a second connection, wherein the filter has an optional retaining ring disposed between the first connection and the second connection a drilling mud inlet at the openings of the filter, and a drilling mud outlet at the second end of the first body is disclosed. Methods of installing and using the drilling mud screen system are also disclosed.

91 Claims, 82 Drawing Sheets

Related U.S. Application Data application No. 15/959,070, filed on Apr. 20, 2018, now Pat. No. 11,028,656.

(60) Provisional application No. 62/598,521, filed on Dec. 14, 2017, provisional application No. 62/491,700, filed on Apr. 28, 2017.

(56) References Cited

U.S. PATENT DOCUMENTS

| | | | | |
|---|---|---|---|---|
| 6,517,125 | B2 | 2/2003 | Brisco | |
| 6,598,685 | B1 | 7/2003 | Mashburn | |
| 6,782,952 | B2 | 8/2004 | Garay et al. | |
| 6,976,546 | B2 | 12/2005 | Herst | |
| 7,243,740 | B2 | 7/2007 | Frith | |
| 7,913,760 | B2 | 3/2011 | Robichaux et al. | |
| 8,127,867 | B1 | 3/2012 | Droke | |
| 8,381,808 | B2 | 2/2013 | Rogers et al. | |
| 8,695,715 | B2 | 4/2014 | Rogers et al. | |
| 9,151,124 | B2 | 10/2015 | Iblings et al. | |
| 9,353,605 | B2 | 5/2016 | Hailey et al. | |
| 9,598,919 | B1 * | 3/2017 | Cantrell | E21B 23/006 |
| 9,624,727 | B1 | 4/2017 | Hutton | |
| 9,677,361 | B2 | 6/2017 | Patterson | |
| 10,280,719 | B1 | 5/2019 | O'Neal | |
| 10,323,484 | B2 | 6/2019 | Liess | |
| 10,415,352 | B2 | 9/2019 | Thomas et al. | |
| 10,513,899 | B2 | 12/2019 | Cherewyk | |
| 10,557,323 | B2 | 2/2020 | Pope | |
| 2003/0136584 | A1 | 7/2003 | Risher et al. | |
| 2003/0150616 | A1 | 8/2003 | Mashburn | |
| 2004/0079551 | A1 | 4/2004 | Herst | |
| 2006/0065443 | A1 | 3/2006 | Hall et al. | |
| 2008/0087433 | A1 | 4/2008 | Mashburn et al. | |
| 2013/0306304 | A1 | 11/2013 | Cherewyk et al. | |
| 2015/0101804 | A1 | 4/2015 | Vu | |
| 2015/0198016 | A1 | 7/2015 | Langlais | |
| 2015/0267511 | A1 * | 9/2015 | Patterson | E21B 27/005 166/381 |
| 2016/0327191 | A1 | 11/2016 | Walker et al. | |
| 2017/0058644 | A1 | 3/2017 | Andreychuk et al. | |
| 2018/0128067 | A1 | 5/2018 | Gao et al. | |
| 2018/0135371 | A1 | 5/2018 | Cherewyk | |
| 2018/0258721 | A1 | 9/2018 | Pawar et al. | |
| 2018/0306000 | A1 | 10/2018 | Deboer | |
| 2018/0313178 | A1 | 11/2018 | Biggerstaff et al. | |
| 2019/0085663 | A1 | 3/2019 | Thomas et al. | |
| 2019/0106954 | A1 | 4/2019 | Brown-Kerr et al. | |
| 2019/0112884 | A1 | 4/2019 | Biggerstaff et al. | |
| 2019/0128454 | A1 | 5/2019 | Chirko et al. | |
| 2019/0264546 | A1 | 8/2019 | O'Neal | |

OTHER PUBLICATIONS

International Search Report and Written Opinion of PCT/US2020/059134, dated Mar. 10, 2021, 24 pages.
PCT Aug. 30, 2018 International Search Report and Written Opinion mailed for International Patent Application No. PCT/US2018/029620, filed Apr. 26, 2018, 13 pages.
PCT Nov. 7, 2019 International Preliminary Report on Patentability and Written Opinion mailed for International Patent Application No. PCT/US2018/029620, filed Apr. 26, 2018, 10 pages.
Final Office Action on U.S. Appl. No. 15/959,070 dated Aug. 26, 2020, 14 pages.
Final Office Action on U.S. Appl. No. 16/230,597 dated Jun. 2, 2020, 8 pages.
International Search Report and Written Opinion on PCT/US2020/058868 dated Mar. 10, 2021, 19 pages.
Non-Final Office Action on U.S. Appl. No. 15/959,070 dated Jun. 23, 2020, 18 pages.
Non-Final Office Action on U.S. Appl. No. 16/230,597 dated Nov. 17, 2020, 8 pages.
Non-Final Office Action on U.S. Appl. No. 15/959,070 dated Apr. 20, 2020 (16 pages).
Non-Final Office Action on U.S. Appl. No. 16/230,597 dated Apr. 28, 2020 (7 pages).
Notice of Allowance on U.S. Appl. No. 15/959,070 dated Jan. 6, 2021, 6 pages.
Notice of Allowance on U.S. Appl. No. 16/230,597 dated Mar. 9, 2021, 5 pages.
U.S. Office Action on U.S. Appl. No. 16/677,084 dated Mar. 23, 2021, 14 pages.
Foreign Action other than Search Report on PCT PCT/US2020/058868 dated May 19, 2022, 15 pages.
Non-Final Office Action on U.S. Appl. No. 17/083,201 dated Jul. 28, 2022, 16 pages.
Non-Final Office Action on U.S. Appl. No. 17/010,678 dated Dec. 13, 2022.
Non-Final Office Action on U.S. Appl. No. 17/126,415 dated Sep. 14, 2022.

* cited by examiner

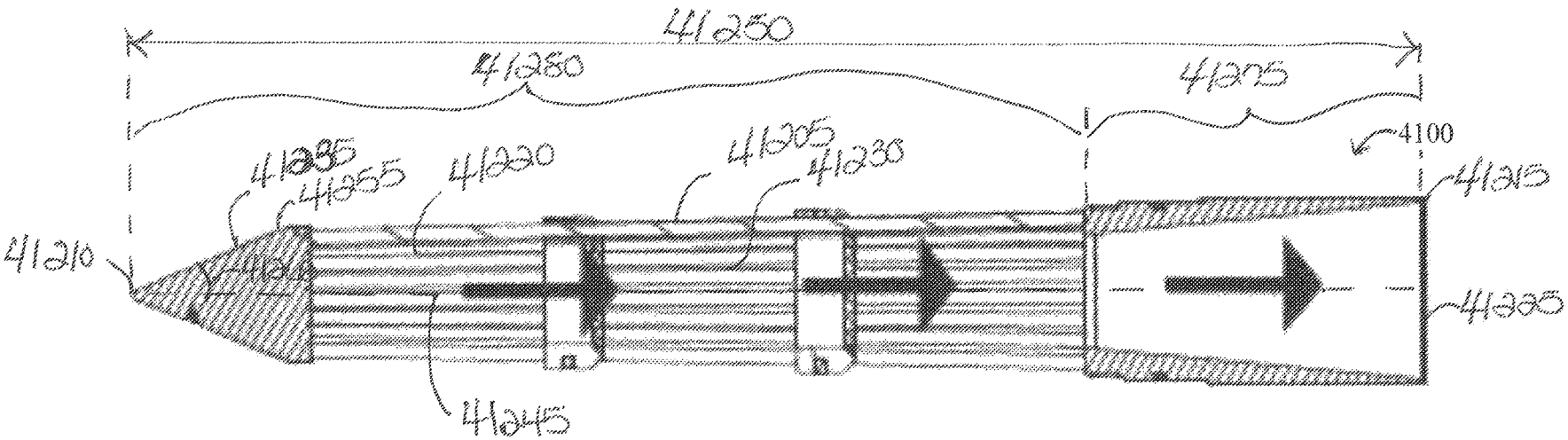
4100
4125
4125
4125

APPARATUS AND METHODS FOR PISTON-STYLE DRILLING MUD SCREEN SYSTEM

PRIOR RELATED APPLICATIONS

This application is a continuation-in-part of U.S. Nonprovisional patent application Ser. No. 16/677,084 entitled "Piston-Style Drilling Mud Screen System and Methods Thereof," filed on Nov. 7, 2019, which is a continuation-in-part of U.S. Nonprovisional patent application Ser. No. 16/230,597 entitled "Piston-Style Drilling Mud Screen System and Methods Thereof," filed on Dec. 21, 2018, which is a continuation-in-part of U.S. Nonprovisional patent application Ser. No. 15/959,070 entitled "Drilling Mud Screen System and Methods Thereof," filed on Apr. 20, 2018, which claims the benefit of U.S. Provisional Patent Application Ser. No. 62/598,521 entitled "Improved Drilling Mud Screen System and Methods Thereof," filed on Dec. 14, 2017, and U.S. Provisional Patent Application Ser. No. 62/491,700 entitled "Drilling Mud Screen System and Methods Thereof," filed on Apr. 28, 2017.

FEDERALLY SPONSORED RESEARCH STATEMENT

Not Applicable (N/A)

REFERENCE TO MICROFICHE APPENDIX

N/A

FIELD OF INVENTION

The present invention relates generally to an improved drilling mud screen system and methods thereof and, more particularly, to an improved, piston-style drilling mud screen system with a drilling mud screen puller/installer tool and methods thereof.

BACKGROUND OF THE INVENTION

Many drilling rigs use drill pipe mud screens that are in-line with the drilling assembly. Typically, drilling mud screens, commonly Type 3 drilling mud screens, are installed on the drill floor or at the bottom of the drill string. If the drilling mud screen is installed on the drill floor, the drilling mud screen must be reinstalled or replaced every time a section of stand pipe is added to the drill string. In other words, the drilling mud screens must be installed at the top of each 90-foot stand of pipe above the rig crew. As each stand of drill pipe is drilled down to the derrick floor, the top drive sub-connection is separated from the drill pipe stand connection and the drilling mud screen is installed to the top of the next stand of pipe going in the hole. This is a dangerous practice that can result in accidents to the crew below.

Although the Type 3 drilling mud screen appears to work for single-shoulder API rotary shouldered connection types, it does not work for proprietary double-shoulder high-strength connection types that eliminate the space where the drilling mud screen is typically located inside the pipe. Instead, the nose of the double-shoulder pin connection on the top of the drive sub-connection is decreased to the exact width of the drilling mud screen flange, so that "theoretically" the nose of the double-shoulder pin connection may have the same contact inside the mating drill pipe box and same shoulder bearing stress at optimal connection make-up torque as it would in an unmodified assembly. Further, the dimensions of the shortened nose of the double-shoulder pin may not be adequate for the selected drilling mud screen flange. When the dimensions of the shortened nose of the double-shoulder pin are outside the acceptable connection tolerances of about ±0.000-inch to about ±0.0010-inch, the mating pin and/or box is damaged. Further, rig crews often forget to install the drilling mud screen. This oversight frequently results in damage as the shortened nose of the double-shoulder pin continuously tries to make-up inside the box but fails. These are dangerous practices that can result in drilling mud leaking onto the drilling rig floor creating a slip hazard and/or in a double-shoulder connection failure. Further, this is an expensive practice that rapidly consumes drilling mud screens long before they need to be replaced.

If the drilling mud screen is installed at the bottom of the drill string, the drilling mud screen must be brought to the surface to be replaced. This is an inefficient practice that can results in lost drilling time.

Thus, an improved drilling mud screen system with a drilling mud screen puller/installer tool is needed to eliminate these problems.

SUMMARY OF THE INVENTION

In an embodiment, a drilling mud screen system comprises a first body having a first drilling mud inlet, an optional first drilling mud inlet, a first drilling mud outlet and a drilling mud screen access port, an optional drilling mud screen insert, a drilling mud screen, and a first end cap.

In an embodiment, the first body has a first end, a second end and a first centerline from the first end to the second end.

In an embodiment, the first drilling mud inlet has a second centerline forming a first angle with the first centerline and extending to the first centerline, wherein the first drilling mud inlet is offset from the first end of the first body. In an embodiment, the first angle is from about 20-degrees to about 120-degrees.

In an embodiment, the optional first drilling mud inlet has an optional second centerline forming an optional first angle with the first centerline and extending to the first centerline and forming an optional second angle with the second centerline, wherein the optional first drilling mud inlet is offset from the first end of the first body and wherein the optional first drilling mud inlet is offset from the second centerline radially about the first centerline. In an embodiment, the optional first angle is from about 20-degrees to about 120-degrees.

In an embodiment, the first drilling mud outlet is at the second end of the first body.

In an embodiment, the drilling mud screen access port is at the first end of the first body. In an embodiment, the first end cap is disposed within the drilling mud access port to close and seal the drilling mud access port.

In an embodiment, the drilling mud screen is disposed within the first body between the first drilling mud inlet and the first drilling mud outlet.

In an embodiment, the drilling mud screen comprises a second body having a second drilling mud inlet, a second drilling mud outlet, a second end cap and a filter.

In an embodiment, the drilling mud screen is constructed from AISI 4145 or equivalent, stainless steel or combinations thereof. In an embodiment, the filter has a hardened coating.

In an embodiment, the optional drilling mud screen insert is disposed within the first body between the first drilling mud inlet and the drilling mud screen.

In an embodiment, the second body has a first end and a second end, wherein the first end and/or the second end of the body has a means to engage a drilling mud screen puller/installer tool.

In an embodiment, the second drilling mud inlet is at the first end of the second body.

In an embodiment, the filter has a first end, a second end, and openings, wherein the filter is fluidly connected to the second end of the second body via a first connection and/or an optional first end retaining ring. In an embodiment, the filter is straight or tapered from the first end to the second end of the filter. In an embodiment, the filter is tapered from the first end to the second end of the filter.

In an embodiment, the filter comprises a plurality of rods having a first end and a second end, wherein the rods are spaced a distance apart to form the openings in the filter. In an embodiment, the rods are tapered from the first end to the second end of the filter.

In an embodiment, the filter comprises a formed sheet having drilled holes or slots spaced a distance apart to form the openings in the filter. In an embodiment, the drilled holes or slots are drilled in any configuration and orientation from the first end to the second end of the filter. In an embodiment, the drilled holes or slots are drilled in offset rows or straight rows from the first end to the second end of the filter.

In an embodiment, the second drilling mud outlet is at the openings of the filter.

In an embodiment, the second end cap is fluidly connected at the second end of the filter via a second connection. In an embodiment, the filter has an optional retaining ring disposed between the first connection and the second connection.

In an embodiment, the first body comprises a third body and a fourth body, and wherein the third body is fluidly connected to the fourth body via a union.

In an embodiment, one or more of the first body, the second body, the third body and the fourth body are constructed from AISI 4130/75k or equivalent material, AISI 4145 or equivalent, or combinations thereof.

In an embodiment, the first body has a first portion and a second portion surrounding the filter, and wherein a second inner diameter of the second portion is larger than a first inner diameter of the first portion to provide a high flow rate of drilling mud through the filter.

In an embodiment, the second end cap is a flat plate or a flat plate with holes or slots. In an embodiment, the second end cap is an inverted cone or an inverted cone with holes or slots.

In an embodiment, the first centerline of the first body and an inner surface of the second end cap form a cap angle, wherein the cap angle is from about 30-degrees to about 60-degrees. In an embodiment, the first centerline of the first body and an inner surface of the second end cap form a cap angle, wherein the cap angle is from about 35-degrees to about 45-degrees.

In an embodiment, a drilling mud screen system, comprises a first body having a first drilling mud inlet, a first drilling mud outlet and a drilling mud screen access port, a drilling mud screen, a plug and a first end cap.

In an embodiment, the first body has a first end, a second end and a first centerline from the first end to the second end.

In an embodiment, the first drilling mud inlet has a second centerline forming a first angle with the first centerline and extending to the first centerline, wherein the first drilling mud inlet is offset from the first end of the first body.

In an embodiment, the first drilling mud outlet is at the second end of the first body.

In an embodiment, the drilling mud screen access port is at the first end of the first body. In an embodiment, the first end cap is disposed within the drilling mud access port to close and seal the drilling mud access port.

In an embodiment, the first end cap is disposed within the drilling mud access port to close and seal the drilling mud access port.

In an embodiment, the plug is disposed within the first body between the drilling mud access port and the first drilling mud inlet.

In an embodiment, the drilling mud screen is disposed within the first body between the first drilling mud inlet and the first drilling mud outlet.

In an embodiment, the drilling mud screen comprises a second body having a second drilling mud inlet, a second drilling mud outlet, a second end cap and a filter.

In an embodiment, the drilling mud screen is constructed from AISI 4145 or equivalent, stainless steel or combinations thereof. In an embodiment, the optional drilling mud screen insert, the optional first end retaining ring and/or the optional retaining ring is constructed from AISI 4145 or equivalent, stainless steel or combinations thereof and/or has a hardened coating. In an embodiment, the filter has a hardened coating.

In an embodiment, the second body has a first end and a second end, wherein the first end and/or the second end of the body has a means to engage a drilling mud screen puller/installer tool.

In an embodiment, the second drilling mud inlet is at the first end of the second body.

In an embodiment, the filter has a first end, a second end, and openings, wherein the filter is fluidly connected to the second end of the second body. In an embodiment, the filter is straight or tapered from the first end to the second end of the filter. In an embodiment, the filter is tapered from the first end to the second end of the filter.

In an embodiment, the filter comprises a plurality of rods having a first end and a second end, wherein the rods are spaced a distance apart to form the openings in the filter. In an embodiment, the rods are tapered from the first end to the second end of the filter.

In an embodiment, the filter comprises a formed sheet having drilled holes or slots spaced a distance apart to form the openings in the filter. In an embodiment, the drilled holes or slots are drilled in any configuration and orientation from the first end to the second end of the filter. In an embodiment, the drilled holes or slots are drilled in offset rows or straight rows from the first end to the second end of the filter.

In an embodiment, the second drilling mud outlet is at the openings of the filter.

In an embodiment, the end cap is fluidly connected at the second end of the filter.

In an embodiment, the plug comprises a third body having a first end and a second end, wherein the first end of the third body has a means to engage a drilling mud screen puller/installer tool.

In an embodiment, the first end of the third body has an optional cavity extending towards but not through the flow surface of the plug.

In an embodiment, the third body has an optional port extending from an outer surface of the plug into the optional cavity.

In an embodiment, the second end of the third body has a flow surface to direct the drilling mud from the first drilling mud inlet to the second drilling mud inlet. In an embodiment, the flow surface may be selected from the group consisting of a backwards "J" shape, a curved shape, an "L" shape and combinations and variations thereof.

In an embodiment, one or more of the first body, the second body and the third body are constructed from AISI 4130/75k or equivalent material, AISI 4145 or equivalent, or combinations thereof.

In an embodiment, the first body has a first portion and a second portion surrounding the filter, and wherein a second inner diameter of the second portion is larger than a first inner diameter of the first portion to provide a high flow rate of drilling mud through the filter.

In an embodiment, the second end cap is a flat plate or a flat plate with holes or slots. In an embodiment, the second end cap is an inverted cone or an inverted cone with holes or slots.

In an embodiment, the first centerline of the first body and an inner surface of the second end cap form a cap angle, wherein the cap angle is from about 30-degrees to about 60-degrees. In an embodiment, the first centerline of the first body and an inner surface of the second end cap form a cap angle, wherein the cap angle is from about 35-degrees to about 45-degrees.

In an embodiment, the drilling mud screen system further comprises a transducer subassembly. In an embodiment, the transducer subassembly comprises a body having a drilling mud inlet, a drilling mud outlet and a transducer access port, and a transducer.

In an embodiment, the body has a first end, a second end and a first centerline from the first end to the second end.

In an embodiment, the drilling mud inlet is at the first end of the body.

In an embodiment, the first drilling mud outlet is at the second end of the first body.

In an embodiment, the transducer access port has a second centerline forming a transducer angle with the first centerline and extending to the first centerline, wherein the transducer access port is offset from the first end of the body. In an embodiment, the transducer angle is from about 20-degrees to about 120-degrees.

In an embodiment, the transducer is disposed within the transducer access port to close and seal the transducer access port.

In an embodiment, the drilling mud outlet of the transducer assembly is fluidly connected to the first drilling mud inlet of the drilling mud screen system.

In an embodiment, a drilling mud screen puller/installer tool comprises a hollow body, a striker plate, a shaft having a puller/installer plate and an optional stop plate, groove or painted line, a movable sleeve disposed around a portion of the shaft, and a handle.

In an embodiment, the hollow body has a first end, a second end and a first length.

In an embodiment, the striker plate has a first end and a second end, wherein the first end striker plate is connected to the second end of the body via a first connection.

In an embodiment, the shaft has a first end, a second end and a second length, wherein the second end of the striker plate is connected to the first end of the shaft via a second connection.

In an embodiment, the puller/installer plate has a first end and a second end, wherein the second end of the shaft is connected to the first end of the puller/installer plate via a fourth connection. In an embodiment, the puller/installer plate has a means to engage a drilling mud screen. In an embodiment, the puller/installer plate has one or more extensions to fit an outlet of a first portion and/or an inlet of a second portion of the body of the drilling mud screen and to rotationally engage a shoulder inside the inlet of the second portion of the body of the drilling mud screen.

In an embodiment, the optional stop plate, grove or painted line on the shaft is offset from the first end of the body or the second end of the body. In an embodiment, the stop plate is connected to the shaft via a fifth connection.

In an embodiment, the movable sleeve has a first end, a second end and a third length, wherein the movable sleeve is disposed around a portion of the shaft.

In an embodiment, the handle is connected to the movable sleeve via a third connection.

In an embodiment, one or more of the first, second, third, fourth and fifth connections are welds.

In an embodiment, one or more of the body and the movable sleeve are constructed from AISI 4140 or equivalent, stainless steel or combinations thereof.

In an embodiment, one or more of the handle and the shaft are constructed from AISI 1018 or equivalent.

In an embodiment, one or more of the rounded end, the striker plate and the puller/installer plate are constructed from stainless steel.

In an embodiment, a method of installing a drilling mud screen system comprises a) providing a drilling mud screen system, b) stopping a drilling mud pump to fluidly connect the drilling mud screen to the drilling mud pump, c) fluidly connecting the drilling mud screen system in line with and immediately upstream or downstream of the drilling mud pump; and d) operating the drilling mud pump to produce flow of drilling mud through the drilling mud screen system.

In an embodiment, step c) comprises fluidly connecting a drilling mud inlet of the drilling mud screen system to a high-pressure outlet of the drilling mud pump and fluidly connecting a drilling mud outlet of the drilling mud screen system to a vibrator hose or a standpipe.

In an embodiment, step c) comprises fluidly connecting a drilling mud inlet of the drilling mud screen system to a high-pressure inlet of the drilling mud pump and fluidly connecting a drilling mud outlet of the drilling mud screen system to an inlet of a vibrator hose.

In an embodiment, step c) comprises fluidly connecting a drilling mud inlet of the drilling mud screen system to an outlet of a vibrator hose and a drilling mud outlet to an inlet of a standpipe.

In an embodiment, step c) comprises fluidly connecting a drilling mud inlet of the drilling mud screen system to an outlet of a first portion of a standpipe and a drilling mud outlet to an inlet of a second portion of the standpipe.

In an embodiment, step e) comprises filtering or screening debris from drilling mud.

In an embodiment, a method of installing and using a drilling mud screen system comprises: a) providing the drilling mud screen system; b) stopping a drilling mud pump; c) fluidly connecting a first transducer subassembly, having a transducer, in line with and downstream of the drilling mud pump and fluidly connecting the drilling mud screen system in line with and immediately downstream of the first transducer subassembly; and d) operating the drilling mud pump to produce flow of drilling mud through the first transducer subassembly and the drilling mud screen system.

In an embodiment, the method further comprises step (e) monitoring the transducer of the first transducer subassembly for property information immediately upstream of the drilling mud screen system and step (f) using the property information to determine a status of the drilling mud screen system.

In an embodiment, step (c) comprises fluidly connecting a first transducer subassembly, having a transducer, in line with and downstream of the drilling mud pump and fluidly connecting the drilling mud screen system in line with and immediately downstream of the first transducer subassembly, and fluidly connecting a gate valve in line with and immediately downstream of the drilling mud screen system, fluidly connecting a second transducer assembly, having a low torque plug valve, in line with and immediately downstream of the gate valve and wherein step (d) comprises operating the drilling mud pump to produce flow of drilling mud through the first transducer subassembly, the drilling mud screen system, the gate valve and the second transducer subassembly.

In an embodiment, the method of claim 78 further comprises step (e) stopping the drilling mud pump, step (f) closing the gate valve to isolate the drilling mud screen system, and step (g) pumping cement through the low torque plug valve of the second transducer subassembly, a vibrator hose, a stand pipe, a top drive and a case running tool (CRT).

In an embodiment, a method of removing and replacing a drilling mud screen comprises a) providing the drilling mud screen system; b) stopping a drilling mud pump connected to the drilling mud screen system; c) opening a drilling mud screen access port in the drilling mud screen system to remove and replace a drilling mud screen; d) accessing the interior of the drilling mud screen system to pull the plug from the drilling mud screen system; e) accessing the interior of the drilling mud screen system to pull the drilling mud screen from the drilling mud screen system and to install a replacement drilling mud screen into the drilling mud screen system; f) accessing the interior of the drilling mud screen system to reinstall the plug into the drilling mud screen system; g) closing the drilling mud screen access port in the drilling mud screen system; and h) operating the drilling mud pump to produce flow of drilling mud through the drilling mud screen system.

In an embodiment, step d) comprises using a puller/installer plate and/or a rounded end of a puller/installer tool to engage and pull the plug from the drilling mud screen system. In an embodiment, step d) comprises using a puller/installer plate and/or a rounded end of a puller/installer tool to engage and pull the plug from the drilling mud screen system and, optionally using a stop plate, groove or painted line of the puller/installer tool to determine when the replacement drilling mud screen is installed into the drilling mud screen system.

In an embodiment, step e) comprises using a puller/installer plate of a puller/installer tool to engage and pull the drilling mud screen from the drilling mud screen system. In an embodiment, step e) comprises using a puller/installer plate and/or a rounded end of a puller/installer tool to install the replacement drilling mud screen into the drilling mud screen system.

In an embodiment, step f) comprises using a puller/installer plate and/or a rounded end of a puller/installer tool to reinstall the plug into the drilling mud screen system.

In an embodiment, a piston-style drilling mud screen system comprises an optional first assembly having a first drilling mud inlet, an optional second assembly having a fourth drilling mud outlet, a first body, a second body, a lock system and, optionally, a skid.

In an embodiment, a piston-style drilling mud screen system comprises a first assembly having a first drilling mud inlet, a second assembly having a fourth drilling mud outlet, a first body, a second body, a lock system and, optionally, a skid.

In an embodiment, the first assembly has a first end and a second end, the first drilling mud inlet at the first end of the first assembly, and the first drilling mud outlet at the second end of the first assembly.

In an embodiment, the first body has a first end and a second end, a second drilling mud inlet at the first end of the first body, and a second drilling mud outlet at the second end of the first body. In an embodiment, the first drilling mud outlet of the first assembly is fluidly connected to the second drilling mud inlet of the first body. In an embodiment, the first drilling mud outlet of the first assembly is fluidly connected to the second drilling mud inlet of the first body via a quarter-turn breech lock connection.

In an embodiment, the first body has a first sleeve extending from the second end of the first body, and the second drilling mud outlet of the first body is fluidly connected to the third drilling mud inlet of the first body via the first sleeve. In an embodiment, the first sleeve is integral to the second end of the first body. In an embodiment, the first sleeve is fluidly connected to the second end of the first body.

In an embodiment, the first end of the first body has a means to engage a drilling mud screen puller/installer tool.

In an embodiment, the second body has a first end and a second end, a third drilling mud inlet at the first end of the second body, and a third drilling mud outlet at the second end of the second body. In an embodiment, the second drilling mud outlet of the first body is fluidly connected to the third drilling mud inlet of the second body.

In an embodiment, the second body has a second sleeve extending from the first end of the second body, and the second drilling mud outlet of the first body is fluidly connected to the third drilling mud inlet of the second body via the second sleeve. In an embodiment, the second sleeve is integral to the first end of the second body. In an embodiment, the second sleeve is fluidly connected to the first end of the second body.

In an embodiment, a drilling mud screen is disposed within the first body and the second body between the first drilling mud inlet and the second drilling mud outlet.

In an embodiment, the lock system comprises a third body, a fourth body, a first lock and a second lock.

In an embodiment, the third body having a first end and a second end, a first inlet at the first end of the third body, and a first outlet at the second end of the third body. In an embodiment, the second end the first body is disposed through the first end of the third body such that the second end of the first body is held by a lip at the first end of the third body.

In an embodiment, the third body of the lock system are capable of receiving a portion of the first body when the first lock is unlocked.

In an embodiment, the fourth body has a first end and a second end, a second inlet at the first end of the fourth body, and a second outlet at the second end of the fourth body. In an embodiment, the first outlet of the third body is connected to the second inlet of the fourth body. In an embodiment, the first outlet of the third body is connected to the second inlet of the fourth body via a threaded connection.

In an embodiment, the fourth body of the lock system is capable of receiving a portion of the second body when the second lock is unlocked.

In an embodiment, the first lock extends through the third body and engages the first body when the piston-style drilling mud screen system is closed. In an embodiment, the first lock is a spring-loaded lock.

In an embodiment, the first end of the second body is disposed through the second end of the fourth body such that the first end of the second body is held by a lip at or near the second end of the fourth body.

In an embodiment, the second lock extends through the fourth body and engages the second body when the piston-style drilling mud screen system is closed. In an embodiment, the second lock is a spring-loaded lock.

In an embodiment, the second assembly has a first end and a second end, a fourth drilling mud inlet at the first end of the second assembly, and a fourth drilling mud outlet at the second end of the second assembly.

In an embodiment, the third drilling mud outlet of the second body is fluidly connected to the fourth drilling mud inlet of the second assembly.

In an embodiment, the third drilling mud outlet of the second body is fluidly connected to the fourth drilling mud inlet of the second assembly via a quarter-turn breech lock connection.

In an embodiment, the skid comprises a base, a first support, a second support and a third support.

In an embodiment, the first support has a first end and a second end, wherein the first end of the first support is attached to the base and wherein the second end of the first support is attached to the first assembly.

In an embodiment, the second support has a first end and a second end, wherein the first end of the second support is attached to the base and wherein the second end of the second support is attached to the second assembly.

In an embodiment, the third support has a first end and a second end, wherein the first end of the third support is attached to the base and wherein the second end of the third support is attached to the lock system.

In an embodiment, one or more of the first support, the second support and the third support is capable of being lowered, pivoted, raised, rotated or any combination thereof. In an embodiment, one or more of the first support, the second support and the third support is capable of being lowered, pivoted, raised, rotated or any combination thereof via a connection, coupling and/or extension. In an embodiment, the one or more of the first support, the second support and the third support is capable of being automatically lowered, pivoted, raised and/or rotated. In an embodiment, the one or more of the first support, the second support and the third support is capable of being manually lowered, pivoted, raised and/or rotated.

In an embodiment, the piston-style drilling mud screen system further comprises a transducer subassembly. In an embodiment, the transducer subassembly comprises a body having a drilling mud inlet, a drilling mud outlet and a transducer access port, and a transducer.

In an embodiment, the body has a first end, a second end and a first centerline from the first end to the second end.

In an embodiment, the drilling mud inlet is at the first end of the body.

In an embodiment, the first drilling mud outlet is at the second end of the first body.

In an embodiment, the transducer access port has a second centerline forming a transducer angle with the first centerline and extending to the first centerline, wherein the transducer access port is offset from the first end of the body. In an embodiment, the transducer angle is from about 20-degrees to about 120-degrees.

In an embodiment, the transducer is disposed within the transducer access port to close and seal the transducer access port.

In an embodiment, the drilling mud outlet of the transducer assembly is fluidly connected to the first drilling mud inlet of the piston-style drilling mud screen system. In an embodiment, the drilling mud outlet of the transducer subassembly is fluidly connected to the first drilling mud inlet of the piston-style drilling mud screen system via a crossover connection.

In an embodiment, one or more of the first assembly, the second assembly, the first body, the second body, the third body and the fourth body are constructed from AISI 4130/75k or equivalent material, AISI 4145 or equivalent, or combinations thereof.

In an embodiment, the drilling mud screen is constructed from AISI 4145 or equivalent, stainless steel or combinations thereof. In an embodiment, the drilling mud screen has a hardened coating.

In an embodiment, a method of installing a piston-style drilling mud screen system comprises the steps of: a) providing the piston-style drilling mud screen system; b) stopping a drilling mud pump to fluidly connect the piston-style drilling mud screen to the drilling mud pump; c) fluidly connecting the piston-style drilling mud screen system in line with and immediately upstream or downstream of the drilling mud pump; and d) operating the drilling mud pump to produce flow of drilling mud through the piston-style drilling mud screen system.

In an embodiment, step c) comprises fluidly connecting a drilling mud inlet of the piston-style drilling mud screen system to a high-pressure outlet of the drilling mud pump and fluidly connecting a drilling mud outlet of the piston-style drilling mud screen system to a vibrator hose or a standpipe.

In an embodiment, step c) comprises fluidly connecting a drilling mud inlet of the piston-style drilling mud screen system to a high-pressure inlet of the drilling mud pump and fluidly connecting a drilling mud outlet of the piston-style drilling mud screen system to an inlet of a vibrator hose.

In an embodiment, step c) comprises fluidly connecting a drilling mud inlet of the piston-style drilling mud screen system to an outlet of a vibrator hose and a drilling mud outlet of the piston-style drilling mud screen system to an inlet of a standpipe.

In an embodiment, step c) comprises fluidly connecting a drilling mud inlet of the piston-style drilling mud screen system to an outlet of a first portion of a standpipe and a drilling mud outlet of the piston-style drilling mud screen system to an inlet of a second portion of the standpipe.

In an embodiment, the method further comprises step e) filtering or screening debris from drilling mud.

In an embodiment, a method of removing and replacing a drilling mud screen in a piston-style drilling mud screen system comprises the steps: a) providing a piston-style drilling mud screen system; b) stopping a drilling mud pump connected to the piston-style drilling mud screen system; c) opening the lock system in the piston-style drilling mud screen system to remove and replace a drilling mud screen; d) accessing the interior of the piston-style drilling mud screen system to pull the drilling mud screen from the piston-style drilling mud screen system and to install a replacement drilling mud screen into the piston-style drilling mud screen system; e) closing the lock system in the piston-style drilling mud screen system; and f) operating the drilling mud pump to produce flow of drilling mud through the piston-style drilling mud screen system.

In an embodiment, the method further comprises step (g) monitoring the transducer of the first transducer subassembly for property information immediately upstream of the piston-style drilling mud screen system and step (h) using the property information to determine a status of the piston-style drilling mud screen system.

In an embodiment, step c) comprises: (c-1) disengaging the first lock of the lock system from the first body and disengaging the second lock of the lock system from the second body of the piston-style drilling mud screen system; (c-2) rotating the first body to unlatch the first assembly and rotating the second body to unlatch the second assembly; and (c-3) sliding the first body further into the lock system to disengage the first assembly and sliding the second body into the lock system to disengage the second assembly.

In an embodiment, step c) further comprises: (c-4) lifting, lowering, pivoting, rotating, sliding or otherwise moving one or more of the first assembly, the second assembly, the lock system and any combination thereof to open the piston-style drilling mud screen system to remove the drilling mud screen.

In an embodiment, step d) further comprises using a puller/installer plate of a puller/installer tool to engage and pull the drilling mud screen from the drilling mud screen system.

In an embodiment, step d) further comprises using a puller/installer plate and/or a rounded end of a puller/installer tool to install the replacement drilling mud screen into the drilling mud screen system and, optionally, using a stop plate, groove or painted line of the puller/installer tool to determine when the replacement drilling mud screen is installed into the drilling mud screen system.

In an embodiment, step e) comprises: (e-1) lifting, lowering, pivoting, rotating, sliding or otherwise moving one or more of the first assembly, the second assembly, the lock system and any combination thereof to close the piston-style drilling mud screen system; (e-2) rotating the first body to latch the first assembly and rotating the second body to latch the second assembly; and (e-3) engaging the first lock of the lock system from the first body and engaging the second lock of the lock system from the second body of the piston-style drilling mud screen system.

In an embodiment, a method of installing a piston-style drilling mud screen system comprises the steps of: a) providing a piston-style drilling mud screen system; b) stopping a drilling mud pump; c) fluidly connecting a first transducer subassembly, having a transducer, in line with and downstream of the drilling mud pump and fluidly connecting the piston-style drilling mud screen system in line with and immediately downstream of the first transducer subassembly; and d) operating the drilling mud pump to produce flow of drilling mud through the first transducer subassembly and the piston-style drilling mud screen system.

In an embodiment, step (c) comprises fluidly connecting a first transducer subassembly, having a transducer, in line with and downstream of the drilling mud pump and fluidly connecting the piston-style drilling mud screen system in line with and immediately downstream of the first transducer subassembly, and fluidly connecting a gate valve in line with and immediately downstream of the piston-style drilling mud screen system, fluidly connecting a second transducer assembly, having a low torque plug valve, in line with and immediately downstream of the gate valve.

In an embodiment, step (d) comprises operating the drilling mud pump to produce flow of drilling mud through the first transducer subassembly, the piston-style drilling mud screen system, the gate valve and the second transducer subassembly.

In an embodiment, the method further comprises step (e) stopping the drilling mud pump, step (f) closing the gate valve to isolate the piston-style drilling mud screen system, and step (g) pumping cement through the low torque plug valve of the second transducer subassembly, a vibrator hose, a stand pipe, a top drive and a case running tool (CRT).

In an embodiment, an alternate piston-style drilling mud screen system comprises an optional first assembly having a first drilling mud inlet, an optional second assembly having a fourth drilling mud outlet, a first body, a second body, a union system and, optionally, a skid.

In an embodiment, a piston-style drilling mud screen system comprises a first assembly having a first drilling mud inlet, a second assembly having a fourth drilling mud outlet, a first body, a second body, a union system and, optionally, a skid.

In an embodiment, the first assembly has a first end and a second end, the first drilling mud inlet at the first end of the first assembly, and the first drilling mud outlet at the second end of the first assembly.

In an embodiment, the first body has a first end and a second end, a second drilling mud inlet at the first end of the first body, and a second drilling mud outlet at the second end of the first body. In an embodiment, the first drilling mud outlet of the first assembly is fluidly connected to the second drilling mud inlet of the first body. In an embodiment, the first drilling mud outlet of the first assembly is fluidly connected to the second drilling mud inlet of the first body via a connection.

In an embodiment, the second end of the first body is modified to reduce an inside surface exit angle to transition from a first inner diameter of the first body to a second inner diameter of the fifth body. In an embodiment, the exit angle is from about 10-degrees to about 90-degrees. In an embodiment, the exit angle is about 40-degrees.

In an embodiment, the first end of the first body has a means to engage a drilling mud screen puller/installer tool.

In an embodiment, the second body has a first end and a second end, a third drilling mud inlet at the first end of the second body, and a third drilling mud outlet at the second end of the second body. In an embodiment, the second drilling mud outlet of the first body is fluidly connected to the third drilling mud inlet of the second body.

In an embodiment, the first end of the second body is modified to reduce an inside surface entry angle to transition from the second inner diameter of the fifth body to a third inner diameter of the second body. In an embodiment, the entry angle is from about 10-degrees to about 90-degrees. In an embodiment, the entry angle is about 30-degrees.

In an embodiment, a drilling mud screen is disposed within the first body and the second body between the first drilling mud inlet and the second drilling mud outlet.

In an embodiment, the union system comprises a third body, a fourth body and a fifth body.

In an embodiment, the third body has a first inlet at a first end and a first outlet at second end.

In an embodiment, the fourth body has a second inlet at a first end and a second outlet at a second end.

In an embodiment, the fifth body has a first and second end. In an embodiment, the second end of the first body is disposed through the first end of the fifth body such that a portion of the third body is disposed between the second end of the second body and a portion of the first end of the fifth body. In an embodiment, the first end of the second body is disposed through the second end of the fifth body such that a portion of the fourth body is disposed between the first end of the second body and a portion of the second end of the fifth body.

In an embodiment, the second end of the third body and the first end of the fifth body form a first union; and the second end of the fifth body and the first end of the fourth body form a second union.

In an embodiment, the first drilling mud outlet of the first assembly is fluidly connected to the second drilling mud inlet of the first body via a connection.

In an embodiment, the third drilling mud outlet of the second body is fluidly connected to the fourth drilling mud inlet of the second assembly via a connection.

In an embodiment, the fifth body is capable of receiving a portion of the first body when the first drilling mud outlet of the first subassembly is opened.

In an embodiment, the fifth body is capable of receiving a portion of the second body when the second drilling mud inlet of the second subassembly is opened.

In an embodiment, the skid comprises a base, a first support, a second support and a third support.

In an embodiment, the first support has a first end and a second end, wherein the first end of the first support is attached to the base and wherein the second end of the first support is attached to the first assembly.

In an embodiment, the second support has a first end and a second end, wherein the first end of the second support is attached to the base and wherein the second end of the second support is attached to the second assembly.

In an embodiment, the third support has a first end and a second end, wherein the first end of the third support is attached to the base and wherein the second end of the third support is attached to the union system.

In an embodiment, one or more of the first support, the second support and the third support is capable of being lowered, pivoted, raised, rotated or any combination thereof. In an embodiment, one or more of the first support, the second support and the third support is capable of being lowered, pivoted, raised, rotated or any combination thereof via a connection, coupling and/or extension. In an embodiment, the one or more of the first support, the second support and the third support is capable of being automatically lowered, pivoted, raised and/or rotated. In an embodiment, the one or more of the first support, the second support and the third support is capable of being manually lowered, pivoted, raised and/or rotated.

In an embodiment, the piston-style drilling mud screen system further comprises a transducer subassembly. In an embodiment, the transducer subassembly comprises a body having a drilling mud inlet, a drilling mud outlet and a transducer access port, and a transducer.

In an embodiment, the body has a first end, a second end and a first centerline from the first end to the second end.

In an embodiment, the drilling mud inlet is at the first end of the body.

In an embodiment, the first drilling mud outlet is at the second end of the body.

In an embodiment, the transducer access port has a second centerline forming a transducer angle with the first centerline and extending to the first centerline, wherein the transducer access port is offset from the first end of the body. In an embodiment, the transducer angle is from about 20-degrees to about 120-degrees.

In an embodiment, the transducer is disposed within the transducer access port to close and seal the transducer access port.

In an embodiment, the drilling mud outlet of the transducer assembly is fluidly connected to the first drilling mud inlet of the piston-style drilling mud screen system. In an embodiment, the drilling mud outlet of the transducer subassembly is fluidly connected to the first drilling mud inlet of the piston-style drilling mud screen system via a crossover connection.

In an embodiment, one or more of the first assembly, the second assembly, the first body, the second body, the third body and the fourth body are constructed from AISI 4130/75k or equivalent material, AISI 4145 or equivalent, or combinations thereof.

In an embodiment, the drilling mud screen is constructed from AISI 4145 or equivalent, stainless steel or combinations thereof. In an embodiment, the drilling mud screen has a hardened coating.

In an embodiment, a method of installing a piston-style drilling mud screen system comprising the steps of: (a) providing the piston-style drilling mud screen system; (b) stopping a drilling mud pump to fluidly connect the piston-style drilling mud screen to the drilling mud pump; (c) fluidly connecting the piston-style drilling mud screen system in line with and immediately upstream or downstream of the drilling mud pump; and (d) operating the drilling mud pump to produce flow of drilling mud through the piston-style drilling mud screen system.

In an embodiment, step c) comprises fluidly connecting a drilling mud inlet of the piston-style drilling mud screen system to a high-pressure outlet of the drilling mud pump and fluidly connecting a drilling mud outlet of the piston-style drilling mud screen system to a vibrator hose or a standpipe.

In an embodiment, step c) comprises fluidly connecting a drilling mud inlet of the piston-style drilling mud screen system to a high-pressure inlet of the drilling mud pump and fluidly connecting a drilling mud outlet of the piston-style drilling mud screen system to an inlet of a vibrator hose.

In an embodiment, step c) comprises fluidly connecting a drilling mud inlet of the piston-style drilling mud screen system to an outlet of a vibrator hose and a drilling mud outlet of the piston-style drilling mud screen system to an inlet of a standpipe.

In an embodiment, step c) comprises fluidly connecting a drilling mud inlet of the piston-style drilling mud screen system to an outlet of a first portion of a standpipe and a drilling mud outlet of the piston-style drilling mud screen system to an inlet of a second portion of the standpipe.

In an embodiment, the method further comprises step e) filtering or screening debris from drilling mud.

In an embodiment, a method of removing and replacing a drilling mud screen in a piston-style drilling mud screen system comprising the steps: (a) providing the piston-style drilling mud screen system; (b) stopping a drilling mud pump connected to the piston-style drilling mud screen system; (c) opening the first drilling mud outlet of the first subassembly and/or the second drilling mud inlet of the second subassembly in the piston-style drilling mud screen system to remove and replace a drilling mud screen; (d) accessing the interior of the piston-style drilling mud screen system to pull the drilling mud screen from the piston-style drilling mud screen system and to install a replacement drilling mud screen into the piston-style drilling mud screen system; (e) closing the first drilling mud outlet of the first subassembly and/or the second drilling mud inlet of the second subassembly in the piston-style drilling mud screen system; and (f) operating the drilling mud pump to produce flow of drilling mud through the piston-style drilling mud screen system.

In an embodiment, step c) comprises: (c-1) rotating the first body to disengage the first assembly and/or rotating the second body to disengage the second assembly; and (c-2) sliding the first body further into the union system to fully disengage the first assembly and/or sliding the second body into the union system to fully disengage the second assembly. In an embodiment, step c) further comprises: (c-3) lifting, lowering, pivoting, rotating, sliding or otherwise moving one or more of the first assembly, the second assembly, the union system and any combination thereof to open the piston-style drilling mud screen system to remove the drilling mud screen.

In an embodiment, step d) further comprises using a puller/installer plate of a puller/installer tool to engage and pull the drilling mud screen from the drilling mud screen system. In an embodiment, step d) further comprises using a puller/installer plate and/or a rounded end of a puller/installer tool to install the replacement drilling mud screen into the drilling mud screen system and, optionally, using a stop plate, groove or painted line of the puller/installer tool to determine when the replacement drilling mud screen is installed into the drilling mud screen system.

In an embodiment, step e) comprises: (e-1) lifting, lowering, pivoting, rotating, sliding or otherwise moving one or more of a first assembly, a second assembly, the union system and any combination thereof to close the piston-style drilling mud screen system; (e-2) sliding the first body to engage the first assembly and/or sliding the second body to engage the second body; and (e-3) rotating the first body to fully engage the first assembly and/or rotating the second body to fully engage the second assembly.

In an embodiment, a method of installing a piston-style drilling mud screen system comprising the steps of: (a) providing the piston-style drilling mud screen system; (b) stopping a drilling mud pump; (c) fluidly connecting a first transducer subassembly, having a transducer, in line with and downstream of the drilling mud pump and fluidly connecting the piston-style drilling mud screen system in line with and immediately downstream of the first transducer subassembly; and (d) operating the drilling mud pump to produce flow of drilling mud through the first transducer subassembly and the piston-style drilling mud screen system.

In an embodiment, step (c) comprises fluidly connecting a first transducer subassembly, having a transducer, in line with and downstream of the drilling mud pump and fluidly connecting the piston-style drilling mud screen system in line with and immediately downstream of the first transducer subassembly, and fluidly connecting a gate valve in line with and immediately downstream of the piston-style drilling mud screen system, fluidly connecting a second transducer assembly, having a low torque plug valve, in line with and immediately downstream of the gate valve and wherein step (d) comprises operating the drilling mud pump to produce flow of drilling mud through the first transducer subassembly, the piston-style drilling mud screen system, the gate valve and the second transducer subassembly.

In an embodiment, the method further comprises step (e) monitoring the transducer of the first transducer subassembly for property information immediately upstream of the piston-style drilling mud screen system and step (f) using the property information to determine a status of the piston-style drilling mud screen system.

In an embodiment, the method further comprises step (e) stopping the drilling mud pump, step (f) closing the gate valve to isolate the piston-style drilling mud screen system, and step (g) pumping cement through the low torque plug valve of the second transducer subassembly, a vibrator hose, a stand pipe, a top drive and a case running tool (CRT).

In an embodiment, a flow loop configuration comprises a first drilling mud manifold or Y-connector, a drilling mud screen system and a second drilling mud manifold or T-connector.

In an embodiment, the flow loop configuration comprises a first drilling mud manifold having a first drilling mud inlet and a plurality of first drilling mud outlets; a plurality of drilling mud screen systems comprising: a first body having a first end, a second end and a first centerline from the first end to the second end; a first drilling mud inlet having a second centerline forming a first angle with the first centerline and extending to the first centerline, wherein the first drilling mud inlet is offset from the first end of the first body and wherein the first angle is from about 20-degrees to about 120-degrees; a first drilling mud outlet at the second end of the first body; a drilling mud screen access port at the first end of the first body; a first end cap, disposed within the drilling mud access port to close and seal the drilling mud access port; and a drilling mud screen, disposed within the first body between the first drilling mud inlet and the first drilling mud outlet; a second drilling mud manifold having a plurality of second drilling mud inlets and a second drilling mud outlet; wherein one of the plurality of first drilling mud outlets are fluidly connected to each of the first drilling mud inlets of the plurality of drilling mud screen systems; and wherein each the first drilling mud outlets of the plurality of drilling mud screen systems are fluidly connected to one of the plurality of second drilling mud inlets of the second drilling mud manifold.

In an embodiment, the first body comprises a second and a third body and wherein the second body is fluidly connected to the third body.

In an embodiment, the flow loop configuration further comprises a first plurality of gate valves, wherein each of the plurality of first drilling mud outlets of the first manifold are fluidly connected to one of the first plurality of gate valves and each of the first plurality of gate valves is fluidly connected to one of the first drilling mud inlets of the plurality of drilling mud screen systems.

In an embodiment, flow loop configuration further comprises a second plurality of gate valves, wherein each of the first drilling mud outlets of the plurality of drilling mud screen systems is fluidly connected to one of the second plurality of gate valves and each of the second plurality of gate valves is fluidly connected to one of second drilling mud inlets of the second manifold.

In an embodiment, the flow loop configuration further comprises a first gate valve, wherein the first gate valve is fluidly connected to the first drilling mud inlet of the first drilling mud manifold.

In an embodiment, the flow loop configuration further comprises a second gate valve, wherein the second gate valve is fluidly connected to the second drilling mud outlet of the second drilling mud manifold.

In an embodiment, a flow loop configuration comprises a first drilling mud manifold or Y-connector, a piston-style drilling mud screen system comprising a lock system or a union system and a second drilling mud manifold or T-connector.

In an embodiment, the flow loop configuration further comprises a first plurality of gate valves, wherein each of the plurality of first drilling mud outlets of the first manifold are fluidly connected to one of the first plurality of gate valves and each of the first plurality of gate valves is fluidly connected to one of the first drilling mud inlets of the plurality of drilling mud screen systems.

In an embodiment, the flow loop configuration further comprises a second plurality of gate valves, wherein each of the first drilling mud outlets of the plurality of drilling mud screen systems is fluidly connected to one of the second plurality of gate valves and each of the second plurality of gate valves is fluidly connected to one of second drilling mud inlets of the second manifold.

In an embodiment, a drilling mud screen comprises a first body having a first end and a second end and a first centerline, a filter having a first end, a second end, and openings, wherein the second end of the filter is fluidly connected to the first end of the first body via a first connection and/or an optional first end retaining ring, a first end cap fluidly connected at the first end of the filter via a second connection, wherein the filter has an optional retaining ring disposed between the first connection and the second connection, a drilling mud inlet at the openings of the filter, and a drilling mud outlet at the second end of the first body.

In an embodiment, the first body and/or filter is constructed from alloy steel, tool steel, or combinations thereof. In an embodiment, the first body and/or filter is constructed from AISI 4130/75k or equivalent material, AISI 4145 or equivalent, or combinations thereof.

In an embodiment, the first body and/or filter has a hardened coating. In an embodiment, the first body and/or filter has a Carbide coating with about 6% Cobalt binder or equivalent.

In an embodiment, the filter comprises a plurality of rods having a first end and a second end. In an embodiment, the filter is tapered from the second end to the first end.

In an embodiment, the rods are spaced a distance apart to form the openings in the filter. In an embodiment, the rods are tapered from the first end to the second end.

In an embodiment, the filter comprises a formed sheet having drilled holes or slots spaced a distance apart to form the openings in the filter. In an embodiment, the filter is tapered from the second end to the first end.

In an embodiment, the drilled holes or slots are drilled in offset rows or straight rows from the first end to the second end.

In an embodiment, the first end cap is a flat plate or a flat plate with holes or slots.

In an embodiment, the first end cap is an inverted cone or an inverted cone with holes or slots.

In an embodiment, the first centerline of the first body and an outer surface of the first end cap forms a cap angle, wherein the cap angle is from about 30-degrees to about 90-degrees. In an embodiment, the first centerline of the first body and an outer surface of the first end cap forms a cap angle, wherein the cap angle is from about 35-degrees to about 45-degrees.

In an embodiment, the optional first end retaining ring and/or the optional retaining ring is/are modified to reduce inside surface entry and exit angles of the drilling mud screen.

In an embodiment, the entry and exit angles are from about 10 degrees to about 90-degrees. In an embodiment, the entry and exit angles are from about 10-degrees to about 50-degrees. In an embodiment, the entry and exit angles are about 30-degrees.

In an embodiment, the optional first end retaining ring and/or the optional retaining ring is constructed of alloy steel, stainless steel, or combinations thereof. In an embodiment, the optional first end retaining ring and/or the optional retaining ring is constructed from AISI 4145 or equivalent, stainless steel, or combinations thereof.

In an embodiment, the first end cap is constructed of alloy steel, stainless steel, or combinations thereof.

In an embodiment, the first end cap has a hardened coating. In an embodiment, the first end cap has a Carbide coating with about 6% Cobalt binder or equivalent material.

In an embodiment, the filter has a first section, a second section and a third section. In an embodiment, the first section is about 20-25% longer than the second section and/or the third section.

In an embodiment, an alternative drilling mud screen system comprises a second body having a first drilling mud inlet, a first drilling mud outlet and a drilling mud screen access port, a reversed drilling mud screen as discussed herein, and a second end cap. In an embodiment, the first drilling mud outlet is adapted to be fluidly connected to an inlet of a vibrator hose or an inlet to a standpipe or at any point in the standpipe.

In an embodiment, the second body has a first end, a second end and a second centerline from the first end to the second end.

In an embodiment, the first drilling mud inlet has a third centerline forming a first angle with the second centerline and extending to the second centerline, wherein the first drilling mud inlet is offset from the first end of the second body. In an embodiment, the first angle is from about 20-degrees to about 120-degrees.

In an embodiment, the first drilling mud outlet is at the second end of the second body.

In an embodiment, the drilling mud screen access port is at the first end of the second body. In an embodiment, the second end cap is disposed within the drilling mud access port to close and seal the drilling mud access port.

In an embodiment, the reversed drilling mud screen is disposed within the second body between the first drilling mud inlet and the first drilling mud outlet.

In an embodiment, the reversed drilling mud screen is constructed from AISI 4145 or equivalent, stainless steel or combinations thereof. In an embodiment, the reversed drilling mud screen has a hardened coating.

In an embodiment, the second body comprises a third body and a fourth body, and wherein the third body is fluidly connected to the fourth body via a union.

In an embodiment, the first body has a first portion and a second portion surrounding the filter. In an embodiment, a first inner diameter of the first portion is larger than a second inner diameter of the second portion to provide a high flow rate of drilling mud through the filter.

In an embodiment, one or more of the first body, the second body, the third body and the fourth body are constructed from AISI 4130/75k or equivalent material, AISI 4145 or equivalent, or combinations thereof.

In an embodiment, the filter comprises a plurality of rods having a first end and a second end. In an embodiment, the filter is tapered from the second end to the first end.

In an embodiment, the rods are spaced a distance apart to form the openings in the filter. In an embodiment, the rods are tapered from the first end to the second end.

In an embodiment, the filter comprises a formed sheet having drilled holes or slots spaced a distance apart to form the openings in the filter. In an embodiment, the filter is tapered from the second end to the first end.

In an embodiment, the drilled holes or slots are drilled in offset rows or straight rows from the first end to the second end.

In an embodiment, the first end cap is a flat plate or a flat plate with holes or slots.

In an embodiment, the first end cap is an inverted cone or an inverted cone with holes or slots.

In an embodiment, the first centerline of the first body and an outer surface of the first end cap forms a cap angle, wherein the cap angle is from about 30-degrees to about 90-degrees. In an embodiment, the first centerline of the first body and an outer surface of the first end cap forms a cap angle, wherein the cap angle is from about 35-degrees to about 45-degrees.

In an embodiment, the filter, the first end retaining ring and/or the retaining ring are constructed from AISI 4145 or equivalent, stainless steel or combinations thereof. In an embodiment, the filter, the first end retaining ring and/or the retaining ring has a hardened coating. In an embodiment, the filter, the first end retaining ring and/or the retaining ring has a Carbide coating with about 6% Cobalt binder.

In an embodiment, the drilling mud screen system further comprises a transducer subassembly. In an embodiment, the transducer subassembly comprises a transducer body having a drilling mud inlet, a drilling mud outlet and a transducer access port, and a transducer.

In an embodiment, the transducer body has a first end, a second end and a third centerline from the first end to the second end.

In an embodiment, the drilling mud inlet is at the first end of the transducer body.

In an embodiment, the first drilling mud outlet is at the second end of the transducer body.

In an embodiment, the transducer access port has a fourth centerline forming a transducer angle with the third centerline and extending to the third centerline, wherein the transducer access port is offset from the first end of the transducer body. In an embodiment, the transducer angle is from about 20-degrees to about 120-degrees.

In an embodiment, the transducer is disposed within the transducer access port to close and seal the transducer access port.

In an embodiment, the drilling mud outlet of the transducer assembly is fluidly connected to the first drilling mud inlet of the drilling mud screen system.

In an embodiment, a method of installing a drilling mud screen comprise (a) stopping a drilling mud pump to fluidly connect a drilling mud screen as discussed herein to the drilling mud pump, (b) fluidly connecting the drilling mud screen system in line with and immediately upstream or downstream of the drilling mud pump, and (c) operating the drilling mud pump to produce flow of drilling mud through the drilling mud screen system.

In an embodiment, step b) comprises fluidly connecting a drilling mud inlet of the drilling mud screen to a high-pressure outlet of the drilling mud pump and fluidly connecting a drilling mud outlet of the drilling mud screen to a vibrator hose or a standpipe. In an embodiment, step b) comprises fluidly connecting a drilling mud inlet of the drilling mud screen to a high-pressure inlet of the drilling mud pump and fluidly connecting a drilling mud outlet of the drilling mud screen to an inlet of a vibrator hose. In an embodiment, step b) comprises fluidly connecting a drilling mud inlet of the drilling mud screen to an outlet of a vibrator hose and a drilling mud outlet of the drilling mud screen to an inlet of a standpipe. In an embodiment, step b) comprises fluidly connecting a drilling mud inlet of the drilling mud screen to an outlet of a first portion of a standpipe and a drilling mud outlet of the drilling mud screen to an inlet of a second portion of the standpipe.

In an embodiment, the method further comprises step d) filtering or screening debris from drilling mud.

In an embodiment, a method of installing a drilling mud screen system comprises (a) stopping a drilling mud pump to fluidly connect a drilling mud screen as discussed herein to the drilling mud pump, (b) fluidly connecting the drilling mud screen system in line with and immediately upstream or downstream of the drilling mud pump, and (c) operating the drilling mud pump to produce flow of drilling mud through the drilling mud screen system.

In an embodiment, step b) comprises fluidly connecting a drilling mud inlet of the drilling mud screen system to a high-pressure outlet of the drilling mud pump and fluidly connecting a drilling mud outlet of the drilling mud screen system to a vibrator hose or a standpipe. In an embodiment, step b) comprises fluidly connecting a drilling mud inlet of the drilling mud screen system to a high-pressure inlet of the drilling mud pump and fluidly connecting a drilling mud outlet of the drilling mud screen system to an inlet of a vibrator hose. In an embodiment, step b) comprises fluidly connecting a drilling mud inlet of the drilling mud screen system to an outlet of a vibrator hose and a drilling mud outlet to an inlet of a standpipe. In an embodiment, step b) comprises fluidly connecting a drilling mud inlet of the drilling mud screen system to an outlet of a first portion of a standpipe and a drilling mud outlet of the drilling mud screen system to an inlet of a second portion of the standpipe.

In an embodiment, the method further comprises step d) filtering or screening debris from drilling mud.

In an embodiment, a method of removing and replacing a drilling mud screen comprises (a) stopping a drilling mud pump connected to a drilling mud screen system as discussed herein, (b) opening a drilling mud screen access port and/or a union in the drilling mud screen system to remove and replace the drilling mud screen, (c) accessing the interior of the drilling mud screen system to pull the drilling mud screen from the drilling mud screen system and to install a replacement drilling mud screen into the drilling mud screen system, (d) closing the drilling mud screen access port and/or the union in the drilling mud screen system, and (e) operating the drilling mud pump to produce flow of drilling mud through the drilling mud screen system.

In an embodiment, step b) comprises opening a drilling mud screen access port in the body of the drilling mud screen system. In an embodiment, step b) comprises opening the drilling mud screen access port of the third body and opening a union between the third body and the fourth body of the drilling mud screen system to remove and replace the drilling mud screen.

In an embodiment, step d) comprises closing the drilling mud screen access port in of the body the drilling mud screen system. In an embodiment, step d) comprises closing the drilling mud screen access port of the third body and connecting the union between the third body and the fourth body of the drilling mud screen system.

In an embodiment, a method of installing a drilling mud screen system comprises (a) stopping a drilling mud pump, (b) fluidly connecting a first transducer subassembly, having a first transducer, in line with and downstream of the drilling mud pump and fluidly connecting a drilling mud screen system as discussed herein in line with and immediately downstream of the first transducer subassembly, and (c)

operating the drilling mud pump to produce flow of drilling mud through the first transducer subassembly and the drilling mud screen system.

In an embodiment, the method further comprises step (d) monitoring the first transducer of the first transducer subassembly for property information immediately upstream of the drilling mud screen system, and step (e) using the property information to determine a status of the drilling mud screen system.

In an embodiment, step (b) comprises (b-1) fluidly connecting the first transducer subassembly, having the first transducer, in line with and downstream of the drilling mud pump, (b-2) fluidly connecting the drilling mud screen system in line with and immediately downstream of the first transducer subassembly, (b-3) fluidly connecting a gate valve in line with and immediately downstream of the drilling mud screen system, and (b-4) fluidly connecting a second transducer assembly, having a low torque plug valve, in line with and immediately downstream of the gate valve.

In an embodiment, step (c) comprises operating the drilling mud pump to produce flow of drilling mud through the first transducer subassembly, the drilling mud screen system, the gate valve and the second transducer subassembly.

In an embodiment, the method further comprises step (d) stopping the drilling mud pump, step (e) closing the gate valve to isolate the drilling mud screen system, and step (f) pumping cement through the low torque plug valve of the second transducer subassembly, a vibrator hose, a stand pipe, a top drive and a case running tool (CRT).

In an embodiment, a second alternate piston-style drilling mud screen system comprises an optional first assembly having a first drilling mud inlet, an optional second assembly having a fourth drilling mud outlet, a reversed drilling mud screen, a second body, a third body, a union system and, optionally, a skid.

In an embodiment, a piston-style drilling mud screen system comprises a first assembly having a first drilling mud inlet, a second assembly having a fourth drilling mud outlet, a reversed drilling mud screen as discussed herein, a second body, a third body, a union system and, optionally, a skid.

In an embodiment, the first assembly has a first end and a second end, the first drilling mud inlet at the first end of the first assembly, and the first drilling mud outlet at the second end of the first assembly.

In an embodiment, the second body has a first end and a second end, a second drilling mud inlet at the first end of the second body, and a second drilling mud outlet at the second end of the second body. In an embodiment, the first drilling mud outlet of the first assembly is fluidly connected to the second drilling mud inlet of the second body. In an embodiment, the first drilling mud outlet of the first assembly is fluidly connected to the second drilling mud inlet of the second body via a connection.

In an embodiment, the second end of the second body is modified to reduce an inside surface exit angle to transition from a first inner diameter of the second body to a second inner diameter of the sixth body. In an embodiment, the exit angle is from about 10-degrees to about 90-degrees. In an embodiment, the exit angle is about 40-degrees.

In an embodiment, the third body has a first end and a second end, a third drilling mud inlet at the first end of the third body, and a third drilling mud outlet at the second end of the third body. In an embodiment, the second drilling mud outlet of the second body is fluidly connected to the third drilling mud inlet of the third body.

In an embodiment, the first end of the third body is modified to reduce an inside surface entry angle to transition from the second inner diameter of the sixth body to a third inner diameter of the third body. In an embodiment, the entry angle is from about 10-degrees to about 90-degrees. In an embodiment, the entry angle is about 30-degrees.

In an embodiment, the reversed drilling mud screen is disposed within the second body and the third body between the first drilling mud inlet and the second drilling mud outlet.

In an embodiment, the union system comprises a fourth body, a fifth body and a sixth body.

In an embodiment, the fourth body has a first inlet at a first end and a first outlet at second end.

In an embodiment, the fifth body has a second inlet at a first end and a second outlet at a second end.

In an embodiment, the sixth body has a first and second end. In an embodiment, the second end of the second body is disposed through the first end of the sixth body such that a portion of the fourth body is disposed between the second end of the third body and a portion of the first end of the sixth body. In an embodiment, the first end of the third body is disposed through the second end of the sixth body such that a portion of the fifth body is disposed between the first end of the third body and a portion of the second end of the sixth body.

In an embodiment, the second end of the fourth body and the first end of the sixth body form a first union; and the second end of the sixth body and the first end of the fifth body form a second union.

In an embodiment, the first drilling mud outlet of the first assembly is fluidly connected to the second drilling mud inlet of the first body via a connection.

In an embodiment, the third drilling mud outlet of the third body is fluidly connected to the fourth drilling mud inlet of the second assembly via a connection.

In an embodiment, the first drilling mud outlet of the first assembly is fluidly connected to the second drilling mud inlet of the second body via a connection.

In an embodiment, the third drilling mud outlet of the third body is fluidly connected to the fourth drilling mud inlet of the second assembly via a connection.

In an embodiment, the first outlet of the fourth body is connected to the second inlet of the fifth body via a connection.

In an embodiment, the sixth body is capable of receiving a portion of the second body when the first drilling mud outlet of the first subassembly is opened.

In an embodiment, the sixth body is capable of receiving a portion of the third body when the second drilling mud inlet of the second subassembly is opened.

In an embodiment, the skid comprises a base, a first support, a second support and a third support.

In an embodiment, the first support has a first end and a second end, wherein the first end of the first support is attached to the base and wherein the second end of the first support is attached to the first assembly.

In an embodiment, the second support has a first end and a second end, wherein the first end of the second support is attached to the base and wherein the second end of the second support is attached to the second assembly.

In an embodiment, the third support has a first end and a second end, wherein the first end of the third support is attached to the base and wherein the second end of the third support is attached to the union system.

In an embodiment, one or more of the first support, the second support and the third support is capable of being lowered, pivoted, raised, rotated or any combination thereof. In an embodiment, one or more of the first support, the second support and the third support is capable of being lowered, pivoted, raised, rotated or any combination thereof via a connection, coupling and/or extension. In an embodiment, the one or more of the first support, the second support and the third support is capable of being automatically lowered, pivoted, raised and/or rotated. In an embodiment, the one or more of the first support, the second support and the third support is capable of being manually lowered, pivoted, raised and/or rotated.

In an embodiment, the piston-style drilling mud screen system further comprises a transducer subassembly. In an embodiment, the transducer subassembly comprises a transducer body having a drilling mud inlet, a drilling mud outlet and a transducer access port, and a transducer.

In an embodiment, the transducer body has a first end, a second end and a first centerline from the first end to the second end.

In an embodiment, the drilling mud inlet is at the first end of the transducer body.

In an embodiment, the first drilling mud outlet is at the second end of the transducer body.

In an embodiment, the transducer access port has a second centerline forming a transducer angle with the first centerline and extending to the first centerline, wherein the transducer access port is offset from the first end of the transducer body. In an embodiment, the transducer angle is from about 20-degrees to about 120-degrees.

In an embodiment, the transducer is disposed within the transducer access port to close and seal the transducer access port.

In an embodiment, the drilling mud outlet of the transducer assembly is fluidly connected to the first drilling mud inlet of the piston-style drilling mud screen system. In an embodiment, the drilling mud outlet of the transducer subassembly is fluidly connected to the first drilling mud inlet of the piston-style drilling mud screen system via a crossover connection.

In an embodiment, one or more of the first assembly, the second assembly, the second body, the third body, the fourth body, the fifth body and the sixth body are constructed from AISI 4130/75k or equivalent material, AISI 4145 or equivalent, or combinations thereof.

In an embodiment, the reversed drilling mud screen is constructed from AISI 4145 or equivalent, stainless steel or combinations thereof.

In an embodiment, the reversed drilling mud screen has a hardened coating.

In an embodiment, a method of removing and replacing a drilling mud screen in a piston-style drilling mud screen system comprises (a) stopping a drilling mud pump connected to the piston-style drilling mud screen system as discussed herein, (b) opening the first drilling mud outlet of the first subassembly and/or the second drilling mud inlet of the second subassembly in the piston-style drilling mud screen system to remove and replace a drilling mud screen, (c) accessing the interior of the piston-style drilling mud screen system to pull the drilling mud screen from the piston-style drilling mud screen system and to install a replacement drilling mud screen into the piston-style drilling mud screen system, (d) closing the first drilling mud outlet of the first subassembly and/or the second drilling mud inlet of the second subassembly in the piston-style drilling mud screen system, and (e) operating the drilling mud pump to produce flow of drilling mud through the piston-style drilling mud screen system.

In an embodiment, step (b) comprises (b-1) rotating the second body to disengage the first assembly and/or rotating the third body to disengage the second assembly, and (b-2) sliding the second body further into the union system to fully disengage the first assembly and/or sliding the third body into the union system to fully disengage the second assembly. In an embodiment, step (b) further comprises (b-3) lifting, lowering, pivoting, rotating, sliding or otherwise moving one or more of the first assembly, the second assembly, the union system and any combination thereof to open the piston-style drilling mud screen system to remove the drilling mud screen.

In an embodiment, step (d) comprises (d-1) lifting, lowering, pivoting, rotating, sliding or otherwise moving one or more of a first assembly, a second assembly, the union system and any combination thereof to close the piston-style drilling mud screen system, (d-2) sliding the second body to engage the first assembly and/or sliding the third body to engage the second body, and (d-3) rotating the second body to fully engage the first assembly and/or rotating the third body to fully engage the second assembly.

In an embodiment, a method of installing a piston-style drilling mud screen system comprises (a) stopping a drilling mud pump, (b) fluidly connecting a first transducer subassembly, having a first transducer, in line with and downstream of the drilling mud pump and fluidly connecting the piston-style drilling mud screen system as discussed herein in line with and immediately downstream of the first transducer subassembly, and (c) operating the drilling mud pump to produce flow of drilling mud through the first transducer subassembly and the piston-style drilling mud screen system.

In an embodiment, the method further comprises step (d) monitoring the transducer of the first transducer subassembly for property information immediately upstream of the piston-style drilling mud screen system and step (e) using the property information to determine a status of the piston-style drilling mud screen system.

In an embodiment, step (b) comprises (b-1) fluidly connecting the first transducer subassembly, having the first transducer, in line with and downstream of the drilling mud pump and fluidly connecting the piston-style drilling mud screen system as discussed herein in line with and immediately downstream of the first transducer subassembly, (b-2) fluidly connecting a gate valve in line with and immediately downstream of the piston-style drilling mud screen system, (b-3) fluidly connecting a second transducer assembly, having a low torque plug valve, in line with and immediately downstream of the gate valve.

In an embodiment, step (c) comprises operating the drilling mud pump to produce flow of drilling mud through the first transducer subassembly, the piston-style drilling mud screen system, the gate valve and the second transducer subassembly.

In an embodiment, the method further comprises step (d) stopping the drilling mud pump, step (e) closing the gate valve to isolate the piston-style drilling mud screen system, and step (f) pumping cement through the low torque plug valve of the second transducer subassembly, a vibrator hose, a stand pipe, a top drive and a case running tool (CRT).

These and other objects, features and advantages will become apparent as reference is made to the following detailed description, preferred embodiments, and examples, given for the purpose of disclosure, and taken in conjunction with the accompanying drawings and appended claims.

BRIEF DESCRIPTION OF THE DRAWINGS

The patent or application file contains at least one drawing executed in color. Copies of this patent or patent application publication with color drawing(s) will be provided by the U.S. Patent and Trademark Office upon request and payment of a required fee.

For a further understanding of the nature and objects of the present invention, reference should be made to the following detailed disclosure, taken in conjunction with the accompanying drawings, in which like parts are given like reference numerals, and wherein:

FIG. 30A-1 illustrates a cross-sectional view of an exemplary piston-style drilling mud screen system according to an embodiment of the present invention, showing the piston-style drilling mud screen system mounted on a skid;

FIG. 30A-2 illustrates a cross-sectional view of an exemplary piston-style drilling mud screen system according to an embodiment of the present invention, showing the piston-style drilling mud screen system mounted on a skid;

FIG. 30A-3 illustrates a cross-sectional view of an exemplary piston-style drilling mud screen system according to an embodiment of the present invention, showing the piston-style drilling mud screen system mounted on a skid;

FIG. 30A-4 illustrates a cross-sectional view of an exemplary piston-style drilling mud screen system according to an embodiment of the present invention, showing the piston-style drilling mud screen system mounted on a skid;

FIG. 41B illustrates a detailed view of the reversed drilling mud screen of FIG. 41A;

FIG. 42A-1 illustrates a cross-sectional view of an exemplary piston-style drilling mud screen system according to an embodiment of the invention, showing a reversed drilling mud screen;

FIG. 42A-2 illustrates a cross-sectional view of an exemplary piston-style drilling mud screen system according to an embodiment of the invention, showing a reversed drilling mud screen

DETAILED DESCRIPTION OF EMBODIMENTS OF THE INVENTION

The following detailed description of various embodiments of the present invention references the accompanying drawings, which illustrate specific embodiments in which the invention can be practiced. While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth herein but rather that the claims be construed as encompassing all the features of patentable novelty which reside in the present invention, including all features which would be treated as equivalents thereof by those skilled in the art to which the invention pertains. Therefore, the scope of the present invention is defined only by the appended claims, along with the full scope of equivalents to which such claims are entitled.

Exemplary Drilling Mud Screen System

Figure 1:
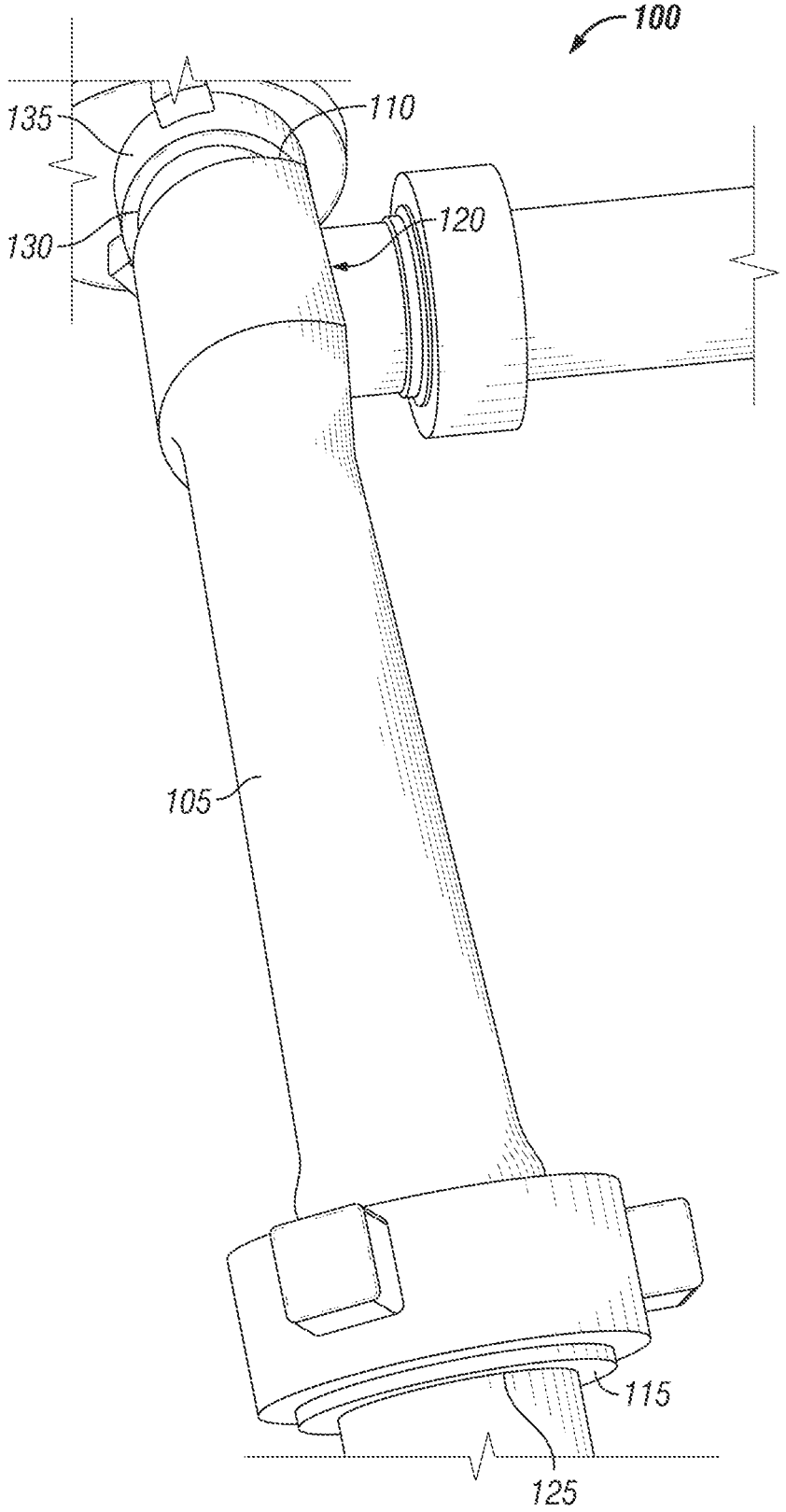
FIG. 1 illustrates an image of an exemplary drilling mud screen system according to an embodiment of the present invention, showing the system installed at an outlet of a drilling mud pump upstream of a drilling rig standpipe assembly.

FIG. 1 illustrates an image of an exemplary drilling mud screen system according to an embodiment of the present invention, showing the system installed at an outlet of a drilling mud pump upstream of a drilling rig standpipe assembly. As shown in FIG. 1, the drilling mud screen system 100 has a body 105 having a first end 110 and a second end 115, a drilling mud inlet 120 and a drilling mud outlet 125, and a drilling mud screen access port 130. In an embodiment, the drilling mud screen access port 130 may be closed with an end cap 135.

In an embodiment, a drilling mud inlet 120 of the drilling mud screen system 100 may be fluidly connected to a high-pressure outlet of a drilling mud pump via a connection. In an embodiment, a drilling mud outlet 125 of the drilling mud screen system 100 may be fluidly connected to an inlet of a vibrator hose to a standpipe via a connection.

Alternatively, the drilling mud screen system 100 may be installed between an outlet of the vibrator hose and an inlet of the standpipe, or at any point in the standpipe via a connection.

In an embodiment, the drilling mud inlet 120 may be fluidly connected to, for example, an outlet to a drilling mud pump via a connection; and the drilling mud outlet 125 may be fluidly connected to, for example, an inlet to a vibrator hose via a connection. Any suitable connection may be used for the drilling mud inlet and the drilling mud outlet. For example, suitable connections include, but are not limited to, pipe fittings and welds. Connections are well known in the art. In an embodiment, the drilling mud inlet 120 may be fluidly connected to, for example, an outlet to a drilling mud pump via a weld; and the drilling mud outlet 125 may be fluidly connected to, for example, an inlet to a vibrator hose via a weld.

Single-Piece Body

Figure 2:
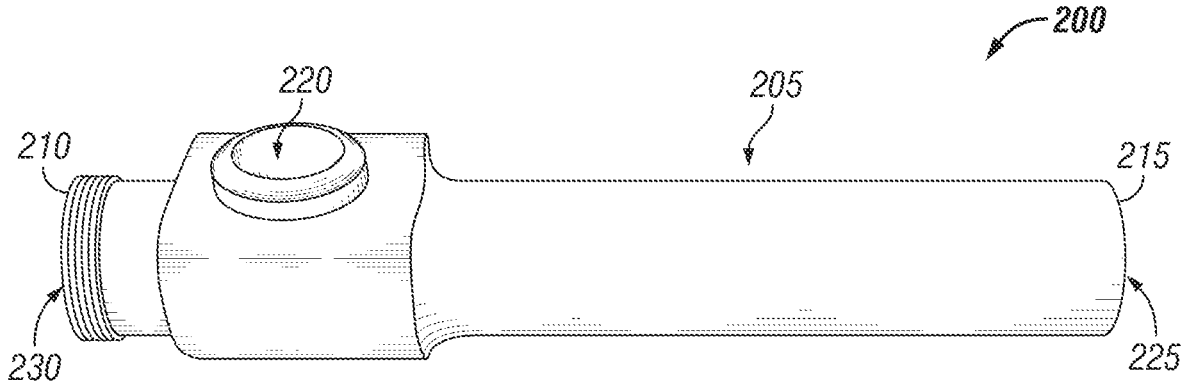
FIG. 2 illustrates an image of a single-piece body for the exemplary drilling mud screen system of FIG. 1, showing an unassembled view of a drilling mud inlet, a drilling mud outlet and a drilling mud screen access port.

FIG. 2 illustrates an image of a single-piece body for the exemplary drilling mud screen system of FIG. 1, showing an unassembled view of a drilling mud inlet 220, a drilling mud outlet 225, and a drilling mud screen access port 230. As shown in FIG. 2, the drilling mud screen system 200 has a body 205 having a first end 210 and a second end 215, an inlet 220 and an outlet 225, and a mud screen access port 230.

In an embodiment, the drilling mud inlet 220 may be fluidly connected to, for example, an outlet of a drilling mud pump via a connection; and the drilling mud outlet 225 may be fluidly connected to, for example, an inlet of a vibrator hose via a connection. Any suitable connection may be used for the drilling mud inlet 220 and the drilling mud outlet 225. For example, suitable connections include, but are not limited to, pipe fittings and welds. Connections are well known in the art. In an embodiment, the drilling mud inlet 220 may be fluidly connected to, for example, an outlet of a drilling mud pump via a weld; and the drilling mud outlet 225 may be fluidly connected to, for example, an inlet of a vibrator hose via a weld.

Figure 3A:
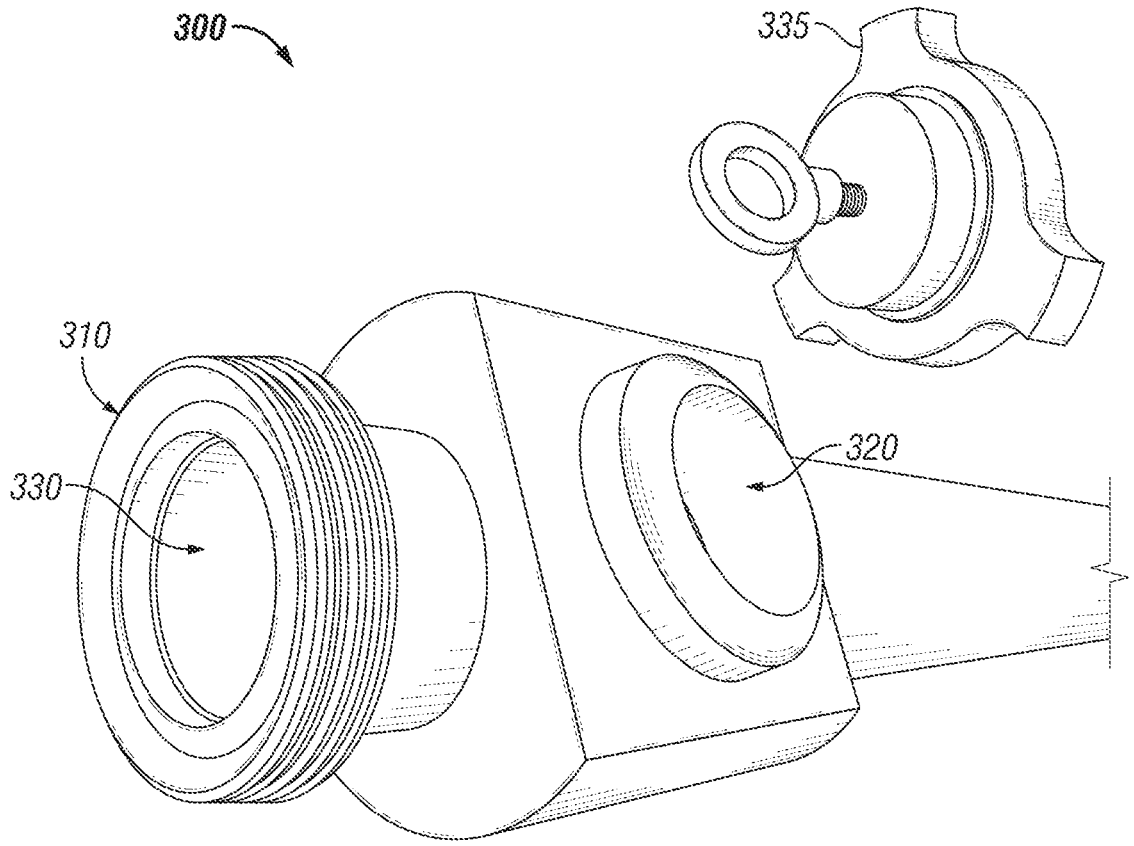
FIG. 3A illustrates an image of a single-piece body for the exemplary drilling mud screen system of FIG. 2, showing a detailed view of a drilling mud inlet and a drilling mud screen access port.

FIG. 3A illustrates an image of a single-piece body for the exemplary drilling mud screen system of FIG. 2, showing a detailed view of a drilling mud inlet 320 and a drilling mud screen access port 330. As shown in FIG. 3A, the drilling mud screen system 300 has a body 305 having a first end 310, an inlet 320, a drilling mud screen access port 330, and an end cap 335.

Figure 3B:
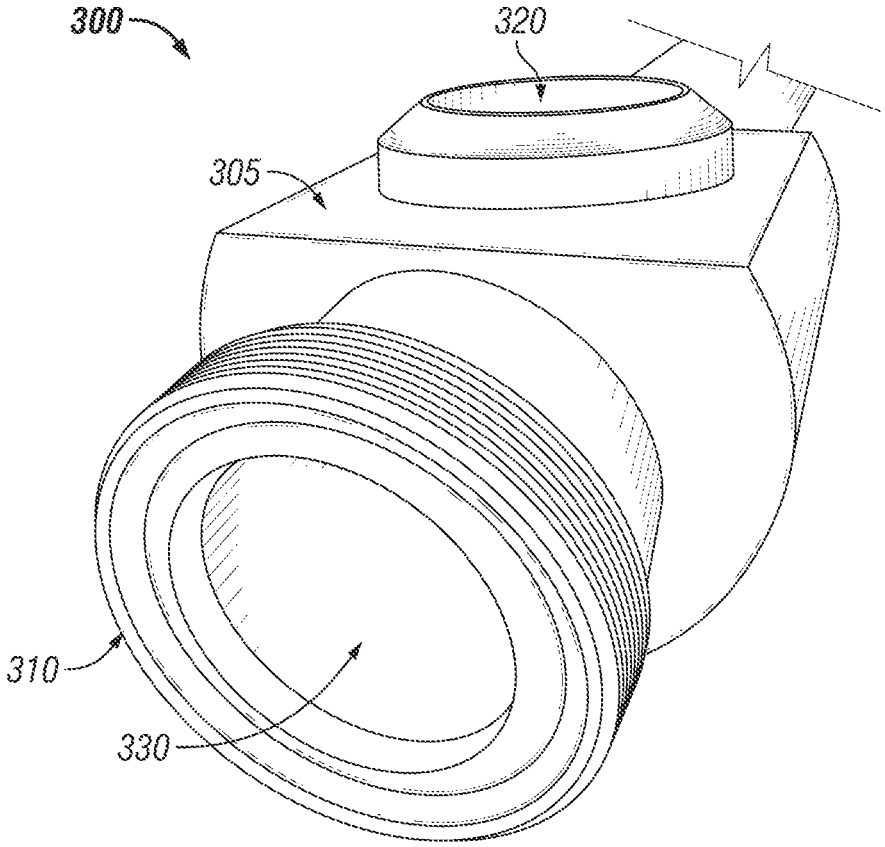
FIG. 3B illustrates an image of a single-piece body for the exemplary drilling mud screen system of FIG. 3A, showing a detailed view of the drilling mud screen access port.

FIG. 3B illustrates an image of the single-piece body of FIG. 3A, showing a detailed view of the drilling mud screen access port 330. As shown in FIG. 3B, the drilling mud screen system 300 has a body 305 having a first end 310, an inlet 320, and a drilling mud screen access port 330.

Figure 3C:
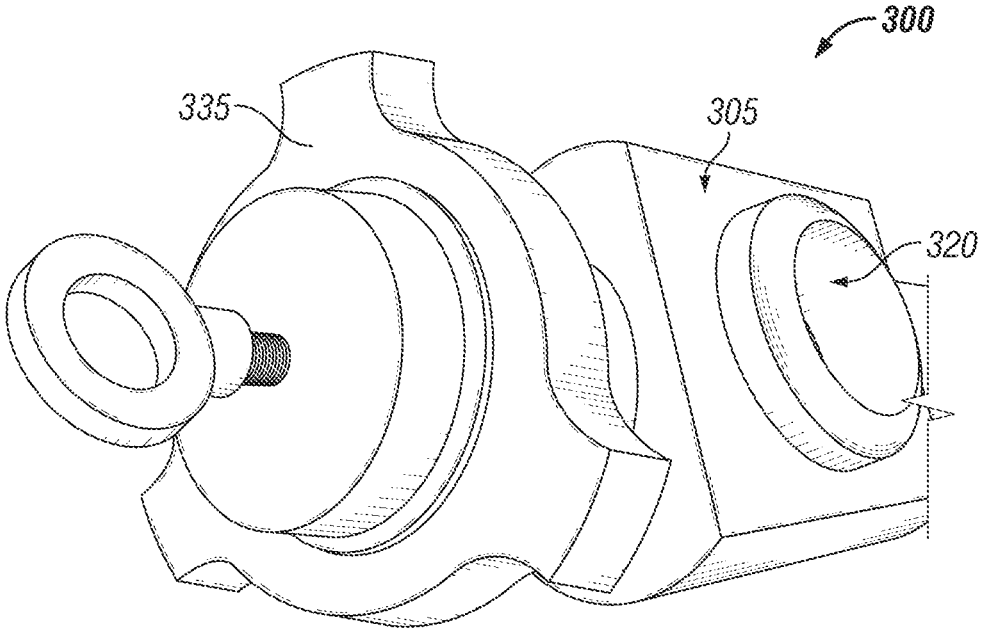
FIG. 3C illustrates an image of the single-piece body for the exemplary drilling mud screen system of FIG. 3A, showing an end cap installed in the drilling mud screen access port.

FIG. 3C illustrates an image of the single-piece body of FIG. 3A, showing an end cap 335 installed in a drilling mud screen access port 330. As shown in FIG. 3C, the drilling mud screen access port 330 of the drilling mud screen system 300 may be closed with an end cap 335 via a fitting. Any suitable fitting may be used. For example, suitable fittings include, but are not limited to, pipe fittings. Fittings are well known in the art.

In an embodiment, the drilling mud screen access port 330 of the drilling mud screen system 300 may be sealed with an end cap 335 via an O-ring. Any suitable O-ring may be used. For example, suitable O-rings include, but are not limited to, 300 Series O-rings. O-rings are well known in the art.

In an embodiment, the end cap 335 of the drilling mud screen system 300 may comprise a cap, an O-ring and a pipe collar. In an embodiment, the end cap 335 may be a five-inch 1002 WECO cap with an O-ring.

Figure 3D:
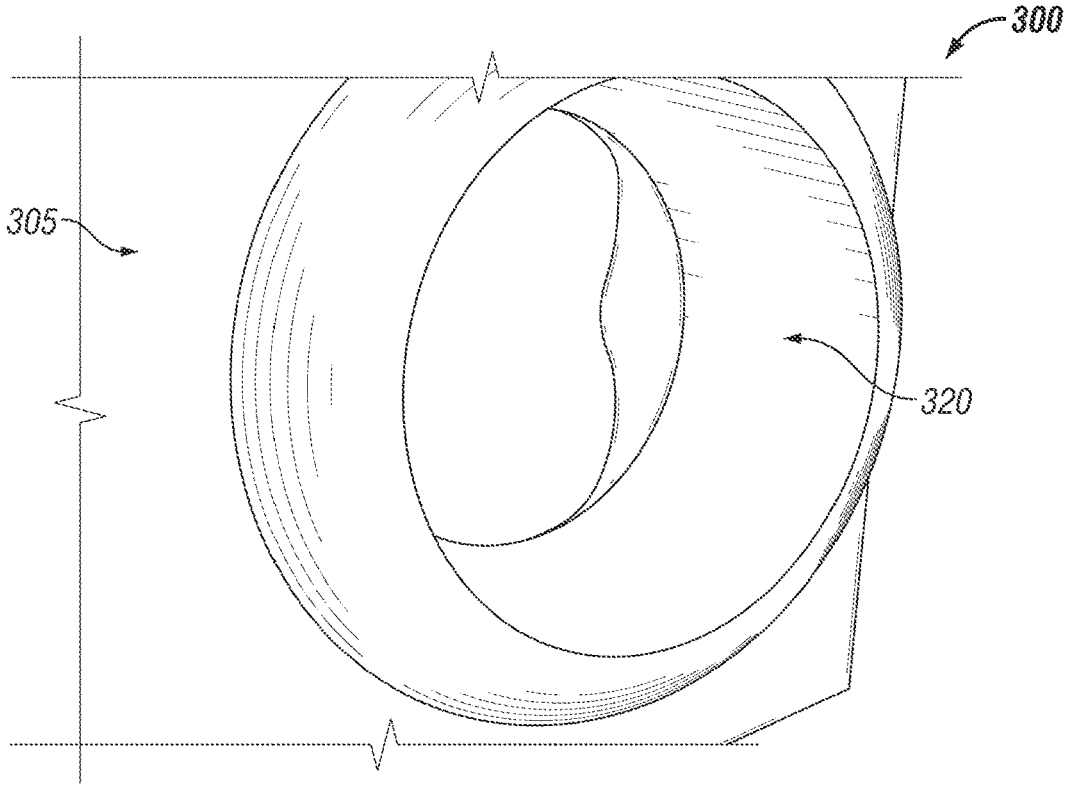
FIG. 3D illustrates an image of a single-piece body for the exemplary drilling mud screen system of FIGS. 3A-3C, showing a detailed view of the drilling mud inlet.
Figure 3E:
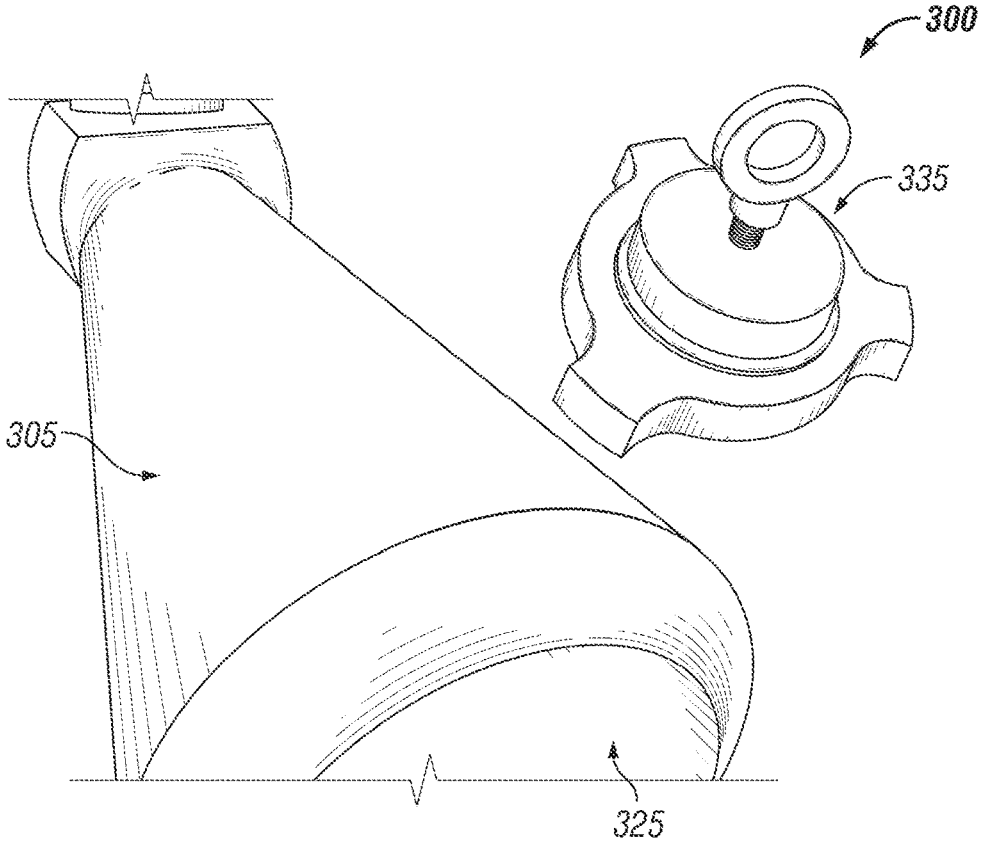
FIG. 3E illustrates an image of a single piece body of the exemplary drilling mud screen system of FIGS. 3A-3C, showing a detailed view of the drilling mud outlet.

FIG. 3D illustrates an image of a single-piece body of the exemplary drilling mud screen system of FIGS. 3A-3C, showing a detailed view of the drilling mud inlet 320; and FIG. 3E illustrates an image of a single-piece body of the exemplary drilling mud screen system of FIGS. 3A-3C, showing a detailed view of the drilling mud outlet 325.

In an embodiment, the drilling mud inlet 320 may be fluidly connected to, for example, an outlet of a drilling mud pump via a connection; and the drilling mud outlet 325 may be fluidly connected to an inlet of a vibrator hose via a connection. Any suitable connection may be used for the drilling mud inlet 320 and the drilling mud outlet 325. For example, suitable connections include, but are not limited to, pipe fittings and welds. Connections are well known in the art. In an embodiment, the drilling mud inlet 320 may be fluidly connected to, for example, an outlet of a drilling mud pump via a weld; and the drilling mud outlet 325 may be fluidly connected to an inlet of a vibrator hose via a weld.

Figure 4A:
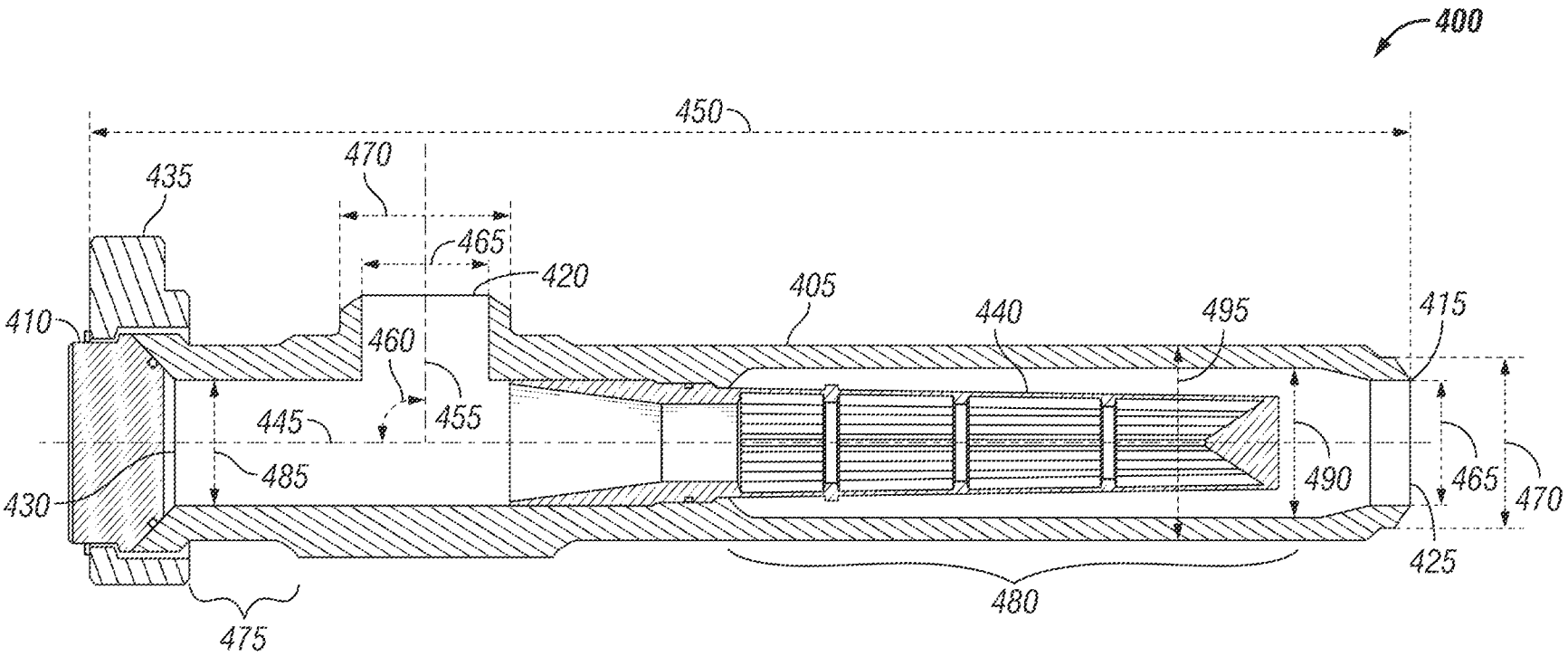
FIG. 4A illustrates an upper, cross-sectional view of an exemplary drilling mud screen system according to an embodiment of the present invention, showing a drilling mud screen.

FIG. 4A illustrates an upper, cross-sectional view of an exemplary drilling mud screen system according to an embodiment of the present invention, showing a drilling mud screen. As shown in FIG. 4A, the drilling mud screen system 400 has a body 405 having a first end 410 and a second end 415, a drilling mud inlet 420 and a drilling mud outlet 425, a drilling mud screen access port 430, an end cap 435 and a drilling mud screen 440.

Any suitable connection may be used for the drilling mud inlet 420 and the drilling mud outlet 425. For example, suitable connections include, but are not limited to, pipe fittings and welds. Connections are well known in the art.

In an embodiment, the body 405 of the drilling mud screen system 400 may be constructed of any suitable material. For example, suitable materials include, but are not limited to, any alloy steel suitable for a drilling mud application. In an embodiment, the body 405 may be constructed of an American Iron and Steel Industry (AISI) 4130/75k yield or equivalent material. See e.g., FIG. 2. In an embodiment, the inner surface of the body 405 may be unpainted. See e.g., FIGS. 1 & 3A-3E. In an embodiment, the outer surface of the body 405 may be painted. Id.

In an embodiment, the body 405 has a first centerline 445 and a length 450. In an embodiment, the first centerline 445 extends through the center of the drilling mud screen access port 430 to the drilling mud outlet 425. The length 450 of the body 405 may be any suitable length. In an embodiment, the length 450 of the body 405 may be from about 30-inches to about 50-inches, and any range or value there between. In an embodiment, the length 450 may be about 40-inches.

In an embodiment, the body 405 has a second centerline 455. In an embodiment, the second centerline 455 extends through the center of the drilling mud inlet 420 to the first centerline 445.

In an embodiment, the first centerline 445 and the second centerline 455 form a first angle 460. In an embodiment, the first angle 460 may be from about 30-degrees to about 120-degrees, and any range or value there between. In an embodiment, the first angle 460 may be about 45-degrees. In an embodiment, the first angle 460 may be about 90-degrees.

In an embodiment, the first drilling mud inlet 420 may be offset from a first end 410 of the body 405. The first drilling mud inlet 420 may be offset from a first end 410 of the body 405 at any suitable distance. In an embodiment, the second centerline 455 may be offset from the first end 410 of the body 405 from about 9-inches to about 13-inches, and any range or value there between. In an embodiment, the second centerline 455 may be offset from the first end 410 of the body 405 about 11-inches.

In an embodiment, the drilling mud inlet 420 may have any suitable inner diameter 465; and the drilling mud inlet 420 may have any suitable outer diameter 470. In an embodiment, the inner diameter 465 of the drilling mud inlet 420 may be from about 3-inches to about 5-inches, and any range or value there between. In an embodiment, the inner diameter 465 of the drilling mud inlet 420 may be about 4-inches.

In an embodiment, the outer diameter 470 of the drilling mud inlet 420 may be from about 4.5-inches to about 6.5-inches, and any range or value there between. In an embodiment, the outer diameter 470 of the drilling mud inlet 420 may be about 5.5-inches.

In an embodiment, the body 405 has a first portion 475 and a second portion 480. In an embodiment, the first portion 475 of the body 405 may have a first inner diameter 485 and an outer diameter 495; and the second portion 480 of the body 405 may have a second inner diameter 490 and an outer diameter 495.

In an embodiment, the first inner diameter 485 of the body 405 may be from about 3-inches to about 5-inches, and any range or value there between. In an embodiment, the first inner diameter 485 of the body 405 may be about 4-inches.

In an embodiment, the second inner diameter 490 of the body 405 may be from about 3-inches to about 5-inches, and any range or value there between. In an embodiment, the second inner diameter 490 of the body 405 may be about 4-inches.

In an embodiment, a second portion 480 of the body 405 may have a second inner diameter 490 to provide a high flow rate of drilling mud through the drilling mud screen 440. In an embodiment, the second inner diameter 490 of the body 405 may be from about 3.5-inches to about 5.5-inches, and any range or value there between. In an embodiment, the second inner diameter 490 of the body 405 may be from about 4.5-inches to about 5.5-inches, and any range or value there between.

In an embodiment, the outer diameter 495 of the first portion 475 and/or the second portion 480 of the body 405 may be from about 5.5-inches to about 7.5-inches, and any range or value there between. In an embodiment, the outer diameter 495 of the first portion 475 and/or the second portion 480 of the body 405 may be about 6.5-inches.

In an embodiment, the drilling mud outlet 425 may have any suitable inner diameter 465; and the drilling mud outlet 425 may have any suitable outer diameter 470. In an embodiment, the inner diameter 465 of the drilling mud outlet 425 may be from about 3-inches to about 5-inches, and any range or value there between. In an embodiment, the inner diameter 465 of the drilling mud outlet 425 may be about 4-inches.

In an embodiment, the outer diameter 470 of the drilling mud outlet 425 may be from about 4.5-inches to about 6.5-inches, and any range or value there between. In an embodiment, the outer diameter 470 of the drilling mud outlet 425 may be about 5.5-inches.

Figure 4B:
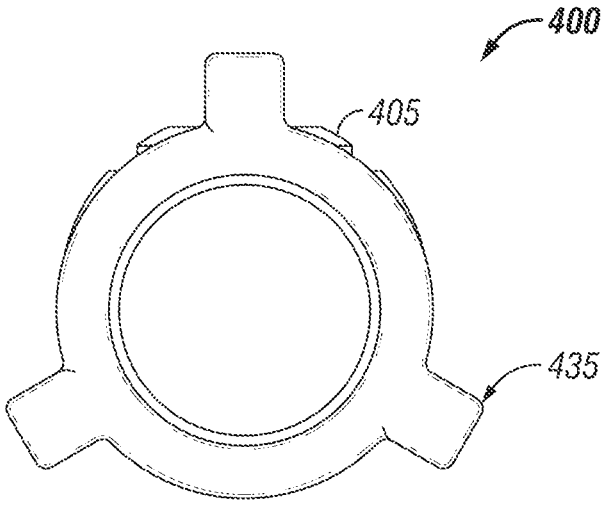
FIG. 4B illustrates a detailed view of A-A of FIG. 4A, showing an end cap installed.
Figure 4C:
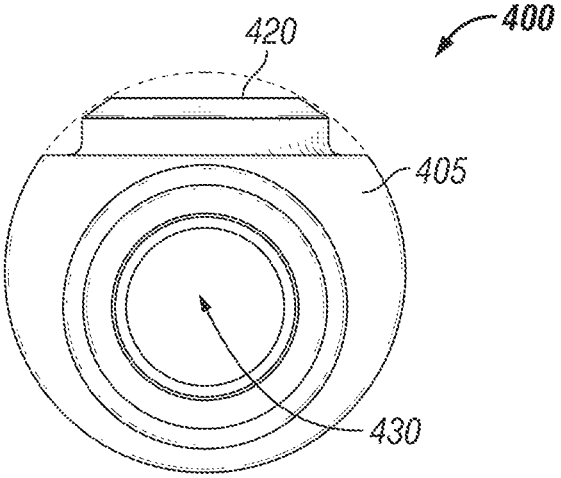
FIG. 4C illustrates a detailed view of A-A of FIGS. 4A-4B, showing the end cap removed.

FIG. 4B illustrates a detailed view of A-A of FIG. 4A, showing an end cap 435 installed; and FIG. 4C illustrates a detailed view of A-A of FIGS. 4A-4B, showing the end cap 435 removed.

Drilling Mud Screen

The drilling mud screen 500 may be any suitable filter or screen capable of filtering or screening debris from drilling muds and completion fluids. For example, suitable drilling mud screens include, but are not limited to, drill screens and rod screens.

Figure 5A:
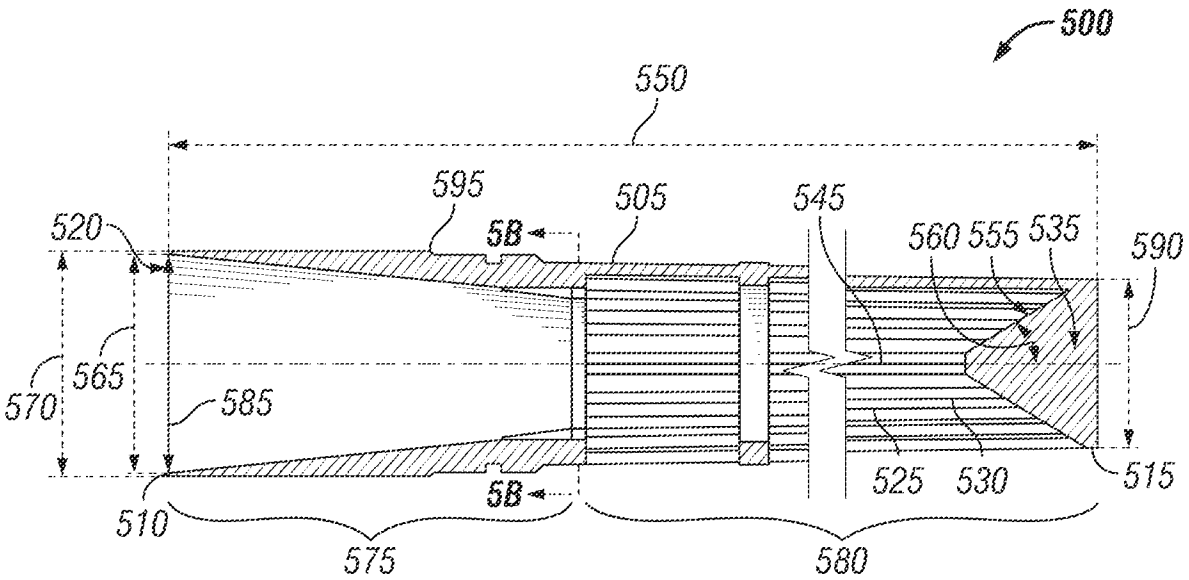
FIG. 5A illustrates an upper, cross-sectional view of a drilling mud screen according to an embodiment of the present invention, showing a filter and an end cap.

FIG. 5A illustrates an upper, cross-sectional view of a drilling mud screen according to an embodiment of the present invention, showing a filter 530 and an end cap 535. As shown in FIG. 5A, the drilling mud screen 500 has a body 505 having a first end 510 and a second end 515, a drilling mud inlet 520, a drilling mud outlet 525, a filter 530 and an end cap 535.

In an embodiment, the drilling mud inlet 520 may be fluidly connected to, for example, an outlet of a drilling mud pump via a connection; and the drilling mud outlet 525 may be fluidly connected to an inlet of a vibrator hose via a connection. Any suitable connection may be used for the drilling mud inlet 520 and the drilling mud outlet 525. For example, suitable connections include, but are not limited to, pipe fittings and welds. Connections are well known in the art. In an embodiment, the drilling mud inlet 520 may be fluidly connected to, for example, an outlet of a drilling mud pump via a weld; and the drilling mud outlet 525 may be fluidly connected to an inlet of a vibrator hose via a weld.

In an embodiment, the body 505 of the drilling mud screen 500 may be constructed of any suitable material. For example, suitable materials include, but are not limited to, any alloy steel or tool steel. In an embodiment, the body 505 may be constructed of an AISI 4145 or equivalent material. See e.g., FIGS. 5A-5E. In an embodiment, the body 505 may be constructed of tool steel or equivalent material.

In an embodiment, the body 505 of the drilling mud screen 500 may have a hardened coating to reduce washing (i.e., erosion) of the screen 500. For example, suitable hardened coatings include, but are not limited to, any Carbide coating or equivalent. In an embodiment, the body 505 may have a Carbide coating with about 6% Cobalt binder or equivalent material.

In an embodiment, the body 505 of the drilling mud screen 500 has a centerline 545 and a length 550. In an embodiment, the centerline 545 extends through the center of the drilling mud screen inlet 520 to the end cap 535. The length 550 of the body 505 may be any suitable length. In an embodiment, the length 550 of the body 505 may be from about 20-inches to about 30-inches, and any range or value there between. In an embodiment, the length 550 may be about 25-inches.

In an embodiment, the drilling mud inlet 520 of the drilling mud screen 500 may have any suitable inner diameter 565; and the drilling mud inlet 520 may have any suitable outer diameter 570. In an embodiment, the inner diameter 565 of the drilling mud inlet 520 may be from about 3-inches to about 5-inches, and any range or value there between. In an embodiment, the inner diameter 565 of the drilling mud inlet 520 may be about 3.9-inches.

In an embodiment, the outer diameter 570 of the drilling mud inlet 520 may be from about 4-inches to about 6-inches, and any range or value there between. In an embodiment, the outer diameter 570 of the drilling mud inlet 520 may be about 4-inches.

In an embodiment, the body 505 of the drilling mud screen 500 has a first portion 575 and a second portion 580. In an embodiment, the first portion 575 of the body 505 has a first length; and the second portion 580 of the body 505 has a second length. The first portion 575 and the second portion 580 may be any suitable length. In an embodiment, the first portion 575 may have a first length from about 6-inches to about 10-inches; and the second portion 580 may have a second length from about 14-inches to about 20-inches, and any range or value there between. In an embodiment, the first portion 575 may have a first length of about 7.5-inches; and the second portion 580 may have a second length of about 17.5-inches.

In an embodiment, a second portion 580 of the body 505 of the drilling mud screen 500 may have a filter 530. In an embodiment, the filter 530 may comprise a plurality of rods spaced a distance apart to form a filter. In an embodiment, the distance may be less than a particle size (e.g., diameter) desired to be filtered from the drilling mud. Particle filtration is well known in the art.

In an embodiment, the filter 530 may comprise a formed sheet having drilled holes spaced a distance apart to form a filter. In an embodiment, the size of the holes (e.g., diameter) may be less than a particle size (e.g., diameter) desired to be filtered. Particle filtration is well known in the art.

In an embodiment, a second portion 580 of the body 505 of the drilling mud screen 500 may have a drilling mud outlet 525. In an embodiment, the drilling mud outlet 525 may comprise a plurality of spaces (i.e., flow passages) between a plurality of rods. In an embodiment, the drilling mud outlet 525 may comprise a plurality of holes (i.e., flow passages) drilled in a formed sheet.

In an embodiment, a first end 510 of a first portion 575 of the body 505 of the drilling mud screen 500 may have a first inner diameter 585; and a second end 515 of a second portion 580 of the body 505 may have a second inner diameter 590.

In an embodiment, the first end 510 of the first portion 575 may be shaped to accept a puller/installer plate 975 of a drilling mud screen puller/installer tool 800, 900, as discussed below. See e.g., FIGS. 5A, 8A & 9A.

In an embodiment, the body 505 and/or a filter 530 of the drilling mud screen 500 may have a tapered drilling mud flow path from a larger inner diameter to a smaller inner diameter to reduce washing (i.e., erosion) of the screen 500.

In an embodiment, the first inner diameter 585 of the first end 510 of the body 505 of the drilling mud screen 500 may be from about 3-inches to about 5-inches, and any range or value there between. In an embodiment, the first inner diameter 585 of the first end 510 of the body 505 may be about 3.9-inches.

Figure 5B:
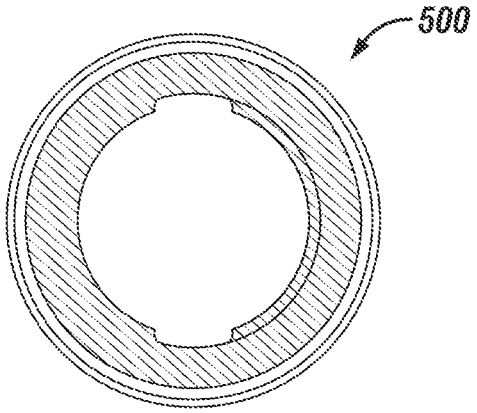
FIG. 5B illustrates a detailed view of A-A of FIG. 5A, showing an inlet of a second portion of a body and an outlet of the first portion of the body.

FIG. 5B illustrates a detailed view of A-A of FIG. 5A, showing an outlet of a first portion 575 of the body 505 and an inlet of the second portion 580 of the body 505. In an embodiment, an inner diameter of an outlet of the first portion 575 and an inlet of the second portion 590 of the body 505 may be from about 2-inches to about 3-inches, and any range or value there between. In an embodiment, the inner diameter of the outlet of the first portion 575 of the body 505 and the inlet of the second portion 590 of the body 505 may be about 2.5-inches.

Figure 12A:
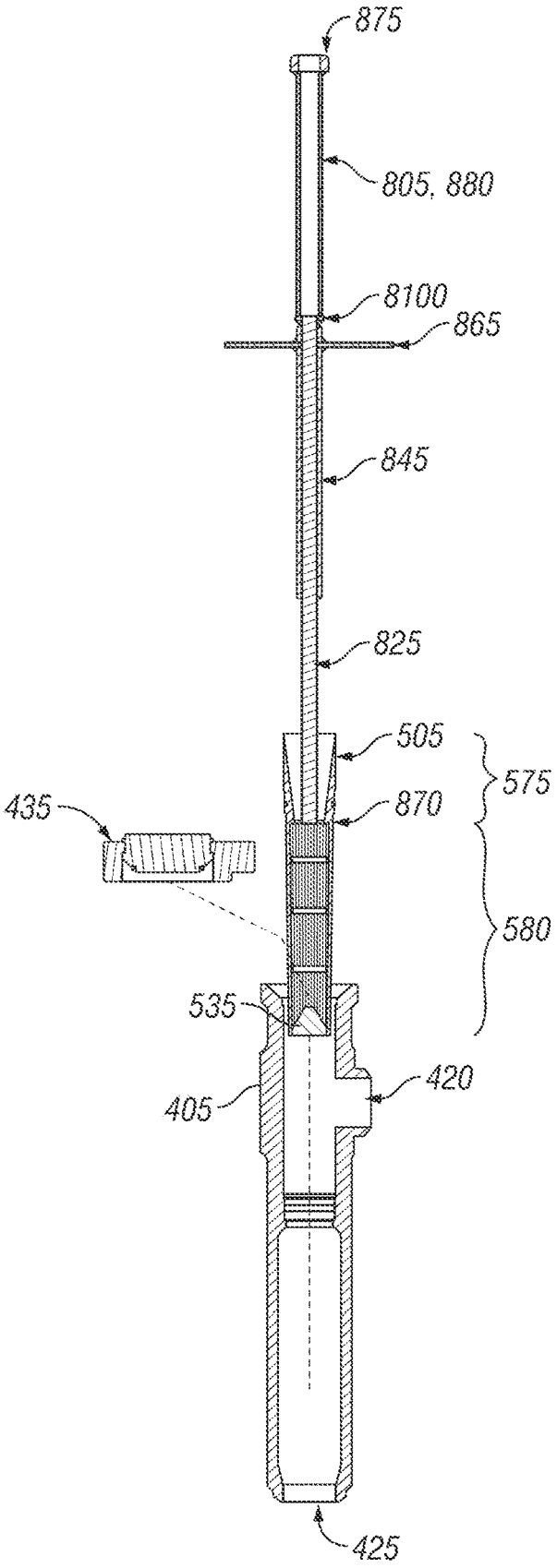
FIG. 12A illustrates a cross-sectional view of the exemplary drilling mud tool of FIG. 8A pulling the drilling mud screen of FIG. 5 from the exemplary drilling mud screen system of FIG. 4.
Figure 12B:
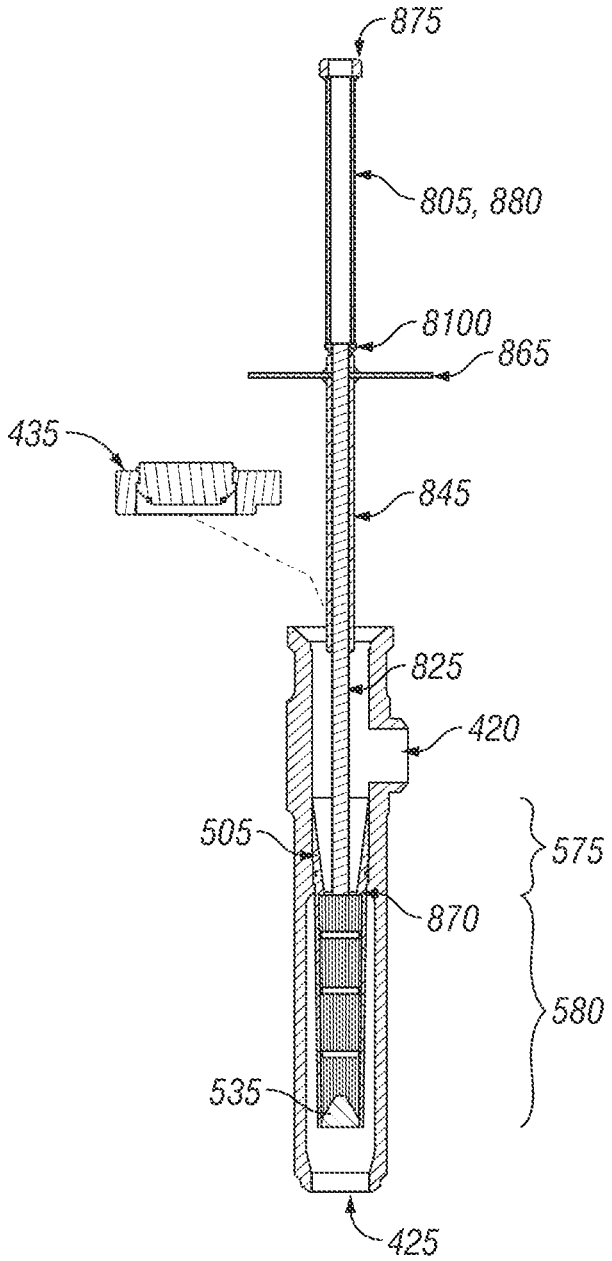
FIG. 12B illustrates a cross-sectional view of the exemplary drilling mud tool of FIG. 8A installing the drilling mud screen of FIG. 5 into the exemplary drilling mud screen system of FIG. 4.
Figure 13A:
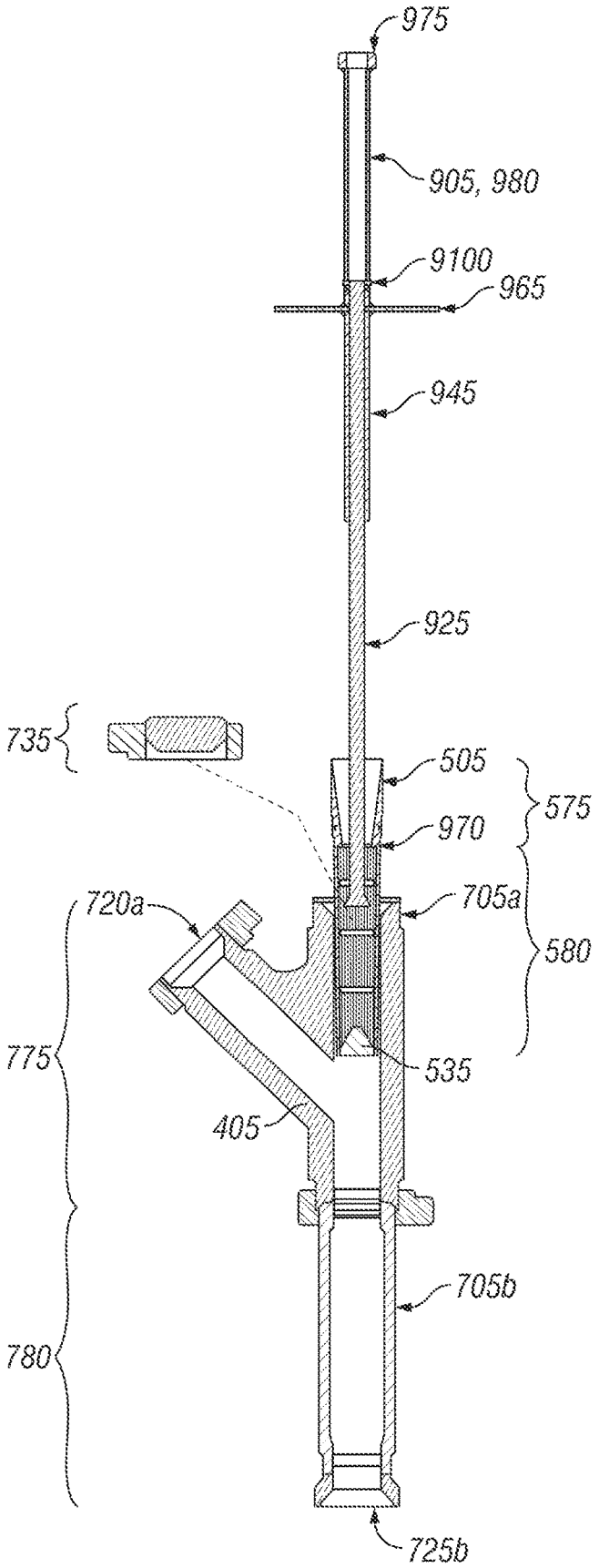
FIG. 13A illustrates a cross-sectional view of the exemplary drilling mud tool of FIG. 9A pulling the drilling mud screen of FIG. 5 from the exemplary drilling mud screen system of FIG. 7A.
Figure 13B:
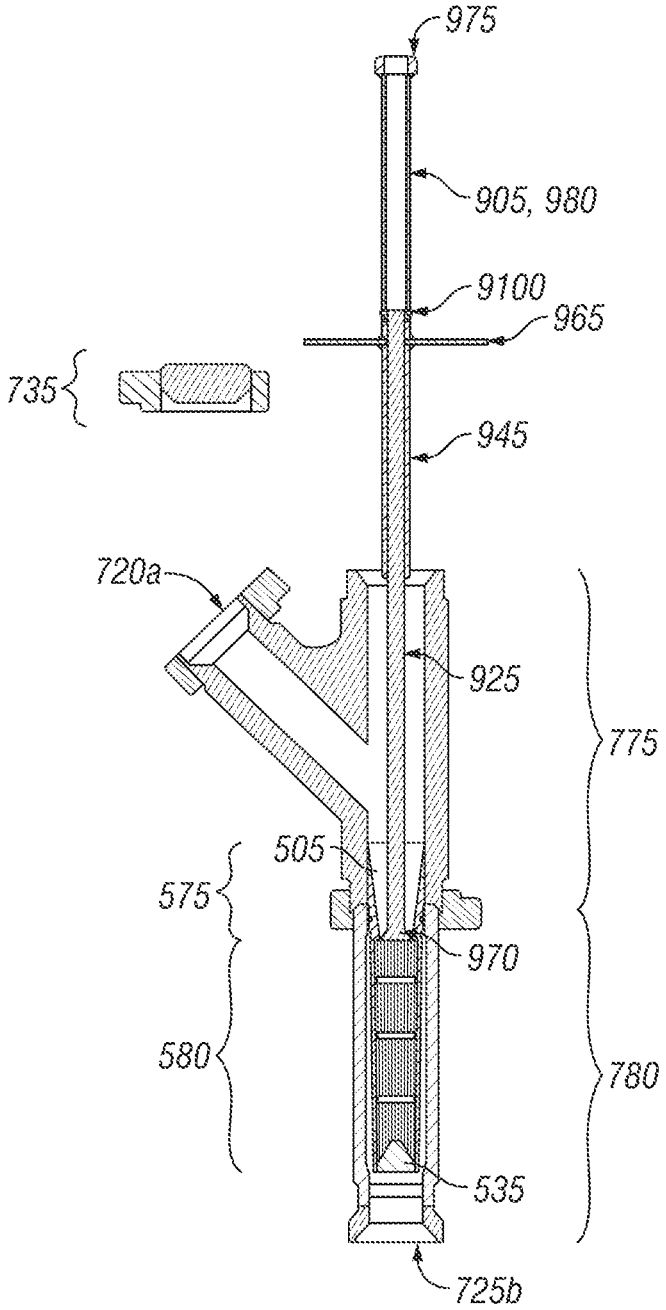
FIG. 13B illustrates a cross-sectional view of the exemplary drilling mud tool of FIG. 9A installing the drilling mud screen of FIG. 5 into the exemplary drilling mud screen system of FIG. 7A.

In an embodiment, the outlet of the first portion 575 and/or the inlet of the second portion 590 of the body 505 may be shaped to accept a rounded end 875, 975 of a drilling mud screen puller/installer tool 800, 900. See e.g., FIGS. 5B, 8B & 9B. See also FIGS. 12B & 13B. In an embodiment, the inlet of the second portion 590 of the body 505 may have an inner shoulder to provide a pushing surface for the rounded end 875, 975 of the drilling mud screen puller/installer tool 800, 900. Id.

In an embodiment, the outlet of the first portion 575 and/or the inlet of the second portion 580 of the body 505 may have a means to engage 540 a drilling mud screen puller/installer tool 800, 900, as discussed below. See e.g., FIGS. 5A, 8A & 9A. The means to engage 540 may be any suitable means to accept, and provide a pulling surface for, the drilling mud screen puller/installer tool 800, 900. For example, a suitable means to engage 540 includes, but is not limited to, a "key" opening to rotationally engage an inner shoulder. In an embodiment, the outlet of the first portion 575 and/or the inlet of the second portion 590 of the body 505 may be shaped to accept a puller/installer plate 870, 970 of a drilling mud screen puller/installer tool 800, 900. See e.g., FIGS. 5B, 8B & 9B. See also FIGS. 12A, 13A & 29. In an embodiment, the inlet of the second portion 590 of the body 505 may have an inner shoulder to provide a pulling surface for the puller/installer plate 870, 970 of the drilling mud screen puller/installer tool 800, 900. Id.

In an embodiment, the second inner diameter 590 of the second end 515 of the body 505 of the drilling mud screen 500 may be from about 2-inches to about 3-inches, and any range or value there between. In an embodiment, the second inner diameter 590 of the second end 515 of the body 505 may be about 2.3-inches.

In an embodiment, the outer surface 595 of the first portion 575 of the body 505 of the drilling mud screen 500 may be adapted to engage one or more shoulders in an inner surface of the body 505. In an embodiment, a first shoulder and a second shoulder of the body 505 may be offset from a first end 510 of the body 505. Cf. FIGS. 4A & 5A. The first and second shoulders may be offset from the first end 510 of the body 505 at any suitable distance. In an embodiment, the first shoulder may be offset from the first end 510 of the body 505 from about 4-inches to about 8-inches; and the second shoulder may be offset from the first end 510 of the body 505 from about 5-inches to about 9-inches, and any range or value there between. In an embodiment, the first shoulder may be offset from the first end 510 of the body 505 about 4.8-inches; and the second shoulder may be offset from the first end 510 of the body 505 about 6.8-inches.

In an embodiment, the outer surface 595 of the body 505 of the drilling mud screen 500 may be sealed against an inner surface of the body 505 via an O-ring. Cf. FIGS. 4A & 5A. Any suitable O-ring may be used. For example, suitable O-rings include, but are not limited to, 300 Series O-rings. O-rings are well known in the art.

Figure 5C:
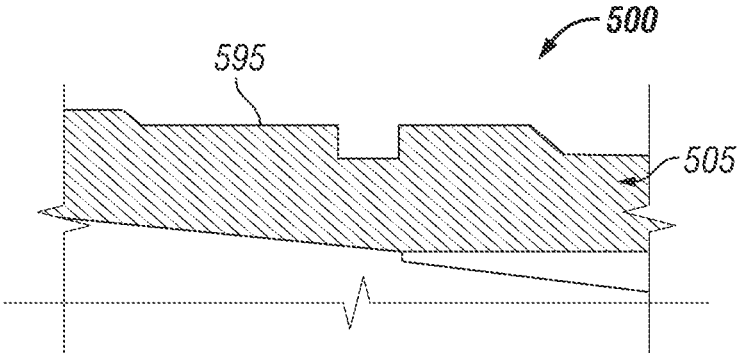
FIG. 5C illustrates a detailed view of B of FIG. 5A, showing a detailed view of a groove for an O-ring.
Figure 5D:
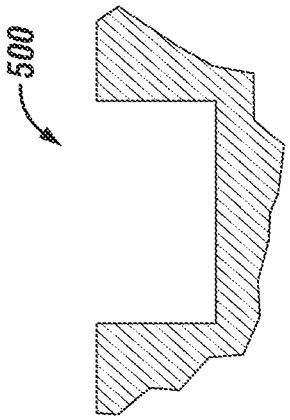
FIG. 5D illustrates a detailed view of C of FIG. 5A, showing an enlarged detailed view of the groove for an O-ring.

FIG. 5C illustrates a detailed view of B of FIG. 5A; and FIG. 5D illustrates a detailed view of C of FIG. 5A, both showing detailed views of a groove for an O-ring. In an embodiment, a groove for an O-ring may be offset from a first end 510 of the body 505 of the drilling mud screen 500. The groove for the O-ring may be offset from the first end 510 of the body 505 at any suitable distance. In an embodiment, the groove for the O-ring may be offset from the first end 510 of the body 505 from about 4-inches to about 8-inches, and any range or value there between. In an embodiment, the groove for the O-ring may be offset from the first end 510 of the body 505 about 5.7-inches.

In an embodiment, the filter 530 may have a plurality of rods spaced a distance apart to form a filter, or, alternatively, a formed sheet having drilled holes spaced a distance apart to form a filter. In an embodiment, the plurality of rods may be tapered from a larger outer diameter to a smaller outer diameter to encourage drilling mud flow to exit in straight lines through the drilling mud outlet 525 (i.e., through flow passages between the plurality rods) to reduce washing (i.e., erosion) of the screen 500. In an embodiment, the filter 530 may have a plurality of straight rows of holes drilled in a formed sheet to encourage drilling mud flow to exit in straight rows of strings through the drilling mud outlet 525 (i.e., through straight flow passages of the drilled holes) to reduce washing (i.e., erosion) of the screen 500.

In an embodiment, a first end of a filter 530 may be connected to a second end 515 of the body 505 via a connection; and a second end of a filter 530 may be connected to a first end of the end cap 535 via a connection. Any suitable connection may be used for the drilling mud inlet 530. For example, suitable connections include, but are not limited to, welds. Connections are well known in the art. In an embodiment, the first end of the filter 530 may be connected to the second end 515 of the body 505 via a weld; and the second end of the filter 530 may be connected to the first end of the end cap 535 via a weld.

In an embodiment, the first end of the filter 530 may fit into a first recess in the second end 515 of the body 505; and the second end of the filter may fit into a second recess in the first end of the end cap 535. In an embodiment, the first recess and the second recess may be a plurality of recessed holes or a recessed groove. In an embodiment, the first recess and the second recess may be a plurality of recessed holes.

In an embodiment, the filter 530 may be held together with a retaining ring. In an embodiment, the retaining ring may have a plurality of holes to hold the plurality of rods to form the filter 530. In an embodiment, the plurality of rods may be connected to the plurality of holes in the retainer ring via a connection. Any suitable connection may be used for the drilling mud inlet 530. For example, suitable connections include, but are not limited to, welds. Connections are well known in the art. In an embodiment, the plurality of rods may be connected to the plurality of holes in the retainer ring via a weld.

In an embodiment, the filter 530, including any retaining rings, of the drilling mud screen 500 may be constructed of any suitable material. For example, suitable materials include, but are not limited to, any alloy steel. In an embodiment, the filter 530 may be constructed of 304 stainless steel material. See e.g., FIGS. 5A & 5E. In an embodiment, the filter 530 may have a hardened coating to reduce washing (i.e., erosion) of the screen 500.

In an embodiment, the end cap 535 of the drilling mud screen 500 has an inner surface 555. In an embodiment, the inner surface 555 of the end cap 535 of the drilling mud screen 500 may redirect the flow to reduce washing (i.e., erosion) of the screen 500. In an embodiment, the inner surface 555 of the end cap 535 of the drilling mud screen 500 forms an inverted cone relative to the second end 515 of the body 505 of the drilling mud screen 500 (i.e., an upstream pointing cone) to redirect the flow. In an embodiment, the tip of the inverted cone may have a rounded or squared shape.

In an embodiment, the body 505 of the drilling mud screen 500 has a centerline 545 and a length 550. In an embodiment, the centerline 545 extends through the center of the drilling mud screen inlet 520 to the end cap 535. In an embodiment, the centerline 545 of the body 505 of the drilling mud screen 500 and the inner surface 555 of the end cap 535 form an angle 560. In an embodiment, the angle 560 may be from about 30-degrees to about 60-degrees, and any range or value there between. In an embodiment, the angle 560 may be from about 35-degrees to about 45-degrees, and any range or value there between.

In an embodiment, the end cap 535 of the drilling mud screen 500 may be constructed of any suitable material. For example, suitable materials include, but are not limited to, any alloy steel. In an embodiment, the end cap 535 may be constructed of 304 stainless steel material. See e.g., FIGS. 5A & 5E. In an embodiment, the end cap 535 of the drilling mud screen 500 may have a hardened coating to reduce washing (i.e., erosion) of the screen 500. For example, suitable hardened coatings include, but are not limited to, any Carbide coating or equivalent. In an embodiment, the end cap 535 may have a Carbide coating with about 6% Cobalt binder or equivalent material.

Figure 5E:
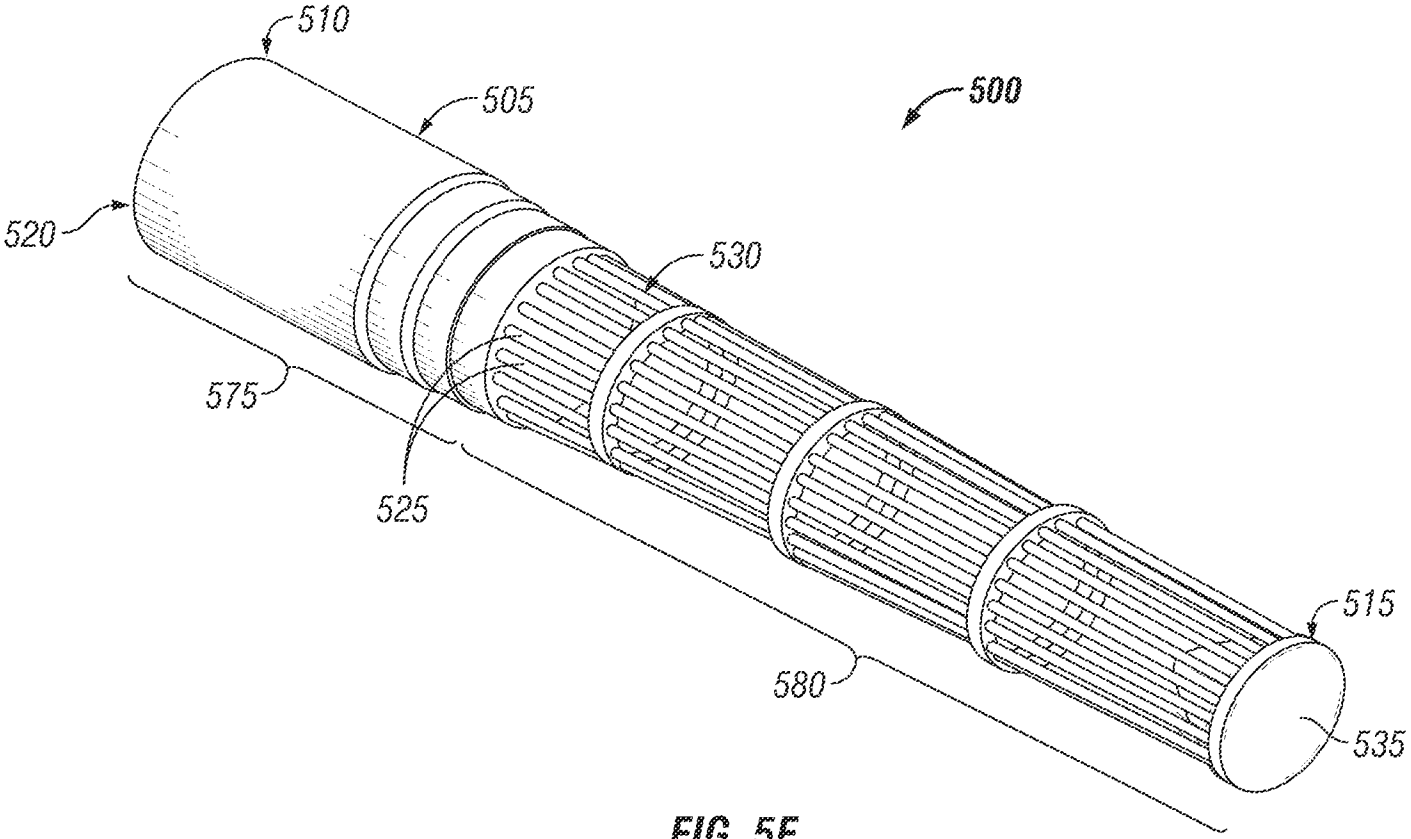
FIG. 5E illustrates an upper, right perspective view of the drilling mud screen of FIG. 5A.

FIG. 5E illustrates an upper, right side perspective view of the drilling mud screen of FIG. 5A. As shown in FIG. 5E, the drilling mud screen 500 has a body 505 having a first end 510 and a second end 515, a drilling mud inlet 520, a drilling mud outlet 525, a filter 530 and an end cap 535. In an embodiment, the body 505 of the drilling mud screen 500 has a first portion 575 and a second portion 580.

Optional Plug for Single-Piece Body

As discussed above, the single-piece body 405 for the exemplary drilling mud screen system of FIGS. 1-4 has a drilling mud flow passage from the drilling mud inlet 420 (through the drilling mud inlet 520 of the drilling mud screen 440, through the drilling mud outlet 525 of the drilling mud screen 440) and to the drilling mud outlet 425. See e.g., FIGS. 4A & 5.

The single-piece body 405, however, also has a drilling mud flow passage into a void between the drilling mud inlet 420 the mud screen access port 430. Id.

Figure 14:
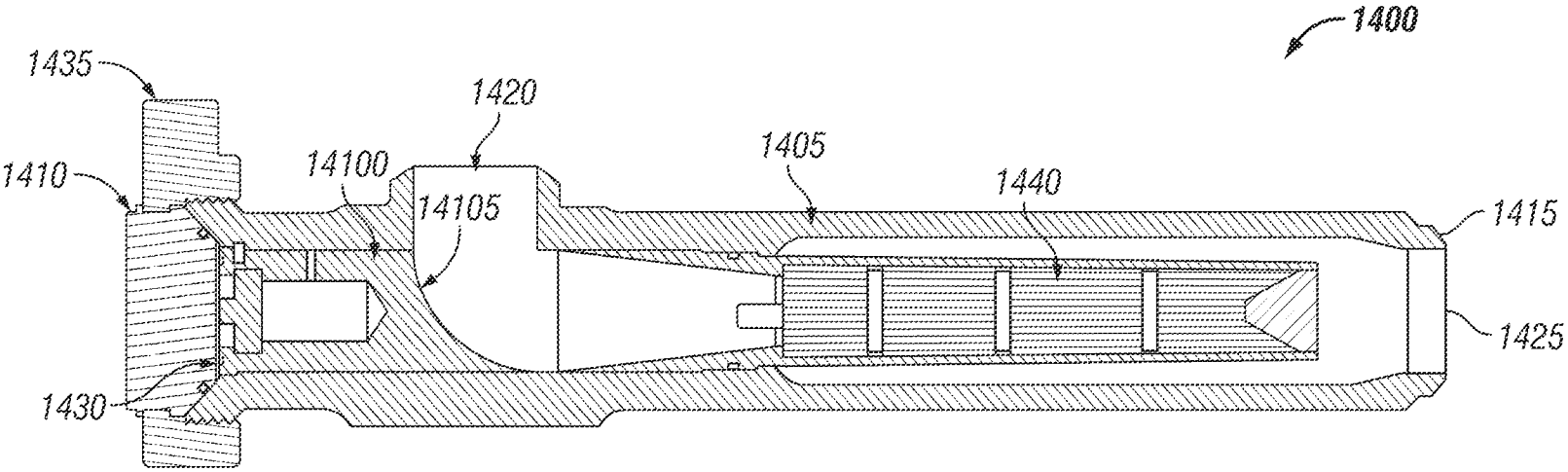
FIG. 14 illustrates a cross-sectional view of the exemplary drilling mud screen of FIG. 4, showing an optional plug installed in the drilling mud screen system.
Figures 1, 30A:
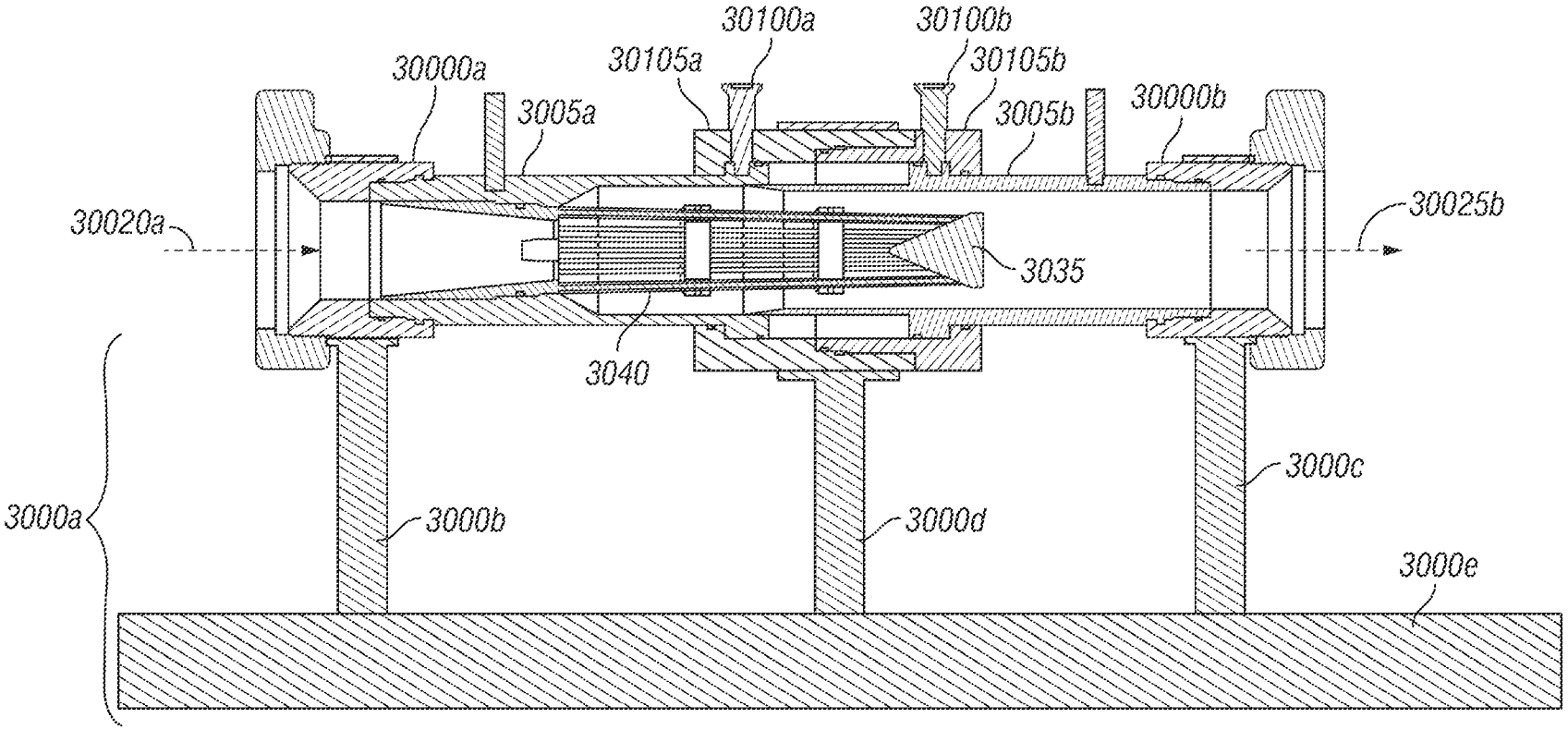
Figures 2, 30A:
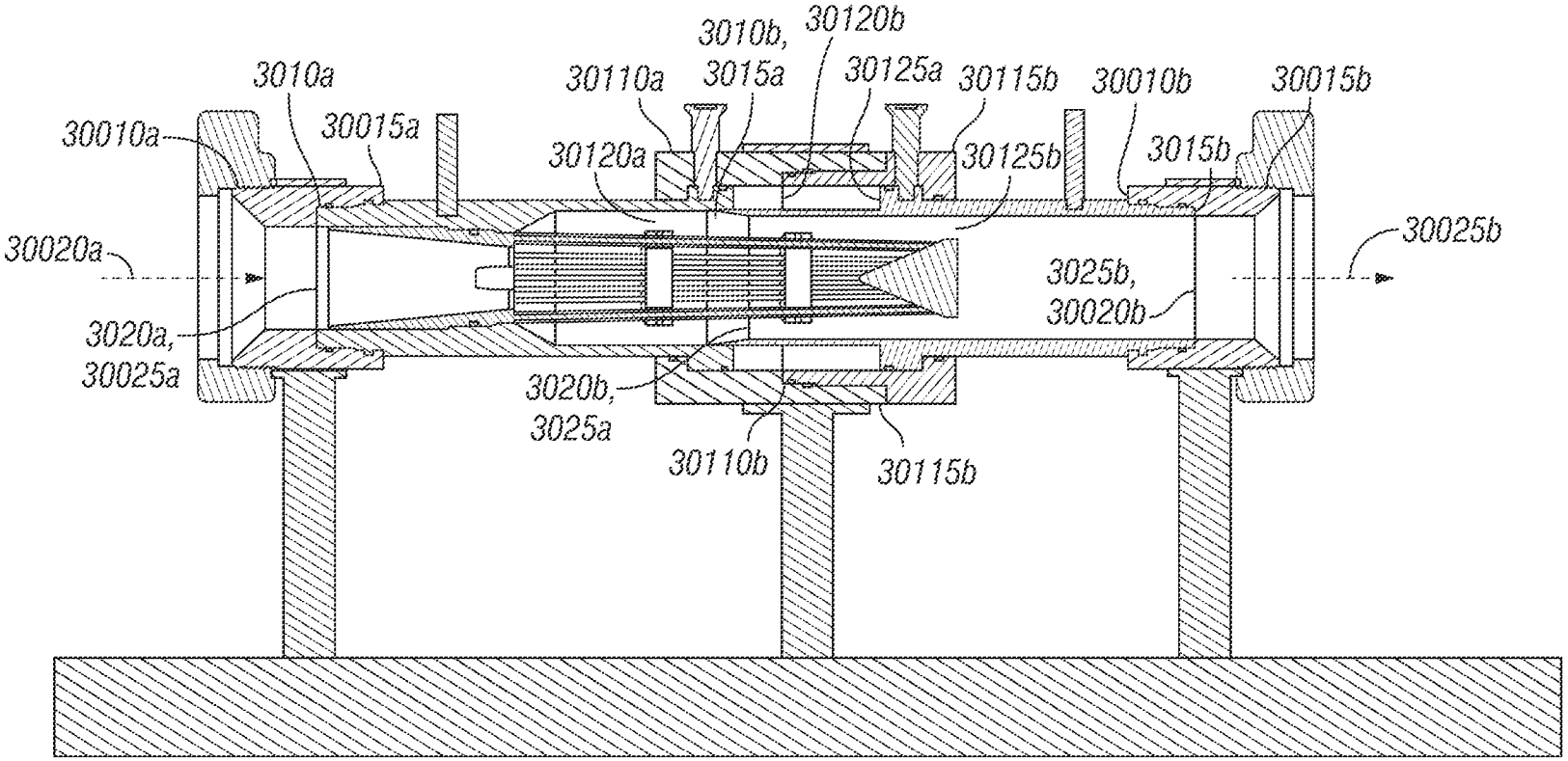
Figures 3, 30A:
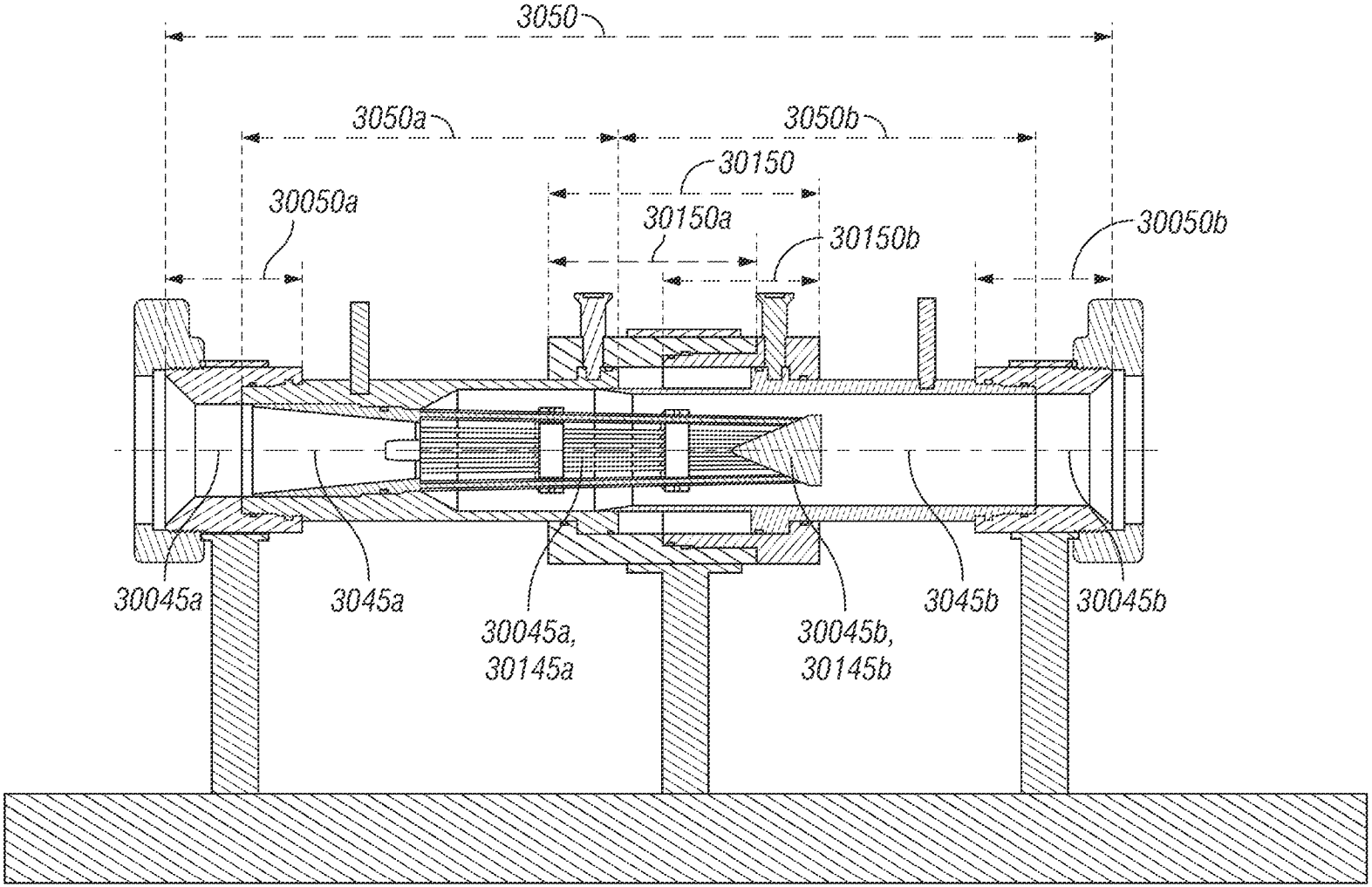
Figures 4, 30A:
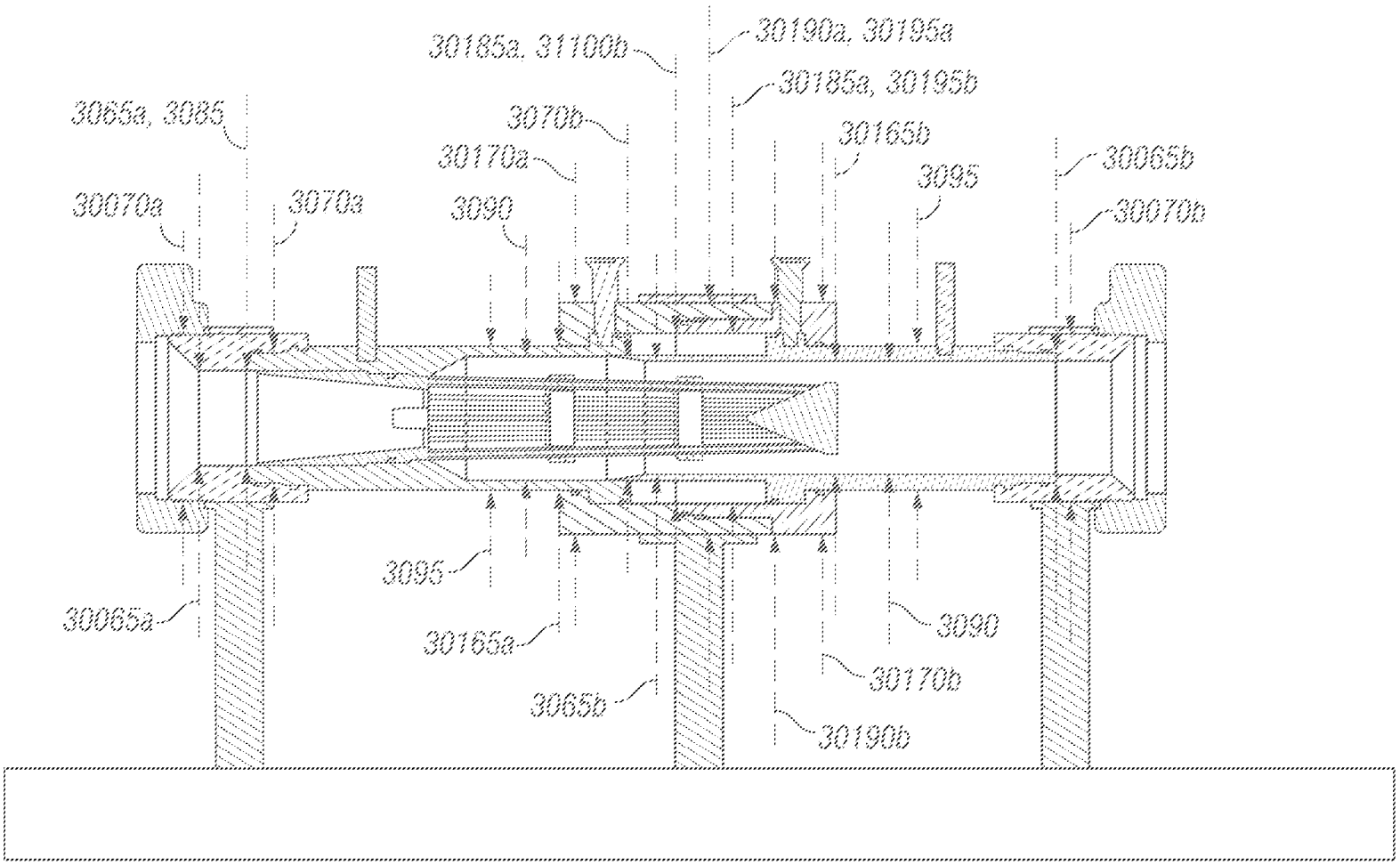

FIG. 14 illustrates a cross-sectional view of the exemplary drilling mud screen of FIG. 4, showing an optional plug installed in the drilling mud screen system. As shown in FIGS. 4 and 14, the drilling mud screen system 400, 1400 has a body 405, 1405 having a first end 410, 1410 and a second end 415, 1415, a drilling mud inlet 420, 1420 and a drilling mud outlet 425, 1425, a drilling mud screen access port 430, 1430, an end cap 435, 1435, a drilling mud screen 440, 1440 and a plug 14100. In an embodiment, the optional plug 14100 has a flow surface 14105.

In an embodiment, the optional plug 14100 fills the void between the drilling mud inlet 420, 1420 and the mud screen access port 430, 1430; and the flow surface 14105 of the optional plug 14000 directs the drilling mud from the drilling mud inlet 420, 1420 of the drilling mud screen system 400, 1400 to the drilling mud inlet 520 of the drilling mud screen 440, 1440, resulting in increased flow efficiency and decreased erosion.

In an embodiment, the plug 14100 may be constructed of any suitable material. For example, suitable materials include, but are not limited to, any alloy steel suitable for a drilling mud application. In an embodiment, the plug 14100 may be constructed of an American Iron and Steel Industry (AISI) 4130/75k yield or equivalent material.

In an embodiment, the plug 14100 may have any suitable outer diameter to fit within the body 405, 1405. In an embodiment, the outer diameter of the plug 14100 may be from about 3-inches to about 5-inches, and any range or value there between. In an embodiment, the outer diameter of the plug 14100 may be about 3.9-inches.

In an embodiment, the optional plug 14100 has a flow surface 14105 to direct the drilling mud from the drilling mud inlet 420, 1420 of the drilling mud screen system 400, 1400 to the drilling mud inlet 520 of the drilling mud screen 440, 1440. See e.g., FIGS. 4A & 5. In an embodiment, the flow surface 14105 may have any suitable shape to direct the drilling mud from the drilling mud inlet of the drilling mud screen system to the drilling mud inlet of the drilling mud screen. Suitable shapes include, but are not limited to, a backward "J" shape, a curved shape, an "L" shape and any combination or variation thereof, as discussed further below.

Figure 15A:
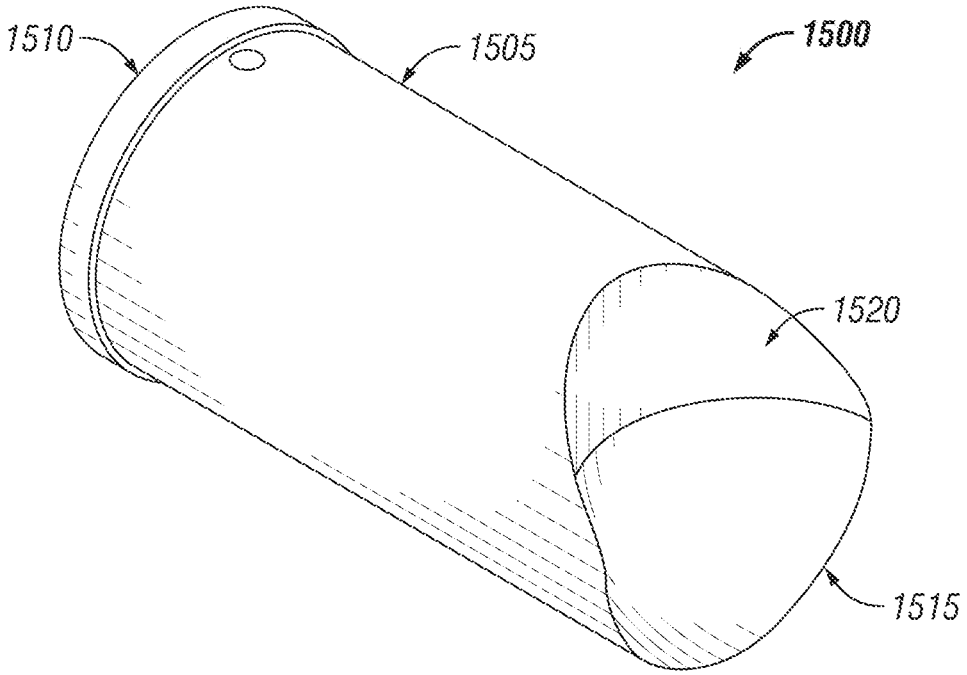
FIG. 15A illustrates an upper, right perspective view of an optional plug with a backward "J" shaped flow surface according to an embodiment of the present invention.
Figure 15B:
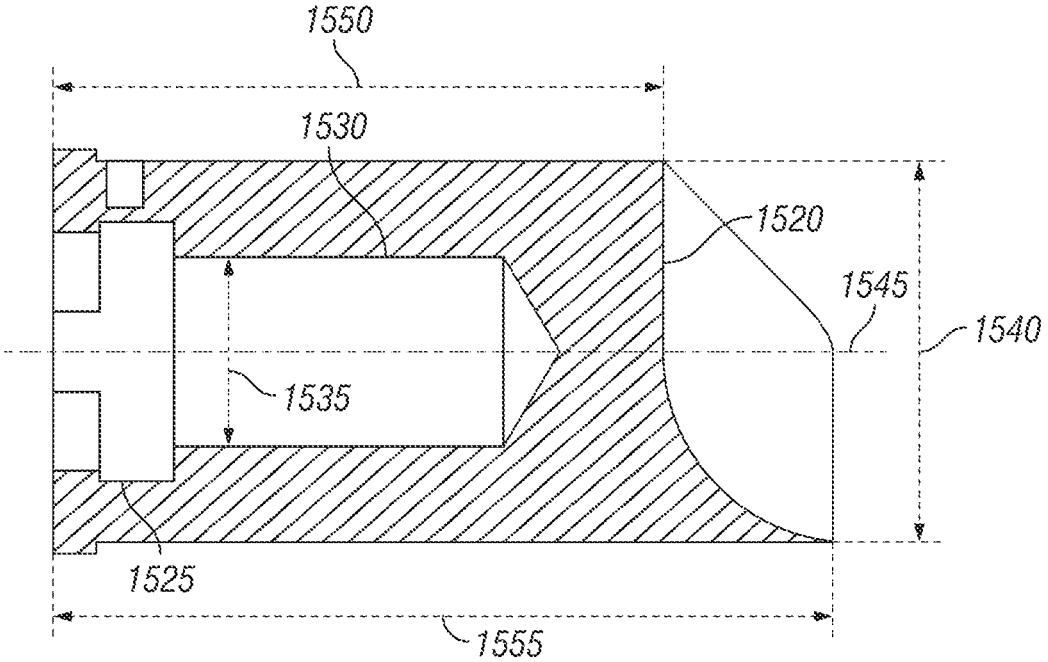
FIG. 15B illustrates a cross-sectional view of the optional plug with the backward "J" shaped flow surface of FIG. 15A.

FIG. 15A illustrates an upper, right perspective view of an optional plug with a backward "J" shaped flow surface according to an embodiment of the present invention; and FIG. 15B illustrates a cross-sectional view of the optional plug with the backward "J" shaped flow surface of FIG. 15A. As shown in FIGS. 15A and 15B, the optional plug 1500 has a body 1505 having a first end 1510 and a second end 1515, a flow surface 1520, an optional cavity 1530 and an optional port 1560.

In an embodiment, the first end 1510 of the body 1505 may have a means to engage 1525 a drilling mud screen puller/installer tool 800. See e.g., FIGS. 8A, 15A-15B & 18A-18B. The means to engage 1525 may be any suitable means to accept, and provide a pulling surface for, the drilling mud screen puller/installer tool 800. For example, a suitable means to engage 1525 includes, but is not limited to, a "key" opening to rotationally engage an inner shoulder.

In an embodiment, the first end 1510 of the plug 1500 may have an optional cavity 1530 extending towards, but not through, the flow surface 1520 of the plug 1500.

In an embodiment, the first end 1510 of the plug 1500 may have an optional port 1560 extending from an outer surface of the plug 1500 into the optional cavity 1530.

In an embodiment, the first end 1510 of the plug 1500 may have any suitable inner diameter 1535 of the optional cavity 1530. In an embodiment, the inner diameter 1535 of the optional cavity 1530 may be from about 1-inch to about 3-inches, and any range or value there between. In an embodiment, the inner diameter 1535 of the optional cavity 1530 may be about 2-inches.

In an embodiment, the plug 1500 may have any suitable outer diameter 1540. In an embodiment, the outer diameter 1540 of the plug 1500 may be from about 3-inches to about 5-inches, and any range or value there between. In an embodiment, the outer diameter 1540 of the plug 1500 may be about 3.9-inches.

In an embodiment, the body 1505 has a centerline 1545, a first length 1550 and a second length 1555. In an embodiment, the first length 1550 of the body 1505 may be any suitable length. In an embodiment, the first length 1550 of the body 1505 may be from about 6-inches to about 10-inches, and any range or value there between. In an embodiment, the length 1550 may be about 8-inches.

In an embodiment, the second length 1555 of the body 1505 may be any suitable length. In an embodiment, the second length 1555 may be from about 8-inches to about 14-inches, and any range or value there between. In an embodiment, the second length 1555 may be about 11.5-inches.

In an embodiment, the second end 1515 of the plug 1500 may have a flow surface 1520. In an embodiment, the flow surface 1520 may have any suitable shape to direct the drilling mud from the drilling mud inlet of the drilling mud screen system to the drilling mud inlet of the drilling mud screen. Suitable shapes include, but are not limited to, a backward "J" shape, a curved shape, an "L" shape and any combination or variation thereof, as discussed further below. In an embodiment, the flow surface 1520 may have a backward "J" shape. See e.g., FIG. 15B.

Figure 16A:
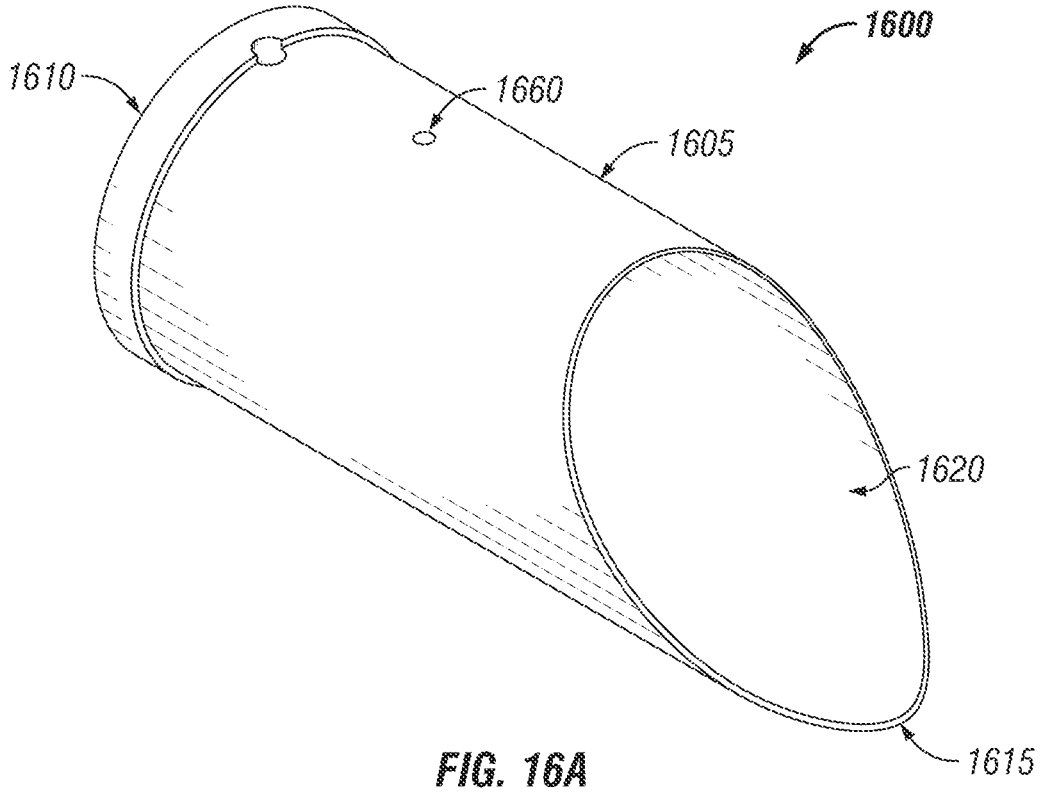
FIG. 16A illustrates an upper, right perspective view of an optional plug with a curved shaped flow surface according to an embodiment of the present invention.
Figure 16B:
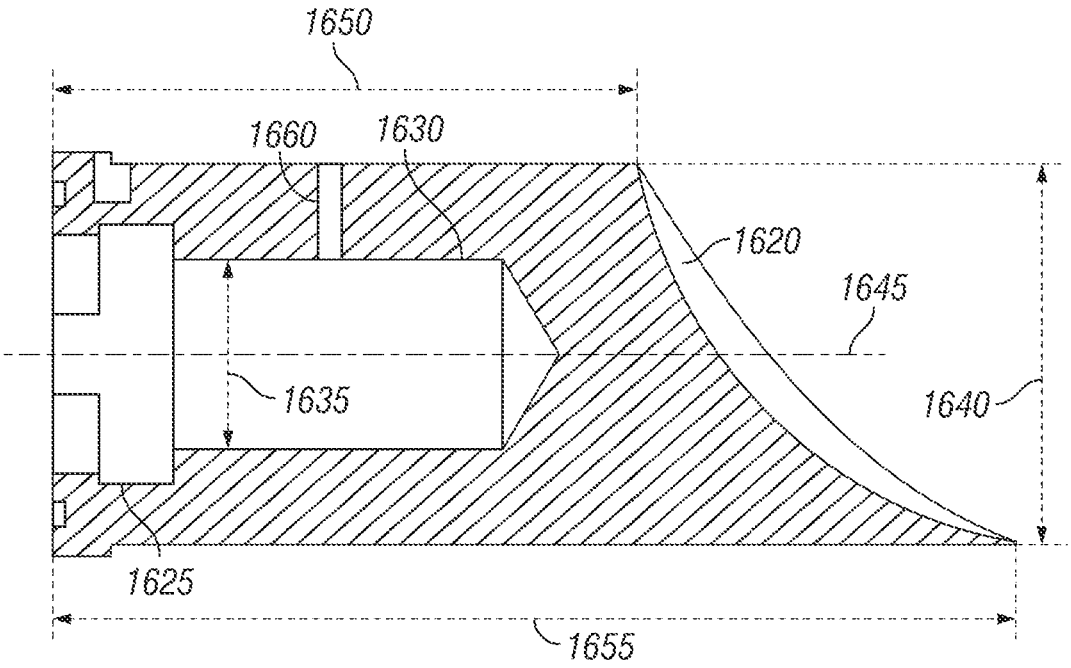
FIG. 16B illustrates a cross-sectional view of the optional plug with the curved shaped flow surface of FIG. 16A.

FIG. 16A illustrates an upper, right perspective view of an optional plug with a curved flow surface according to an embodiment of the present invention; and FIG. 16B illustrates a cross-sectional view of the optional plug with the curved flow surface of FIG. 16A. As shown in in FIGS. 16A and 16B, the optional plug 1600 has a body 1605 having a first end 1610 and a second end 1615, a flow surface 1620, an optional cavity 1630 and an optional port 1660.

In an embodiment, the first end 1610 of the body 1605 may have a means to engage 1625 a drilling mud screen puller/installer tool 800. See e.g., FIGS. 8A, 16A-16B, 18A-18B & 29. The means to engage 1625 may be any suitable means to accept, and provide a pulling surface for, the drilling mud screen puller/installer tool 800. For example, a suitable means to engage 1625 includes, but is not limited to, a "key" opening to rotationally engage an inner shoulder.

In an embodiment, the first end 1610 of the plug 1600 may have an optional cavity 1630 extending towards, but not through, the flow surface 1620 of the plug 1600.

In an embodiment, the first end 1610 of the plug 1600 may have an optional port 1660 extending from an outer surface of the plug 1600 into the optional cavity 1630.

In an embodiment, the first end 1610 of the plug 1600 may have any suitable inner diameter 1635 of the optional cavity 1630. In an embodiment, the inner diameter 1635 of the optional cavity 1630 may be from about 1-inch to about 3-inches, and any range or value there between. In an embodiment, the inner diameter 1635 of the optional cavity 1630 may be about 2-inches.

In an embodiment, the plug 1600 may have any suitable outer diameter 1640. In an embodiment, the outer diameter 1640 of the plug 1600 may be from about 3-inches to about 5-inches, and any range or value there between. In an embodiment, the outer diameter 1640 of the plug 1600 may be about 3.9-inches.

In an embodiment, the body 1605 has a centerline 1645, a first length 1650 and a second length 1655. In an embodiment, the first length 1650 of the body 1605 may be any suitable length. In an embodiment, the first length 1650 of the body 1605 may be from about 6-inches to about 10-inches, and any range or value there between. In an embodiment, the length 1650 may be about 8-inches.

In an embodiment, the second length 1655 of the body 1605 may be any suitable length. In an embodiment, the second length 1655 may be from about 8-inches to about 15-inches, and any range or value there between. In an embodiment, the second length 1655 may be about 12-inches.

In an embodiment, the second end 1615 of the plug 1600 may have a flow surface 1620. In an embodiment, the flow surface 1620 may have any suitable shape to direct the drilling mud from the drilling mud inlet of the drilling mud screen system to the drilling mud inlet of the drilling mud screen. Suitable shapes include, but are not limited to, a backward "J" shape, a curved shape, an "L" shape and any combination or variation thereof, as discussed further below. In an embodiment, the flow surface 1620 may have a curved shape. See e.g., FIG. 16B.

Figure 17A:
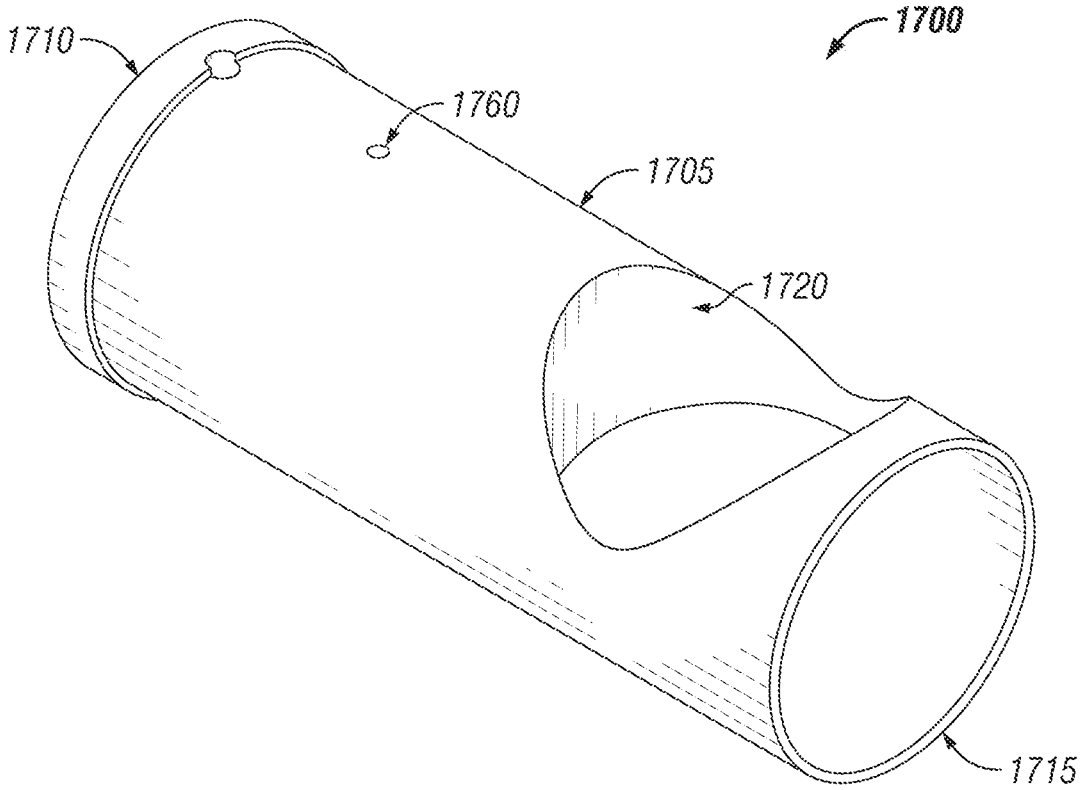
FIG. 17A illustrates an upper, right side perspective view of an optional plug with an "L" shaped flow surface according to an embodiment of the present invention.
Figure 17B:
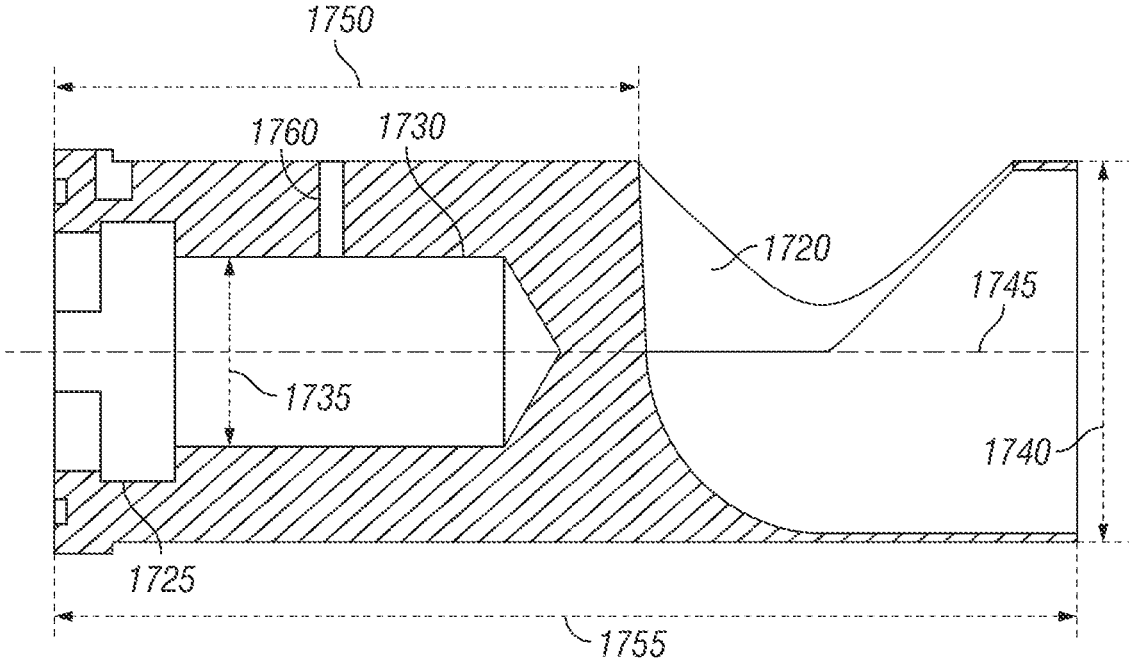
FIG. 17B illustrates a cross-sectional view of an optional plug with an "L" shaped flow surface of FIG. 17A.

FIG. 17A illustrates an upper, right perspective view of an optional plug with an "L" flow surface according to an embodiment of the present invention; and FIG. 17B illustrates a cross-sectional view of an optional plug with an "L" flow surface of FIG. 17A. As shown in FIGS. 17A and 17B, the optional plug 1700 has a body 1705 having a first end 1710 and a second end 1715, a flow surface 1720, an optional cavity 1730 and an optional port 1760.

In an embodiment, the first end 1710 of the body 1705 may have a means to engage 1725 a drilling mud screen puller/installer tool 800. See e.g., FIGS. 8A, 17A-17B, 18A-18B & 29. The means to engage 1725 may be any suitable means to accept, and provide a pulling surface for, the drilling mud screen puller/installer tool 800. For example, a suitable means to engage 1725 includes, but is not limited to, a "key" opening to rotationally engage an inner shoulder.

In an embodiment, the first end 1710 of the plug 1700 may have an optional cavity 1730 extending towards, but not through, the flow surface 1720 of the plug 1700.

In an embodiment, the first end 1710 of the plug 1700 may have an optional port 1760 extending from an outer surface of the plug 1700 into the optional cavity 1730.

In an embodiment, the first end 1710 of the plug 1700 may have any suitable inner diameter 1735 of the optional cavity 1730. In an embodiment, the inner diameter 1735 of the optional cavity 1730 may be from about 1-inch to about 3-inches, and any range or value there between. In an embodiment, the inner diameter 1735 of the optional cavity 1730 may be about 2-inches.

In an embodiment, the plug 1700 may have any suitable outer diameter 1740. In an embodiment, the outer diameter 1740 of the plug 1700 may be from about 3-inches to about 5-inches, and any range or value there between. In an embodiment, the outer diameter 1740 of the plug 1700 may be about 3.9-inches.

In an embodiment, the body 1705 has a centerline 1745, a first length 1750 and a second length 1755. In an embodiment, the first length 1750 of the body 1705 may be any suitable length. In an embodiment, the first length 1750 of the body 1705 may be from about 6-inches to about 10-inches, and any range or value there between. In an embodiment, the length 1750 may be about 8-inches.

In an embodiment, the second length 1755 of the body 1705 may be any suitable length. In an embodiment, the second length 1755 may be from about 8-inches to about 15-inches, and any range or value there between. In an embodiment, the second length 1755 may be about 12-inches.

In an embodiment, the second end 1715 of the plug 1700 may have a flow surface 1720. In an embodiment, the flow surface 1720 may have any suitable shape to direct the drilling mud from the drilling mud inlet of the drilling mud screen system to the drilling mud inlet of the drilling mud screen. Suitable shapes include, but are not limited to, a backward "J" shape, a curved shape, an "L" shape and any combination or variation thereof, as discussed further below. In an embodiment, the flow surface 1720 may have an "L" shape. See e.g., FIG. 17B.

Two-Piece Body

Figure 6A:
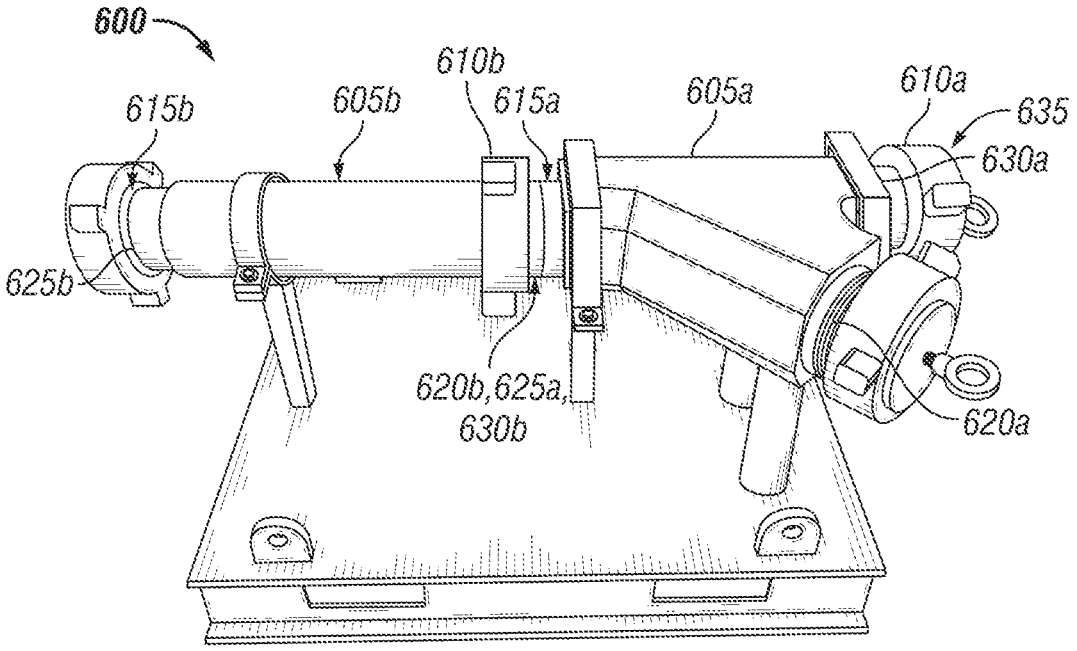
FIG. 6A illustrates an image of a mud screen system according to an embodiment of the present invention, showing a two-piece body for the system.

FIG. 6A illustrates an image of a drilling mud screen system according to an embodiment of the present invention, showing a two-piece body for the system.

As shown in FIG. 6A, the drilling mud screen system 600 has a first body 605*a* having a first end 610*a* and a second end 615*a*, a first drilling mud inlet 620*a*, a first drilling mud outlet 625*a*, a first drilling mud screen access port 630*a*, and an end cap 635. The drilling mud screen system 600 has a second body 605*b* having a first end 610*b* and a second end 615*b*, a second drilling mud inlet 620*b* and a second drilling mud outlet 625*b*, and a second drilling mud screen access port 630*b*.

In an embodiment, the first drilling mud inlet 620*a* may be fluidly connected to, for example, an outlet of a drilling mud pump via a connection; and the second drilling mud outlet 625*b* may be fluidly connected to an inlet of a vibrator hose via a connection. Any suitable connection may be used for the first drilling mud inlet 620*a* and second drilling mud outlet 625*b*. For example, suitable connections include, but are not limited to, pipe fittings and welds. Connections are well known in the art. In an embodiment, the first drilling mud inlet 620*a* may be fluidly connected to, for example, an outlet of a drilling mud pump via a weld; and the second drilling mud outlet 625*b* may be fluidly connected to an inlet of a vibrator hose via a weld.

As shown in FIG. 6A, the drilling mud screen access port 630 of the drilling mud screen system 600 may be closed with an end cap 635 via a connection. Any suitable connection may be used. For example, suitable connections include, but are not limited to, pipe fittings. Connections are well known in the art.

In an embodiment, the drilling mud screen access port 630 of the drilling mud screen system 600 may be sealed with an end cap 635 via an O-ring. Any suitable O-ring may be used. For example, suitable O-rings include, but are not limited to, 300 Series O-rings. O-rings are well known in the art.

In an embodiment, the end cap 635 of the drilling mud screen system 600 may comprise a cap, an O-ring and a pipe collar. In an embodiment, the end cap may be a five-inch 1002 WECO cap with an O-ring.

Figure 6B:
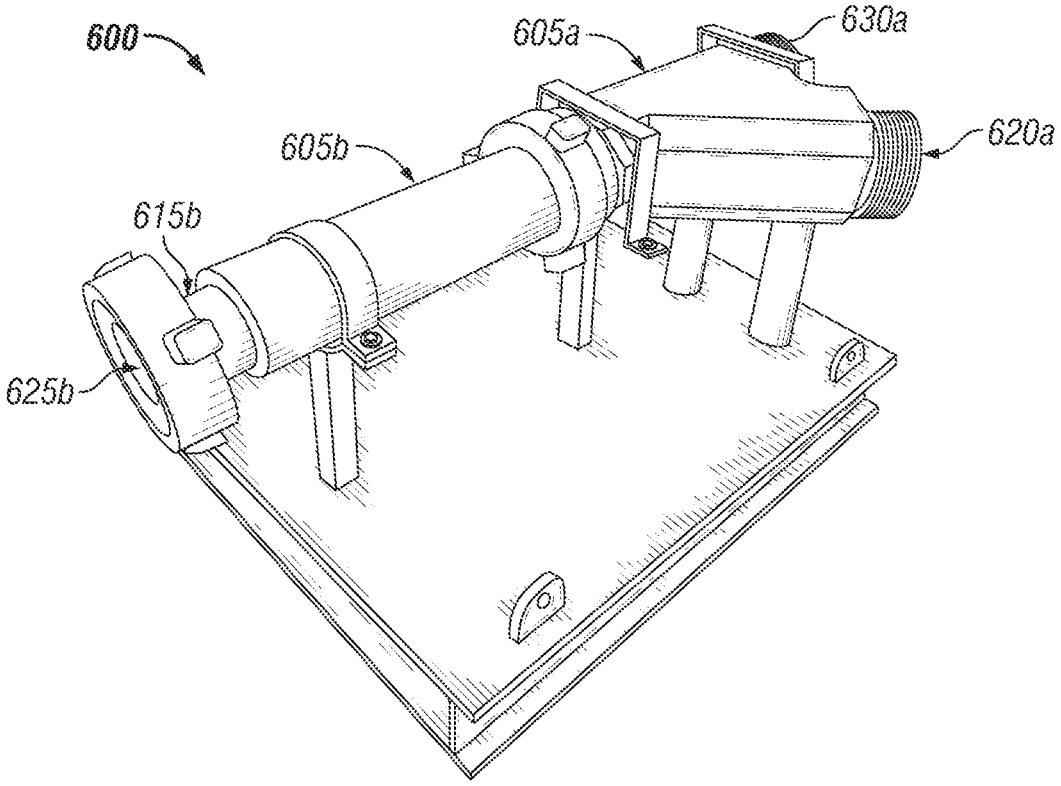
FIG. 6B illustrates an image of the exemplary drilling mud screen system of FIG. 6A, showing a drilling mud outlet.

FIG. 6B illustrates an image of the exemplary drilling mud screen system of FIG. 6A, showing a second drilling mud outlet 625*b*.

Figure 6C:
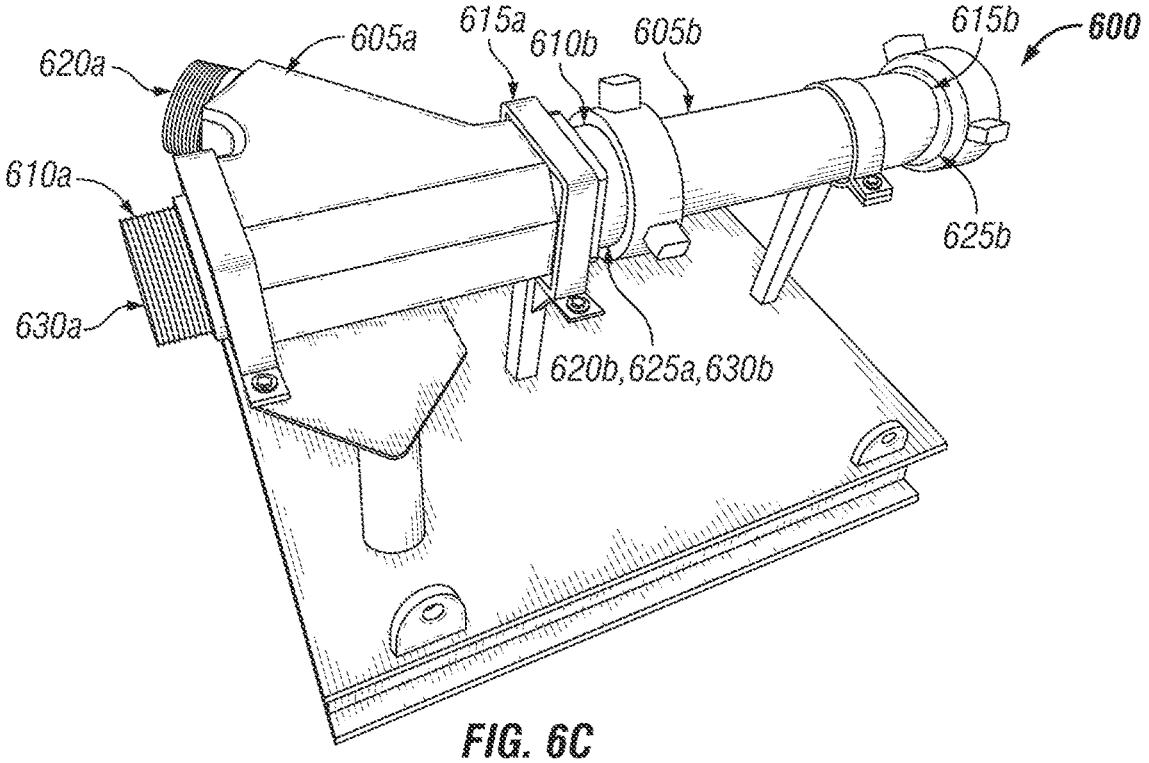
FIG. 6C illustrates an image of the exemplary drilling mud screen system of FIGS. 6A-6B.

FIG. 6C illustrates an image of the exemplary drilling mud screen system of FIGS. 6A-6B.

Figure 6D:
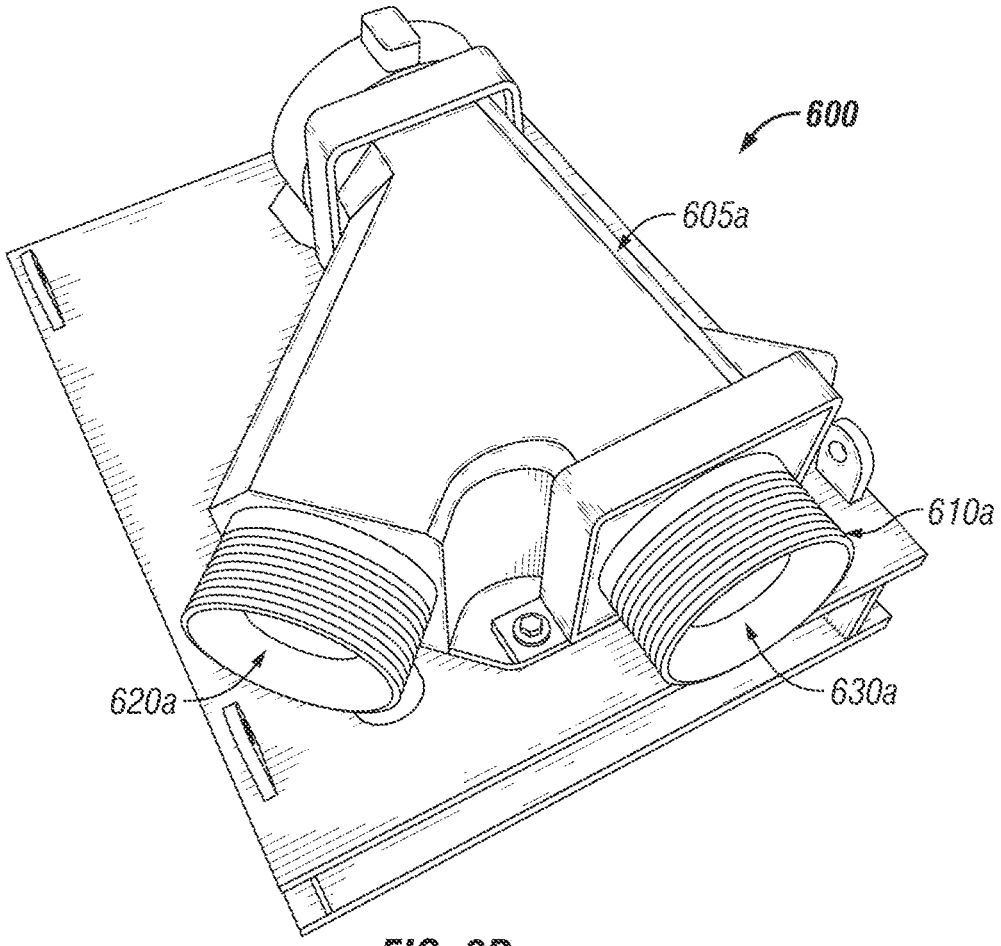
FIG. 6D illustrates an image of the exemplary drilling mud screen system of FIGS. 6A-6C, showing a drilling mud inlet and a drilling mud screen access port.

FIG. 6D illustrates an image of the exemplary drilling mud screen system of FIGS. 6A-6C, showing a detailed view of a first body 605*a* of the drilling mud screen system 600. In an embodiment, the first body 605*a* may be a five-inch 1002 WECO Y-housing.

Standard Single Inlet and Optional Reduced Angle Inlet Version

Figure 7A:
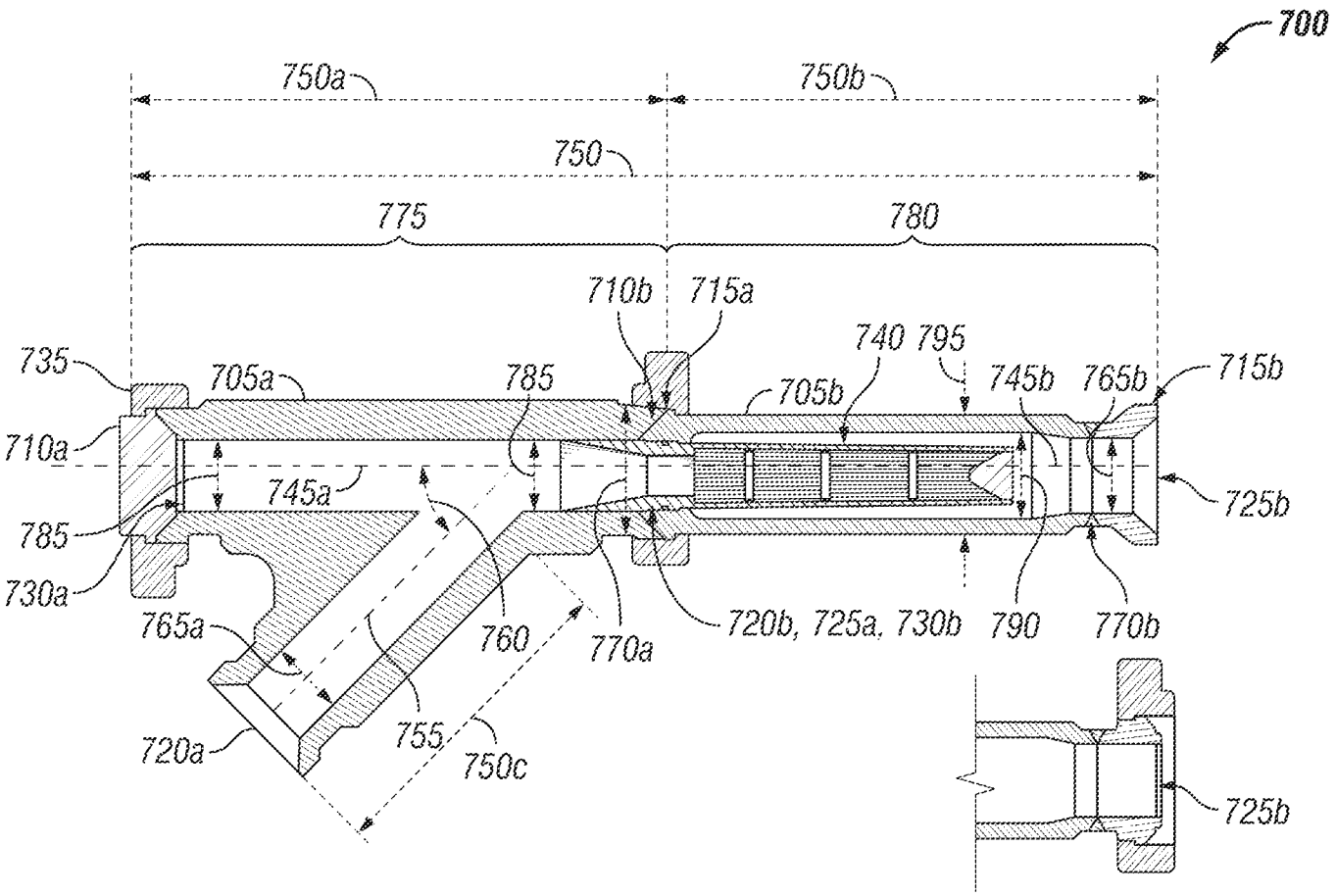
FIG. 7A illustrates an upper, cross-sectional view of a drilling mud screen system according to an embodiment of the present invention, showing a single-inlet drilling mud system.

FIG. 7A illustrates an upper, cross-sectional view of a drilling mud screen system 700 according to an embodiment of the present invention, showing a standard single-inlet drilling mud system.

Figure 19:
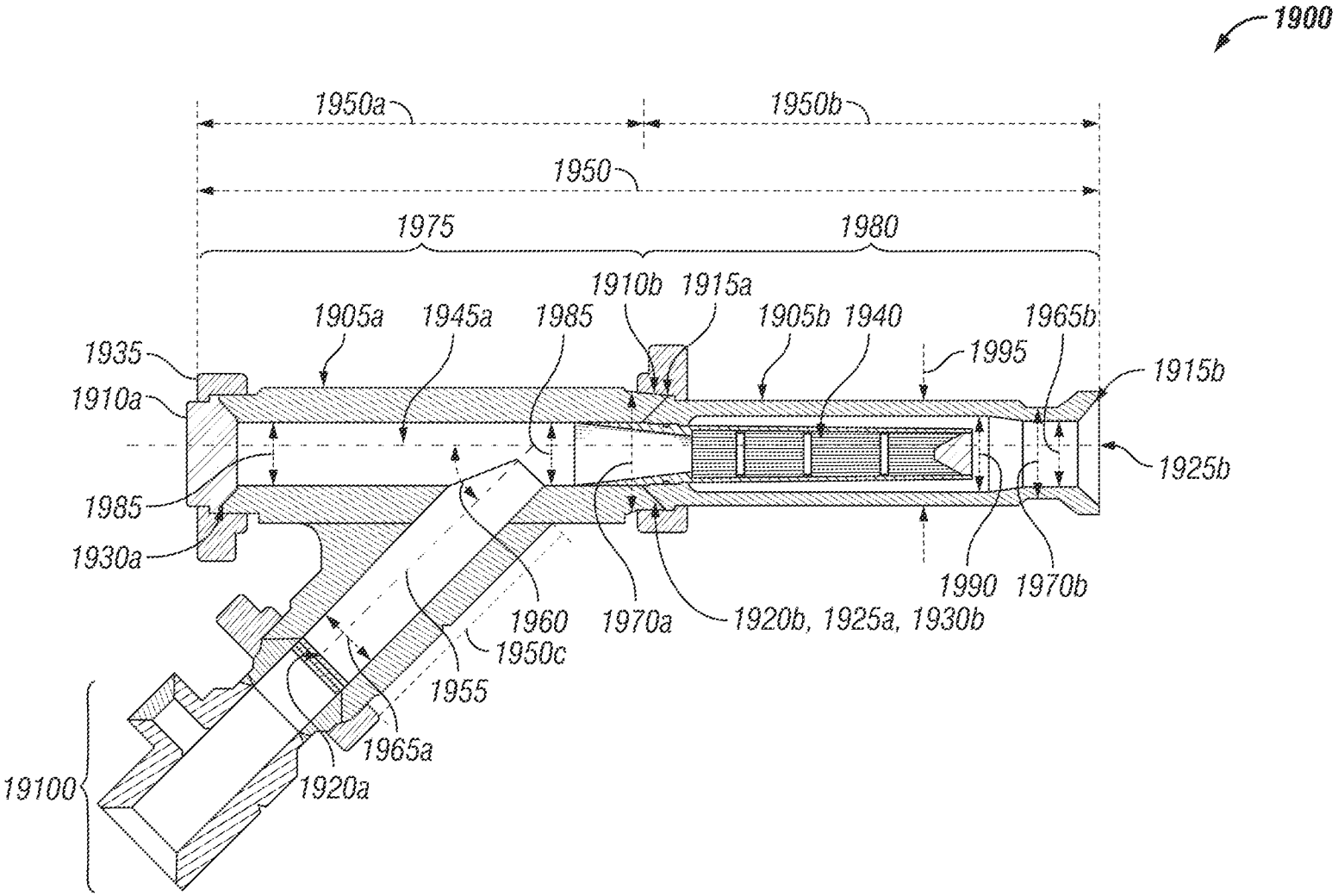
FIG. 19 illustrates a cross-sectional view of the drilling mud screen system in a monitoring configuration according to an embodiment of the present invention, showing an optional transducer subassembly.

FIG. 19 illustrates a cross-sectional view of the drilling mud screen system in a monitoring configuration 1900 according to an embodiment of the present invention, showing an optional transducer subassembly 19100.

Figure 21A:
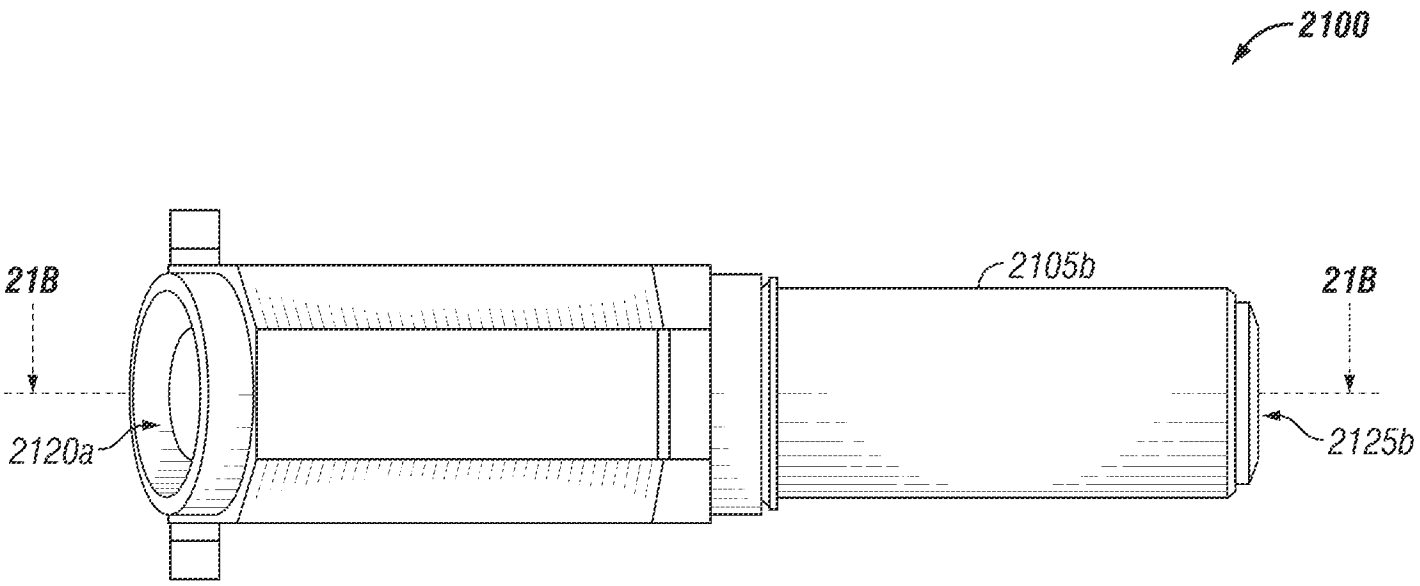
FIG. 21A illustrates an upper view of a mud screen system according to an embodiment of the present invention, showing an optional two-piece body for the system.
Figure 21B:
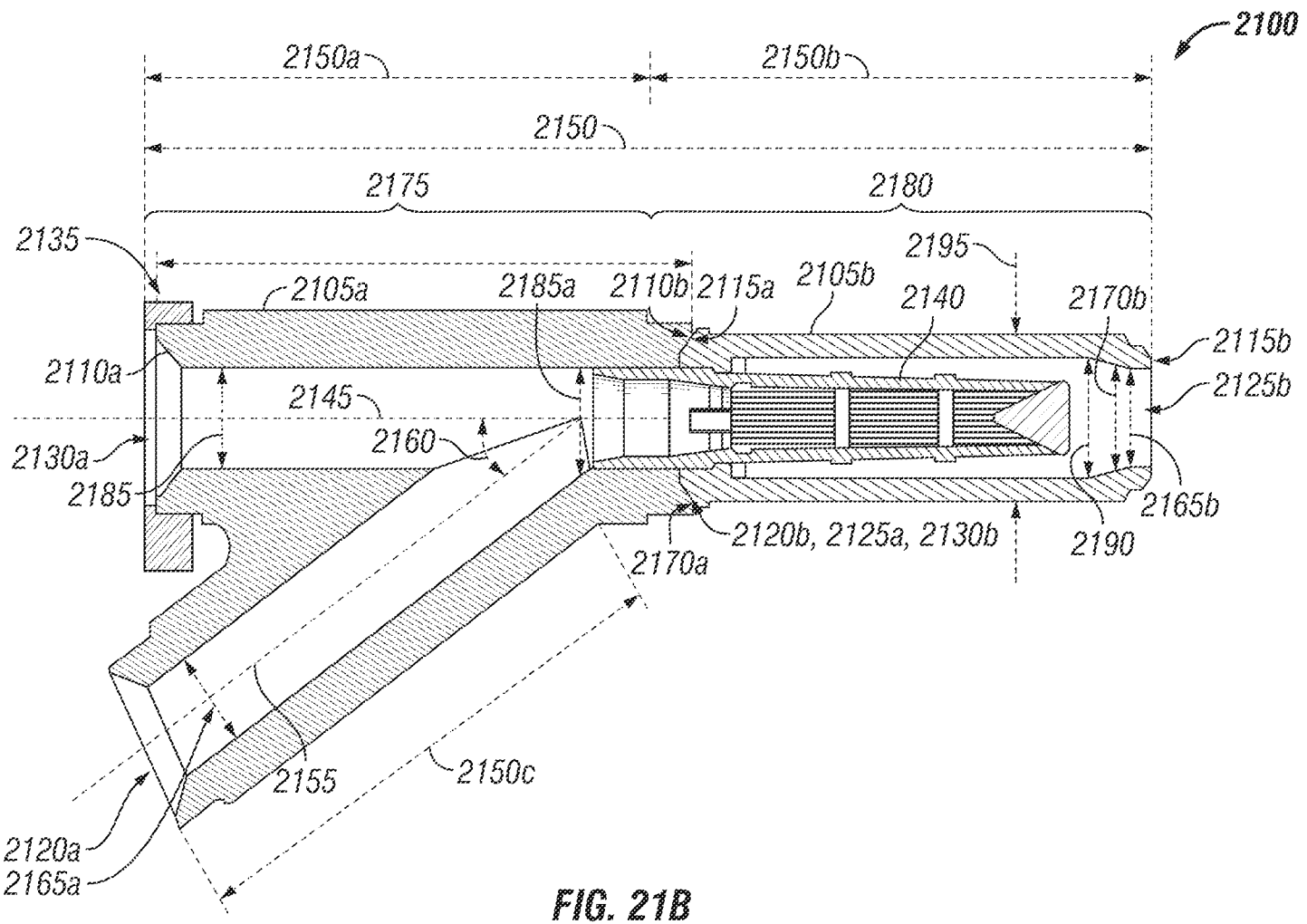
FIG. 21B illustrates a detailed, cross-sectional view of A-A of FIG. 21A, showing an entry angle of about 30 degrees.

FIG. 21A illustrates an upper view of a mud screen system 2100 according to an embodiment of the present invention, showing an optional two-piece body for the system; and FIG. 21B illustrates a detailed, cross-sectional view of A-A of FIG. 21A, showing an entry angle of about 30 degrees.

Figure 23:
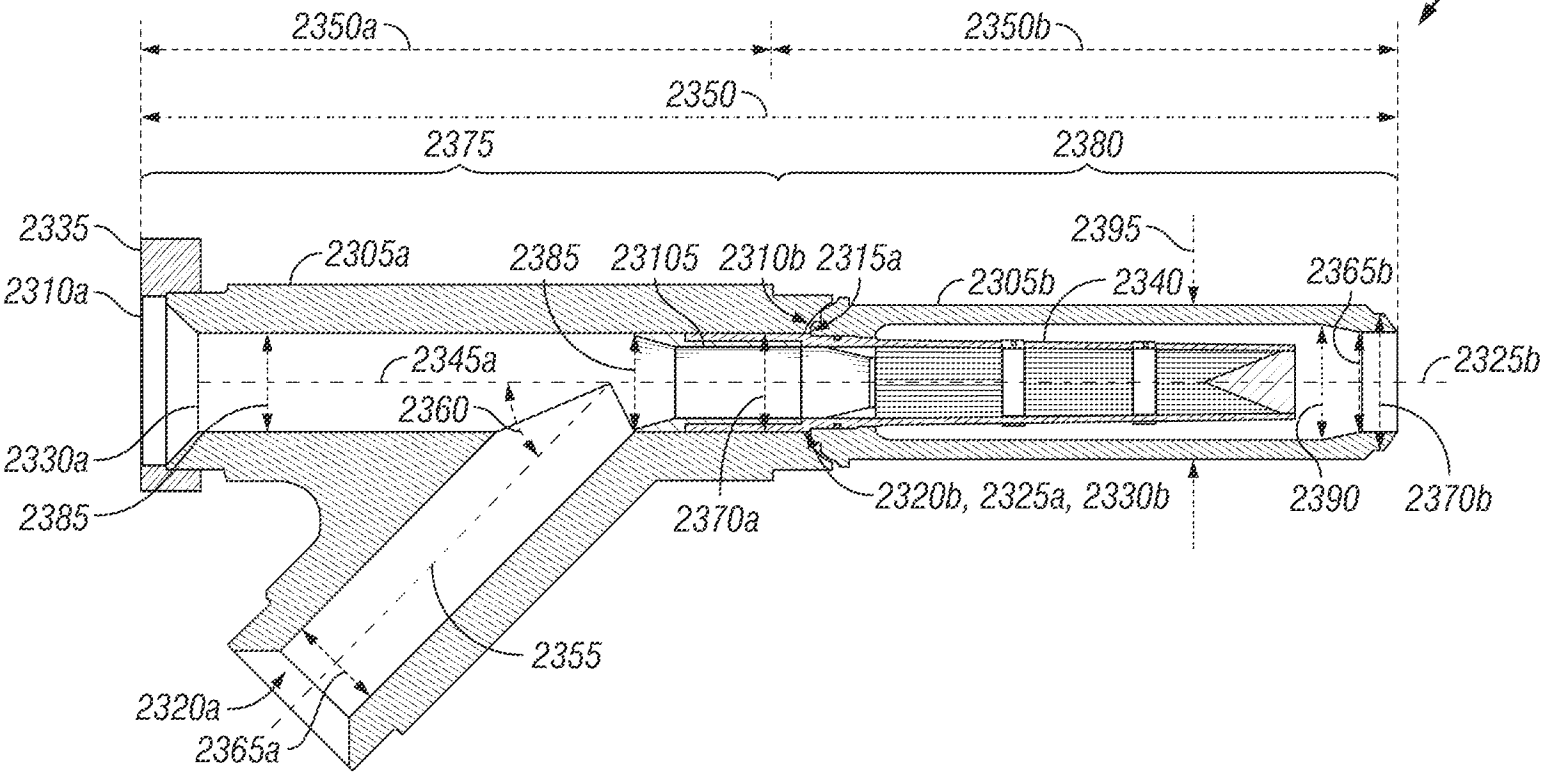
FIG. 23 illustrates a cross-sectional view of a mud screen system according to an embodiment of the present invention, showing an optional drilling mud screen insert inserted into a drilling mud screen.

FIG. 23 illustrates a cross-sectional view of a mud screen system 2300 according to an embodiment of the present invention, showing an optional drilling mud screen insert 23105 inserted into a drilling mud screen 2340.

Figure 41A:
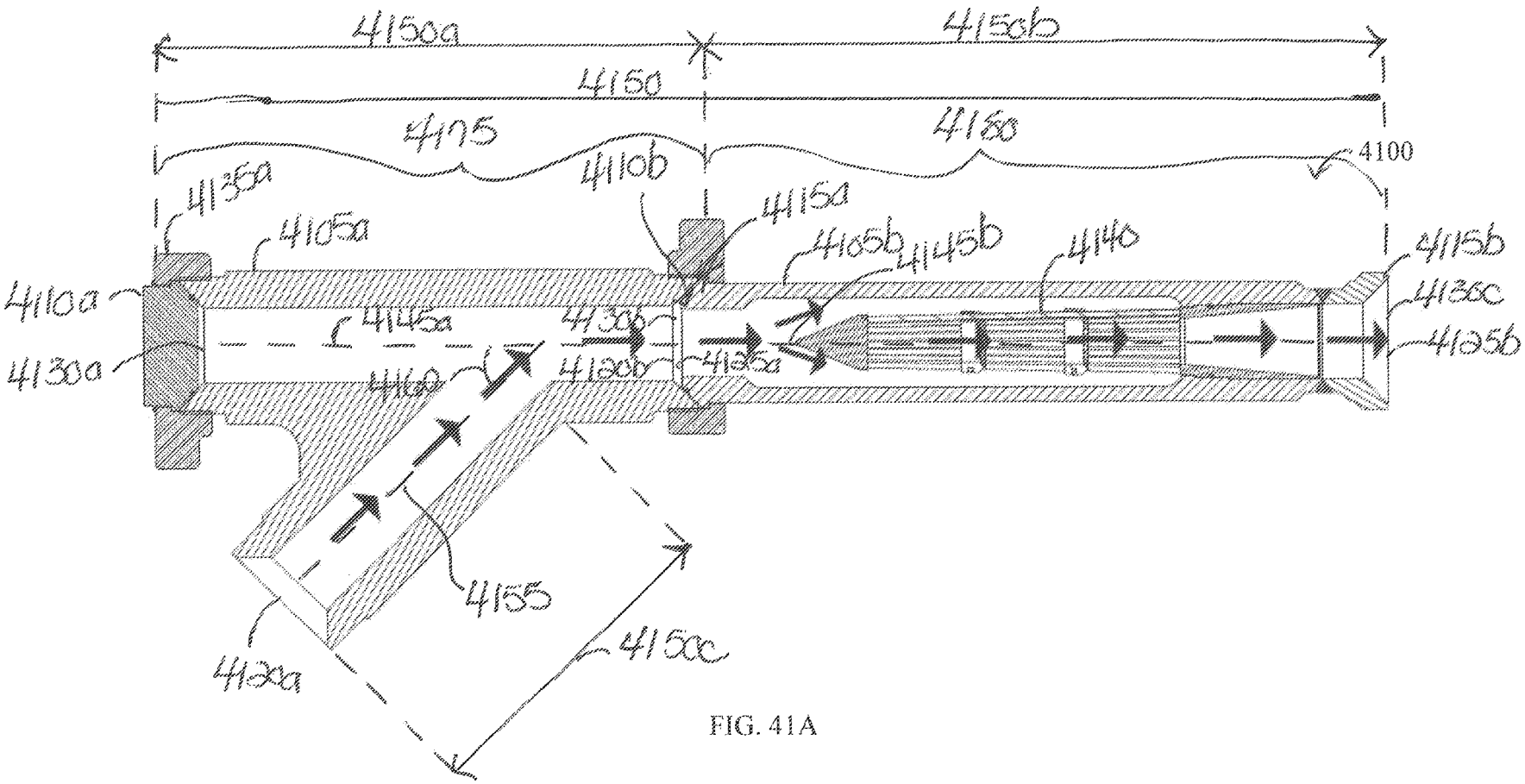
FIG. 41A illustrates a cross-sectional view of an exemplary drilling mud screen system according to an embodiment of the invention, showing a reversed drilling mud screen.

FIG. 41A illustrates a cross-sectional view of an exemplary drilling mud screen system 4100 according to an embodiment of the invention, showing a reversed drilling mud screen 4140.

As shown in FIGS. 7A, 19, 23 and 41A, the drilling mud screen system 700, 1900, 2100, 2300, 4100 has a first body 705*a*, 1905*a*, 2105*a*, 2305*a*, 4105*a* having a first end 710*a*, 1910*a*, 2110*a*, 2310*a*, 4110*a* and a second end 715*a*, 1915*a*, 2115*a*, 2315*a*, 4115*a*, a first drilling mud inlet 720*a*, 1920*a*, 2120*a*, 2320*a*, 4120*a* and a first drilling mud outlet 725*a*, 1925*a*, 2125*a*, 2325*a*, 4125*a*, an end cap 735, 1935, 2135, 2335, 4135, and a first drilling mud screen access port 730*a*, 1930*a*, 2130*a*, 2330*a*, 4130*a*. The drilling mud screen system 700, 1900, 2100, 2300, 4100 has a second body 705*b*, 1905*b*, 2105*b*, 2305*b*, 4105*b* having a first end 710*b*, 1910*b*, 2110*b*, 2310*b*, 4110*b* and a second end 715*b*, 1915*b*, 2115*b*, 2315*b*, 4115*b*, a second drilling mud inlet 720*b*, 1920*b*, 2120*b*, 2320*b*, 4120*b*, a second drilling mud outlet 725*b*, 1925*b*, 2125*b*, 2325*b*, 4125*b*, a second drilling mud screen access port 730*b*, 1930*b*, 2130*b*, 2330*b*, 4130*b*, and a third access port 4130*c*.

In an embodiment, the first drilling mud inlet 720*a*, 1920*a*, 2120*a*, 2320*a* may be fluidly connected to, for example, an outlet of a drilling mud pump via a connection; and the second drilling mud outlet 725*b*, 1925*b*, 2125*b*, 2325*b* may be fluidly connected to an inlet of a vibrator hose via a connection. Any suitable connection may be used for the first drilling mud inlet 720*a*, 1920*a*, 2120*a*, 2320*a* and second drilling mud outlet 725*b*, 1925*b*, 2125*b*, 2325*b*. For example, suitable connections include, but are not limited to, pipe fittings and welds. Connections are well known in the art. In an embodiment, the first drilling mud inlet 720*a*, 1920*a*, 2120*a*, 2320*a* may be fluidly connected to, for example, an outlet of a drilling mud pump via a weld; and the second drilling mud outlet 725*b*, 1925*b*, 2125*b*, 2325*b* may be fluidly connected to an inlet of a vibrator hose via a weld.

In an embodiment, the first body 705*a*, 1905*a*, 2105*a*, 2305*a*, 4105*a* and the second body 705*b*, 1905*b*, 2105*b*, 2305*b*, 4105*a* may be fluidly connected by a connection. Any suitable connection may be used for the first body 705*a*, 1905*a*, 2105*a*, 2305*a*, 4105*a* and the second body 705*b*, 1905*b*, 2105*b*, 2305*b*, 4105*b*. For example, suitable connections include, but are not limited to, pipe fittings. Connections are well known in the art. In an embodiment, the first body 705*a*, 1905*a*, 2105*a*, 2305*a*, 4105*a* and the second body 705*b*, 1905*b*, 2105*b*, 2305*b*, 4105*b* may be fluidly connected by a union. In an embodiment, the union may be a five-inch 1002 WECO union.

In an embodiment, the first body 705*a*, 1905*a*, 2105*a*, 2305*a*, 4105*a* and the second body 705*b*, 1905*b*, 2105*b*, 2305*b*, 4105*b* of the drilling mud screen system 700, 1900, 2100, 2300, 4100 may be constructed of any suitable material. For example, suitable materials include, but are not limited to, any alloy steel suitable for a drilling mud application. In an embodiment, the first body 705*a*, 1905*a*, 2105*a*, 2305*a*, 4105*a* and the second body 705*b*, 1905*b*, 2105*b*, 2305*b*, 4105*b* may be constructed of an AISI 4130/75k yield or equivalent material. See e.g., FIGS. 6A-6D. In an embodiment, the inner surface of the first body 705*a*, 1905*a*, 2105*a*, 2305*a*, 4105*a* and the second body 705*b*, 1905*b*, 2105*b*, 2305*b*, 4105*b* may be unpainted. See e.g., FIG. 6D. In an embodiment, the outer surface of the first body 705*a*, 1905*a*, 2105*a*, 2305*a*, 4105*a* and the second body 705*b*, 1905*b*, 2105*b*, 2305*b*, 4105*b* may be painted. See e.g., FIGS. 6A-6D.

In an embodiment, the drilling mud screen system 700, 1900, 2100, 2300, 4100 has a length 750, 1950, 2150, 2350, 4150. The length 750, 1950, 2150, 2350, 4150 may be any suitable length. In an embodiment, the length 750, 1950, 2150, 2350, 4150 may be from about 40-inches to about 80-inches, and any range or value there between. In an embodiment, the length 750, 1950, 2150, 2350, 4150 may be about 56-inches.

In an embodiment, the first body 705*a*, 1905*a*, 2105*a*, 2305*a*, 4105*a* has a first centerline 745*a*, 1945*a*, 2145*a*, 2345*a*, 4145*a* and a first length 750*a*, 1950*a*, 2150*a*, 2350*a*, 4150*a*. In an embodiment, the first centerline 745*a*, 1945*a*, 2145*a*, 2345*a*, 4145*a* extends through the center of the first drilling mud screen access port 730*a*, 1930*a*, 2130*a*, 2330*a*, 4130*a* to the first drilling mud outlet 725*a*, 1925*a*, 2125*a*, 2325*a*, 4125*a*. The first length 750*a*, 1950*a*, 2150*a*, 2350*a*, 4150*a* of the first body 705*a*, 1905*a*, 2105*a*, 2305*a*, 4105*a* may be any suitable length. In an embodiment, the first length 750*a*, 1950*a*, 2150*a*, 2350*a*, 4150*a* of the first body 705*a*, 1905*a*, 2105*a*, 2305*a*, 4105*a* may be from about 20-inches to about 40-inches, and any range or value there between. In an embodiment, the first length 750*a*, 1950*a*, 2150*a*, 2350*a*, 4150*a* may be about 27-inches or 30-inches.

In an embodiment, the first body 705*a*, 1905*a*, 2105*a*, 2305*a*, 4105*a* has a second centerline 755, 1955, 2155, 2355, 4155 and a third length 750*c*, 1950*c*, 2150*c*, 2350*c*, 4150*c*. In an embodiment, the second centerline 755, 1955, 2155, 2355, 4155 extends through the center of the first drilling mud inlet 720*a*, 1920*a*, 2120*a*, 2320*a*, 4120*a* to the first centerline 745*a*, 1945*a*, 2145*a*, 2345*a*, 4145*a* of the first body 705*a*, 1905*a*, 2105*a*, 2305*a*, 4105*a*. The third length 750*c*, 1950*c*, 2150*c*, 2350*c*, 4150*c* of the first body 705*a*, 1905*a*, 2105*a*, 2305*a*, 4105*a* may be any suitable length.

In an embodiment, the third length 750*c*, 1950*c*, 2350*c*, 4150*c* of the first body 705*a*, 1905*a*, 2305*a*, 4105*a* may be from about 10-inches to about 20-inches, and any range or value there between. In an embodiment, the third length 750*c*, 1950*c*, 2350*c*, 4150*c* may be about 14-inches or 16-inches.

In an embodiment, the third length 2150*c* of the first body 2105*a* may be from about 20-inches to about 40-inches, and any range or value there between. In an embodiment, the third length 2150*c* may be about 25-inches or 30-inches.

In an embodiment, the first centerline 745*a*, 1945*a*, 2145*a*, 2345*a*, 4145*a* and the second centerline 755, 1955, 2155, 2355, 4155 of the first body 705*a*, 1905*a*, 2105*a*, 2305*a*, 4105*a* form a first angle 760, 1960, 2160, 2360, 4160.

In an embodiment, the first angle 760, 1960, 2360, 4160 may be from about 30-degrees to about 120-degrees, and any range or value there between. In an embodiment, the first angle 760, 1960, 2360, 4160 may be from about 45-degrees to about 60-degrees. In an embodiment, the first angle 760, 1960, 2360, 4160 may be about 90-degrees.

In an embodiment, the first body 2105*a* may be modified to reduce the entry angle 2160 of the first drilling mud inlet 2120, resulting in increased flow efficiency and decreased erosion. In an embodiment, the first angle 2160 may be from about 20-degrees to about 120-degrees, and any range or value there between. In an embodiment, the first angle 2160 may be about 30-degrees.

In an embodiment, the first drilling mud inlet 720*a*, 1920*a*, 2120*a*, 2320*a*, 4120*a* may be offset from a first end 710*a*, 1910*a*, 2110*a*, 2310*a*, 4110*a* of the first body 705*a*, 1905*a*, 2105*a*, 2305*a*, 4105*a*. The first drilling mud inlet 720*a*, 1920*a*, 2120*a*, 2320*a*, 4120*a* may be offset from a first end 710*a*, 1910*a*, 2110*a*, 2310*a*, 4110*a* of the first body 705*a*, 1905*a*, 2105*a*, 2305*a*, 4105*a* at any suitable distance. In an embodiment, the second centerline 755, 1955, 2155, 2355, 4155 may be offset from the first end 710*a*, 1910*a*, 2110*a*, 2310*a*, 4110*a* of the first body 705*a*, 1905*a*, 2105*a*, 2305*a*, 4105*a* from about 15-inches to about 20-inches, and any range or value there between. In an embodiment, the second centerline 755, 1955, 2155, 2355, 4155 may be offset from the first end 710*a*, 1910*a*, 2110*a*, 2310*a*, 4110*a* of the first body 705*a*, 1905*a*, 2105*a*, 2305*a*, 4105*a* about 18-inches.

In an embodiment, the first drilling mud inlet 720*a*, 1920*a*, 2120*a*, 2320*a*, 4120*a* may have any suitable first inner diameter 765*a*, 1965*a*, 2165*a*, 2365*a*; and the first drilling mud inlet 720*a*, 1920*a*, 2120*a*, 2320*a*, 4120*a* may have any suitable first outer diameter 770*a*, 1970*a*, 2170*a*, 2370*a*. In an embodiment, the first inner diameter 765*a*, 1965*a*, 2165*a*, 2365*a* of the first drilling mud inlet 720*a*, 1920*a*, 2120*a*, 2320*a*, 4120*a* may be from about 3-inches to about 5-inches, and any range or value there between. In an embodiment, the first inner diameter 765*a*, 1965*a*, 2165*a*, 2365*a* of the first drilling mud inlet 720*a*, 1920*a*, 2120*a*, 2320*a*, 4120*a* may be about 4-inches.

In an embodiment, the first outer diameter 770*a*, 1970*a*, 2170*a*, 2370*a* of the first drilling mud inlet 720*a*, 1920*a*, 2120*a*, 2320*a*, 4120*a* may be from about 4.5-inches to about 6.5-inches, and any range or value there between. In an embodiment, the first outer diameter 770*a*, 1970*a*, 2170*a*, 2370*a* of the first drilling mud inlet 720*a*, 1920*a*, 2120*a*, 2320*a*, 4120*a* may be about 5.5-inches.

In an embodiment, the second body 705*b*, 1905*b*, 2105*b*, 2305*b*, 4105*b* has a second centerline 745*b*, 1945*b*, 2135*b*, 2345*b*, 4145*b* and a second length 750*b*, 1950*b*, 2150*b*, 2350*b*, 4150*b*. In an embodiment, the second centerline 745*b*, 1945*b*, 2145*b*, 2345*b*, 4145*b* extends through the center of the second drilling mud screen access port 730*b*, 1930*b*, 2130*b*, 2330*b*, 4130*b* (and the second drilling mud inlet 720*b*, 1920*b*, 2120*b*, 2320*b*, 4120*b*) to the second drilling mud outlet 725*b*, 1925*b*, 2125*b*, 2325*b*, 4125*b*. The second length 750*b*, 1950*b*, 2150*b*, 2350*b*, 4150*b* of the second body 705*b*, 1905*b*, 2105*b*, 2305*b*, 4105*b* may be any suitable length. In an embodiment, the second length 750*b*, 1950*b*, 2150*b*, 2350*b*, 4150*b* of the second body 705*b*, 1905*b*, 2105*b*, 2305*b*, 4105*b* may be from about 20-inches to about 40-inches, and any range or value there between. In an embodiment, the second length 750*b*, 1950*b*, 2150*b*, 2350*b*, 4105*b* may be about 25-inches.

In an embodiment, the second drilling mud inlet 720*b*, 1920*b*, 2120*b*, 2320*b*, 4120*b* may have any suitable second inner diameter 765*b*, 1965*b*, 2165*b*, 2365*b*; and the second drilling mud inlet 720*b*, 1920*b*, 2120*b*, 2320*b*, 4120*b* may have any suitable second outer diameter 770*b*, 1970*b*, 2170*b*, 2370*b*. In an embodiment, the second inner diameter 765*b*, 1965*b*, 2165*b*, 2365*b* of the second drilling mud inlet 720*b*, 1920*b*, 2120*b*, 2320*b*, 4120*b* may be from about 3-inches to about 5-inches, and any range or value there between. In an embodiment, the second inner diameter 765*b*, 1965*b*, 2165*b*, 2365*b* of the second drilling mud inlet 720*b*, 1920*b*, 2120*b*, 2320*b*, 4120*b* may be about 4-inches.

In an embodiment, the second outer diameter 770*b*, 1970*b*, 2170*b*, 2370*b* of the second drilling mud inlet 720*b*, 1920*b*, 2120*b*, 2320*b*, 4120*b* may be from about 4.5-inches to about 6.5-inches, and any range or value there between. In an embodiment, the second outer diameter 770*b*, 1970*b*, 2170*b*, 2370*b* of the second drilling mud inlet 720*b*, 1920*b*, 2120*b*, 2320*b*, 4120*b* may be about 5.5-inches.

In an embodiment, the first body 705*a*, 1905*a*, 2105*a*, 2305*a*, 4105*a* has a first portion 775, 1975, 2175, 2375, 4175 and the second body 705*b*, 1905*b*, 2105*b*, 2305*b*, 4105*b* has a second portion 780, 1980, 2180, 2380, 4180. In an embodiment, the first portion 775, 1975, 2175, 2375, 4175 of the first body 705*a*, 1905*a*, 2105*a*, 2305*a*, 4105*a* may have a first inner diameter 785, 1985, 2185, 2385 and an outer diameter 795, 1995, 2195, 2395; and the second portion 780, 1980, 2180, 2380, 4180 of the second body 705*b*, 1905*b*, 2105*b*, 2305*b*, 4105*b* may have a second inner diameter 790, 1990, 2190, 2390 and an outer diameter 795, 1995, 2195, 2395.

In an embodiment, the first inner diameter 785, 1985, 2185, 2385 of the first body 705*a*, 1905*a*, 2105*a*, 2305*a*, 4105*a* may be from about 3-inches to about 5-inches, and any range or value there between. In an embodiment, the first inner diameter 785, 1985, 2185, 2385 of the first body 705*a*, 1905*a*, 2105*a*, 2305*a*, 4105*a* may be about 4-inches.

In an embodiment, the first drilling mud outlet 725*a*, 1925*a*, 2125*a*, 2325*a*, 4125*a* may have any suitable first inner diameter 765*a*, 1965*a*, 2165*a*, 2365*a*; and the first drilling mud outlet 725*a*, 1925*a*, 2135*a*, 2325*a*, 4125*a* may have any suitable first outer diameter 770*a*, 1970*a*, 2170*a*, 2370*a*. In an embodiment, the first inner diameter 765*a*, 1965*a*, 2165*a*, 2365*a* of the first drilling mud outlet 725*a*, 1925*a*, 2125*a*, 2325*a*, 4125*a* may be from about 3-inches to about 5-inches, and any range or value there between. In an embodiment, the first inner diameter 765*a*, 1965*a*, 2165*a*, 2365*a* of the first drilling mud outlet 725*a*, 1925*a*, 2125*a*, 2325*a*, 4125*a* may be about 4-inches.

In an embodiment, the first outer diameter 770*a*, 1970*a*, 2170*a*, 2370*a* of the first drilling mud outlet 725*a*, 1925*a*, 2125*a*, 2325*a*, 4125*a* may be from about 4.5-inches to about 6.5-inches, and any range or value there between. In an embodiment, the first outer diameter 770*a*, 1970*a*, 2170*a*, 2370*a* of the first drilling mud outlet 725*a*, 1925*a*, 2125*a*, 2325*a*, 4125*a* may be about 5-inches.

In an embodiment, the second inner diameter 790, 1990, 2190, 2390 of the second body 705*b*, 1905*b*, 2105*b*, 2305*b*, 4105*b* may be from about 3-inches to about 5-inches, and any range or value there between. In an embodiment, the second inner diameter 790, 1990, 2190, 2390 of the second body 705*b*, 1905*b*, 2105*b*, 2305*b*, 4105*b* may be about 4-inches.

In an embodiment, a second portion 780, 1980, 2180, 2380 of the second body 705*b*, 1905*b*, 2105*b*, 2305*b*, 4105*b* may have a second inner diameter 790, 1990, 2190, 2390 to provide a high flow rate of drilling mud through the drilling mud screen 740, 1940, 2140, 2340, 4140. In an embodiment, the second inner diameter 790, 1990, 2190, 2390 of the second body 705*b*, 1905*b*, 2105*b*, 2305*b*, 4105*b* may be from about 3.5-inches to about 5.5-inches, and any range or value there between. In an embodiment, the second inner diameter 790, 1990, 2190, 2390 of the second body 705*b*, 1905*b*, 2105*b*, 2305*b*, 4105*b* may be from about 4.5-inches to about 5.5-inches, and any range or value there between.

In an embodiment, the first outer diameter 795, 1995, 2195, 2395 of the first portion 775, 1975, 2175, 2375, 4175 of the first body 705*a*, 1905*a*, 2105*a*, 2305*a*, 4105*a* and/or the second portion 780, 1980, 2180, 2380, 4180 of the second body 705*b*, 1905*b*, 2105*b*, 2305*b*, 4105*b* may be from about 5.5-inches to about 7.5-inches, and any range or value there between. In an embodiment, the first outer diameter 795, 1995, 2195, 2395 of the first portion 775, 1975, 2175, 2375, 4175 of the first body 705*a*, 1905*a*, 2105*a*, 2305*a*, 4105*a* and/or the second portion 780, 1980, 2180, 2380, 4180 of the second body 705*b*, 1905*b*, 2105*b*, 2305*b*, 4105*b* may be about 6.5-inches.

In an embodiment, the second drilling mud outlet 725*b*, 1925*b*, 2125*b*, 2325*b*, 4125*b* may have any suitable second inner diameter 765*b*, 1965*b*, 2165*b*, 2365*b*; and the second drilling mud outlet 725*b*, 1925*b*, 2125*b*, 2325*b*, 4125*b* may have any suitable second outer diameter 770*b*, 1970*b*, 2170*b*, 2370*b*. In an embodiment, the second inner diameter 765*b*, 1965*b*, 2165*b*, 2365*b* of the second drilling mud outlet 725*b*, 1925*b*, 2125*b*, 2325*b*, 4125*b* may be from about 3-inches to about 5-inches, and any range or value there between. In an embodiment, the second inner diameter 765*b*, 1965*b*, 2165*b*, 2365*b* of the second drilling mud outlet 725*b*, 1925*b*, 2125*b*, 2325*b*, 4125*b* may be about 4-inches.

In an embodiment, the second outer diameter 770*b*, 1970*b*, 2170*b*, 2370*b* of the second drilling mud outlet 725*b*, 1925*b*, 2125*b*, 2325*b*, 4125*b* may be from about 4.5-inches to about 6.5-inches, and any range or value there between. In an embodiment, the second outer diameter 770*b*, 1970*b*, 2170*b*, 2370*b* of the second drilling mud outlet 725*b*, 1925*b*, 2125*b*, 2325*b*, 4125*b* may be about 5.5-inches.

Optional Double Inlet

Figure 7B:
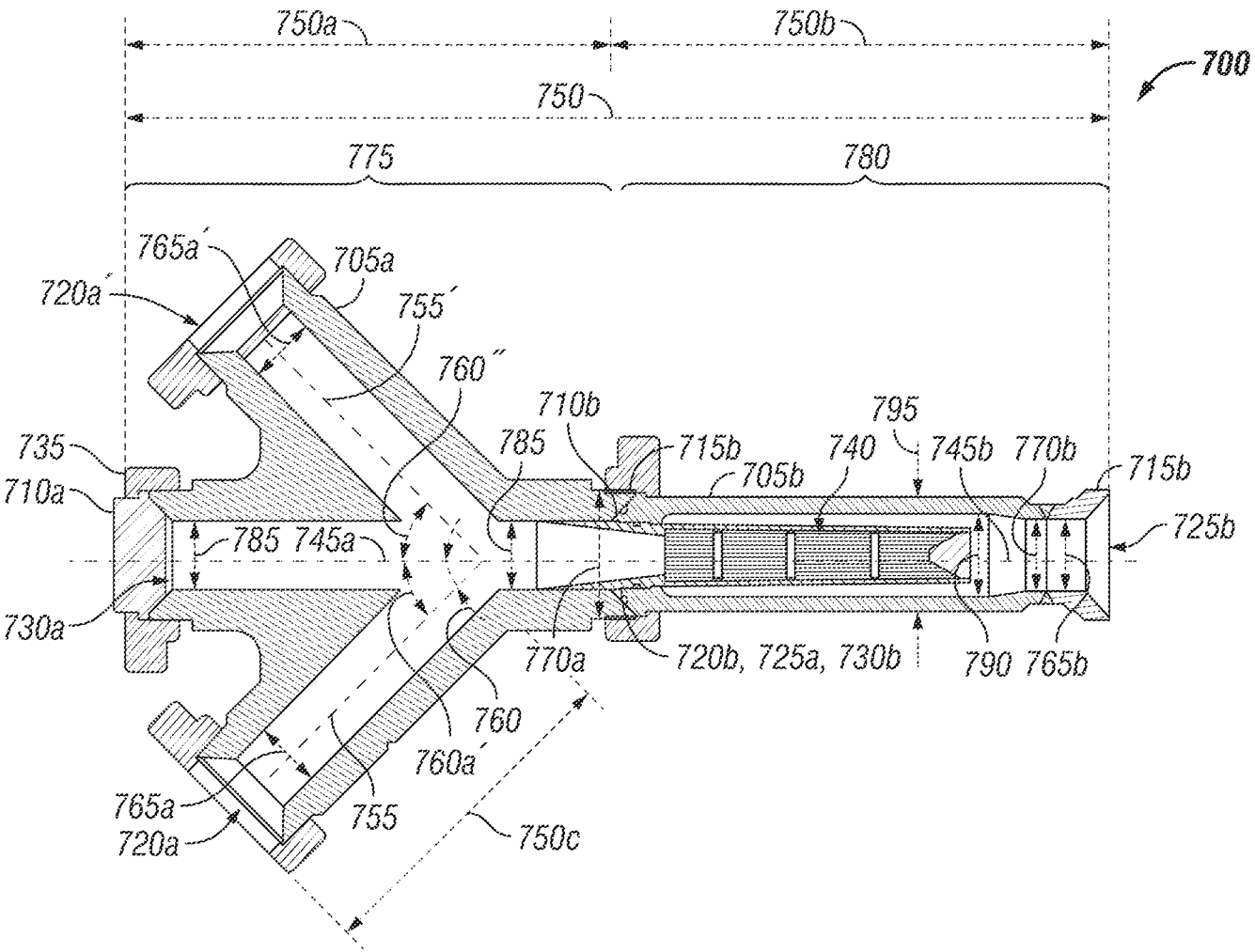
FIG. 7B illustrates an upper, cross-sectional view of a drilling mud screen system according to an embodiment of the present invention, showing a double-inlet drilling mud system.

FIG. 7B illustrates an upper, cross-sectional view of a drilling mud screen system according to an embodiment of the present invention, showing an optional double-inlet drilling mud system.

As shown in FIG. 7B, the drilling mud screen system 700 has a first body 705*a* having a first end 710*a* and a second end 715*a*, a first drilling mud inlet 720*a*, an optional first drilling mud inlet 720*a*' and a first drilling mud outlet 725*a*, an end cap 735, and a first drilling mud screen access port 730*a*. The drilling mud screen system 700 has a second body 705*b* having a first end 710*b* and a second end 715*b*, a second drilling mud inlet 720*b*, a second drilling mud outlet 725*b*, and a second drilling mud screen access port 730*b*.

In an embodiment, the first drilling mud inlet 720*a* and the optional first drilling mud inlet 720*a*' may be fluidly connected to, for example, an outlet of a drilling mud pump via a connection; and the second drilling mud outlet 725*b* may be fluidly connected to an inlet of a vibrator hose via a connection. Any suitable connection may be used for the first drilling mud inlet 720*a*, the optional first drilling mud inlet 720*a*' and the second drilling mud outlet 725*b*. For example, suitable connections include, but are not limited to, pipe fittings and welds. Connections are well known in the art. In an embodiment, the first drilling mud inlet 720*a* and the optional first drilling mud inlet 720*a*' may be fluidly connected to, for example, an outlet of a drilling mud pump via a weld; and the second drilling mud outlet 725*b* may be fluidly connected to an inlet of a vibrator hose via a weld.

In an embodiment, the first body 705*a* and the second body 705*b* may be fluidly connected by a connection. Any suitable connection may be used for the first body 705*a* and the second body 705*b*. For example, suitable connections include, but are not limited to, pipe fittings. Connections are well known in the art. In an embodiment, the first body 705*a* and the second body 705*b* may be fluidly connected by a union. In an embodiment, the union may be a five-inch 1002 WECO union.

In an embodiment, the first body 705*a* and the second body 705*b* of the drilling mud screen system 700 may be constructed of any suitable material. For example, suitable materials include, but are not limited to, any alloy steel suitable for a drilling mud application. In an embodiment, the first body 705*a* and the second body 705*b* may be constructed of an AISI 4130/75k yield or equivalent material. See e.g., FIGS. 6A-6D. In an embodiment, the inner surface of the first body 705*a* and the second body 705*b* may be unpainted. See e.g., FIG. 6D. In an embodiment, the outer surface of the first body 705*a* and the second body 705*b* may be painted. See e.g., FIGS. 6A-6D.

In an embodiment, the drilling mud screen system has a length 750. The length 750 may be any suitable length. In an embodiment, the length 750 may be from about 40-inches to about 80-inches, and any range or value there between. In an embodiment, the length 750 may be about 56-inches.

In an embodiment, the first body 705*a* has a first centerline 745*a* and a first length 750*a*. In an embodiment, the first centerline 745*a* extends through the center of the first drilling mud screen access port 730*a* to the first drilling mud outlet 725*a*. The first length 750*a* of the first body 705*a* may be any suitable length. In an embodiment, the first length 750*a* of the first body 705*a* may be from about 20-inches to about 40-inches, and any range or value there between. In an embodiment, the first length 750*a* may be about 30-inches.

In an embodiment, the first body 705*a* has a second centerline 755 and a third length 750*c*. In an embodiment, the second centerline 755 extends through the center of the first drilling mud inlet 720*a* to the first centerline 745*a* of the first body 705*a*. The third length 750*c* of the first body 705*a* may be any suitable length. In an embodiment, the third length 750*c* of the first body 705*a* may be from about 10-inches to about 20-inches, and any range or value there between. In an embodiment, the third length 750*c* may be about 14-inches or 16-inches.

In an embodiment, the first body 705*a* has a second centerline 755 and a third length 750*c*, and an optional second centerline 755' and an optional third length 750*c'*. In an embodiment, the second centerline 755 extends through the center of the first drilling mud inlet 720*a* to the first centerline 745*a* of the first body 705*a*. In an embodiment, the optional second centerline 755' extends through the center of the optional first drilling mud inlet 720*a'* to the first centerline 745*a* of the first body 705*a*. The third length 750*c* of the first body 705*a* may be any suitable length; and the optional third length 750*c'* of the first body 705*a* may be any suitable length.

In an embodiment, the third length 750*c* of the first body 705*a* may be from about 10-inches to about 20-inches, and any range or value there between. In an embodiment, the third length 750*c* may be about 14-inches or 16-inches.

In an embodiment, the optional third length 750*c'* of the first body 705*a* may be from about 10-inches to about 20-inches, and any range or value there between. In an embodiment, the optional third length 750*c'* may be about 14-inches or 16-inches.

In an embodiment, the third length 750*c* may be the same as the optional third length 750*c'*. In an embodiment, the third length 750*c* may be different from the optional third length 750*c'*.

In an embodiment, the first centerline 745*a* and the second centerline 755 of the first body 705*a* form a first angle 760. In an embodiment, the first angle 760 may be from about 30-degrees to about 120-degrees, and any range or value there between. In an embodiment, the first angle 760 may be from about 45-degrees to about 60-degrees. In an embodiment, the first angle 760 may be about 90-degrees.

In an embodiment, the first drilling mud inlet 720*a* may be offset from a first end 710*a* of the first body 705*a*. The first drilling mud inlet 720*a* may be offset from a first end 710*a* of the first body 705*a* at any suitable distance. In an embodiment, the second centerline 755 may be offset from the first end 710*a* of the first body 705*a* from about 15-inches to about 20-inches, and any range or value there between. In an embodiment, the second centerline 755 may be offset from the first end 710*a* of the first body 705*a* about 18-inches.

In an embodiment, the first drilling mud inlet 720*a* may have any suitable first inner diameter 765*a*; and the first drilling mud inlet 720*a* may have any suitable first outer diameter 770*a*. In an embodiment, the first inner diameter 765*a* of the first drilling mud inlet 720*a'* may be from about 3-inches to about 5-inches, and any range or value there between. In an embodiment, the first inner diameter 765*a* of the first drilling mud inlet 720*a* may be about 4-inches.

In an embodiment, the first centerline 745*a* and the optional second centerline 755' of the first body 705*a* form an optional first angle 760'. In an embodiment, the optional first angle 760' may be from about 30-degrees to about 120-degrees, and any range or value there between. In an embodiment, the optional first angle 760' may be from about 45-degrees to about 60-degrees. In an embodiment, the optional first angle 760' may be about 90-degrees.

In an embodiment, the first angle 760 may be the same as the optional first angle 760'. In an embodiment, the first angle 760 may be different from the optional first angle 760'.

In an embodiment, the optional first drilling mud inlet 720*a'* may be offset from a first end 710*a* of the first body 705*a*. The optional first drilling mud inlet 720*a'* may be offset from a first end 710*a* of the first body 705*a* at any suitable distance. In an embodiment, the optional first centerline 755' may be offset from the first end 710*a* of the first body 705*a* from about 15-inches to about 20-inches, and any range or value there between. In an embodiment, the optional first centerline 755' may be offset from the first end 710*a* of the first body 705*a* about 18-inches.

In an embodiment, the optional second centerline 755' of the optional first drilling mud inlet 720*a'* may be offset from the second centerline 755 of the first drilling mud inlet 720*a* radially about the first centerline 745*a* of the first body 705*a* to form an optional second angle 760". In an embodiment, the optional second angle 760" may be from about 30 degrees to about 120 degrees, and any range or value there between. In an embodiment, the optional second angle 760" may be from about 45-degrees to about 120-degrees. In an embodiment, the optional second angle 760" may be from about 90-degrees to about 120-degrees. In an embodiment, the optional second angle 760" may be about 120-degrees. See e.g., FIG. 7B.

In an embodiment, the optional first drilling mud inlet 720*a'* may have any suitable optional first inner diameter 765*a'*; and the optional first drilling mud inlet 720*a'* may have any suitable optional first outer diameter 770*a'*. In an embodiment, the optional first inner diameter 765*a'* of the optional first drilling mud inlet 720*a'* may be from about 3-inches to about 5-inches, and any range or value there between. In an embodiment, the optional first inner diameter 765*a'* of the optional first drilling mud inlet 720*a'* may be about 4-inches.

In an embodiment, the first outer diameter 770*a* of the first drilling mud inlet 720*a* may be from about 4.5-inches to about 6.5-inches, and any range or value there between. In an embodiment, the first outer diameter 770*a* of the first drilling mud inlet 720*a* may be about 5.5-inches.

In an embodiment, the optional first outer diameter 770*a'* of the optional first drilling mud inlet 720*a'* may be from about 4.5-inches to about 6.5-inches, and any range or value there between. In an embodiment, the optional first outer diameter 770*a'* of the optional first drilling mud inlet 720*a'* may be about 5.5-inches.

In an embodiment, the second body 705*b* has a second centerline 745*b* and a second length 750*b*. In an embodiment, the second centerline 745*b* extends through the center of the second drilling mud screen access port 730*b* (and the second drilling mud inlet 720*b*) to the second drilling mud outlet 725*b*. The second length 750*b* of the second body 705*b* may be any suitable length. In an embodiment, the second length 750*b* of the second body 705*b* may be from about 20-inches to about 40-inches, and any range or value there between. In an embodiment, the second length 750*b* may be about 25-inches.

In an embodiment, the second drilling mud inlet 720*b* may have any suitable second inner diameter 765*b*; and the second drilling mud inlet 720*b* may have any suitable second outer diameter 770*b*. In an embodiment, the second inner diameter 765*b* of the second drilling mud inlet 720*b* may be from about 3-inches to about 5-inches, and any range or value there between. In an embodiment, the second inner diameter 765*b* of the second drilling mud inlet 720*b* may be about 4-inches.

In an embodiment, the second outer diameter 770*b* of the second drilling mud inlet 720*b* may be from about 4.5-inches to about 6.5-inches, and any range or value there between. In an embodiment, the second outer diameter 770*b* of the second drilling mud inlet 720*b* may be about 5.5-inches.

In an embodiment, the first body 705*a* has a first portion 775 and the second body 705*b* has a second portion 780. In an embodiment, the first portion 775 of the first body 705*a* may have a first inner diameter 785 and an outer diameter 795; and the second portion 780 of the second body 705*b* may have a second inner diameter 790 and an outer diameter 795.

In an embodiment, the first inner diameter 785 of the first body 705*a* may be from about 3-inches to about 5-inches, and any range or value there between. In an embodiment, the first inner diameter 785 of the first body 705*a* may be about 4-inches.

In an embodiment, the first drilling mud outlet 725*a* may have any suitable first inner diameter 765*a*; and the first drilling mud outlet 725*a* may have any suitable first outer diameter 770*a*. In an embodiment, the first inner diameter 765*a* of the first drilling mud outlet 725*a* may be from about 3-inches to about 5-inches, and any range or value there between. In an embodiment, the first inner diameter 765*a* of the first drilling mud outlet 725*a* may be about 4-inches.

In an embodiment, the first outer diameter 770*a* of the first drilling mud outlet 725*a* may be from about 4.5-inches to about 6.5-inches, and any range or value there between. In an embodiment, the first outer diameter 770*a* of the first drilling mud outlet 725*a* may be about 5-inches.

In an embodiment, the second inner diameter 790 of the second body 705*b* may be from about 3-inches to about 5-inches, and any range or value there between. In an embodiment, the second inner diameter 790 of the second body 705*b* may be about 4-inches.

In an embodiment, a second portion 780 of the second body 705*b* may have a second inner diameter 790 to provide a high flow rate of drilling mud through the drilling mud screen 740. In an embodiment, the second inner diameter 790 of the second body 705*b* may be from about 3.5-inches to about 5.5-inches, and any range or value there between. In an embodiment, the second inner diameter 790 of the second body 705*b* may be from about 4.5-inches to about 5.5-inches, and any range or value there between.

In an embodiment, the first outer diameter 795 of the first portion 775 of the first body 705*a* and/or the second portion 780 of the second body 705*b* may be from about 5.5-inches to about 7.5-inches, and any range or value there between. In an embodiment, the first outer diameter 795 of the first portion 775 of the first body 705*a* and/or the second portion 780 of the second body 705*b* may be about 6.5-inches.

In an embodiment, the second drilling mud outlet 725*b* may have any suitable second inner diameter 765*b*; and the second drilling mud outlet 725*b* may have any suitable second outer diameter 770*b*. In an embodiment, the second inner diameter 765*b* of the second drilling mud outlet 725*b* may be from about 3-inches to about 5-inches, and any range or value there between. In an embodiment, the second inner diameter 765*b* of the second drilling mud outlet 725*b* may be about 4-inches.

In an embodiment, the second outer diameter 770*b* of the second drilling mud outlet 725*b* may be from about 4.5-inches to about 6.5-inches, and any range or value there between. In an embodiment, the second outer diameter 770*b* of the second drilling mud outlet 725*b* may be about 5.5-inches.

Two-Piece Piston Body

In an embodiment, a piston-style drilling mud screen system may be used to provide easier access to the drilling mud screen and to reduce the foot-print of the drilling mud screen system.

Figure 30B:
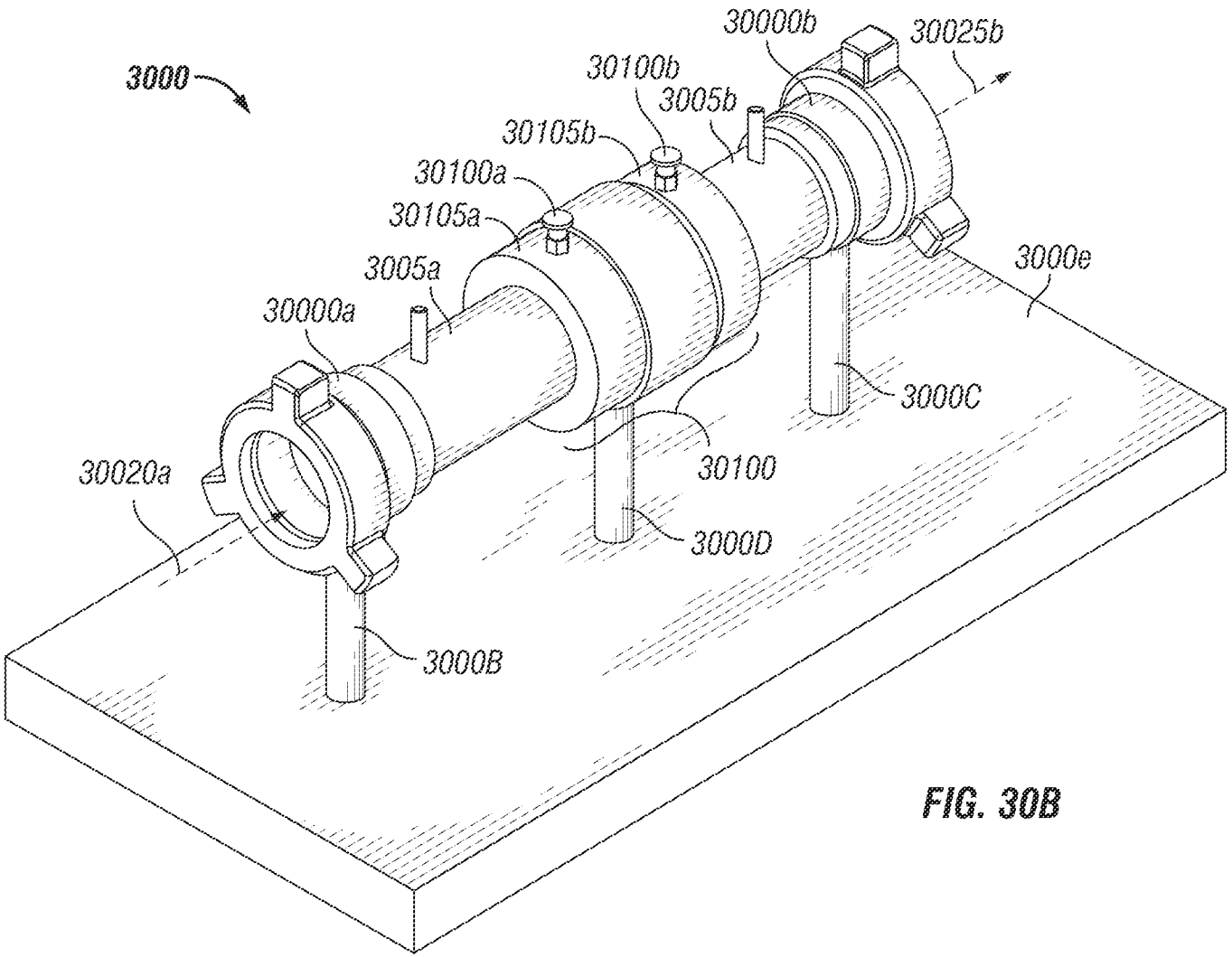
FIG. 30B illustrates an upper, left perspective view of the exemplary piston-style drilling mud screen system of FIG. 30A, showing the piston-style drilling mud screen system in a closed position.
Figure 30C:
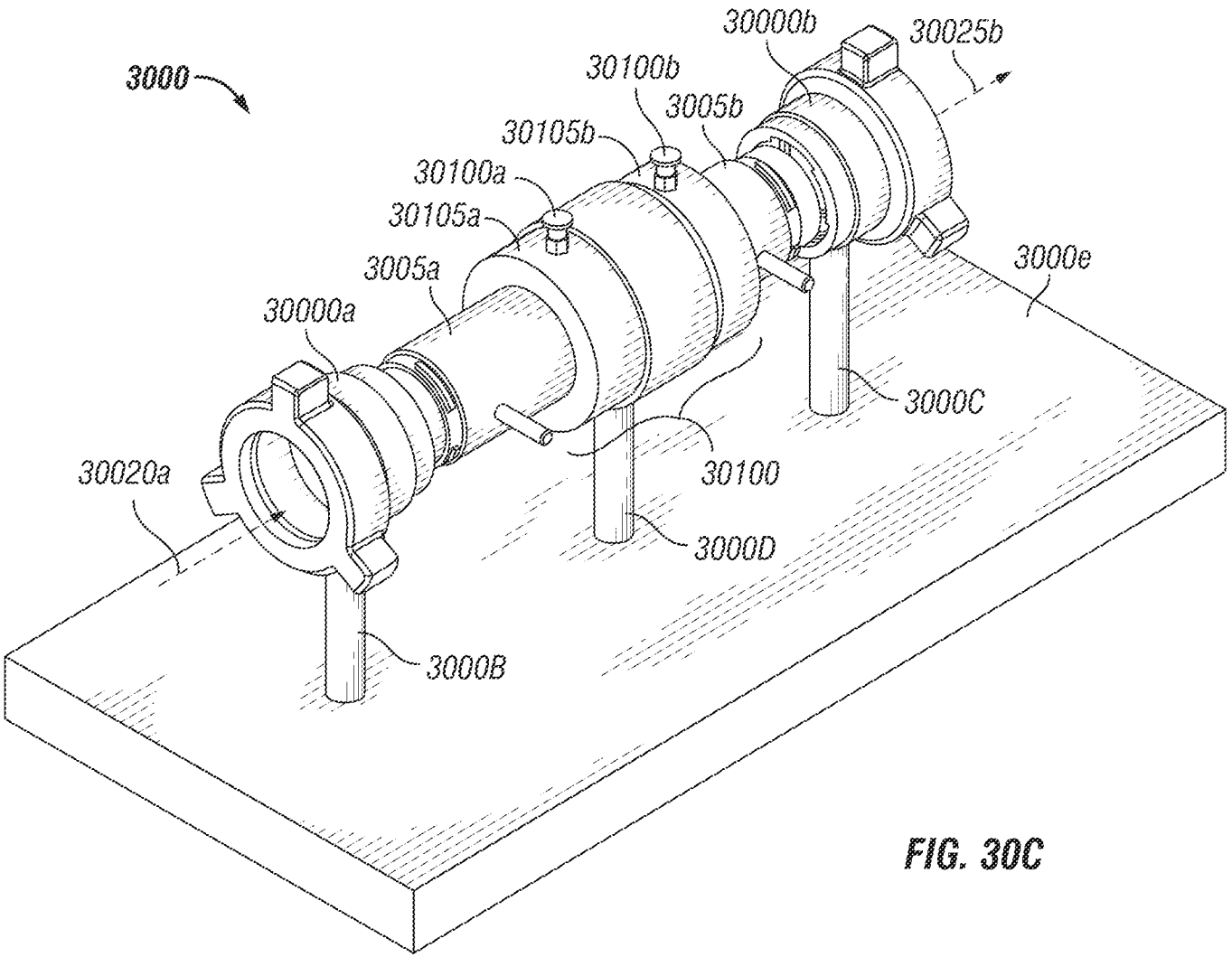
FIG. 30C illustrates an upper, left perspective view of the exemplary piston-style drilling mud screen system of FIGS. 30A-30B, showing the piston-style drilling mud screen system an unlatched position.
Figure 30D:
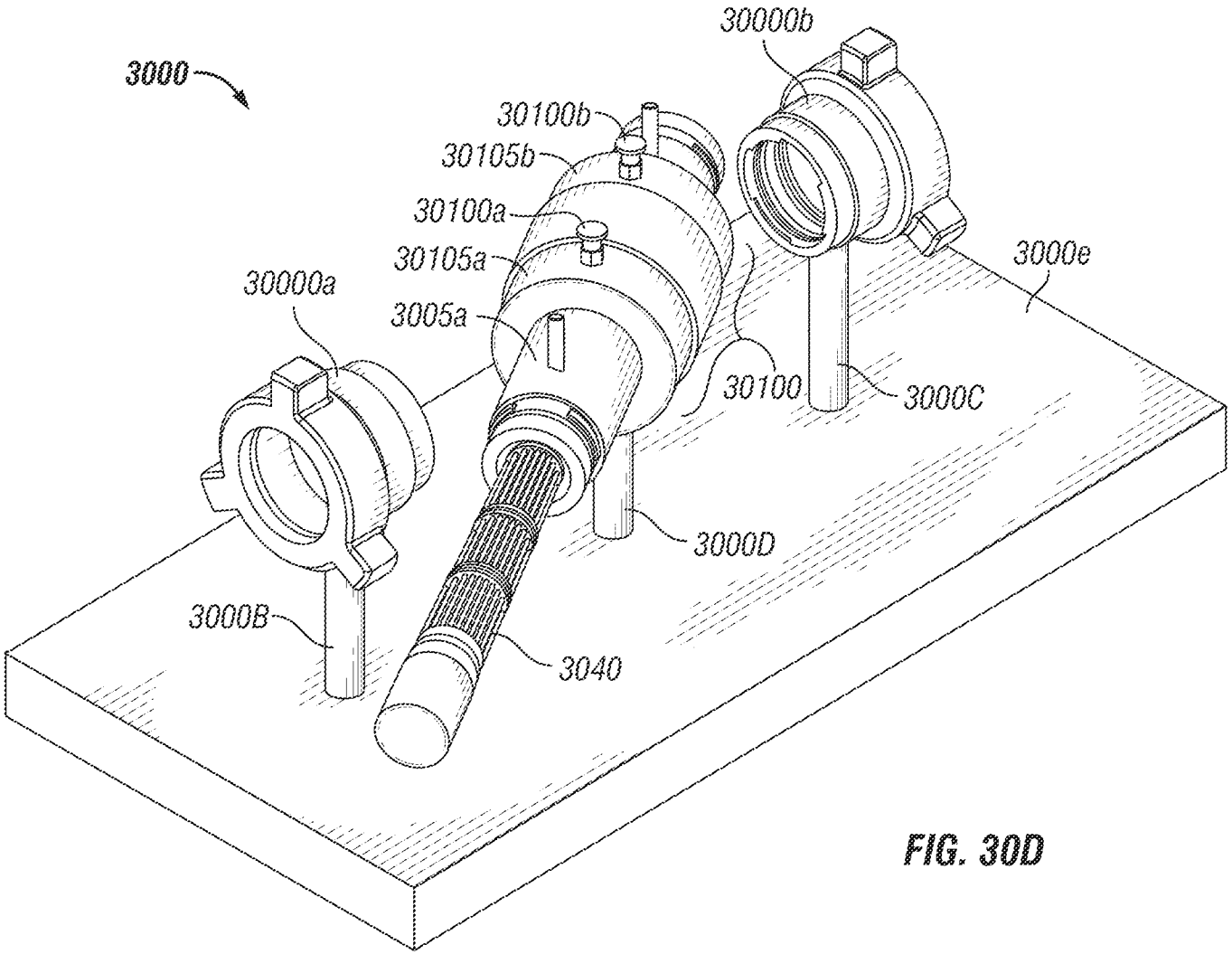
FIG. 30D illustrates an upper, left perspective view of the exemplary piston-style drilling mud screen system of FIGS. 30A and 30C, showing the piston-style drilling mud screen system an unlatched and rotated position for removal of a drilling mud screen.
Figure 30E:
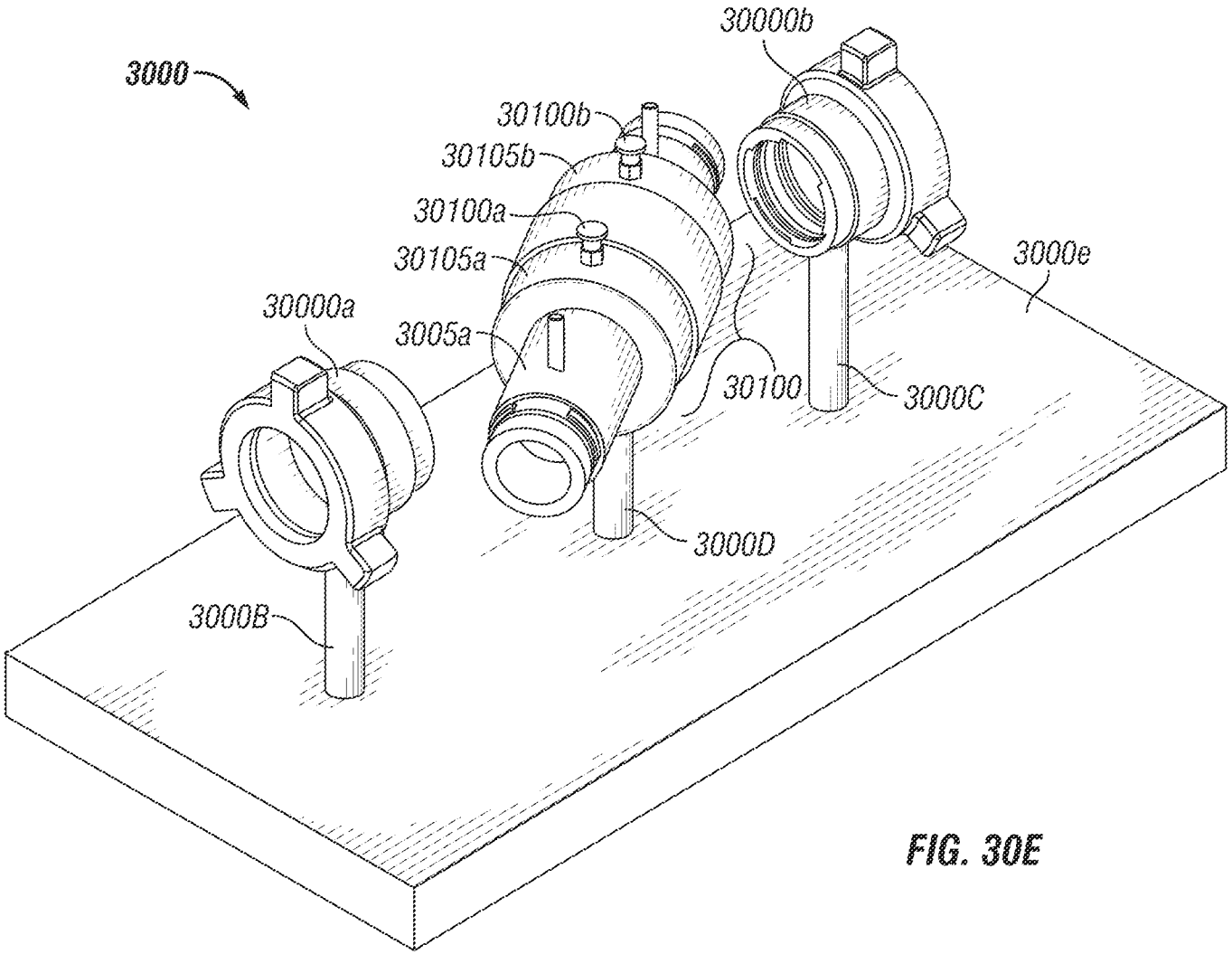
FIG. 30E illustrates an upper, left perspective view of the exemplary piston-style drilling mud screen system of FIGS. 30A and 30D, showing the piston-style drilling mud screen system an unlatched and rotated position after removal of the drilling mud screen.
Figure 30F:
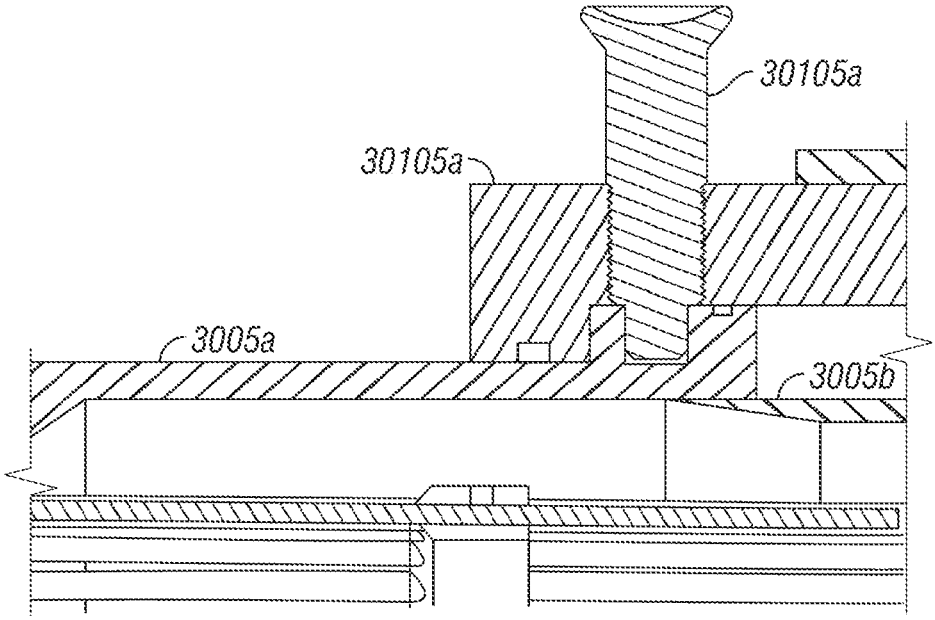
FIG. 30F illustrates a detailed view of an exemplary positive lock mechanism for the exemplary piston-style drilling mud screen system of FIGS. 30A-30E, showing a spring-loaded lock mechanism.
Figure 30G:
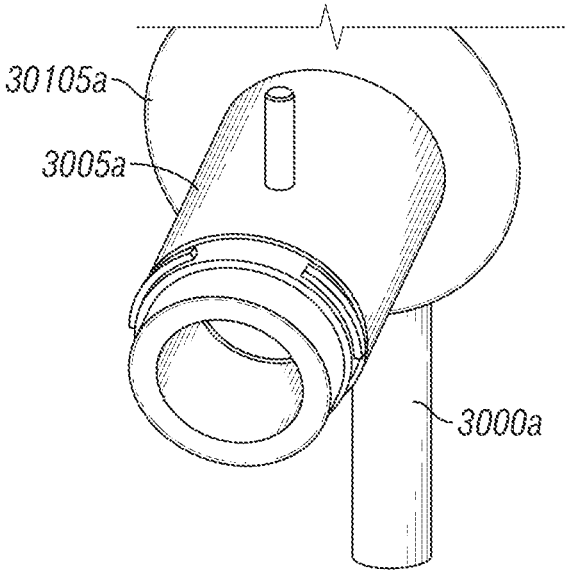
FIG. 30G illustrates a detailed view of an exemplary breech lock connection for the exemplary piston-style drilling mud screen system of FIGS. 30A-30F, showing a quarter-turn breech lock connection.

FIG. 30A illustrates a cross-sectional view of an exemplary piston-style drilling mud screen system 3000 according to an embodiment of the present invention, showing a two-piece piston body for the system mounted on a skid 3000*a*; FIG. 30B illustrates an upper, left perspective view of the exemplary piston-style drilling mud screen system 3000 of FIG. 30A, showing the piston-style drilling mud screen system in a closed position; FIG. 30C illustrates an upper, left perspective view of the exemplary piston-style drilling mud screen system 3000 of FIGS. 30A-30B, showing the piston-style drilling mud screen system an unlatched position; FIG. 30D illustrates an upper, left perspective view of the exemplary piston-style drilling mud screen system 3000 of FIGS. 30A and 30C, showing the piston-style drilling mud screen system an unlatched and rotated position for removal of a drilling mud screen; FIG. 30E illustrates an upper, left perspective view of the exemplary piston-style drilling mud screen system 3000 of FIGS. 30A and 30D, showing the piston-style drilling mud screen system an unlatched and rotated position after removal of the drilling mud screen 3040; FIG. 30F illustrates a detailed view of an exemplary positive lock mechanism for the piston-style drilling mud screen system 3000 of FIGS. 30A-30E, showing a spring-loaded lock mechanism; and FIG. 30G illustrates a detailed view of an exemplary breech lock connection for the exemplary piston-style drilling mud screen system 3000 of FIGS. 30A-30F, showing a quarter turn breech lock connection.

As shown in FIGS. 30A-30G, the piston-style drilling mud screen system 3000 comprises a first subassembly 30000*a*, a first body 3005*a*, a lock system 30100 (discussed below), a second body 3005*b* and a second subassembly 30000*b*. The piston-style drilling mud screen system 3000 has a first subassembly 30000*a* having a first end 30010*a* and a second end 30015*a*, a first inlet 30020*a* of the first subassembly 30000*a* and a first outlet 30025*a* of the first subassembly 30000*a*. The piston-style drilling mud screen system 3000 has a first body 3005*a* having a first end 3010*a* and a second end 3015*a*, a first drilling mud inlet 3020*a* of the first body 3005*a* and a first drilling mud outlet 3025*a* of the first body 3005*a* (and a first drilling mud screen access port 3030*a* of the first body 3005*a*). The piston-style drilling mud screen system 3000 has a second body 3005*b* having a first end 3010*b* and a second end 3015*b*, a second drilling mud inlet 3020*b* of the second body 3005*b* (and a second drilling mud screen access port 3030*b* of the second body 3005*b*) and a second drilling mud outlet 3025*b* of the second body 3005*b*. The piston-style drilling mud screen system 3000 has a second subassembly 30000*b* having a first end 30010*b* and a second end 30015*b*, a second inlet 30020*b* of the second subassembly 30000*b* and a second outlet 30025*b* of the second subassembly 30000*b*.

In an embodiment, the first drilling mud inlet 30020*a* of the first subassembly 30000*a* may be fluidly connected to, for example, an outlet of a drilling mud pump via a connection; and the second drilling mud outlet 30025*b* of the second subassembly 30000*b* may be fluidly connected to an inlet of a vibrator hose via a connection. Any suitable connection may be used for the first drilling mud inlet 30020*a* of the first subassembly 30000*a* and the second drilling mud outlet 30025*b* of the second subassembly 30000*b*. For example, suitable connections include, but are not limited to, pipe fittings and welds. Connections are well known in the art. In an embodiment, the first drilling mud inlet 30020*a* of the first subassembly 30000*a* may be fluidly connected to, for example, an outlet of a drilling mud pump via a weld; and the second drilling mud outlet 30025*b* of the second subassembly 30000*b* may be fluidly connected to an inlet of a vibrator hose via a weld.

In an embodiment, the first drilling mud inlet 3020*a* of the first body 3005*a* may be fluidly connected to the first drilling mud outlet 30025*a* of the first subassembly 30000*a* via a connection; and the second drilling mud outlet 3025*b* of the second body 3005*b* may be fluidly connected to the second drilling mud inlet 30020*b* of the second subassembly 30000*b* via a connection. Any suitable connection may be used for the first drilling mud inlet 3020*a* of the first body 3005*a* and second drilling mud outlet 3025*b* of the second body 3005*b*. For example, suitable connections include, but are not limited to, pipe fittings and quarter-turn breech lock connections. In an embodiment, the first drilling mud inlet 3020*a* of the first body 3005*a* may be fluidly connected to, for example, a first drilling mud outlet 30025*a* of a first subassembly 30000*a* via a quarter-turn breech lock connection; and the second drilling mud outlet 3025*b* of the second body 3005*b* may be fluidly connected to a second drilling mud inlet 30020*b* of the second subassembly 30000*b* via a quarter-turn breech lock connection.

In an embodiment, the first drilling mud outlet 3025*a* of the first body 3005*a* may be fluidly connected to the second drilling mud inlet 3020*b* of the second body 3005*b* via a sleeve extending from a first end 3010*b* of the second body 3005*b*. See e.g., FIG. 30A. The sleeve may be integral to the second body 3005*b* or fluidly connected to the second body 3005*b*. In an embodiment, a first end of the sleeve of the second body 3005*b* may be inserted into the first drilling mud outlet 3025*a* of the first body 3005*a*. In an embodiment, the first body 3005*a* and/or the second body 3005*b* may be sealed via an O-ring. Any suitable O-ring may be used. For example, suitable O-rings include, but are not limited to, 300 Series O-rings. O-rings are well known in the art.

In an embodiment, the first drilling mud outlet 3025*a* of the first body 3005*a* may be fluidly connected to the second drilling mud inlet 3020*b* of the second body 3005*b* via a sleeve extending from a second end 3015*a* of the first body 3005*a*. The sleeve may be integral to the first body 3005*a* or fluidly connected to the first body 3005*a*. In an embodiment, a second end of the sleeve of the first body 3005*a* may be inserted into the second drilling mud inlet 3020*b* of the second body 3005*b*. In an embodiment, the first body 3005*a* and/or the second body 3005*b* may be sealed via an O-ring. Any suitable O-ring may be used. For example, suitable O-rings include, but are not limited to, 300 Series O-rings. O-rings are well known in the art.

In an embodiment, the first drilling mud outlet 3025*a* of the first body 3005*a* may be fluidly connected to the second drilling mud inlet 3020*b* of the second body 3005*b* via a union. In an embodiment, the union may be a lock system 30100. In an embodiment, the first body 3005*a* and/or the second body 3005*b* may be sealed with the lock system 30100 via an O-ring. Any suitable O-ring may be used. For example, suitable O-rings include, but are not limited to, 300 Series O-rings. O-rings are well known in the art.

In an embodiment, the first drilling mud outlet 3025*a* of the first body 3005 may be fluidly connected to a first inlet 30125*a* of a first body 30105*a* of the lock system 30100. In an embodiment, the first body 3005*a* may be sealed with the lock system 30100 via an O-ring. Any suitable O-ring may be used. For example, suitable O-rings include, but are not limited to, 300 Series O-rings. O-rings are well known in the art.

In an embodiment, a first outlet 30125*a* of the first body 30105*a* of the lock system 30100 may be fluidly connected to a second inlet 30120*b* of a second body 30105*b* of the lock system 30100. In an embodiment, the first body 30105*a* of the lock system 30100 may be sealed with the second body 30105*b* of the lock system 30100 via an O-ring. Any suitable O-ring may be used. For example, suitable O-rings include, but are not limited to, 300 Series O-rings. O-rings are well known in the art.

In an embodiment, the second outlet 30125*b* of the second body 30105*b* of the lock system 30100 may be fluidly connected to the second drilling mud inlet 3020*b* of the second body 3005*b*. In an embodiment, the second body 3005*b* may be sealed with the lock system 30100 via an O-ring. Any suitable O-ring may be used. For example, suitable O-rings include, but are not limited to, 300 Series O-rings. O-rings are well known in the art.

In an embodiment, the first subassembly 30000*a* and the second subassembly 30000*b* of the drilling mud screen system 3000 may be constructed of any suitable material. For example, suitable materials include, but are not limited to, any alloy steel suitable for a drilling mud application. In an embodiment, the first subassembly 30000*a* and the second subassembly 30000*b* may be constructed of an AISI 4130/75k yield or equivalent material. See e.g., FIGS. 30A-30E. In an embodiment, the inner surface of the first subassembly 30000*a* and the second subassembly 30000*b* may be unpainted. In an embodiment, the outer surface of the first subassembly 30000*a* and the second assembly 30000*b* may be painted.

In an embodiment, the first body 3005*a* and the second body 3005*b* of the drilling mud screen system 3000 may be constructed of any suitable material. For example, suitable materials include, but are not limited to, any alloy steel suitable for a drilling mud application. In an embodiment, the first body 3005*a* and the second body 3005*b* may be constructed of an AISI 4130/75k yield or equivalent material. See e.g., FIGS. 30A-30E. In an embodiment, the inner surface of the first body 3005*a* and the second body 3005*b* may be unpainted. In an embodiment, the outer surface of the first body 3005*a* and the second body 3005*b* may be painted.

In an embodiment, the drilling mud screen system 3000 has a length 3050. The length 3050 may be any suitable length. In an embodiment, the length 3050 may be from about 40-inches to about 80-inches, and any range or value there between. In an embodiment, the length 3050 may be about 41 inches or about 42-inches.

In an embodiment, the drilling mud screen system 3000, including a first subassembly 30000*a* and a second subassembly 30000*b*, has a length 30050. The length 30050 may be any suitable length. In an embodiment, the length 30050 may be from about 40-inches to about 100-inches, and any range or value there between. In an embodiment, the length 30050 may be about 60-inches.

In an embodiment, the first subassembly 30000*a* has a first centerline 30045*a* and a first length 30050*a*. In an embodiment, the first centerline 30045*a* extends through the center of the first drilling mud screen inlet 30020*a* of the first subassembly 30000*a* to the first drilling mud outlet 30025*a* of the first subassembly 30000*a* (and the first drilling mud screen inlet 3020*a* of the first body 3005*a*). The first length 30050*a* of the first subassembly 30000*a* may be any suitable length. In an embodiment, the first length 30050*a* of the first subassembly 30000*a* may be from about 4-inches to about 10-inches, and any range or value there between. In an embodiment, the first length 30050*a* of the first subassembly 30000*a* may be about 6-inches.

In an embodiment, the first drilling mud inlet 30020*a* of the first subassembly 30000*a* may have any suitable first inner diameter 30065*a*; and the first drilling mud inlet 30020*a* of the first subassembly 30000*a* may have any suitable first outer diameter 30070*a*. In an embodiment, the first inner diameter 30065*a* of the first drilling mud inlet 30020*a* may be from about 3-inches to about 5-inches, and any range or value there between. In an embodiment, the first inner diameter 30065*a* of the first drilling mud inlet 30020*a* may be about 4-inches.

In an embodiment, the first outer diameter 30070*a* of the first drilling mud inlet 30020*a* may be from about 4.5-inches to about 6.5-inches, and any range or value there between. In an embodiment, the first outer diameter 30070*a* of the first drilling mud inlet 30020*a* may be about 5.5-inches.

In an embodiment, the second subassembly 30000*b* has a second centerline 30045*b* and a second length 30050*b*. In an embodiment, the second centerline 30045*b* extends through the center of the second drilling mud screen inlet 30020*b* of the second subassembly 30000*b* (and the second drilling mud outlet 3025*b* of the second body 3005*b*) to the second drilling mud outlet 30020*b* of the second subassembly 30000*b*. The second length 30050*b* of the second subassembly 30000*b* may be any suitable length. In an embodiment, the second length 30050*b* of the second subassembly 30000*b* may be from about 4-inches to about 10-inches, and any range or value there between. In an embodiment, the second length 30050*b* of the second subassembly 30000*b* may be about 6-inches.

In an embodiment, the second drilling mud inlet 30020*b* of the second subassembly 30000*b* may have any suitable second inner diameter 30065*b*; and the second drilling mud inlet 30020*b* of the second subassembly 30000*b* may have any suitable second outer diameter 30070*b*. In an embodiment, the second inner diameter 30065*b* of the second drilling mud inlet 30020*b* may be from about 3-inches to about 5-inches, and any range or value there between. In an embodiment, the second inner diameter 30065*b* of the second drilling mud inlet 30020*b* may be about 4-inches.

In an embodiment, the second outer diameter 30070*b* of the second drilling mud inlet 30020*b* may be from about 4.5-inches to about 6.5-inches, and any range or value there between. In an embodiment, the second outer diameter 30070*b* of the second drilling mud inlet 30020*b* may be about 5.5-inches.

In an embodiment, the first body 3005*a* has a first centerline 3045*a* and a first length 3050*a*. In an embodiment, the first centerline 3045*a* extends through the center of the first drilling mud screen inlet 3020*a* to the first drilling mud outlet 3025*a* (and the first drilling mud screen access port 3030*a*). The first length 3050*a* of the first body 3005*a* may be any suitable length. In an embodiment, the first length 3050*a* of the first body 3005*a* may be from about 15-inches to about 40-inches, and any range or value there between. In an embodiment, the first length 3050*a* may be about 16.5-inches.

In an embodiment, the first drilling mud inlet 3020*a* may have any suitable first inner diameter 3065*a*; and the first drilling mud inlet 3020*a* may have any suitable first outer diameter 3070*a*. In an embodiment, the first inner diameter 3065*a* of the first drilling mud inlet 3020*a* may be from about 3-inches to about 5-inches, and any range or value there between. In an embodiment, the first inner diameter 3065*a* of the first drilling mud inlet 3020*a* may be about 4-inches.

In an embodiment, the first outer diameter 3070*a* of the first drilling mud inlet 3020*a* may be from about 4.5-inches to about 6.5-inches, and any range or value there between. In an embodiment, the first outer diameter 3070*a* of the first drilling mud inlet 3020*a* may be about 5.5-inches.

In an embodiment, the first drilling mud outlet 3025*a* may have any suitable first inner diameter 3065*a*; and the first drilling mud outlet 3025*a* may have any suitable first outer diameter 3070*a*. In an embodiment, the first inner diameter 3065*a* of the first drilling mud outlet 3025*a* may be from about 3-inches to about 5-inches, and any range or value there between. In an embodiment, the first inner diameter 3065*a* of the first drilling mud outlet 3025*a* may be about 4-inches.

In an embodiment, the first outer diameter 3070*a* of the first drilling mud outlet 3025*a* may be from about 4.5-inches to about 6.5-inches, and any range or value there between. In an embodiment, the first outer diameter 3070*a* of the first drilling mud outlet 3025*a* may be about 5.5-inches.

In an embodiment, the second body 3005*b* has a second centerline 3045*b* and a second length 3050*b*. In an embodiment, the second centerline 3045*b* extends through the center of the second drilling mud screen access port 3030*b* (and the second drilling mud inlet 3020*b*) to the second drilling mud outlet 3025*b*. The second length 3050*b* of the second body 3005*b* may be any suitable length. In an embodiment, the second length 3050*b* of the second body 3005*b* may be from about 15-inches to about 40-inches, and any range or value there between. In an embodiment, the second length 3050*b* may be about 18-inches or about 19-inches.

In an embodiment, the second drilling mud inlet 3020*b* may have any suitable second inner diameter 3065*b*; and the second drilling mud inlet 3020*b* may have any suitable second outer diameter 3070*b*. In an embodiment, the second inner diameter 3065*b* of the second drilling mud inlet 3020*b* may be from about 3-inches to about 5-inches, and any range or value there between. In an embodiment, the second inner diameter 3065*b* of the second drilling mud inlet 3020*b* may be about 4-inches.

In an embodiment, the second outer diameter 3070*b* of the second drilling mud inlet 3020*b* may be from about 4.5-inches to about 6.5-inches, and any range or value there between. In an embodiment, the second outer diameter 3070*b* of the second drilling mud inlet 3020*b* may be about 5.5-inches.

In an embodiment, the second drilling mud outlet 3025*b* may have any suitable second inner diameter 3065*b*; and the second drilling mud outlet 3025*b* may have any suitable second outer diameter 3070*b*. In an embodiment, the second inner diameter 3065*b* of the second drilling mud outlet 3025*b* may be from about 3-inches to about 5-inches, and any range or value there between. In an embodiment, the second inner diameter 3065*b* of the second drilling mud outlet 3025*b* may be about 4-inches.

In an embodiment, the second outer diameter 3070*b* of the second drilling mud outlet 3025*b* may be from about 4.5-inches to about 6.5-inches, and any range or value there between. In an embodiment, the second outer diameter 3070*b* of the second drilling mud outlet 3025*b* may be about 5.5-inches.

Lock System

The piston-style drilling mud screen system 3000 has a lock system 30100. The lock system 30100 has a first lock 30100*a*, and a second lock 30100*b*, a first body 30105*a* of the lock system 30100 having a first end 30105*a* and a second end 30105*b*, a second body 30105*b* of the lock system 30100 having a first end 30110*a* and a second end 30110*b*.

In an embodiment, the first end 30110*a* of the first body 30105*a* of the lock system 30100 (and the second end 3015*a* of the first body 3005*a*) may be adapted to receive the first lock 30100*a*. See e.g., FIG. 30F. In an embodiment, the first lock 30100*a* may extend through the first end 30110*a* of the first body 30105*a* of the lock system and engage the second end 3015*a* of the first body 3005*a* when the system 3000 is closed.

The first lock 30100*a* may be any suitable positive locking mechanism. For example, a suitable first lock 30100*a* includes, but is not limited to, a spring-loaded lock. In an embodiment, the first lock 30100*a* may be a spring-loaded lock. See e.g., FIG. 30F.

In an embodiment, the second end 3015*a* of the first body 3005*a* may be disposed through the first end 30110*a* of the first body 30105*a* of the lock system 30100 such that the second end 3015*a* of the first body 3005*a* is held by a first lip at the first end 30110*a* of the first body 30105*a* of the lock system 30100. See e.g., FIG. 30A.

In an embodiment, the second end 3015*a* of the first body 3005*a* and the first end 30110*b* of the first body 30105*a* of the lock system 30100 may be sealed via an O-ring. Any suitable O-ring may be used. For example, suitable O-rings include, but are not limited to, 300 Series O-rings. O-rings are well known in the art.

In an embodiment, the second end 30115*b* of the second body 30105*b* of the lock system 30100 (and the second end 3015*b* of the second body 3005*b*) may be adapted to receive the second lock 30100*b*. See e.g., FIG. 30F. In an embodiment, the second lock 31000*b* may extend through the second end 30115*b* of the second body 30105*b* of the lock system 30100 and engage the second body 3005*b* when the system is closed.

The second lock 30100*b* may be any suitable positive locking mechanism. For example, a suitable second lock 30100*b* includes, but is not limited to, a spring-loaded lock. In an embodiment, the second lock 30100*b* may be a spring-loaded lock. See e.g., FIG. 30F.

In an embodiment, the first end 3010*b* of the second body 3005*b* may be disposed through the second end 30115*b* of the second body 30105*b* of the lock system 30100 such that the first end 3010*b* of the second body 3005*b* is held by a second lip at or near the second end 30115*b* of the second body 30105*b* of the lock system 30100.

In an embodiment, the first end 3010*b* of the second body 3005*b* and the second end 30115*b* of the second body 30105*b* of the lock system 30100 may be sealed via an O-ring. Any suitable O-ring may be used. For example, suitable O-rings include, but are not limited to, 300 Series O-rings. O-rings are well known in the art.

In an embodiment, the second end 30115*a* of the first body 30105*a* and the first end 30110*b* of the second body 30105*b* of the lock system 30100 may be attached by a connection. Any suitable connection may be used for the second end 30115*a* of the first body 30105*a* and the first end 30110*b* of the second body 30105*b* of the lock system 30100. For example, suitable connections include, but are not limited to, pipe fittings and threads. Connections are well known in the art. In an embodiment, the first end 30110*b* of second body 30105*b* of the lock system 30100 may be threaded into the second end 30115*a* of the first body 30105*a* of the lock system 30100. In an embodiment, the second end 30115*a* of the first body 30105*a* of the lock system 30100 may be threaded into the first end 30110*b* of the second body 30105*b* of the lock system 30100.

In an embodiment, the second end 30115*a* of the first body 30105*a* and the first end 30110*b* of the second body 30105*b* of the lock system 30100 may be sealed via an O-ring. Any suitable O-ring may be used. For example, suitable O-rings include, but are not limited to, 300 Series O-rings. O-rings are well known in the art.

In an embodiment, the first body 30105*a* and the second body 30105*b* of the lock system 30100 may be constructed of any suitable material. For example, suitable materials include, but are not limited to, any alloy steel suitable for a drilling mud application. In an embodiment, the first body 30105*a* and the second body 30105*b* may be constructed of an AISI 4130/75k yield or equivalent material. See e.g., FIGS. 30A-30E. In an embodiment, the inner surface of the first body 30105*a* and the second body 30105*b* may be unpainted. In an embodiment, the outer surface of the first body 30105*a* and the second body 30105*b* may be painted.

In an embodiment, the lock system 30100 has a length 30150. The length 30150 may be any suitable length. In an embodiment, the length 30150 may be from about 8-inches to about 20-inches, and any range or value there between. In an embodiment, the length 30150 may be about 11-inches or about 12-inches.

In an embodiment, the first body 30105*a* has a first centerline 30145*a* and a first length 30150*a*. In an embodiment, the first centerline 30145*a* extends through the center of the first inlet 30120*a* to the first outlet 30125*a*. The first length 30150*a* of the first body 30105*a* may be any suitable length. In an embodiment, the first length 30150*a* of the first body 30105*a* may be from about 4-inches to about 15-inches, and any range or value there between. In an embodiment, the first length 30150*a* may be about 9-inches or about 10-inches.

In an embodiment, the first inlet 30120*a* of the first body 30105*a* may have any suitable first inner diameter 30165*a*; and the first inlet 30120*a* of the first body 30105*a* may have any suitable first outer diameter 30170*a*. In an embodiment, the first inner diameter 30065*a* of the first inlet 30020*a* may be from about 4.5-inches to about 6.5-inches (e.g., outer diameter of first body 3005*a*), and any range or value there between. In an embodiment, the first inner diameter 30165*a* of the first inlet 30120*a* may be about 5.5-inches.

In an embodiment, the first outer diameter 30170*a* of the first inlet 30020*a* may be from about 6-inches to about 8-inches, and any range or value there between. In an embodiment, the first outer diameter 30170*a* of the first inlet 30120*a* may be about 7-inches.

In an embodiment, the first body 30105*a* may have any suitable first inner diameter 30185*a*; and the first body 30105*a* may have any suitable first outer diameter 30190*a*. In an embodiment, the first inner diameter 30170*a* of the first body 30105*a* may be from about 4.5-inches to about 6-inches (e.g., outer diameter of second body 3005*b*), and any range or value there between. In an embodiment, the first inner diameter 30170*a* of the first body 30105*a* may be about 5.5-inches.

In an embodiment, the first outer diameter 30190*a* of the first body 30105*a* may be from about 6-inches to about 8-inches, and any range or value there between. In an embodiment, the first outer diameter 30090*a* of the first body 30105*a* may be about 7-inches.

In an embodiment, the first outlet 30125*a* of the first body 30105*a* may have any suitable first inner diameter 31100*a*; and the first outlet 30125*a* of the first body 30105*a* may have any suitable first outer diameter 30195*a*. In an embodiment, the first inner diameter 31100*a* of the first outlet 30125*a* may be from about 4.5-inches to about 6.5-inches (e.g., outer diameter of first body 3005*a*), and any range or value there between. In an embodiment, the first inner diameter 31100*a* of the first outlet 30125*a* may be about 5.5-inches.

In an embodiment, the second body 30105*b* has a second centerline 30145*b* and a second length 30150*b*. In an embodiment, the second centerline 30145*b* extends through the center of the second inlet 30120*b* to the second outlet 30125*b*. The second length 30150*b* of the second body 30105*b* may be any suitable length. In an embodiment, the second length 30150*b* of the second body 30105*b* may be from about 4-inches to about 10-inches, and any range or value there between. In an embodiment, the second length 30150*b* may be about 6-inches or about 7-inches.

In an embodiment, the second inlet 30120*b* of the second body 30105*b* may have any suitable second inner diameter 31100*b*; and the second inlet 30120*b* of the second body 30105*b* may have any suitable second outer diameter 30195*b*. In an embodiment, the second inner diameter 31100*b* of the second inlet 30020*b* may be from about 4.5-inches to about 6.5-inches (e.g., outer diameter of second body 3005*b*), and any range or value there between. In an embodiment, the second inner diameter 31100*b* of the second inlet 30120*b* may be about 5.5-inches.

In an embodiment, the second body 30105*b* may have any suitable second inner diameter 30185*b*; and the second body 30105*b* may have any suitable second outer diameter 30190*b*. In an embodiment, the second inner diameter 30170*b* of the second body 30105*b* may be from about 4.5-inches to about 6.5-inches (e.g., outer diameter of second body 3005*b*), and any range or value there between. In an embodiment, the second inner diameter 30170*b* of the second body 30105*b* may be about 5.5-inches.

In an embodiment, the second outer diameter 30190*b* of the second body 30105*b* may be from about 6-inches to about 8-inches, and any range or value there between. In an embodiment, the second outer diameter 30090*b* of the second body 30105*b* may be about 7-inches.

In an embodiment, the second outlet 30125*b* of the second body 30105*b* may have any suitable second inner diameter 30165*b*; and the second outlet 30125*b* of the second body 30105*b* may have any suitable second outer diameter 30170*b*. In an embodiment, the second inner diameter 30165*b* of the second outlet 30125*b* may be from about 4.5-inches to about 6.5-inches (e.g., outer diameter of second body 3005*b*), and any range or value there between. In an embodiment, the second inner diameter 30165*b* of the second outlet 30125*b* may be about 5.5-inches.

In an embodiment, the second outer diameter 30170*b* of the second outlet 30125*b* may be from about 6-inches to about 8-inches, and any range or value there between. In an embodiment, the second outer diameter 30070*b* of the second outlet 30125*b* may be about 7-inches.

Alternative Two-Piece Piston Body

Figure 33A:
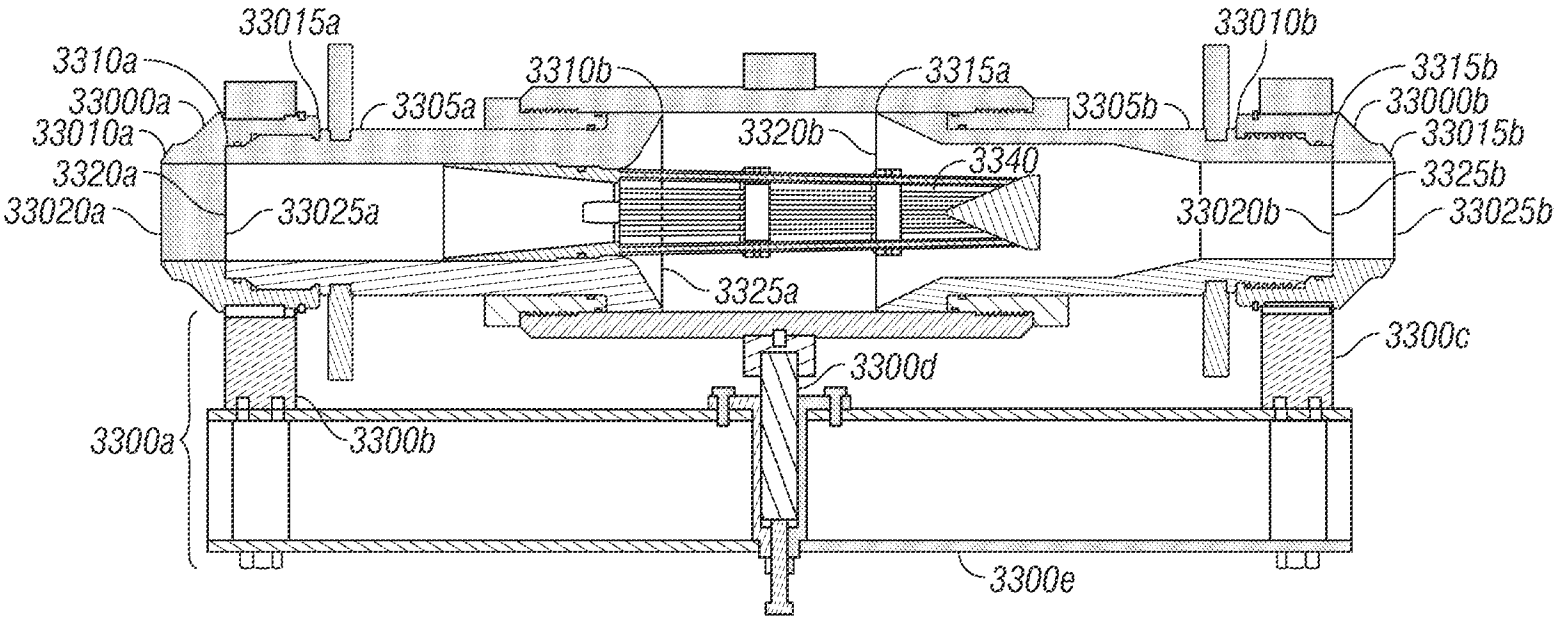
FIG. 33A illustrates a cross-sectional view of an exemplary piston-style drilling mud screen system according to an embodiment of the present invention, showing the piston-style drilling mud screen system.
Figure 33B:
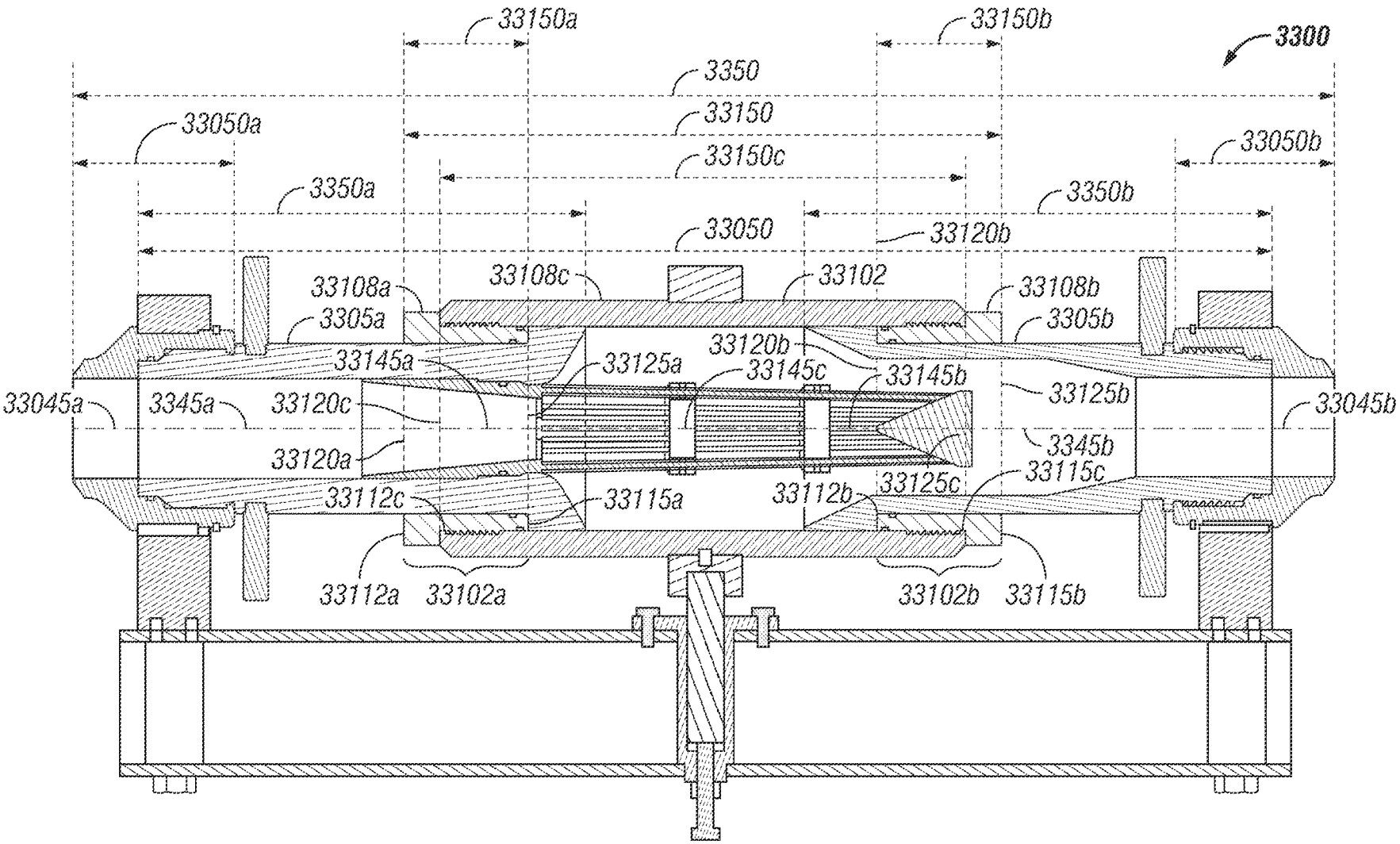
FIG. 33B illustrates a cross-sectional view of an exemplary piston-style drilling mud screen system according to an embodiment of the present invention, showing the piston-style drilling mud screen system.
Figure 33C:
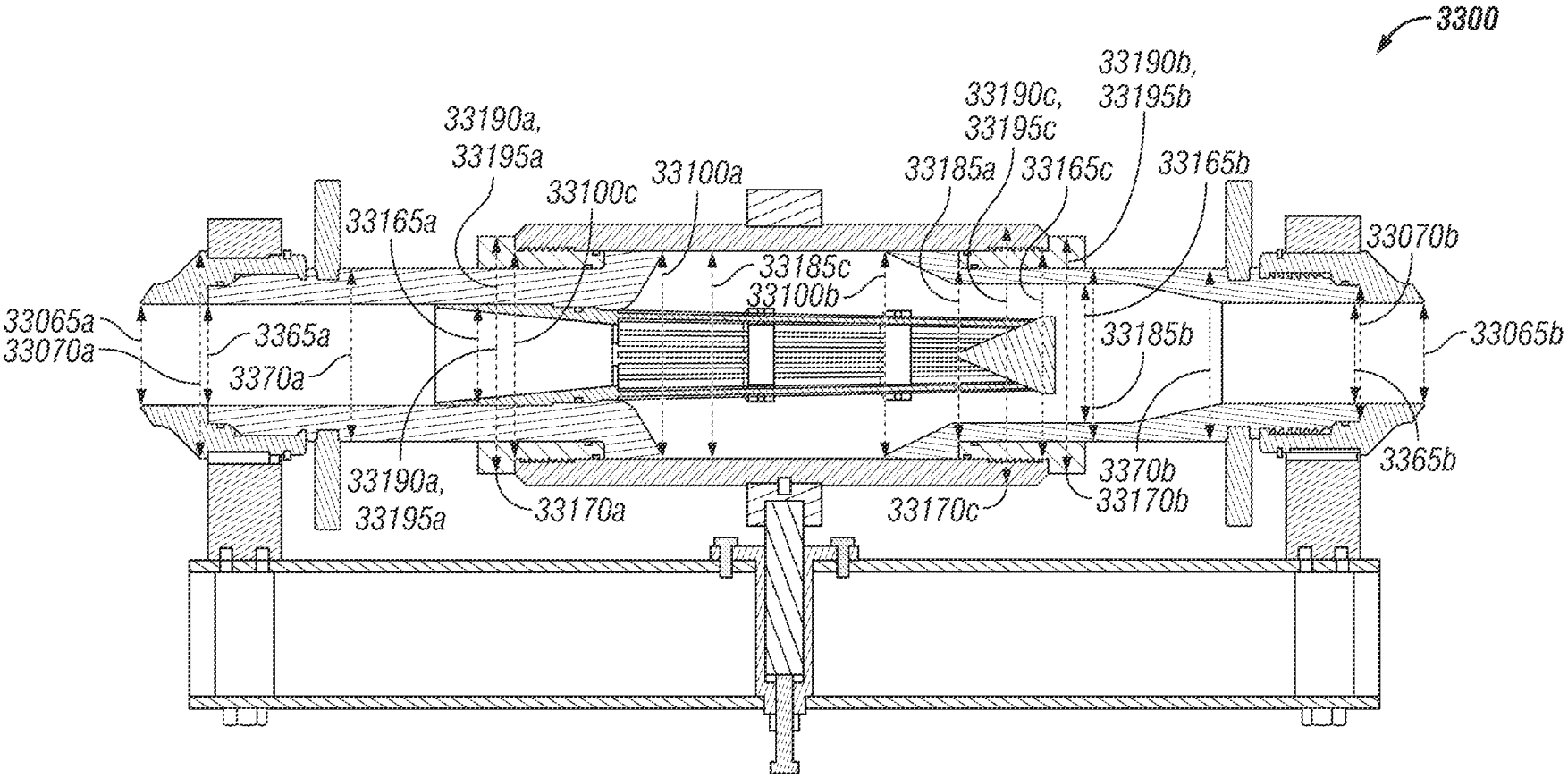
FIG. 33C illustrates a cross-sectional view of an exemplary piston-style drilling mud screen system according to an embodiment of the present invention, showing the piston-style drilling mud screen system.
Figure 34A:
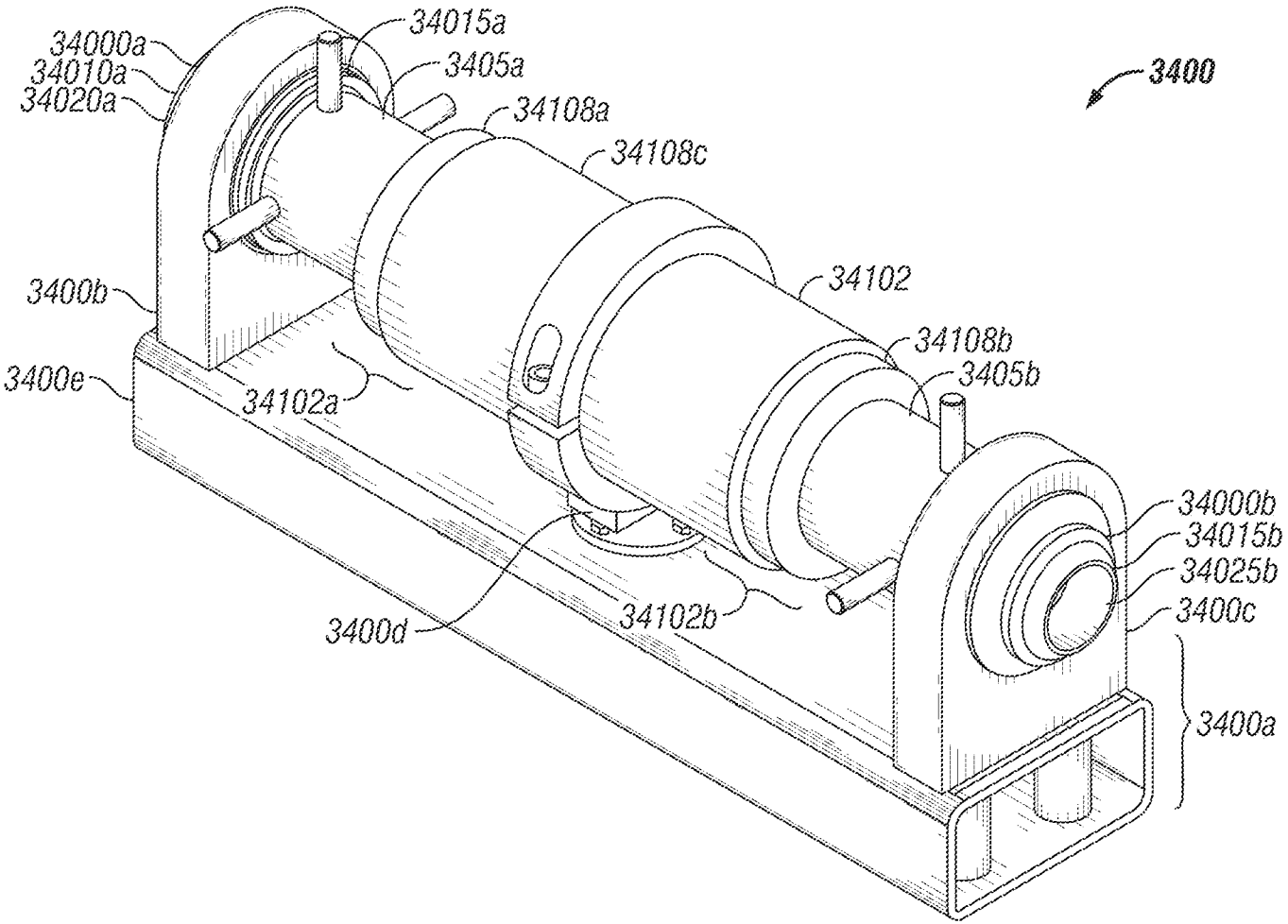
FIG. 34A illustrates an upper, right perspective view of the exemplary piston-style drilling mud screen system of FIGS. 33A-33C, showing the piston-style drilling mud screen system in a closed position.
Figure 34B:
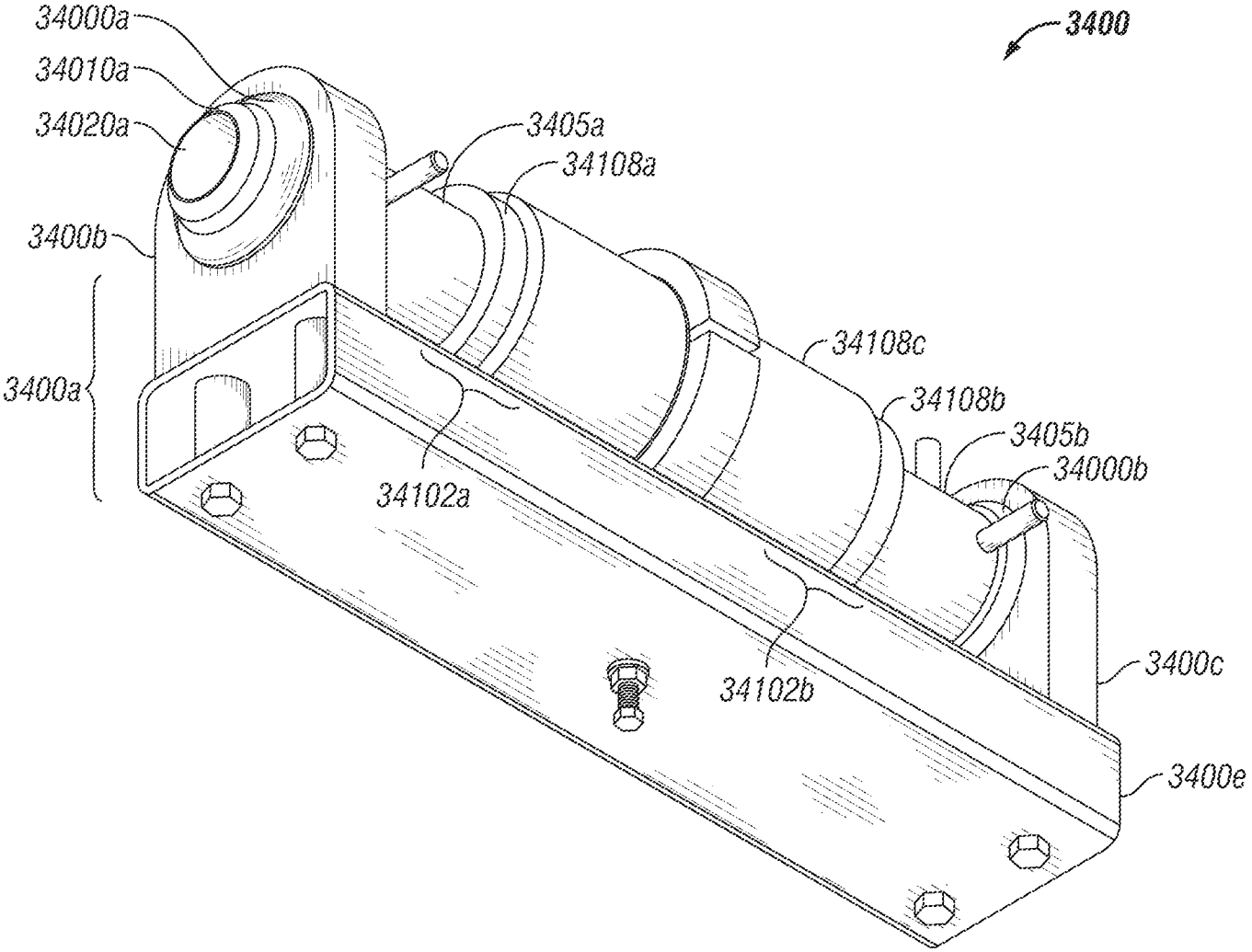
FIG. 34B illustrates a lower, left perspective view of the exemplary piston-style drilling mud screen system of FIGS. 33A-33C, showing the piston-style drilling mud screen system in a closed position.

In an embodiment, an alternative piston-style drilling mud screen system may be used to provide easier access to the drilling mud screen and to reduce the foot-print of the drilling mud screen system. This piston-style drilling mud screen system uses pipe fitting connections instead of breech-lock connections and a union system instead of a lock system FIGS. 33A-33C illustrate a cross-sectional view of an exemplary piston-style drilling mud screen system 3300 according to an embodiment of the present invention, showing an alternative two-piece piston body for the system (after installation of a drilling mud screen 3340) mounted on an alternative skid 3300*a*; FIG. 34A illustrates an upper, right perspective view of the exemplary piston-style drilling mud screen system 3400, showing the piston-style drilling mud screen system in a closed position mounted on an alternative skid 3400*a*; and FIG. 34B illustrates a lower, left perspective view of the exemplary piston-style drilling mud screen system 3400 of FIG. 34A, showing the piston-style drilling mud screen system a closed position mounted on the alternative skid 3400*a*.

Figures 1, 42A:
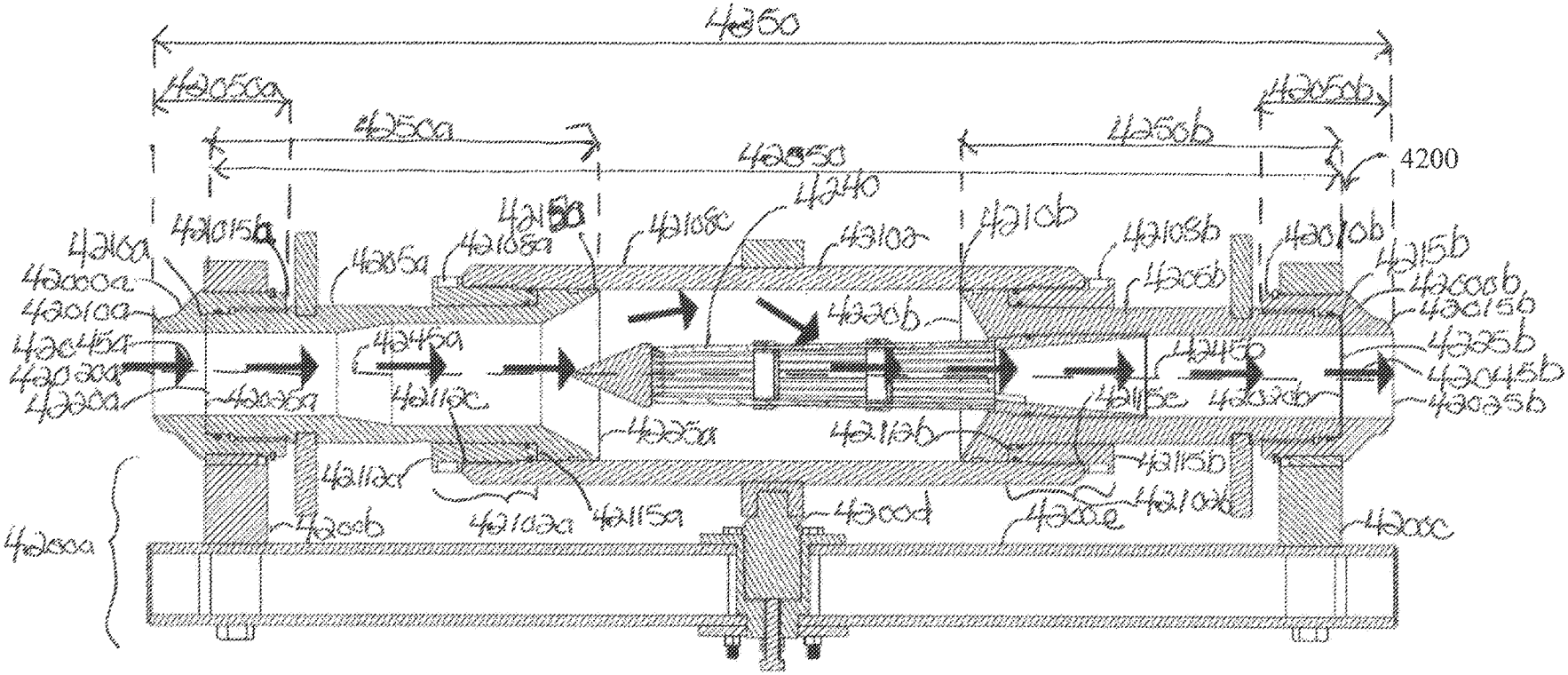
Figure 42A:
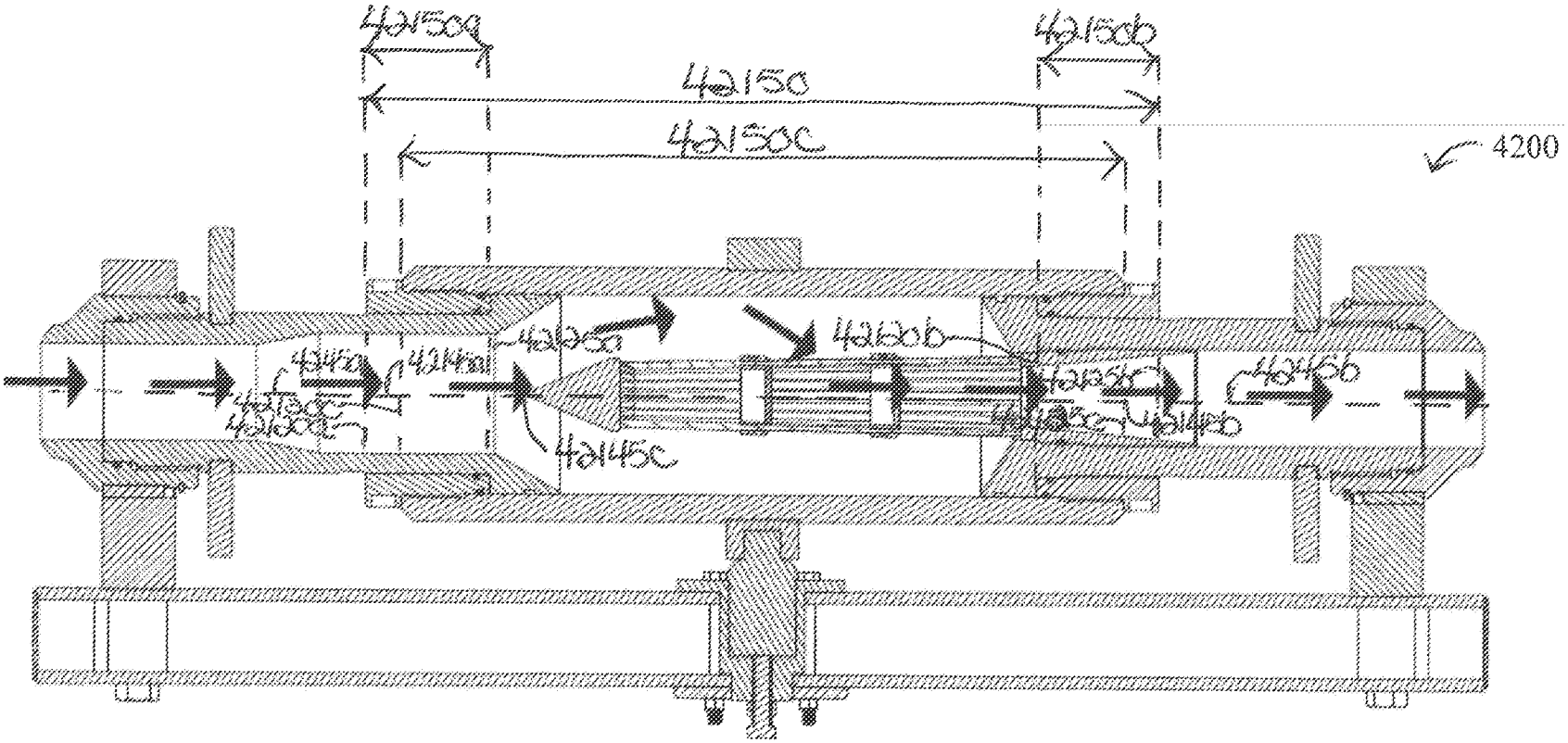

FIGS. 42A-1 and 42A-2 illustrate a cross-sectional view of an exemplary piston-style drilling mud screen system 4200 according to an embodiment of the invention, showing a reversed drilling mud screen 4240.

As shown in FIGS. 33A-33C, 34A-34B, 42A-1 and 42A-2, the piston-style drilling mud screen system 3300, 3400, 4200 comprises a first subassembly 33000*a*, 34000*a*, 42000*a*, a first body 3305*a*, 3405*a*, 4205*a*, a union system 33102, 42102 (discussed below), a second body 3305*b*, 3405*b*, 4205*b* and a second subassembly 33000*b*, 34000*b*, 42000*a*. The piston-style drilling mud screen system 3300, 3400, 4200 has a first subassembly 33000*a*, 34000*a*, 42000*a* having a first end 33010*a*, 34010*a*, 42010*a* and a second end 33015*a*, 34015*a*, 42015*a*, a first inlet 33020*a*, 34020*a*, 42020*a* of the first subassembly 33000*a*, 34000*a*, 42000*a* and a first outlet 33025*a*, 42025*a* of the first subassembly 33000*a*, 34000*a*, 42000*a*. The piston-style drilling mud screen system 3300, 3400, 4200 has a first body 3305*a*, 3405*a*, 4205*a* having a first end 3310*a*, 4210*a* and a second end 3315*a*, 4215*a*, a first drilling mud inlet 3320*a*, 4220*a* of the first body 3305*a*, 3405*a*, 4205*a* and a first drilling mud outlet 3325*a*, 3425*a*, 4225*a* of the first body 3305*a*, 3405*a*, 4205*a* (and a first drilling mud screen access port 3330*a*, 3430*a*, 4230*a* of the first body 3305*a*, 3405*a*, 4205*a*). The piston-style drilling mud screen system 3300, 3400, 4200 has a second body 3305*b*, 3405*b*, 4205*b* having a first end 3310*b*, 4210*b* and a second end 3315*b*, 4215*b*, a second drilling mud inlet 3320*b*, 4220*b* of the second body 3305*b*, 3405*b*, 4205*b* (and a second drilling mud screen access port 3330*b*, 3430*b*, 4230*b* of the second body 3305*b*, 3405*b*, 4205*b*) and a second drilling mud outlet 3325*b*, 4225*b* of the second body 3305*b*, 3405*b*, 4205*b*. The piston-style drilling mud screen system 3300, 3400, 4200 has a second subassembly 33000*b*, 34000*b*, 42000*b* having a first end 33010*b*, 34010*b*, 42010*b* and a second end 33015*b*, 34015*b*, 42015*b*, a second inlet 33020*b*, 42020*b* of the second subassembly 33000*b*, 34000*b*, 42000*b* and a second outlet 33025*b*, 34025*b*, 42025*b* of the second subassembly 33000*b*, 34000*b*, 42000*b*.

In an embodiment, the second end 3315*a*, 4215*a* of the first body 3305*a*, 3405*a*, 4205*a* may be modified to reduce inside surface exit angle to transition a first inner diameter 3365*a* of the first drilling mud outlet 3325*a*, 4225*a* of the first body 3305*a*, 3405*a*, 4205*a* to a third inner diameter 33185*c* of a third body 33108*c*, 34108*c*, 42108*c* of a union system 33102, 34102, 42102, as discussed below. In an embodiment, the exit angle may be from about 10-degrees to about 90-degrees, and any range or value there between, with respect to the first centerline 3345*a*, 4245*a* of the first body 3305*a*, 3405*a*, 4205*a*. In an embodiment, the exit angle may be about 40-degrees. See e.g., FIGS. 33A-33C, 42A-1 & 42A-2.

In an embodiment, the first end 3310*b*, 4210*b* of the second body 3305*b*, 3405*b*, 4205*b* may be modified to reduce inside surface entry angle to transition the third inner diameter 33185*c* of a third body 33108*c*, 34108*c*, 42108*c* of a union system 33102, 34102, 42102 to a second inner diameter 3365*b* of the second drilling mud inlet 3320*b*, 4220*b* of the second body 3305*b*, 3405*b*, 4205*b*, as discussed below. In an embodiment, the entry angle may be from about 10-degrees to about 90-degrees, and any range or value there between, with respect to the second centerline 3345*b*, 4245*b* of the second body 3305*b*, 3405*b*, 4205*b*. In an embodiment, the entry angle may be about 30-degrees. See e.g., FIGS. 33A-33C, 42A-1 & 42A-2.

In an embodiment, the first drilling mud inlet 33020*a*, 34020*a*, 42020*a* of the first subassembly 33000*a*, 34000*a*, 42000*a* may be fluidly connected to, for example, an outlet of a drilling mud pump via a connection; and the second drilling mud outlet 33025*b*, 34025*b*, 42025*b* of the second subassembly 33000*b*, 34000*b*, 42000*b* may be fluidly connected to an inlet of a vibrator hose via a connection. Any suitable connection may be used for the first drilling mud inlet 33020*a*, 34020*a*, 42020*a* of the first subassembly 33000*a*, 34000*a*, 42000*a* and the second drilling mud outlet 33025*b*, 34025*b*, 42025*b* of the second subassembly 33000*b*, 34000*b*, 42000*b*. For example, suitable connections include, but are not limited to, pipe fittings and welds. Connections are well known in the art. In an embodiment, the first drilling mud inlet 33020*a*, 34020*a*, 42020*a* of the first subassembly 33000*a*, 34000*a*, 42000*a* may be fluidly connected to, for example, an outlet of a drilling mud pump via a weld; and the second drilling mud outlet 33025*b*, 34025*b*, 42025*b* of the second subassembly 33000*b*, 34000*b*, 42000*b* may be fluidly connected to an inlet of a vibrator hose via a weld.

In an embodiment, the first drilling mud inlet 3320*a*, 4220*a* of the first body 3305*a*, 3405*a*, 4205*a* may be fluidly connected to the first drilling mud outlet 33025*a*, 42025*a* of the first subassembly 33000*a*, 34000*a*, 42000*a* via a connection; and the second drilling mud outlet 3325*b*, 4225*b* of the second body 3305*b*, 3405*b*, 4205*b* may be fluidly connected to the second drilling mud inlet 33020*b*, 42020*b* of the second subassembly 33000*b*, 34000*b*, 42000*b* via a connection. Any suitable connection may be used for the first drilling mud inlet 3320*a*, 4220*a* of the first body 3305*a*, 3405*a*, 4205*a* and second drilling mud outlet 3325*b*, 4225*b* of the second body 3305*b*, 3405*b*, 4205*b*. For example, suitable connections include, but are not limited to, pipe fittings and other connections. In an embodiment, the first drilling mud inlet 3320*a*, 4220*a* of the first body 3305*a*, 3405*a*, 4205*a* may be fluidly connected to, for example, a first drilling mud outlet 33025*a*, 42025*a* of a first subassembly 33000*a*, 34000*a*, 42000*a* via a pipe fitting; and the second drilling mud outlet 3325*b*, 4225*b* of the second body 3305*b*, 3405*b*, 4205*b* may be fluidly connected to a second drilling mud inlet 33020*b*, 42020*b* of the second subassembly 33000*b*, 34000*b*, 42000*b* via a pipe fitting.

In an embodiment, the first drilling mud outlet 3325*a*, 4225*a* of the first body 3305*a*, 3405*a*, 4205*a* may be fluidly connected to the second drilling mud inlet 3320*b*, 4220*b* of the second body 3305*b*, 3405*b*, 4205*b* via a union. In an embodiment, the union may be a union system 33102, 34102, 42102. In an embodiment, the first body 3305*a*, 3405*a*, 4205*a* and/or the second body 3305*b*, 3405*b*, 4205*b* may be sealed with the union system 33102, 34102, 42102 via an O-ring. Any suitable O-ring may be used. For example, suitable O-rings include, but are not limited to, 300 Series O-rings. O-rings are well known in the art.

In an embodiment, the first drilling mud outlet 3325*a*, 4225*a* of the first body 3305*a*, 3405*a*, 4205*a* may be fluidly connected to a first inlet 33125*a*, 42125*a* of a first body 33108*a*, 34108*a*, 42108*a* of the union system 33102, 34102, 42102. In an embodiment, the first body 3305*a*, 3405*a*, 4205*a* may be sealed with the union system 33102, 34102, 42102 via an O-ring. Any suitable O-ring may be used. For example, suitable O-rings include, but are not limited to, 300 Series O-rings. O-rings are well known in the art.

In an embodiment, a first outlet 33125*a*, 42125*a* of the first body 33108*a*, 34108*a*, 42108*a* of the union system 33102, 34102, 42102 may be fluidly connected to a third inlet 33120*c*, 42120*c* of a third body 33108*c*, 34108*c*, 42108*c* of the union system 33102, 34102, 42102. In an embodiment, the first body 33108*a*, 34108*a*, 42108*a* of the union system 33102, 34102, 42102 may be sealed with the third body 33108*c*, 34108*c*, 42108*c* of the union system 33102, 34102, 42102 via an O-ring. Any suitable O-ring may be used. For example, suitable O-rings include, but are not limited to, 300 Series O-rings. O-rings are well known in the art.

In an embodiment, the second outlet 33125*b*, 42125*b* of the second body 33108*b*, 34108*b*, 42108*b* of the union system 33102, 34102, 42102 may be fluidly connected to the second drilling mud inlet 3320*b*, 4220*b* of the second body 3305*b*, 3405*b*, 4205*b*. In an embodiment, the second body 3305*b*, 3405*b*, 4205*b* may be sealed with the union system 33102, 34102, 42102 via an O-ring. Any suitable O-ring may be used. For example, suitable O-rings include, but are not limited to, 300 Series O-rings. O-rings are well known in the art.

In an embodiment, the first subassembly 33000*a*, 34000*a*, 42000*a* and the second subassembly 33000*b*, 34000*b*, 42000*b* of the drilling mud screen system 3300, 3400, 4200 may be constructed of any suitable material. For example, suitable materials include, but are not limited to, any alloy steel suitable for a drilling mud application. In an embodiment, the first subassembly 33000*a*, 34000*a*, 42000*a* and the second subassembly 33000*b*, 34000*b*, 42000*b* may be constructed of an AISI 4130/75k yield or equivalent material. In an embodiment, the inner surface of the first subassembly 33000*a*, 34000*a*, 42000*a* and the second subassembly 33000*b*, 34000*b*, 42000*b* may be unpainted. In an embodiment, the outer surface of the first subassembly 33000*a*, 34000*a*, 42000*a* and the second assembly 33000*b*, 34000*b*, 42000*b* may be painted.

In an embodiment, the first body 3305*a*, 3405*a*, 4205*a* and the second body 3305*b*, 3405*b*, 4205*b* of the drilling mud screen system 3300, 3400, 4200 may be constructed of any suitable material. For example, suitable materials include, but are not limited to, any alloy steel suitable for a drilling mud application. In an embodiment, the first body 3305*a*, 3405*a*, 4205*a* and the second body 3305*b*, 3405*b*, 4205*b* may be constructed of an AISI 4130/75k yield or equivalent material. In an embodiment, the inner surface of the first body 3305*a*, 3405*a*, 4205*a* and the second body 3305*b*, 3405*b*, 4205*b* may be unpainted. In an embodiment, the outer surface of the first body 3305*a*, 3405*a*, 4205*a* and the second body 3305*b*, 3405*b*, 4205*b* may be painted.

In an embodiment, the drilling mud screen system 3300, 3400, 4200 has a length 3350, 4250. The length 3350, 4250 may be any suitable length. In an embodiment, the length 3350, 4250 may be from about 20-inches to about 100-inches, and any range or value there between. In an embodiment, the length 3350, 4250 may be about 51-inches or about 52-inches.

In an embodiment, the drilling mud screen system 3300, 3400, 4200, including a first subassembly 33000*a*, 34000*a*, 42000*a* and a second subassembly 33000*b*, 34000*b*, 42000*b*, has a length 33050, 42050. The length 33050, 42050 may be any suitable length. In an embodiment, the length 33050, 42050 may be from about 20-inches to about 100-inches, and any range or value there between. In an embodiment, the length 33050, 42050 may be about 50-inches.

In an embodiment, the first subassembly 33000*a*, 34000*a*, 42000*a* has a first centerline 33045*a*, 42045*a* and a first length 33050*a*, 42050*a*. In an embodiment, the first centerline 33045*a*, 42045*a*, 42045*a* extends through the center of the first drilling mud screen inlet 33020*a*, 34020*a*, 42020*a* of the first subassembly 33000*a*, 34000*a*, 42000*a* to the first drilling mud outlet 33025*a*, 42025*a* of the first subassembly 33000*a*, 34000*a*, 42000*a* (and the first drilling mud screen inlet 3320*a*, 4220*a* of the first body 3305*a*, 3405*a*, 4205*a*). The first length 33050*a*, 42050*a* of the first subassembly 33000*a*, 34000*a*, 42000*a* may be any suitable length. In an embodiment, the first length 33050*a*, 42050*a* of the first subassembly 33000*a*, 34000*a*, 42000*a* may be from about 4-inches to about 10-inches, and any range or value there between. In an embodiment, the first length 33050*a*, 42050*a* of the first subassembly 33000*a*, 34000*a*, 42000*a* may be about 6-inches.

In an embodiment, the first drilling mud inlet 33020*a*, 34020*a*, 42020*a* of the first subassembly 33000*a*, 34000*a*, 42000*a* may have any suitable first inner diameter 33065*a*; and the first drilling mud inlet 33020*a*, 34020*a*, 42020*a* of the first subassembly 33000*a*, 34000*a*, 42000*a* may have any suitable first outer diameter 33070*a*. In an embodiment, the first inner diameter 33065*a* of the first drilling mud inlet 33020*a*, 34020*a*, 42020*a* may be from about 3-inches to about 5-inches, and any range or value there between. In an embodiment, the first inner diameter 33065*a* of the first drilling mud inlet 33020*a*, 34020*a*, 42020*a* may be about 4-inches.

In an embodiment, the first outer diameter 33070*a* of the first drilling mud inlet 33020*a*, 34020*a*, 42020*a* may be from about 4.5-inches to about 6.5-inches, and any range or value there between. In an embodiment, the first outer diameter 33070*a* of the first drilling mud inlet 33020*a*, 34020*a*, 42020*a* may be about 5.5-inches.

In an embodiment, the second subassembly 33000*b*, 34000*b*, 42000*b* has a second centerline 33045*b*, 42045*b* and a second length 33050*b*, 42050*b*. In an embodiment, the second centerline 33045*b*, 42045*b* extends through the center of the second drilling mud screen inlet 33020*b*, 42020*b* of the second subassembly 33000*b*, 34000*b*, 42000*b* (and the second drilling mud outlet 3325*b*, 4225*b* of the second body 3305*b*, 3405*b*, 4205*b*) to the second drilling mud outlet 33020*b*, 42020*b* of the second subassembly 33000*b*, 34000*b*, 42000*b*. The second length 33050*b*, 42050*b* of the second subassembly 33000*b*, 34000*b*, 42000*b* may be any suitable length. In an embodiment, the second length 33050*b*, 42050*b* of the second subassembly 33000*b*, 34000*b*, 42000*b* may be from about 4-inches to about 10-inches, and any range or value there between. In an embodiment, the second length 33050*b*, 33050*b* of the second subassembly 33000*b*, 34000*b*, 42000*b* may be about 6-inches.

In an embodiment, the second drilling mud inlet 33020*b*, 42020*b* of the second subassembly 33000*b*, 34000*b*, 42000*b* may have any suitable second inner diameter 33065*b*; and the second drilling mud inlet 33020*b*, 42020*b* of the second subassembly 33000*b*, 34000*b*, 42000*b* may have any suitable second outer diameter 33070*b*. In an embodiment, the second inner diameter 33065*b* of the second drilling mud inlet 33020*b*, 42020*b* may be from about 3-inches to about 5-inches, and any range or value there between. In an embodiment, the second inner diameter 33065*b* of the second drilling mud inlet 33020*b*, 42020*b* may be about 4-inches.

In an embodiment, the second outer diameter 33070*b* of the second drilling mud inlet 33020*b*, 42020*b* may be from about 6-inches to about 10-inches, and any range or value there between. In an embodiment, the second outer diameter 33070*b* of the second drilling mud inlet 33020*b*, 42020*b* may be about 8-inches.

In an embodiment, the first body 3305*a*, 3405*a*, 4205*a* has a first centerline 3345*a*, 4245*a* and a first length 3350*a*, 4250*a*. In an embodiment, the first centerline 3345*a*, 4245*a* extends through the center of the first drilling mud screen inlet 3320*a*, 4220*a* to the first drilling mud outlet 3325*a*, 4225*a* (and the first drilling mud screen access port 3330*a*, 3430*a*, 4230*a*). The first length 3350*a*, 4250*a* of the first body 3305*a*, 3405*a*, 4205*a* may be any suitable length. In an embodiment, the first length 3350*a*, 4250*a* of the first body 3305*a*, 3405*a*, 4205*a* may be from about 15-inches to about 60-inches, and any range or value there between. In an embodiment, the first length 3350*a*, 4250*a* may be about 18.5-inches.

In an embodiment, the first drilling mud inlet 3320*a*, 4220*a* may have any suitable first inner diameter 3365*a*; and the first drilling mud inlet 3320*a*, 4220*a* may have any suitable first outer diameter 3370*a*. In an embodiment, the first inner diameter 3365*a* of the first drilling mud inlet 3320*a*, 4220*a* may be from about 3-inches to about 5-inches, and any range or value there between. In an embodiment, the first inner diameter 3365*a* of the first drilling mud inlet 3320*a*, 4220*a* may be about 4-inches.

In an embodiment, the first outer diameter 3370*a* of the first drilling mud inlet 3320*a*, 4220*a* may be from about 4-inches to about 10-inches, and any range or value there between. In an embodiment, the first outer diameter 3370*a* of the first drilling mud inlet 3320*a*, 4220*a* may be about 6.5-inches.

In an embodiment, the first drilling mud outlet 3325*a*, 4225*a* may have any suitable first inner diameter 3365*a*; and the first drilling mud outlet 3325*a*, 4225*a* may have any suitable first outer diameter 3370*a*. In an embodiment, the first inner diameter 3365*a* of the first drilling mud outlet 3325*a*, 4225*a* may be from about 3-inches to about 5-inches, and any range or value there between. In an embodiment, the first inner diameter 3365*a* of the first drilling mud outlet 3325*a*, 4225*a* may be about 4-inches.

In an embodiment, the first outer diameter 3370*a* of the first drilling mud outlet 3325*a*, 4225*a* may be from about 4-inches to about 10-inches, and any range or value there between. In an embodiment, the first outer diameter 3370*a* of the first drilling mud outlet 3325*a*, 4225*a* may be about 6.5-inches.

In an embodiment, the second body 3305*b*, 3405*b*, 4205*b* has a second centerline 3345*b*, 4245*b* and a second length 3350*b*, 4250*b*. In an embodiment, the second centerline 3345*b*, 4245*b* extends through the center of the second drilling mud screen access port 3330*b*, 3430*b*, 4230*b* (and the second drilling mud inlet 3320*b*, 4220*b*) to the second drilling mud outlet 3325*b*, 4225*b*. The second length 3350*b*, 4250*b* of the second body 3305*b*, 3405*b*, 4205*b* may be any suitable length. In an embodiment, the second length 3350*b*, 4250*b* of the second body 3305*b*, 3405*b*, 4205*b* may be from about 15-inches to about 60-inches, and any range or value there between. In an embodiment, the second length 3350*b*, 4250*b* may be about 18-inches or about 19-inches.

In an embodiment, the second drilling mud inlet 3320*b*, 4220*b* may have any suitable second inner diameter 3365*b*; and the second drilling mud inlet 3320*b*, 4220*b* may have any suitable second outer diameter 3370*b*. In an embodiment, the second inner diameter 3365*b* of the second drilling mud inlet 3320*b*, 4220*b* may be from about 3-inches to about 5-inches, and any range or value there between. In an embodiment, the second inner diameter 3365*b* of the second drilling mud inlet 3320*b*, 4220*b* may be about 4-inches.

In an embodiment, the second outer diameter 3370*b* of the second drilling mud inlet 3320*b*, 4220*b* may be from about 4-inches to about 10-inches, and any range or value there between. In an embodiment, the second outer diameter 3370*b* of the second drilling mud inlet 3320*b*, 4220*b* may be about 6.5-inches.

In an embodiment, the second drilling mud outlet 3325*b*, 4225*b* may have any suitable second inner diameter 3365*b*; and the second drilling mud outlet 3325*b*, 4225*b* may have any suitable second outer diameter 3370*b*. In an embodiment, the second inner diameter 3365*b* of the second drilling mud outlet 3325*b*, 4225*b* may be from about 3-inches to about 5-inches, and any range or value there between. In an embodiment, the second inner diameter 3365*b* of the second drilling mud outlet 3325*b*, 4225*b* may be about 4-inches.

In an embodiment, the second outer diameter 3370*b* of the second drilling mud outlet 3325*b*, 4225*b* may be from about 4-inches to about 10-inches, and any range or value there between. In an embodiment, the second outer diameter 3370*b* of the second drilling mud outlet 3325*b*, 4225*b* may be about 6.5-inches.

Union System

The piston-style drilling mud screen system 3300, 3400, 4200 has a union system 33102, 34102, 42102. The union system 33102, 34102, 42102 has a first body 33108*a*, 34108*a*, 42108*a* of the union system 33102, 34102, 42102 having a first end 33108*a*, 34108*a*, 42108*a* and a second end 33108*b*, 34108*b*, 42108*b*, a second body 33108*b*, 34108*b*, 42108*b* of the union system 33102, 34102, 42102 having a first end 33112*a*, 42112*a* and a second end 33115*a*, and a third body 33108*c*, 34108*c*, 42108*c* of the union system 33102, 34102, 42102 having a first end 33112*c* and a second end 33115*c*.

In an embodiment, the second end 3315*a*, 4215*a* of the first body 3305*a*, 3405*a*, 4205*a* may be disposed through the first end 33112*c*, 42112*c* of the third body 33108*c*, 34108*c*, 42108*c* of the union system 33102, 34102, 42102 such that the second end 33115*a*, 42115*a* of the first body 33108*a*, 34108*a*, 42108*a* of the union system 33102, 34102, 42102 is disposed between the second end 3315*a*, 4215*a* of the first body 3305*a*, 3405*a*, 4205*a* and the first end 33112*c*, 42112*c* of the third body 33108*c*, 34108*c*, 42108*c* of the union system 33102, 34102, 42102. See e.g., FIGS. 33A-33C & 42A-42B.

In an embodiment, the union system 33102, 34102, 42102 may have a first union 33102*a*, 34102*a*, 42102*a* and a second union 33102*b*, 34102*b*, 42102*b*.

In an embodiment, the first union 33102*a*, 34102*a*, 42102*a* may comprise the first body 33108*a*, 34108*a*, 42108*a* of the union system 33102, 34102, 42102 and a portion of the first end 33112*c*, 42112*c* of the third body 33108*c*, 34108*c*, 42108*c* of the union system 33102, 34102, 42102.

In an embodiment, the second union 33102*b*, 34102*b*, 42102*b* may comprise the second body 33108*b*, 34108*b*, 42108*b* and a portion of the second end 33115*c*, 42115*c* of the third body 33108*c*, 34108*c*, 42108*c* of the union system 33102, 34102, 42102.

In an embodiment, the second end 3315*a*, 4215*a* of the first body 3305*a*, 3405*a*, 4205*a* and the first end 33112*a*, 42112*a* and/or the second end 33115*a*, 42115*a* of the first body 33108*a*, 34108*a*, 42108*a* of the union system 33102, 34102, 42102 may be sealed via an O-ring. Any suitable O-ring may be used. For example, suitable O-rings include, but are not limited to, 300 Series O-rings. O-rings are well known in the art.

In an embodiment, the first end 3310*b*, 4210*b* of the second body 3305*b*, 3405*b*, 4205*b* may be disposed through the second end 33115*c*, 42115*c* of the third body 33108*c*, 34108*c*, 42108*c* of the union system 33102, 34102, 42102 such that the first end 33112*b*, 42112*b* of the second body 33108*b*, 34108*b*, 42108*b* of the union system 33102, 34102, 42102 is disposed between the second end 33115*c*, 42115*c* of the third body 33108*c*, 34108*c*, 42108*c* of the union system 33102, 34102, 42102 and the first end 3310*b*, 4210*b* of the second body 3305*b*, 3405*b*, 4205*b*. See e.g., FIGS. 33A-33C & 42A-42B.

In an embodiment, the first end 3310*b*, 4210*b* of the second body 3305*b*, 3405*b*, 4205*b* and the first end 33112*b*, 42112*b* and/or the second end 33115*b*, 42115*b* of the second body 33108*b*, 34108*b*, 42108*b* of the union system 33102, 34102, 42102 may be sealed via an O-ring. Any suitable O-ring may be used. For example, suitable O-rings include, but are not limited to, 300 Series O-rings. O-rings are well known in the art.

In an embodiment, the second end 33115*a*, 42115*a* of the first body 33108*a*, 34108*a*, 42108*a* and the first end 33112*c*, 42112*c* of the third body 33108*c*, 34108*c*, 42108*c* of the union system 33102, 34102, 42102 may be attached by a connection. Any suitable connection may be used for the second end 33115*a*, 42115*a* of the first body 33105*a*, 34105*a*, 42105*a* and the first end 33112*c*, 42112*c* of the third body 33108*c*, 34108*c*, 42108*c* of the union system 33102, 34102, 42102. For example, suitable connections include, but are not limited to, pipe fittings and threads. Connections are well known in the art. In an embodiment, the first end 33112*c*, 42112*c* of the third body 33108*c*, 34108*c*, 42108*c* of the union system 33102, 34102, 42102 may be threaded into the second end 33115*a*, 42115*a* of the first body 33108*a*, 34108*a*, 42108*a* of the union system 33102, 34102, 42102. In an embodiment, the second end 33115*a*, 42115*a* of the first body 33108*a*, 34108*a*, 42108*a* of the union system 33102, 34102, 42102 may be threaded into the first end 33112*c*, 42112*c* of the third body 33108*c*, 34108*c*, 42108*c* of the union system 33102, 34102, 42102.

In an embodiment, the second end 33115*a*, 42115*a* of the first body 33108*a*, 34108*a*, 42108*a* of the union system 33102, 34102, 42102 and the first end 33112*c*, 42112*c* of the third body 33108*c*, 34108*c*, 42108*c* of the union system 33102, 34102, 42102 may be sealed via an O-ring. Any suitable O-ring may be used. For example, suitable O-rings include, but are not limited to, 300 Series O-rings. O-rings are well known in the art.

In an embodiment, the first body 33108*a*, 34108*a*, 42108*a*, the second body 33108*b*, 34108*b*, 42108*b*, and the third body 33108*c*, 34108*c*, 42108*c* of the union system 33102, 34102, 42102 may be constructed of any suitable material. For example, suitable materials include, but are not limited to, any alloy steel suitable for a drilling mud application. In an embodiment, the first body 33108*a*, 34108*a*, 42108*a*, the second body 33108*b*, 34108*b*, 42108*b* and the third body 33108*c*, 34108*c*, 42108*c* may be constructed of an AISI 4130/75k yield or equivalent material. In an embodiment, the inner surface of the first body 33108*a*, 34108*a*, 42108*a*, the second body 33108*b*, 34108*b*, 42108*b* and the third body 33108*c*, 34108*c*, 42108*c* may be unpainted. In an embodiment, the outer surface of the first body 33108*a*, 34108*a*, 42108*a*, the second body 33108*b*, 34108*b*, 42108*b* and the third body 33108*c*, 34108*c*, 42108*c* may be painted.

In an embodiment, the union system 33102, 34102, 42102 has a length 33150, 42150. The length 33150, 42150 may be any suitable length. In an embodiment, the length 33150, 42150 may be from about 10-inches to about 40-inches, and any range or value there between. In an embodiment, the length 33150, 42150 may be about 24-inches or about 25-inches.

In an embodiment, the first body 33108*a*, 34108*a*, 42108*a* has a first centerline 33145*a*, 42145*a* and a first length 33150*a*, 42150*a*. In an embodiment, the first centerline 33145*a*, 42145*a* extends through the center of the first inlet 33120*a*, 42120*a* to the first outlet 33125*a*, 42125*a*. The first length 33150*a*, 42150*a* of the first body 33108*a*, 34108*a*, 42108*a* may be any suitable length. In an embodiment, the first length 33150*a*, 42150*a* of the first body 33108*a*, 34108*a*, 42108*a* may be from about 4-inches to about 15-inches, and any range or value there between. In an embodiment, the first length 33150*a*, 42150*a* may be about 5-inches or about 6-inches.

In an embodiment, the first inlet 33120*a*, 42120*a* of the first body 33108*a*, 34108*a*, 42108*a* may have any suitable first inner diameter 33165*a*; and the first inlet 33120*a*, 42120*a* of the first body 33108*a*, 34108*a*, 42108*a* may have any suitable first outer diameter 33170*a*. In an embodiment, the first inner diameter 33165*a* of the first inlet 33120*a*, 34120*a*, 42120*a* may be from about 3-inches to about 5-inches, and any range or value there between. In an embodiment, the first inner diameter 33165*a* of the first inlet 33120*a*, 42120*a* may be about 4-inches.

In an embodiment, the first outer diameter 33170*a* of the first inlet 33120*a*, 34120*a*, 42120*a* may be from about 6-inches to about 12-inches, and any range or value there between. In an embodiment, the first outer diameter 33170*a* of the first inlet 33120*a*, 34120*a*, 42120*a* may be about 9.5-inches.

In an embodiment, the first body 33108*a*, 34108*a*, 42108*a* may have any suitable first inner diameter 33185*a*; and the first body 33108*a*, 34108*a*, 42108*a* may have any suitable first outer diameter 33190*a*. In an embodiment, the first inner diameter 33185*a* of the first body 33108*a*, 34108*a*, 42108*a* may be from about 6-inches to about 12-inches, and any range or value there between. In an embodiment, the first inner diameter 33185*a* of the first body 33108*a*, 34108*a*, 42108*a* may be about 9.5-inches.

In an embodiment, the first outer diameter 33190*a* of the first body 33108*a*, 34108*a*, 42108*a* may be from about 6-inches to about 12-inches, and any range or value there between. In an embodiment, the first outer diameter 33090*a* of the first body 33108*a*, 34108*a*, 42108*a* may be about 8.5-inches.

In an embodiment, the first outlet 33125*a*, 42125*a* of the first body 33108*a*, 34108*a*, 42108*a* may have any suitable first inner diameter 33200*a*; and the first outlet 33125*a*, 42125*a* of the first body 33108*a*, 34108*a*, 42108*a* may have any suitable first outer diameter 33195*a*. In an embodiment, the first inner diameter 33200*a* of the first outlet 33125*a*, 42125*a* may be from about 4-inches to about 10-inches (e.g., outer diameter of first body 3305*a*, 3405*a*, 4205*a*), and any range or value there between. In an embodiment, the first inner diameter 33200*a* of the first outlet 33125*a*, 42125*a* may be about 8.5-inches.

In an embodiment, the second body 33108*b*, 34108*b*, 42108*b* has a second centerline 33145*b*, 42145*b* and a second length 33150*b*, 42150*b*. In an embodiment, the second centerline 33145*b*, 42145*b* extends through the center of the second inlet 33120*b*, 42120*b* to the second outlet 33125*b*, 42125*b*. The second length 33150*b*, 42150*b* of the second body 33108*b*, 34108*b*, 42108*b* may be any suitable length. In an embodiment, the second length 33150*b*, 42150*b* of the second body 33108*b*, 34108*b*, 42108*b* may be from about 4-inches to about 12-inches, and any range or value there between. In an embodiment, the second length 33150*b*, 42150*b* may be about 5-inches or about 6-inches.

In an embodiment, the second inlet 33120*b*, 42120*b* of the second body 33108*b*, 34108*b*, 42108*b* may have any suitable second inner diameter 33200*b*; and the second inlet 33120*b*, 42120*b* of the second body 33108*b*, 34108*b*, 42108*b* may have any suitable second outer diameter 33195*b*. In an embodiment, the second inner diameter 33200*b* of the second inlet 33120*b*, 42120*b* may be from about 4-inches to about 10-inches (e.g., outer diameter of second body 3305*b*, 3405*b*, 4205*b*), and any range or value there between. In an embodiment, the second inner diameter 33200*a* of the second inlet 33120*b*, 42120*b* may be about 8.5-inches.

In an embodiment, the second body 33108*b*, 34108*b*, 42108*b* may have any suitable second inner diameter 33185*b*; and the second body 33108*b*, 34108*b*, 42108*b* may have any suitable second outer diameter 33190*b*. In an embodiment, the second inner diameter 33185*b* of the second body 33108*b* may be from about 6-inches to about 12-inches, and any range or value there between. In an embodiment, the second inner diameter 33185*b* of the second body 33108*b* may be about 9.5-inches.

In an embodiment, the second outer diameter 33190*b* of the second body 33108*b*, 34108*b*, 42108*b* may be from about 6-inches to about 12-inches, and any range or value there between. In an embodiment, the second outer diameter 33190*b* of the second body 33108*b*, 34108*b*, 42108*b* may be about 9.5-inches.

In an embodiment, the second outlet 33125*b*, 42125*b* of the second body 33108*b*, 34108*b*, 42108*b* may have any suitable second inner diameter 33165*b*; and the second outlet 33125*b*, 42125*b* of the second body 33108*b*, 34108*b*, 42108*b* may have any suitable second outer diameter 33170*b*. In an embodiment, the second inner diameter 33165*b* of the second outlet 33125*b*, 42125*b* may be from about 4-inches to about 6-inches, and any range or value there between. In an embodiment, the second inner diameter 33165*b* of the second outlet 33125*b*, 42125*b* may be about 5-inches.

In an embodiment, the second outer diameter 33170*b* of the second outlet 33125*b*, 42125*b* may be from about 6-inches to about 12-inches, and any range or value there between. In an embodiment, the second outer diameter 33070*b* of the second outlet 33125*b*, 42125*b* may be about 9.5-inches.

In an embodiment, the third body 33108*c*, 34108*c*, 42108*c* has a third centerline 33145*c*, 42145*c* and a third length 33150*c*, 42150*c*. In an embodiment, the third centerline 33145*c* extends through the center of the third inlet 33120*c*, 42120*c* to the third outlet 33125*c*, 42125*c*. The third length 33150*c*, 42150*c* of the third body 33108*c*, 34108*c*, 42108*c* may be any suitable length. In an embodiment, the third length 33150*c*, 42150*c* of the third body 33108*c*, 34108*c*, 42108*c* may be from about 10-inches to about 40-inches, and any range or value there between. In an embodiment, the third length 33150*c*, 42150*c* may be about 21.5-inches.

In an embodiment, the third inlet 33120*c*, 42120*c* of the third body 33108*c*, 34108*c*, 42108*c* may have any suitable third inner diameter 33200*c*; and the third inlet 33120*c*, 42120*c* of the third body 33108*c*, 34108*c*, 42108*c* may have any suitable third outer diameter 33195*c*. In an embodiment, the third inner diameter 33200*c* of the third inlet 33120*c*, 42120*c* may be from about 6-inches to about 12-inches, and any range or value there between. In an embodiment, the third inner diameter 33200*c* of the third inlet 33120*c*, 42120*c* may be about 8.5-inches.

In an embodiment, the third body 33108*c*, 34108*c*, 42108*c* may have any suitable third inner diameter 33185*c*; and the third body 33108*c*, 34108*c*, 42108*c* may have any suitable third outer diameter 33190*c*. In an embodiment, the third inner diameter 33185*c* of the third body 33108*c*, 34108*c*, 42108*c* may be from about 6-inches to about 15-inches, and any range or value there between. In an embodiment, the third inner diameter 33185*c* of the third body 33108*c*, 34108*c*, 42108*c* may be about 10.5-inches.

In an embodiment, the third outer diameter 33190*c* of the third body 33108*c*, 34108*c*, 42108*c* may be from about 6-inches to about 15-inches, and any range or value there between. In an embodiment, the third outer diameter 33190*c* of the third body 33108*c*, 34108*c*, 42108*c* may be about 10.5-inches.

In an embodiment, the third outlet 33125*c*, 42125*c* of the third body 33108*c*, 34108*c*, 42108*c* may have any suitable third inner diameter 33165*c*; and the third outlet 33125*c*, 42125*c* of the third body 33108*c*, 34108*c*, 42108*c* may have any suitable third outer diameter 33170*c*. In an embodiment, the third inner diameter 33165*c* of the third outlet 33125*c*, 42125*c* may be from about 6-inches to about 12-inches, and any range or value there between. In an embodiment, the third inner diameter 33165*c* of the third outlet 33125*c*, 42125*c* may be about 8.5-inches.

In an embodiment, the third outer diameter 33170*c* of the third outlet 33125*c*, 42125*c* may be from about 6-inches to about 15-inches, and any range or value there between. In an embodiment, the third outer diameter 33170*c* of the third outlet 33125*c*, 42125*c* may be about 10.5-inches.

Skid

As shown in FIGS. 30A-30E, 30G and 31, the piston-style drilling mud screen system 3000 may be mounted on a skid 3000*a*. The skid 3000*a* has a first support 3000*b*, a second support 3000*c*, a third support 3000*d* and a base 3000*e*.

In an embodiment, an upper end of the first support 3000*b* may be mechanically coupled to a lower surface of the first subassembly 30000*a* via a connection and/or a coupling; and the lower end of the first support 3000*b* may be mechanically coupled to an upper surface of the base 3000*d* via a connection and/or a coupling.

In an embodiment, the first support 3000*b* may be stationary when the third support 3000*d* is pivotable and/or rotatable, raisable and/or lowerable, and any combination thereof.

In an embodiment, the first support 3000*b* may be pivotable and/or rotatable. In an embodiment, an upper end of the first support 3000*b* may be pivotable and/or rotatable. In an embodiment, a lower end of the first support 3000*b* may be rotatable.

In an embodiment, the first support 3000*b* may be raisable and/or lowerable. In an embodiment, an upper end of the first support 3000*b* may be raisable and/or lowerable. In an embodiment, a lower end of the first support 3000*b* may be raisable and/or lowerable.

Any suitable connection may be used for the first support 3000*b*. For example, suitable connections include, but are not limited to, bands, clamps, fittings and welds.

In an embodiment, an upper end of the first support 3000*b* may be attached to an outer surface of the first subassembly 30000*a* by a connection. For example, suitable connections include, but are not limited to, bands, clamps, fittings and welds. In an embodiment, an upper end of the first support 3000*b* may be attached to an outer surface of the first subassembly 30000*a* by a band or a clamp.

In an embodiment, the lower end of the first support 3000*b* may be attached to the upper surface of the skid 3000*a* (e.g., base 3000*e*) by a connection. For example, suitable connections include, but are not limited to, bands, clamps, fittings and welds. In an embodiment, the lower end of the first support 3000*b* may be attached to the upper surface of the skid 3000*a* (e.g., base 3000*e*) by fittings or welds.

Any suitable coupling may be used for the first support 3000*b*. For example, suitable couplings include, but are not limited to bearings, hinges, pivots, sockets, and combinations thereof. In an embodiment, the coupling for the first support 3000*b* may be a bearing. In an embodiment, the coupling for the first support 3000*b* may be a box channel with a pivot pin.

In an embodiment, the first support 3000*b* may have a coupling at or near an upper end. For example, suitable couplings include, but are not limited to bearings, hinges, pivots, sockets, and combinations thereof. In an embodiment, the first support 3000*b* may have a bearing or a socket at or near an upper end. In an embodiment, the first support 3000*b* may have a hinge or a pivot at or near an upper end.

In an embodiment, the first support 3000*b* may have a coupling at or near a lower end. For example, suitable couplings include, but are not limited to bearings, hinges, pivots, sockets, and combinations thereof. In an embodiment, the first support 3000*b* may have a bearing or a socket at or near a lower end. In an embodiment, the first support 3000*b* may have a hinge or a pivot at or near a lower end.

In an embodiment, the first support 3000*b* may pivot and/or rotate automatically and/or manually. In an embodiment, the first support 3000*b* may pivot and/or rotate electromechanically, hydraulically, mechanically (e.g., geared) or pneumatically. In an embodiment, the first support 3000*b* may pivot and/or rotate manually.

Any suitable extension may be used for the first support 3000*b*. For example, suitable extensions include, but are not limited to articulated arms, extendable pistons, telescoping pipes, and combinations thereof. In an embodiment, the extension for the first support 3000*b* may be an extendable piston. In an embodiment, the extension for the first support 3000*b* may be a telescoping pipe with a clevis pin.

In an embodiment, the first support 3000*b* may have an extension at or near an upper end. For example, suitable extensions include, but are not limited to articulated arms, extendable pistons, telescoping pipes, and combinations thereof. In an embodiment, the first support 3000*b* may have an extendable arm at or near an upper end. In an embodiment, the first support 3000*b* may have a telescoping pipe with a clevis pin at or near an upper end.

In an embodiment, the first support 3000*b* may have an extension at or near a lower end. For example, suitable extensions include, but are not limited to articulated arms, extendable pistons, telescoping pipes, and combinations thereof. In an embodiment, the first support 3000*b* may have an extendable piston at or near a lower end. In an embodiment, the first support 3000*b* may have a telescoping pipe with a clevis pin at or near a lower end.

In an embodiment, the first support 3000*b* may raise and/or lower automatically and/or manually. In an embodiment, the first support 3000*b* may raise and/or lower electro-mechanically, hydraulically, mechanically (e.g., geared) or pneumatically. In an embodiment, the first support 3000*b* may raise and/or lower manually.

In an embodiment, an upper end of the second stationary support 3000*c* may be mechanically coupled to a lower surface of the second subassembly 30000*b*; and the lower end of the second stationary support 3000*c* may be mechanically coupled to an upper surface of the base 3000*e*.

In an embodiment, the second support 3000*c* may be stationary when the third support 3000*d* is pivotable and/or rotatable, raisable and/or lowerable, and any combination thereof.

In an embodiment, the second support 3000*c* may be pivotable and/or rotatable. In an embodiment, an upper end of the second support 3000*c* may be pivotable and/or rotatable. In an embodiment, a lower end of the second support 3000*c* may be rotatable.

In an embodiment, the second support 3000*c* may be raisable and/or lowerable. In an embodiment, an upper end of the second support 3000*c* may be raisable and/or lowerable. In an embodiment, a lower end of the second support 3000*c* may be raisable and/or lowerable.

Any suitable connection may be used for the second support 3000*c*. For example, suitable connections include, but are not limited to, fittings and welds. Connections are well known in the art.

In an embodiment, an upper end of the second support 3000*c* may be attached to an outer surface of the second subassembly 30000*b* by a connection. For example, suitable connections include, but are not limited to, bands, clamps, fittings and welds. In an embodiment, an upper end of the second support 3000*c* may be attached to an outer surface of the second subassembly 30000*b* by a band or a clamp.

In an embodiment, the lower end of the second support 3000*c* may be attached to the upper surface of the skid 3000*a* (e.g., base 3000*e*) by a connection. For example, suitable connections include, but are not limited to, bands, clamps, fittings and welds. In an embodiment, the lower end of the second support 3000*c* may be attached to the upper surface of the skid 3000*a* (e.g., base 3000*e*) by a connection. In an embodiment, the lower end of the second support 3000*c* may be attached to the upper surface of the skid 3000*a* (e.g., base 3000*e*) by fittings or welds.

Any suitable coupling may be used for the second support 3000*c*. For example, suitable couplings include, but are not limited to bearings, hinges, pivots, sockets, and combinations thereof. In an embodiment, the coupling for the second support 3000*c* may be a bearing. In an embodiment, the coupling for the second support 3000*c* may be a box channel with a pivot pin.

In an embodiment, the second support 3000*c* may have a coupling at or near an upper end. For example, suitable couplings include, but are not limited to bearings, hinges, pivots, sockets, and combinations thereof. In an embodiment, the second support 3000*c* may have a bearing or a socket at or near an upper end. In an embodiment, the second support 3000*c* may have a hinge or a pivot at or near an upper end.

In an embodiment, the second support 3000*c* may have a coupling at or near a lower end. For example, suitable couplings include, but are not limited to bearings, hinges, pivots, sockets, and combinations thereof. In an embodiment, the second support 3000*c* may have a bearing or a socket at or near a lower end. In an embodiment, the second support 3000*c* may have a hinge or a pivot at or near a lower end.

In an embodiment, the second support 3000*c* may pivot and/or rotate automatically and/or manually. In an embodiment, the second support 3000*c* may pivot and/or rotate electro-mechanically, hydraulically, mechanically (e.g., geared) or pneumatically. In an embodiment, the second support 3000*c* may pivot and/or rotate manually.

Any suitable extension may be used for the second support 3000*c*. For example, suitable extensions include, but are not limited to articulated arms, extendable pistons, telescoping pipes, and combinations thereof. In an embodiment, the extension for the second support 3000*c* may be an extendable piston. In an embodiment, the coupling for the second support 3000*c* may be a telescoping pipe with a clevis pin.

In an embodiment, the second support 3000*c* may have an extension at or near an upper end. For example, suitable extensions include, but are not limited to articulated arms, extendable pistons, telescoping pipes, and combinations thereof. In an embodiment, the second support 3000*c* may have an extendable arm at or near an upper end. In an embodiment, the second support 3000*c* may have a telescoping pipe with a clevis pin at or near an upper end.

In an embodiment, the second support 3000*c* may have an extension at or near a lower end. For example, suitable extensions include, but are not limited to articulated arms, extendable pistons, telescoping pipes, and combinations thereof. In an embodiment, the second support 3000*c* may have an extendable piston at or near a lower end. In an embodiment, the second support 3000*c* may have a telescoping pipe with a clevis pin at or near a lower end.

In an embodiment, the second support 3000*c* may raise and/or lower automatically and/or manually. In an embodiment, the second support 3000*c* may raise and/or lower electro-mechanically, hydraulically, mechanically (e.g., geared) or pneumatically. In an embodiment, the second support 3000*c* may raise and/or lower manually.

In an embodiment, an upper end of the third support 3000*d* may be mechanically coupled to a lower surface of the lock system 30100 (e.g., a first body 30105*a* of the lock system 30100); and the lower end of the third support 3000*d* may be mechanically coupled to an upper surface of the base 3000*e*.

In an embodiment, the third support 3000*d* may be stationary when the first support 3000*b* and/or the second support 3000*c* are pivotable and/or rotatable, raisable and/or lowerable, and any combination thereof.

In an embodiment, the third support 3000*d* may be pivotable and/or rotatable. In an embodiment, an upper end of the third support 3000*d* may be pivotable and/or rotatable. In an embodiment, the lower end of the third support 3000*d* may be rotatable or stationary.

In an embodiment, the third support 3000*d* may be raisable and/or lowerable. In an embodiment, an upper end of the third support 3000*d* may be raisable and/or lowerable. In an embodiment, a lower end of the third support 3000*d* may be raisable and/or lowerable.

Any suitable connection may be used for the third support 3000*d*. For example, suitable connections include, but are not limited to, fittings and welds. Connections are well known in the art.

In an embodiment, an upper end of the third support 3000*d* may be attached to an outer surface of the lock system 30100 by a connection. For example, suitable connections include, but are not limited to, bands, clamps, fittings and welds. In an embodiment, an upper end of the third support 3000*d* may be attached to an outer surface of the lock system 30100 by a band or a clamp.

In an embodiment, the lower end of the third support 3000*d* may be attached to the upper surface of the skid 3000*a* (e.g., base 3000*e*) by a connection. For example, suitable connections include, but are not limited to, bands, clamps, fittings and welds. In an embodiment, the lower end of the third support 3000*d* may be attached to the upper surface of the skid 3000*a* (e.g., base 3000*e*) by a connection. In an embodiment, the lower end of the third support 3000*d* may be attached to the upper surface of the skid 3000*a* (e.g., base 3000*e*) by fittings or welds.

Any suitable coupling may be used for the third support 3000*d*. For example, suitable couplings include, but are not limited to bearings, hinges, pivots, sockets, and combinations thereof. In an embodiment, the coupling for the third support 3000*d* may be a bearing. In an embodiment, the coupling for the third support 3000*d* may be a box channel with a pivot pin.

In an embodiment, the third support 3000*d* may have a coupling at or near an upper end. For example, suitable couplings include, but are not limited to bearings, hinges, pivots, sockets, and combinations thereof. In an embodiment, the third support 3000*d* may have a bearing or a socket at or near an upper end. In an embodiment, the third support 3000*d* may have a hinge or a pivot at or near an upper end.

In an embodiment, the third support 3000*d* may have a coupling at or near a lower end. For example, suitable couplings include, but are not limited to bearings, hinges, pivots, sockets, and combinations thereof. In an embodiment, the third support 3000*d* may have a bearing or a socket at or near a lower end. In an embodiment, the third support 3000*d* may have a hinge or a pivot at or near a lower end.

In an embodiment, the third support 3000*d* may pivot and/or rotate automatically and/or manually. In an embodiment, the third support 3000*d* may pivot and/or rotate electro-mechanically, hydraulically, mechanically (e.g., geared) or pneumatically. In an embodiment, the third support 3000*d* may pivot and/or rotate manually.

Any suitable extension may be used for the third support 3000*d*. For example, suitable extensions include, but are not limited to articulated arms, extendable pistons, telescoping pipes, and combinations thereof. In an embodiment, the extension for the third support 3000*d* may be an extendable piston. In an embodiment, the extension for the third support 3000*d* may be a telescoping pipe with a clevis pin.

In an embodiment, the third support 3000*d* may have an extension at or near an upper end. For example, suitable extensions include, but are not limited to articulated arms, extendable pistons, telescoping pipes, and combinations thereof. In an embodiment, the third support 3000*d* may have an extendable arm at or near an upper end. In an embodiment, the third support 3000*d* may have a telescoping pipe with a clevis pin at or near an upper end.

In an embodiment, the third support 3000*d* may have an extension at or near a lower end. For example, suitable extensions include, but are not limited to articulated arms, extendable pistons, telescoping pipes, and combinations thereof. In an embodiment, the third support 3000*d* may have an extendable piston at or near a lower end. In an embodiment, the third support 3000*d* may have a telescoping pipe with a clevis pin at or near a lower end.

In an embodiment, the third support 3000*d* may raise and/or lower automatically and/or manually. In an embodiment, the third support 3000*d* may raise and/or lower electro-mechanically, hydraulically, mechanically (e.g., geared) or pneumatically. In an embodiment, the third support 3000*d* may raise and/or lower manually.

In an embodiment, the first support 3000*b*, the second support 3000*c* and/or the third support 3000*d* of the skid 3000*a* of the drilling mud screen system 3000 may be constructed of any suitable material. For example, suitable materials include, but are not limited to, any alloy steel suitable for a drilling mud application. In an embodiment, the first support 3000*b*, the second support 3000*c*, and/or the third support 3000*d* of the skid 3000*a* may be constructed of an alloy steel or equivalent material. See e.g., FIGS. 30A-30E. In an embodiment, the first support 3000*b*, the second support 3000*c*, and/or the third support 3000*d* of the skid 3000*a* may be constructed of a 304 stainless steel material. In an embodiment, the first support 3000*b*, the second support 3000*c*, and/or the third support 3000*d* of the skid 3000*a* may be unpainted. In an embodiment, the first support 3000*b*, the second support 3000*c*, and/or the third support 3000*d* of the skid 3000*a* may be painted.

In an embodiment, the base 3000*e* of the skid 3000*a* of the drilling mud screen system 3000 may be constructed of any suitable material. For example, suitable materials include, but are not limited to, a concrete, a polymer, and any alloy steel suitable for a drilling mud application. In an embodiment, the base 3000*e* may be constructed of a concrete. In an embodiment, the base 3000*e* may be constructed of a polymer. In an embodiment, the base 3000*e* of the skid 3000*a* may be constructed of an alloy steel or equivalent material. See e.g., FIGS. 30A-30E. In an embodiment, the base 3000*e* of the skid 3000*a* may be constructed of a 304 stainless steel material. In an embodiment, the base 3000*e* of the skid 3000*a* may be unpainted. In an embodiment, the base 3000*e* of the skid 3000*a* may be painted.

Alternative Skid

As shown in FIGS. 33A-33C, 34A-34B, 42A-1 and 42A-2, the piston-style drilling mud screen system 3300, 3400, 4200 may be mounted on a skid 3300*a*, 3400*a*, 4200*a*. The skid 3300*a*, 3400*a*, 4200*a* has a first support 3300*b*, 3400*b*, 4200*b*, a second support 3300*c*, 3400*c*, 4200*c*, a third support 3300*d*, 3400*d*, 4200*d* and a base or frame 3300*e*, 3300*e*, 4200*e*.

In an embodiment, an upper end of the first support 3300*b*, 3400*b*, 4200*b* may be mechanically coupled to a lower surface of the first subassembly 33000*a*, 34000*a*, 42000*a* via a connection and/or a coupling; and the lower end of the first support 3300*b*, 3400*b*, 4200*b* may be mechanically coupled to an upper surface of the base or frame 3300*e*, 3400*e*, 4200*e* via a connection and/or a coupling.

In an embodiment, the first support 3300*b*, 3400*b*, 4200*b* may be stationary when the third support 3300*d*, 3400*d*, 4200*d* is pivotable and/or rotatable, raisable and/or lowerable, and any combination thereof.

In an embodiment, the first support 3300*b*, 3400*b*, 4200*b* may be pivotable and/or rotatable. In an embodiment, an upper end of the first support 3300*b*, 3400*b*, 4200*b* may be pivotable and/or rotatable. In an embodiment, a lower end of the first support 3300*b*, 3400*b*, 4200*b* may be rotatable.

In an embodiment, the first support 3300*b*, 3400*b*, 4200*b* may be raisable and/or lowerable. In an embodiment, an upper end of the first support 3300*b*, 3400*b*, 4200*b* may be raisable and/or lowerable. In an embodiment, a lower end of the first support 3300*b*, 3400*b*, 4200*b* may be raisable and/or lowerable.

Any suitable connection may be used for the first support 3300*b*, 3400*b*, 4200*b*. For example, suitable connections include, but are not limited to, bands, clamps, fittings and welds.

In an embodiment, an upper end of the first support 3300*b*, 3400*b*, 4200*b* may be attached to an outer surface of the first subassembly 33000*a*, 34000*a*, 42000*a* by a connection. For example, suitable connections include, but are not limited to, bands, clamps, fittings, saddles and welds. In an embodiment, an upper end of the first support 3300*b*, 3400*b*, 4200*b* may be attached to an outer surface of the first subassembly 33000*a*, 34000*a*, 42000*a* by a band, a clamp and/or a saddle.

In an embodiment, the lower end of the first support 3300*b*, 3400*b*, 4200*b* may be attached to the upper surface of the skid 3300*a*, 3400*a*, 4200*a* (base or frame 3300*e*, 3400*e*, 4200*e*) by a connection. For example, suitable connections include, but are not limited to, bands, clamps, fittings and welds. In an embodiment, the lower end of the first support 3300*b*, 3400*b*, 4200*b* may be attached to the upper surface of the skid 3300*a*, 3400*a*, 4200*a* (base or frame 3300*e*, 3400*e*, 4200*e*) by a connection. In an embodiment, the lower end of the first support 3300*b*, 3400*b*, 4200*b* may be attached to the upper surface of the skid 3300*a*, 3400*a*, 4200*a* (base or frame 3300*e*, 3400*e*, 4200*e*) by fittings or welds.

Any suitable coupling may be used for the first support 3300*b*, 3400*b*, 4200*b*. For example, suitable couplings include, but are not limited to bearings, hinges, pivots, sockets, and combinations thereof. In an embodiment, the coupling for the first support 3300*b*, 3400*b*, 4200*b* may be a bearing. In an embodiment, the coupling for the first support 3300*b*, 3400*b*, 4200*b* may be a box channel with a pivot pin.

In an embodiment, the first support 3300*b*, 3400*b*, 4200*b* may have a coupling at or near an upper end. For example, suitable couplings include, but are not limited to bearings, hinges, pivots, sockets, and combinations thereof. In an embodiment, the first support 3300*b*, 3400*b*, 4200*b* may have a bearing or a socket at or near an upper end. In an embodiment, the first support 3300*b*, 3400*b*, 4200*b* may have a hinge or a pivot at or near an upper end.

In an embodiment, the first support 3300*b*, 3400*b*, 4200*b* may have a coupling at or near a lower end. For example, suitable couplings include, but are not limited to bearings, hinges, pivots, sockets, and combinations thereof. In an embodiment, the first support 3300*b*, 3400*b*, 4200*b* may have a bearing or a socket at or near a lower end. In an embodiment, the first support 3300*b*, 3400*b*, 4200*b* may have a hinge or a pivot at or near a lower end.

In an embodiment, the first support 3300*b*, 3400*b*, 4200*b* may pivot and/or rotate automatically and/or manually. In an embodiment, the first support 3300*b*, 3400*b*, 4200*b* may pivot and/or rotate electro-mechanically, hydraulically, mechanically (e.g., geared) or pneumatically. In an embodiment, the first support 3300*b*, 3400*b*, 4200*b* may pivot and/or rotate manually.

Any suitable extension may be used for the first support 3300*b*, 3400*b*, 4200*b*. For example, suitable extensions include, but are not limited to articulated arms, extendable pistons, telescoping pipes, and combinations thereof. In an embodiment, the extension for the first support 3300*b*, 3400*b*, 4200*b* may be an extendable piston. In an embodiment, the extension for the first support 3300*b*, 3400*b*, 4200*b* may be a telescoping pipe with a clevis pin.

In an embodiment, the first support 3300*b*, 3400*b*, 4200*b* may have an extension at or near an upper end. For example, suitable extensions include, but are not limited to articulated arms, extendable pistons, telescoping pipes, and combinations thereof. In an embodiment, the first support 3300*b*, 3400*b*, 4200*b* may have an extendable arm at or near an upper end. In an embodiment, the first support 3300*b*, 3400*b*, 4200*b* may have a telescoping pipe with a clevis pin at or near an upper end.

In an embodiment, the first support 3300*b*, 3400*b*, 4200*b* may have an extension at or near a lower end. For example, suitable extensions include, but are not limited to articulated arms, extendable pistons, telescoping pipes, and combinations thereof. In an embodiment, the first support 3300*b*, 3400*b*, 4200*b* may have an extendable piston at or near a lower end. In an embodiment, the first support 3300*b*, 3400*b*, 4200*b* may have a telescoping pipe with a clevis pin at or near a lower end.

In an embodiment, the first support 3300*b*, 3400*b*, 4200*b* may raise and/or lower automatically and/or manually. In an embodiment, the first support 3300*b*, 3400*b*, 4200*b* may raise and/or lower electro-mechanically, hydraulically, mechanically (e.g., geared) or pneumatically. In an embodiment, the first support 3300*b*, 3400*b*, 4200*b* may raise and/or lower manually.

In an embodiment, an upper end of the second stationary support 3300*c*, 3400*c*, 4200*c* may be mechanically coupled to a lower surface of the second subassembly 33000*b*, 34000*b*, 42000*b*; and the lower end of the second stationary support 3300*c*, 3400*c*, 4200*c* may be mechanically coupled to an upper surface of the base or frame 3300*e*, 3400*e*, 4200*e*.

In an embodiment, the second support 3300*c*, 3400*c*, 4200*c* may be stationary when the third support 3300*d*, 3400*d*, 4200*d* is pivotable and/or rotatable, raisable and/or lowerable, and any combination thereof.

In an embodiment, the second support 3300*c*, 3400*c*, 4200*c* may be pivotable and/or rotatable. In an embodiment, an upper end of the second support 3300*c*, 3400*c*, 4200*c* may be pivotable and/or rotatable. In an embodiment, a lower end of the second support 3300*c*, 3400*c*, 4200*c* may be rotatable.

In an embodiment, the second support 3300*c*, 3400*c*, 4200*c* may be raisable and/or lowerable. In an embodiment, an upper end of the second support 3300*c*, 3400*c*, 4200*c* may be raisable and/or lowerable. In an embodiment, a lower end of the second support 3300*c*, 3400*c*, 4200*c* may be raisable and/or lowerable.

Any suitable connection may be used for the second support 3300*c*, 3400*c*, 4200*c*. For example, suitable connections include, but are not limited to, fittings and welds. Connections are well known in the art.

In an embodiment, an upper end of the second support 3300*c*, 3400*c*, 4200*c* may be attached to an outer surface of the second subassembly 33000*b*, 34000*b*, 42000*b* by a connection. For example, suitable connections include, but are not limited to, bands, clamps, fittings, saddles and welds. In an embodiment, an upper end of the second support 3300*c*, 3400*c*, 4200*c* may be attached to an outer surface of the second subassembly 33000*b*, 34000*b*, 42000*b* by a band, a clamp and/or a saddle.

In an embodiment, the lower end of the second support 3300*c*, 3400*c*, 4200*c* may be attached to the upper surface of the skid 3300*a*, 3400*a*, 4200*a* (base or frame 3300*e*, 3400*e*, 4200*e*) by a connection. For example, suitable connections include, but are not limited to, bands, clamps, fittings and welds. In an embodiment, the lower end of the second support 3300*c*, 3400*c*, 4200*c* may be attached to the upper surface of the skid 3300*a*, 3400*a*, 4200*a* (base or frame 3300*e*, 3400*e*, 4200*e*) by a connection. In an embodiment, the lower end of the second support 3300*c*, 3400*c*, 4200*c* may be attached to the upper surface of the skid 3300*a*, 3400*a*, 4200*a* (base or frame 3300*e*, 3400*e*, 4200*e*) by fittings or welds.

Any suitable coupling may be used for the second support 3300*c*, 3400*c*, 4200*c*. For example, suitable couplings include, but are not limited to bearings, hinges, pivots, sockets, and combinations thereof. In an embodiment, the coupling for the second support 3300*c*, 3400*c*, 4200*c* may be a bearing. In an embodiment, the coupling for the second support 3300*c*, 3400*c*, 4200*c* may be a box channel with a pivot pin.

In an embodiment, the second support 3300*c*, 3400*c*, 4200*c* may have a coupling at or near an upper end. For example, suitable couplings include, but are not limited to bearings, hinges, pivots, sockets, and combinations thereof. In an embodiment, the second support 3300*c*, 3400*c*, 4200*c* may have a bearing or a socket at or near an upper end. In an embodiment, the second support 3300*c*, 3400*c*, 4200*c* may have a hinge or a pivot at or near an upper end.

In an embodiment, the second support 3300*c*, 3400*c*, 4200*c* may have a coupling at or near a lower end. For example, suitable couplings include, but are not limited to bearings, hinges, pivots, sockets, and combinations thereof. In an embodiment, the second support 3300*c*, 3400*c*, 4200*c* may have a bearing or a socket at or near a lower end. In an embodiment, the second support 3300*c*, 3400*c*, 4200*c* may have a hinge or a pivot at or near a lower end.

In an embodiment, the second support 3300*c*, 3400*c*, 4200*c* may pivot and/or rotate automatically and/or manually. In an embodiment, the second support 3300*c*, 3400*c*, 4200*c* may pivot and/or rotate electro-mechanically, hydraulically, mechanically (e.g., geared) or pneumatically. In an embodiment, the second support 3300*c*, 3400*c*, 4200*c* may pivot and/or rotate manually.

Any suitable extension may be used for the second support 3300*c*, 3400*c*, 4200*c*. For example, suitable extensions include, but are not limited to articulated arms, extendable pistons, telescoping pipes, and combinations thereof. In an embodiment, the extension for the second support 3300*c*, 3400*c*, 4200*c* may be an extendable piston. In an embodiment, the coupling for the second support 3300*c*, 3400*c*, 4200*c* may be a telescoping pipe with a clevis pin.

In an embodiment, the second support 3300*c*, 3400*c*, 4200*c* may have an extension at or near an upper end. For example, suitable extensions include, but are not limited to articulated arms, extendable pistons, telescoping pipes, and combinations thereof. In an embodiment, the second support 3300*c*, 3400*c*, 4200*c* may have an extendable arm at or near an upper end. In an embodiment, the second support 3300*c*, 3400*c*, 4200*c* may have a telescoping pipe with a clevis pin at or near an upper end.

In an embodiment, the second support 3300*c*, 3400*c*, 4200*c* may have an extension at or near a lower end. For example, suitable extensions include, but are not limited to articulated arms, extendable pistons, telescoping pipes, and combinations thereof. In an embodiment, the second support 3300*c*, 3400*c*, 4200*c* may have an extendable piston at or near a lower end. In an embodiment, the second support 3300*c*, 3400*c*, 4200*c* may have a telescoping pipe with a clevis pin at or near a lower end.

In an embodiment, the second support 3300*c*, 3400*c*, 4200*c* may raise and/or lower automatically and/or manually. In an embodiment, the second support 3300*c*, 3400*c*, 4200*c* may raise and/or lower electro-mechanically, hydraulically, mechanically (e.g., geared) or pneumatically. In an embodiment, the second support 3300*c*, 3400*c*, 4200*c* may raise and/or lower manually.

In an embodiment, an upper end of the third support 3300*d*, 3400*d*, 4200*d* may be mechanically coupled to a lower surface of the union system 33102, 34102, 42102 (e.g., a third body 33108*c*, 34108*c*, 42108*c* of the union system 33102, 34102, 42102); and the lower end of the third support 3300*d*, 3400*d*, 4200*d* may be mechanically coupled to an upper surface of the base or frame 3300*e*, 3400*e*, 4200*e*.

In an embodiment, the third support 3300*d*, 3400*d*, 4200*d* may be stationary when the first support 3300*b*, 3400*b*, 4200*b* and/or the second support 3300*c*, 3400*c*, 4200*c* are pivotable and/or rotatable, raisable and/or lowerable, and any combination thereof.

In an embodiment, the third support 3300*d*, 3400*d*, 4200*d* may be pivotable and/or rotatable. In an embodiment, an upper end of the third support 3300*d*, 3400*d*, 4200*d* may be pivotable and/or rotatable. In an embodiment, the lower end of the third support 3300*d*, 3400*d*, 4200*d* may be rotatable or stationary.

In an embodiment, the third support 3300*d*, 3400*d*, 4200*d* may be raisable and/or lowerable. In an embodiment, an upper end of the third support 3300*d*, 3400*d*, 4200*d* may be raisable and/or lowerable. In an embodiment, a lower end of the third support 3300*d*, 3400*d*, 4200*d* may be raisable and/or lowerable.

Any suitable connection may be used for the third support 3300*d*, 3400*d*, 4200*d*. For example, suitable connections include, but are not limited to, fittings and welds. Connections are well known in the art.

In an embodiment, an upper end of the third support 3300*d*, 3400*d*, 4200*d* may be attached to an outer surface of the union system 33102, 34102, 42102 by a connection. For example, suitable connections include, but are not limited to, bands, clamps, fittings, saddles and welds. In an embodiment, an upper end of the third support 3300*d*, 3400*d*, 4200*d* may be attached to an outer surface of the union system 33102, 34102, 42102 by a band or a clamp or a saddle.

In an embodiment, the lower end of the third support 3300*d*, 3400*d*, 4200*d* may be attached to the upper surface of the skid 3300*a*, 3400*a*, 4200*a* (base or frame 3300*e*, 3400*e*, 4200*e*) by a connection. For example, suitable connections include, but are not limited to, bands, clamps, fittings and welds. In an embodiment, the lower end of the third support 3300*d*, 3400*d*, 4200*d* may be attached to the upper surface of the skid 3300*a*, 3400*a*, 4200*a* (base or frame 3300*e*, 3400*e*, 4200*e*) by a connection. In an embodiment, the lower end of the third support 3300*d*, 3400*d*,

4200*d* may be attached to the upper surface of the skid 3300*a*, 3400*a*, 4200*a* (base or frame 3300*e*, 3400*e*, 4200*e*) by fittings or welds.

Any suitable coupling may be used for the third support 3300*d*, 3400*d*, 4200*d*. For example, suitable couplings include, but are not limited to bearings, hinges, pivots, sockets, and combinations thereof. In an embodiment, the coupling for the third support 3300*d*, 3400*d*, 4200*d* may be a bearing. In an embodiment, the coupling for the third support 3300*d*, 3400*d*, 4200*d* may be a box channel with a pivot pin.

In an embodiment, the third support 3300*d*, 3400*d*, 4200*d* may have a coupling at or near an upper end. For example, suitable couplings include, but are not limited to bearings, hinges, pivots, sockets, and combinations thereof. In an embodiment, the third support 3300*d*, 3400*d*, 4200*d* may have a bearing or a socket at or near an upper end. In an embodiment, the third support 3300*d*, 3400*d*, 4200*d* may have a hinge or a pivot at or near an upper end.

In an embodiment, the third support 3300*d*, 3400*d*, 4200*d* may have a coupling at or near a lower end. For example, suitable couplings include, but are not limited to bearings, hinges, pivots, sockets, and combinations thereof. In an embodiment, the third support 3300*d*, 3400*d*, 4200*d* may have a bearing or a socket at or near a lower end. In an embodiment, the third support 3300*d*, 3400*d*, 4200*d* may have a hinge or a pivot at or near a lower end.

In an embodiment, the third support 3300*d*, 3400*d*, 4200*d* may pivot and/or rotate automatically and/or manually. In an embodiment, the third support 3300*d*, 3400*d*, 4200*d* may pivot and/or rotate electro-mechanically, hydraulically, mechanically (e.g., geared) or pneumatically. In an embodiment, the third support 3300*d*, 3400*d*, 4200*d* may pivot and/or rotate manually.

Any suitable extension may be used for the third support 3300*d*, 3400*d*, 4200*d*. For example, suitable extensions include, but are not limited to articulated arms, extendable pistons, telescoping pipes, and combinations thereof. In an embodiment, the extension for the third support 3300*d*, 3400*d*, 4200*d* may be an extendable piston. In an embodiment, the extension for the third support 3300*d*, 3400*d*, 4200*d* may be a telescoping pipe with a clevis pin.

In an embodiment, the third support 3300*d*, 3400*d*, 4200*d* may have an extension at or near an upper end. For example, suitable extensions include, but are not limited to articulated arms, extendable pistons, telescoping pipes, and combinations thereof. In an embodiment, the third support 3300*d*, 3400*d*, 4200*d* may have an extendable arm at or near an upper end. In an embodiment, the third support 3300*d*, 3400*d*, 4200*d* may have a telescoping pipe with a clevis pin at or near an upper end.

In an embodiment, the third support 3300*d*, 3400*d*, 4200*d* may have an extension at or near a lower end. For example, suitable extensions include, but are not limited to articulated arms, extendable pistons, telescoping pipes, and combinations thereof. In an embodiment, the third support 3300*d*, 3400*d*, 4200*d* may have an extendable piston at or near a lower end. In an embodiment, the third support 3300*d*, 3400*d*, 4200*d* may have a telescoping pipe with a clevis pin at or near a lower end.

In an embodiment, the third support 3300*d*, 3400*d*, 4200*d* may raise and/or lower automatically and/or manually. In an embodiment, the third support 3300*d*, 3400*d*, 4200*d* may raise and/or lower electro-mechanically, hydraulically, mechanically (e.g., geared) or pneumatically. In an embodiment, the third support 3300*d*, 3400*d*, 4200*d* may raise and/or lower manually.

In an embodiment, the first support 3300*b*, 3400*b*, 4200*b*, the second support 3300*c*, 3400*c*, 4200*c* and/or the third support 3300*d*, 3400*d*, 4200*d* of the skid 3300*a*, 3400*a*, 4200*a* of the drilling mud screen system 3300, 3400, 4200 may be constructed of any suitable material. For example, suitable materials include, but are not limited to, any alloy steel suitable for a drilling mud application. In an embodiment, the first support 3300*b*, 3400*b*, 4200*b*, the second support 3300*c*, 3400*c*, 4200*c*, and/or the third support 3300*d*, 3400*d*, 4200*d* of the skid 3300*a*, 3400*a*, 4200*a* may be constructed of an alloy steel or equivalent material. See e.g., FIGS. 33A-33C, 34A-34B & 42A-42B. In an embodiment, the first support 3300*b*, 3400*b*, 4200*b*, the second support 3300*c*, 3400*c*, 4200*c*, and/or the third support 3300*d*, 3400*d*, 4200*d* of the skid 3300*a*, 3400*a*, 4200*a* may be constructed of a 304 stainless steel material. In an embodiment, the first support 3300*b*, 3400*b*, 4200*b*, the second support 3300*c*, 3400*c*, 4200*c*, and/or the third support 3300*d*, 3400*d*, 4200*d* of the skid 3300*a*, 3400*a*, 4200*a* may be unpainted. In an embodiment, the first support 3300*b*, 3400*b*, 4200*b*, the second support 3300*c*, 3400*c*, 4200*c*, and/or the third support 3300*d*, 3400*d*, 4200*d* of the skid 3300*a*, 3400*a*, 4200*a* may be painted.

In an embodiment, the base or frame 3300*e*, 3400*e*, 4200*e* of the skid 3300*a*, 3400*a*, 4200*a* of the drilling mud screen system 3300, 3400, 4200 may be constructed of any suitable material. For example, suitable materials include, but are not limited to, a concrete, a polymer, and any alloy steel suitable for a drilling mud application. In an embodiment, the base or frame 3300*e*, 3400*e*, 4200*e* may be constructed of a concrete. In an embodiment, the base or frame 3300*e*, 3400*e*, 4200*e* may be constructed of a polymer. In an embodiment, the base or frame 3300*e*, 3400*e*, 4200*e* of the skid 3300*a*, 3400*a*, 4200*a* may be constructed of an alloy steel or equivalent material. See e.g., FIGS. 33A-33C, 34A-34B & 42A-42B. In an embodiment, the base or frame 3300*e*, 3400*e*, 4200*e* of the skid 3300*a*, 3400*a*, 4200*a* may be constructed of a 304 stainless steel material. In an embodiment, the base or frame 3300*e*, 3400*e*, 4200*e* of the skid 3300*a*, 3400*a*, 4200*a* may be unpainted. In an embodiment, the base or frame 3300*e*, 3400*e*, 4200*e* of the skid 3300*a*, 3400*a*, 4200*a* may be painted.

Optional End Subassembly

Figure 31:
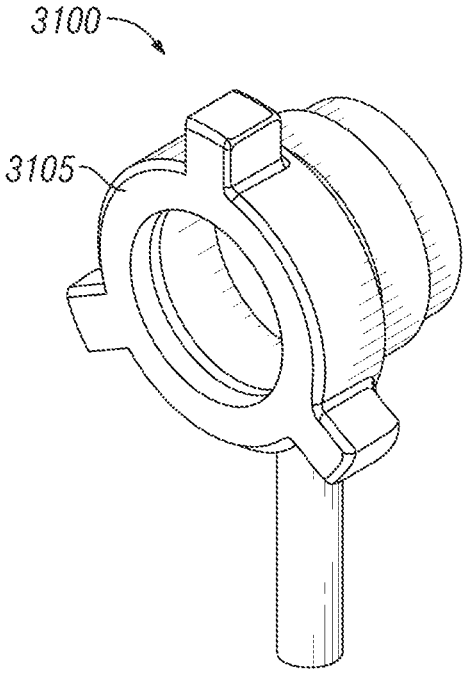
FIG. 31 illustrates a detailed view of an optional end subassembly for a piston-style drilling mud screen system according to an embodiment of the present invention, providing a cross-over connection from a first subassembly and/or a second subassembly to an optional transducer subassembly.

FIG. 31 illustrates a detailed view of an optional end subassembly for a piston-style drilling mud screen system 3000, 3300, 3400 according to an embodiment of the present invention, providing a cross-over connection 3105 from a first subassembly 30000*a*, 33000*a*, 34000*a* and/or a second subassembly 30000*b*, 33000*b*, 34000*b* to an optional transducer subassembly 19100 (discussed below). As shown in FIG. 31, the optional end subassembly 3100 comprises a cross-over connection 3105 from a first subassembly 30000*a*, 33000*a*, 34000*a* and/or a second subassembly 30000*b*, 33000*b*, 34000*b* to an optional transducer subassembly 19100.

Optional Transducer Subassembly for Two-Piece Body and Piston Body

FIG. 19 illustrates a cross-sectional view of the drilling mud screen system in a monitoring configuration 1900 according to an embodiment of the present invention, showing an optional transducer subassembly 19100. As shown in FIG. 19, the drilling mud screen system 19200 has a first body 1905*a* having a first end 1910*a* and a second end 1915*a*, a first drilling mud inlet 1920*a* and a first drilling mud outlet 1925*a*, an end cap 1935, a first drilling mud screen access port 1930*a*, and an optional transducer subassembly 19100.

Figure 28:
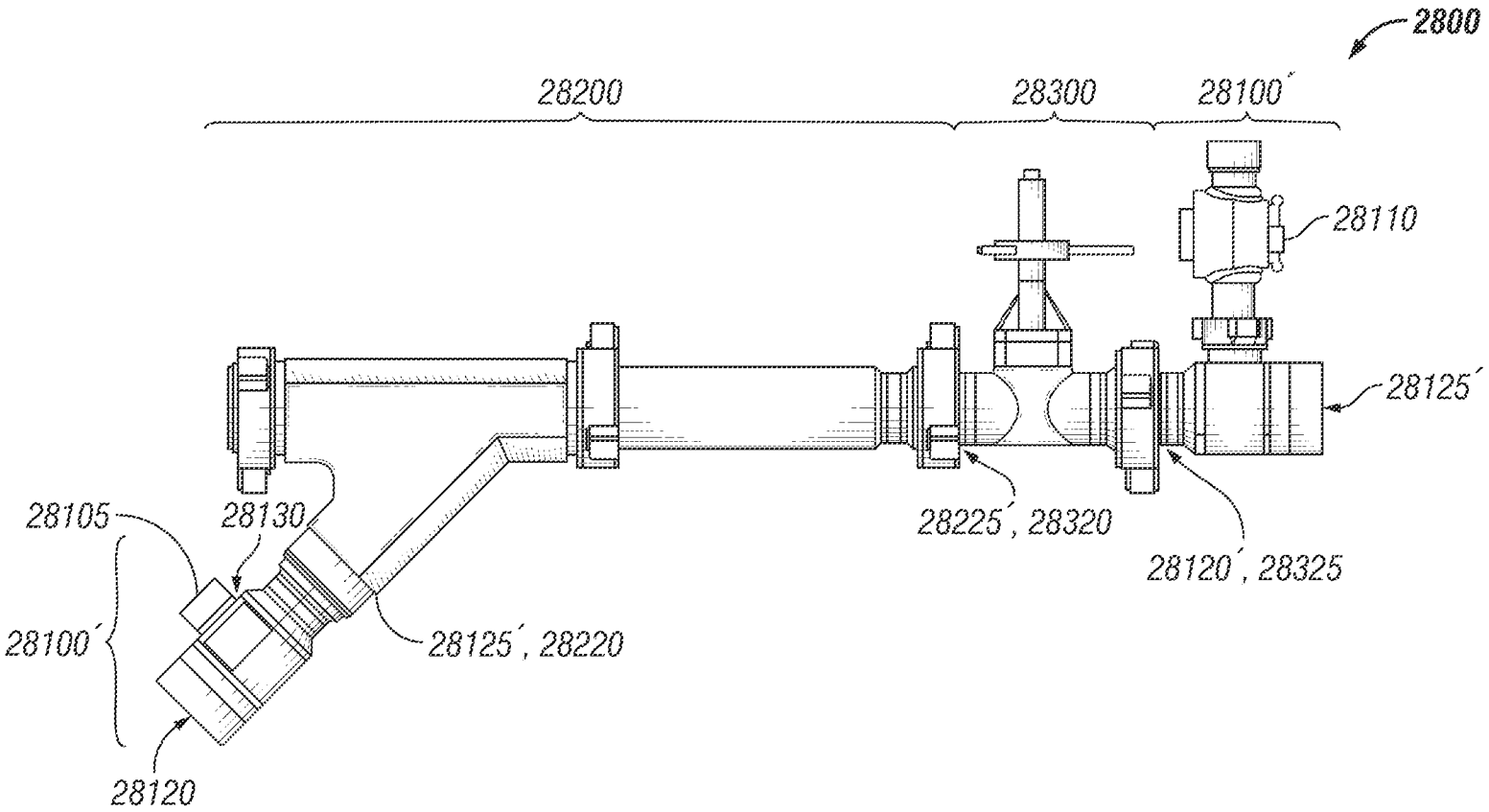
FIG. 28 illustrates a cross-sectional view of a drilling mud screen system in a cementing configuration according to an embodiment of the present invention, showing an optional first transducer subassembly having an optional transducer, a drilling mud screen system, an optional gate valve and an optional second transducer subassembly having an optional low torque plug valve.

As shown in FIGS. 19 and 28, the drilling mud inlet 1920 of the drilling mud screen system 19200, 28200 may be fluidly connected to a drilling mud outlet 28125 of the transducer subassembly 19110, 28100 via a connection. Any suitable connection may be used for the drilling mud inlet 1920 and the drilling mud outlet 28125. For example, suitable connections include, but are not limited to, pipe fittings and welds. Connections are well known in the art. In an embodiment, the drilling mud inlet 1920 of the drilling mud screen system 19200, 28200 may be fluidly connected to a drilling mud outlet 28125 of a transducer subassembly 19100 via a weld.

Figure 20A:
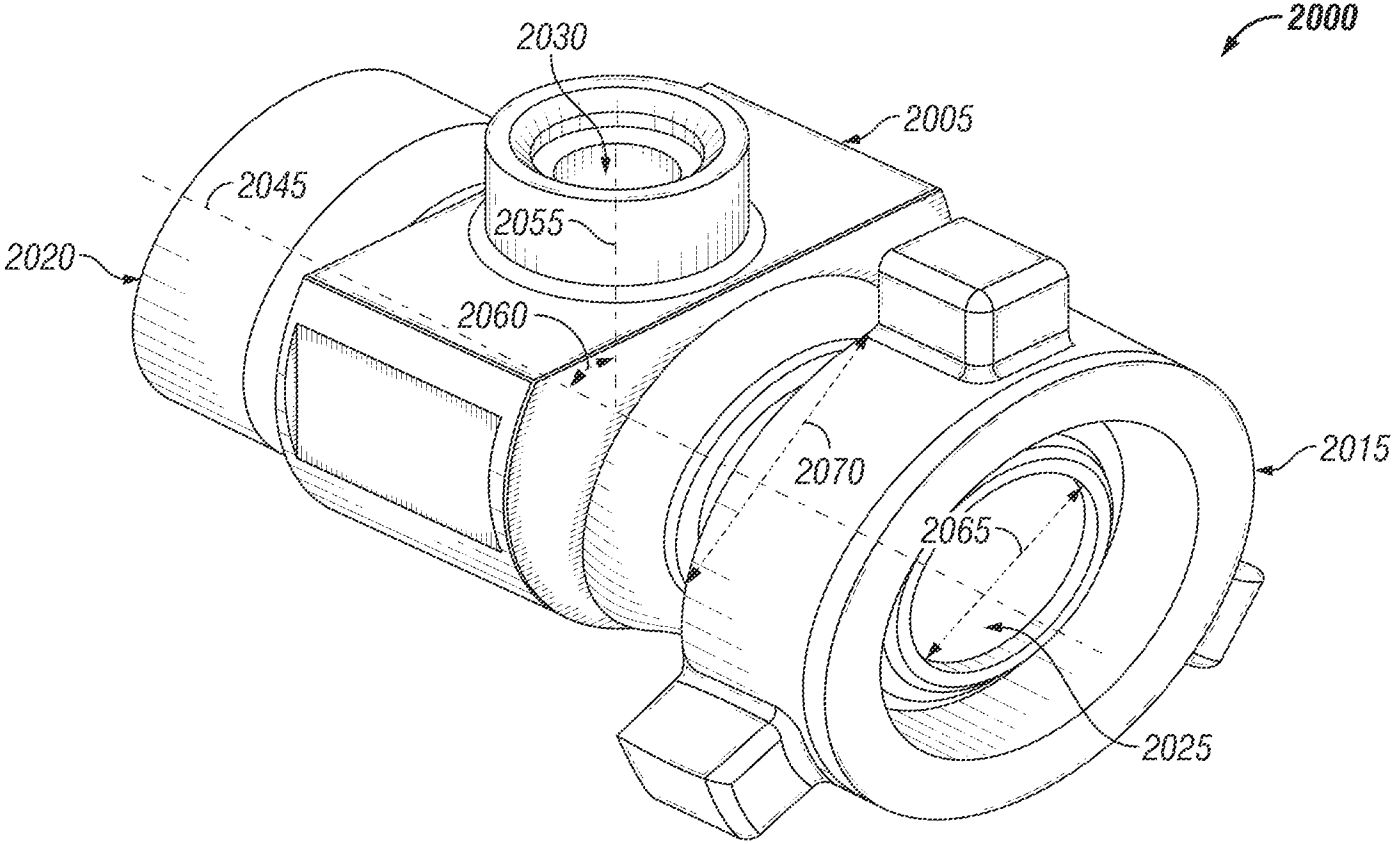
FIG. 20A illustrates an upper, right side perspective view of an optional transducer subassembly according to an embodiment of the present invention.
Figure 20B:
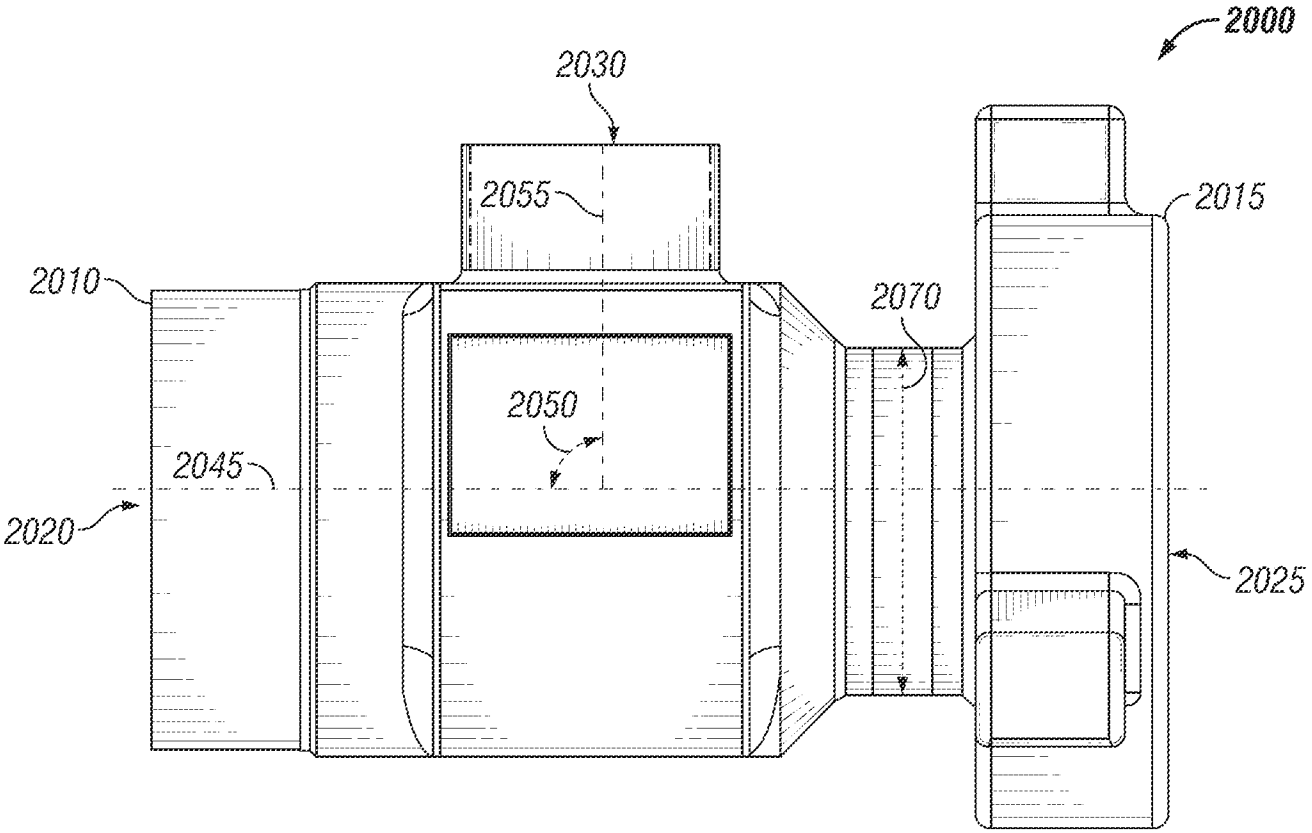
FIG. 20B illustrates a side perspective view of the optional transducer subassembly of FIG. 20A.

FIG. 20A illustrates an upper, right side perspective view of an optional transducer subassembly 2000 according to an embodiment of the present invention; and FIG. 20B illustrates a side perspective view of the optional transducer subassembly of FIG. 20A. As shown in FIGS. 20A and 20B, the optional transducer subassembly 2000 has a body 2005 having a first end 2010 and a second end 2015, an inlet 2020 and an outlet 2025, a transducer port 2030, and a transducer 28105. See e.g., FIG. 28.

In an embodiment, the drilling mud inlet 2020 of the optional transducer subassembly 2000 may be fluidly connected to, for example, an outlet of a drilling mud pump via a connection; and the drilling mud outlet 2025 may be fluidly connected to, for example, an inlet of a drilling mud screen system via a connection. Any suitable connection may be used for the drilling mud inlet 2020 and the drilling mud outlet 2025. For example, suitable connections include, but are not limited to, pipe fittings and welds. Connections are well known in the art. In an embodiment, the drilling mud inlet 2020 of the optional transducer subassembly 2000 may be fluidly connected to, for example, an outlet of a drilling mud pump via a weld; and the drilling mud outlet 2025 of the optional transducer assembly 2000 may be fluidly connected to, for example, an inlet of a drilling mud screen system via a weld.

In an embodiment, the transducer access port 2030 of the optional transducer subassembly 2000 may be closed with a transducer via a fitting. Any suitable type of transducer may be used. For example, suitable types of transducers include, but are not limited to, displacement transducers, flow rate transducers, pressure transducers, temperature transducers and any combination thereof. Any suitable fitting may be used. For example, suitable fittings include, but are not limited to, pipe fittings. Fittings are well known in the art. In an embodiment, the transducer access port 2030 of the optional transducer subassembly 2000 may be closed with a pressure transducer via a 2-inch 1502 WECO union.

In an embodiment, a computing device (such as a rig computer) may include a bus that directly or indirectly couples the following devices: memory, one or more processors, one or more presentation components, one or more input/output (I/O) ports, I/O components, a user interface and a power supply. The computing device may include a variety of computer-readable media. The memory may include computer-storage media in the form of volatile and/or nonvolatile memory. The presentation component(s) present data indications to a user or other device. The user interface allows the user to input/output information to/from the computing device. The one or more I/O ports may allow the computing device to be logically coupled to other devices including a transducer 28105, and other I/O components, some of which may be built in. See e.g., FIG. 28. Examples of other I/O components include a printer, scanner, wireless device, and the like.

In an embodiment, the transducer access port 2030 of the optional transducer subassembly 2000 may be sealed with an end cap via an O-ring. Any suitable O-ring may be used. For example, suitable O-rings include, but are not limited to, 300 Series O-rings. O-rings are well known in the art.

In an embodiment, the body 2005 of the optional transducer subassembly 2000 may be constructed of any suitable material. For example, suitable materials include, but are not limited to, any alloy steel suitable for a drilling mud application. In an embodiment, the body 2005 may be constructed of an American Iron and Steel Industry (AISI) 4130/75k yield or equivalent material. See e.g., FIG. 2. In an embodiment, the inner surface of the body 2005 may be unpainted. In an embodiment, the outer surface of the body 2005 may be painted.

In an embodiment, the body 2005 has a first centerline 2045 and a length 2050. In an embodiment, the first centerline 2045 extends through the center of the drilling mud inlet 2020 to the drilling mud outlet 2025. The length 2050 of the body 2005 may be any suitable length. In an embodiment, the length 2050 of the body 2005 may be from about 10-inches to about 30-inches, and any range or value there between. In an embodiment, the length 2050 may be about 12-inches.

In an embodiment, the body 2005 has a second centerline 2055. In an embodiment, the second centerline 2055 extends through the center of the transducer access port 2030 to the first centerline 2045.

In an embodiment, the first centerline 2045 and the second centerline 2055 form a first angle 2060. In an embodiment, the first angle 2060 may be from about 20-degrees to about 120-degrees, and any range or value there between. In an embodiment, the first angle 2060 may be about 45-degrees. In an embodiment, the first angle 2060 may be about 90-degrees.

In an embodiment, the transducer access port 2030 may be offset from a first end 2010 of the body 2005. The transducer access port 2030 may be offset from a first end 2010 of the body 2005 at any suitable distance. In an embodiment, the second centerline 2055 may be offset from the first end 2010 of the body 2005 from about 6-inches to about 15-inches, and any range or value there between. In an embodiment, the second centerline 2055 may be offset from the first end 2010 of the body 2005 about 7-inches.

In an embodiment, the transducer access port 2030 may have any suitable inner diameter. In an embodiment, the inner diameter of the transducer access port 2030 may be from about 1-inches to about 3-inches, and any range or value there between. In an embodiment, the inner diameter of the transducer access port 2030 may be about 2-inches.

In an embodiment, the outer diameter of the transducer access port 2030 may be from about 1.5-inches to about 3.5-inches, and any range or value there between. In an embodiment, the outer diameter of the transducer access port 2030 may be about 2.5-inches.

In an embodiment, the drilling mud inlet 2020 may have any suitable inner diameter 2065; and the drilling mud inlet 2020 may have any suitable outer diameter 2070. In an embodiment, the inner diameter 2065 of the drilling mud inlet 2020 may be from about 3-inches to about 5-inches, and any range or value there between. In an embodiment, the inner diameter 2065 of the drilling mud inlet 2020 may be about 4-inches.

In an embodiment, the outer diameter 2070 of the drilling mud inlet 2020 may be from about 4.5-inches to about 6.5-inches, and any range or value there between. In an embodiment, the outer diameter 2070 of the drilling mud inlet 2020 may be about 5.5-inches.

In an embodiment, the drilling mud outlet 2025 may have any suitable inner diameter 2065; and the drilling mud outlet 2025 may have any suitable outer diameter 2070. In an embodiment, the inner diameter 2065 of the drilling mud outlet 2025 may be from about 3-inches to about 5-inches, and any range or value there between. In an embodiment, the inner diameter 2065 of the drilling mud outlet 2025 may be about 4-inches.

In an embodiment, the outer diameter 2070 of the drilling mud outlet 2025 may be from about 4.5-inches to about 6.5-inches, and any range or value there between. In an embodiment, the outer diameter 2070 of the drilling mud outlet 2025 may be about 5.5-inches.

Drilling Mud Screen

The drilling mud screen 500 may be any suitable filter or screen capable of filtering or screening debris from drilling muds and completion fluids. For example, suitable drilling mud screens include, but are not limited to, drill screens and rod screens.

FIG. 5A illustrates an upper, cross-sectional view of a drilling mud screen according to an embodiment of the present invention, as discussed above. FIG. 5B illustrates a detailed view of A-A of FIG. 5A; FIG. 5C illustrates a detailed view of B of FIG. 5A; and FIG. 5D illustrates a detailed view of C of FIG. 5A. FIG. 5E illustrates an upper, right side perspective view of the drilling mud screen of FIG. 5A.

Optional Drilling Mud Screen

The drilling mud screen 2200 may be any suitable filter or screen capable of filtering or screening debris from drilling muds and completion fluids. For example, suitable drilling mud screens include, but are not limited to, drill screens and rod screens.

Figure 22A:
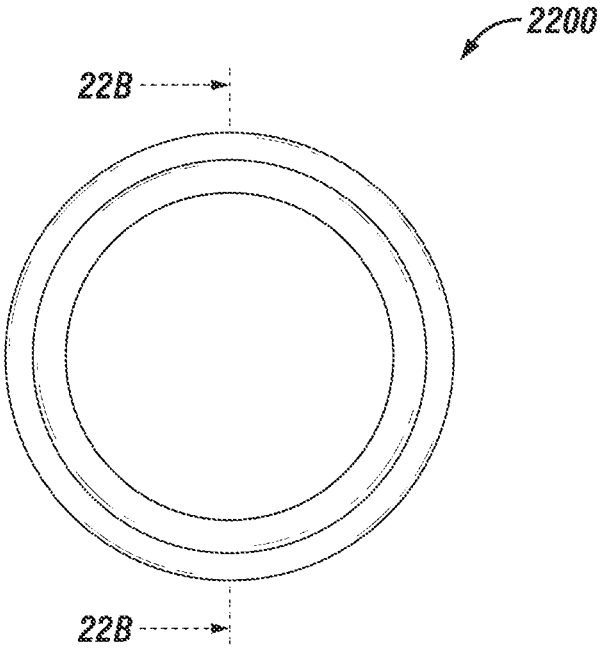
FIG. 22A illustrates an end view of an optional drilling mud screen according to an embodiment of the present invention.
Figure 22B:
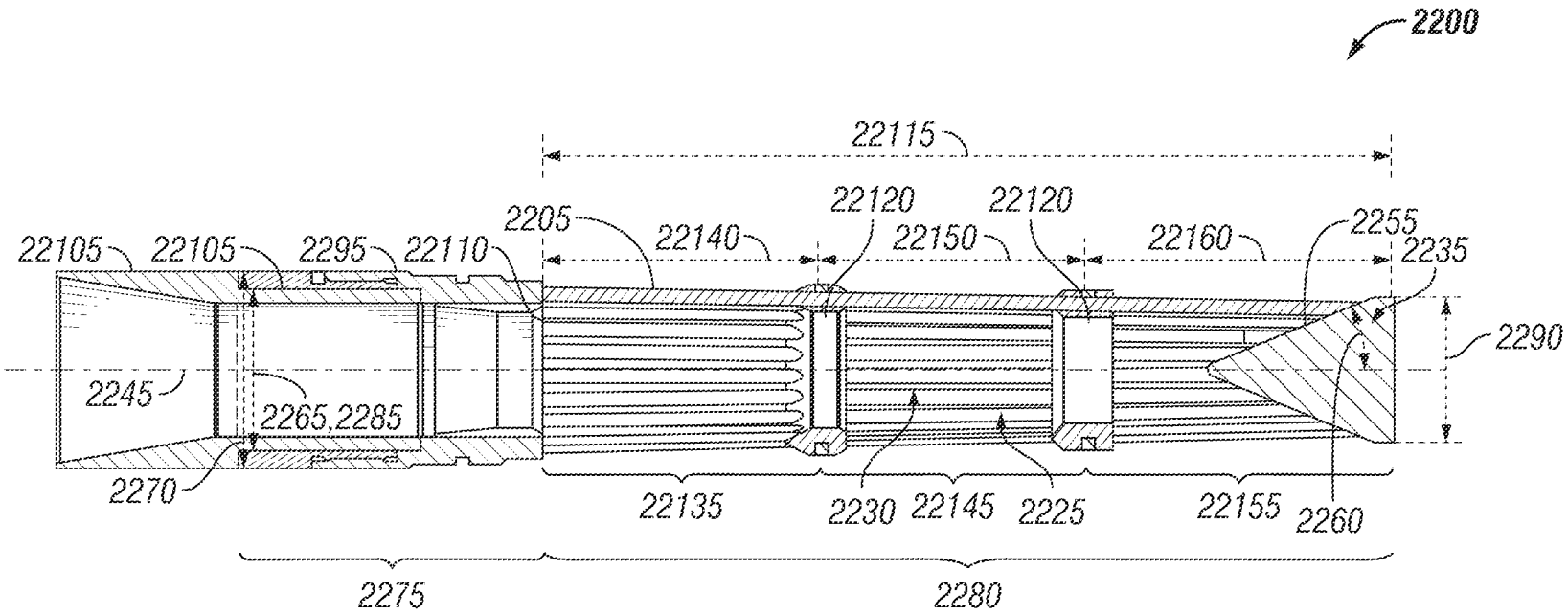
FIG. 22B illustrates a detailed, cross-sectional view of A-A of FIG. 22A, showing an optional drilling mud screen insert, and optional first end retaining ring, an optional filter length, and an optional filter retaining ring.
Figure 22C:
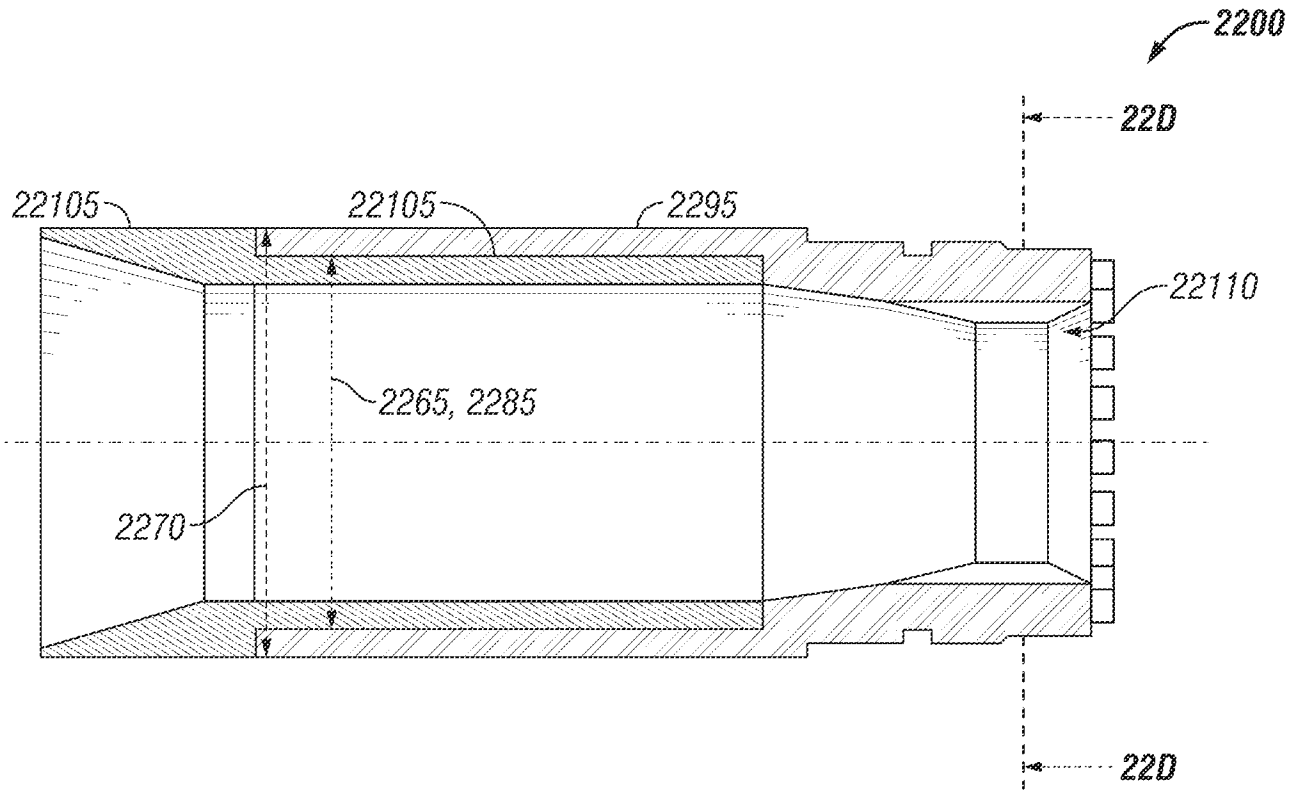
FIG. 22C illustrates a detailed view of B of FIG. 22B.
Figure 22D:
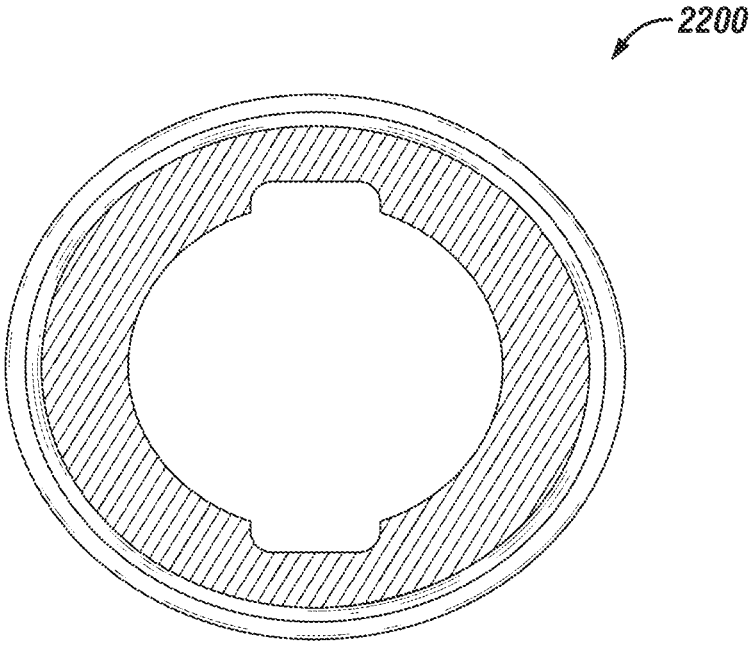
FIG. 22D illustrates a detailed, cross-sectional view of C-C of FIG. 22C.
Figure 22E:
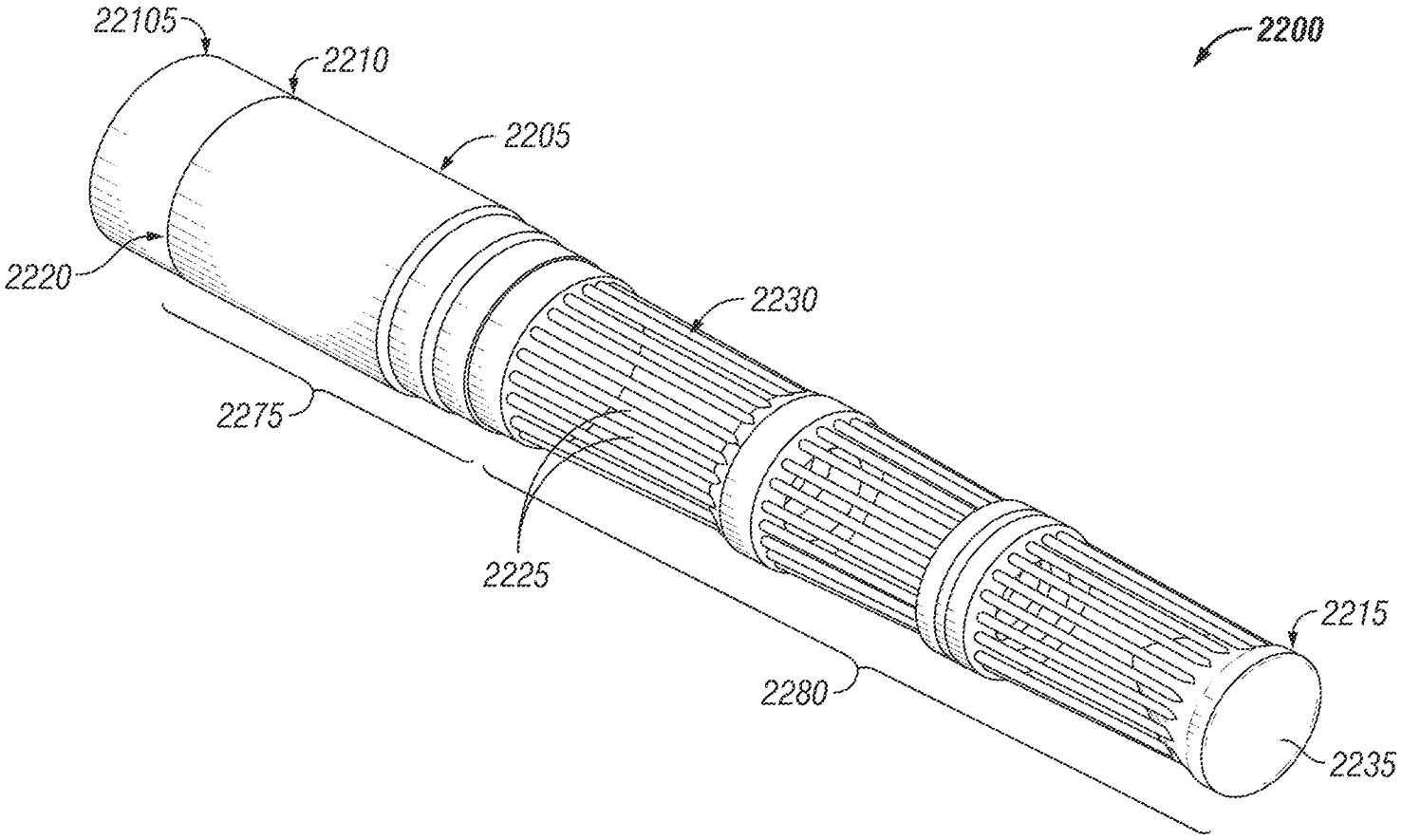
FIG. 22E illustrates an upper, right perspective view of the drilling mud screen of FIGS. 22A-22B.

FIG. 22A illustrates an end view of an optional drilling mud screen 2200 according to an embodiment of the present invention; FIG. 22B illustrates a detailed, cross-sectional view of A-A of FIG. 22A, showing an optional drilling mud screen insert 22105, and optional first end retaining ring 22110, an optional filter length 22115, and an optional retaining ring 22120; FIG. 22C illustrates a detailed view of B of FIG. 22B; FIG. 22D illustrates a detailed, cross-sectional view of C-C of FIG. 22C; and FIG. 22E illustrates an upper, right perspective view of the drilling mud screen of FIGS. 22A-22B.

As shown in FIG. 22B, the drilling mud screen 2200 has a body 2205 having a first end 2210 and a second end 2215, a drilling mud inlet 2220, a drilling mud outlet 2225, a filter 2230 and an end cap 2235.

In an embodiment, the drilling mud inlet 2220 may be fluidly connected to, for example, an outlet of a drilling mud pump via a connection; and the drilling mud outlet 2225 may be fluidly connected to an inlet of a vibrator hose via a connection. Any suitable connection may be used for the drilling mud inlet 2220 and the drilling mud outlet 2225. For example, suitable connections include, but are not limited to, pipe fittings and welds. Connections are well known in the art. In an embodiment, the drilling mud inlet 2220 may be fluidly connected to, for example, an outlet of a drilling mud pump via a weld; and the drilling mud outlet 2225 may be fluidly connected to an inlet of a vibrator hose via a weld.

In an embodiment, the body 2205 of the drilling mud screen 2200 may be constructed of any suitable material. For example, suitable materials include, but are not limited to, any alloy steel or tool steel. In an embodiment, the body 2205 may be constructed of an AISI 4145 or equivalent material. See e.g., FIGS. 5A-5E. In an embodiment, the body 2205 may be constructed of tool steel or equivalent material.

In an embodiment, the body 2205 of the drilling mud screen 2200 may have a hardened coating to reduce washing (i.e., erosion) of the screen 2200. For example, suitable hardened coatings include, but are not limited to, any Carbide coating or equivalent. In an embodiment, the body 2205 may have a Carbide coating with about 6% Cobalt binder or equivalent material.

In an embodiment, the body 2205 of the drilling mud screen 2200 has a centerline 2245 and a length 2250. In an embodiment, the centerline 2245 extends through the center of the drilling mud screen inlet 2220 to the end cap 2235. The length 2250 of the body 2205 may be any suitable length. In an embodiment, the length 2250 of the body 2205 may be from about 20-inches to about 30-inches, and any range or value there between. In an embodiment, the length 2250 may be about 25-inches.

In an embodiment, the drilling mud inlet 2220 of the drilling mud screen 2200 may have any suitable inner diameter 2265; and the drilling mud inlet 2220 may have any suitable outer diameter 2270. In an embodiment, the inner diameter 2265 of the drilling mud inlet 2220 may be from about 3-inches to about 5-inches, and any range or value there between. In an embodiment, the inner diameter 2265 of the drilling mud inlet 2220 may be about 3.9-inches.

In an embodiment, the outer diameter 2270 of the drilling mud inlet 2220 may be from about 4-inches to about 6-inches, and any range or value there between. In an embodiment, the outer diameter 2270 of the drilling mud inlet 2220 may be about 4-inches.

In an embodiment, the body 2205 of the drilling mud screen 2200 has a first portion 2275 and a second portion 2280. In an embodiment, the first portion 2275 of the body 2205 has a first length 22125; and the second portion 2280 of the body 2205 has a second length 22130. The first portion 2275 and the second portion 2280 may be any suitable length. In an embodiment, the first portion 2275 may have a first length 22125 from about 6-inches to about 10-inches, and any range or value there between; and the second portion 2280 may have a second length 22130 from about 14-inches to about 20-inches, and any range or value there between. In an embodiment, the first portion 2275 may have a first length 22125 of about 7.5-inches; and the second portion 2280 may have a second length 22130 of about 17.5-inches.

In an embodiment, the second portion 2280 of the body 2205 has a first section 22135, a second section 22145 and a third section 22155. In an embodiment, the first section 22135 has a third length 22140, the second section 22145 has a fourth length 22150 and the third section 22155 has a fifth length 22160. The first section 22135, the second section 22145 and the third section 22155 may be any suitable length. In an embodiment, the first section 22135 maybe up to about 20-25% longer than the second section 22145 and/or the third section 22155, resulting in increased flow efficiency and decreased erosion.

In an embodiment, the first section 22135 may have a third length 22140 from about 4-inches to about 8-inches, and any range or value there between. In an embodiment, the first section 22135 may have a third length 22140 of about 6-inches.

In an embodiment, the second section 22145 may have a fourth length 22150 from about 4-inches to about 8-inches, and any range or value there between. In an embodiment, the second section 22145 may have a fourth length 22150 of about 5-inches.

In an embodiment, the third section 22155 may have a fifth length 22160 from about 4-inches to about 8-inches, and any range or value there between. In an embodiment, the third section 22155 may have a fifth length 22160 of about 5-inches.

In an embodiment, a second portion 2280 of the body 2205 of the drilling mud screen 2200 may have a filter 2230. In an embodiment, the filter 2230 may comprise a plurality of rods spaced a distance apart to form a filter. In an embodiment, the distance may be less than a particle size (e.g., diameter) desired to be filtered from the drilling mud. Particle filtration is well known in the art.

In an embodiment, the filter 2230 may comprise a formed sheet having drilled holes spaced a distance apart to form a filter. In an embodiment, the size of the holes (e.g., diameter) may be less than a particle size (e.g., diameter) desired to be filtered. Particle filtration is well known in the art.

In an embodiment, a second portion 2280 of the body 2205 of the drilling mud screen 2200 may have a drilling mud outlet 2225. In an embodiment, the drilling mud outlet 2225 may comprise a plurality of spaces (i.e., flow passages) between a plurality of rods. In an embodiment, the drilling mud outlet 2225 may comprise a plurality of holes (i.e., flow passages) drilled in a formed sheet.

In an embodiment, a first end 2210 of a first portion 2275 of the body 2205 of the drilling mud screen 2200 may have a first inner diameter 2285; and a second end 2215 of a second portion 2280 of the body 2205 may have a second inner diameter 2290.

In an embodiment, the first end 2210 of the first portion 2275 may be shaped to accept a puller/installer plate 975 of a drilling mud screen puller/installer tool 800, 900, as discussed below. See e.g., FIGS. 5A, 8A & 9A.

In an embodiment, the body 2205 and/or a filter 2230 of the drilling mud screen 2200 may have a tapered drilling mud flow path from a larger inner diameter to a smaller inner diameter to reduce washing (i.e., erosion) of the screen 2200.

In an embodiment, the first inner diameter 2285 of the first end 2210 of the body 2205 of the drilling mud screen 2200 may be from about 3-inches to about 5-inches, and any range or value there between. In an embodiment, the first inner diameter 2285 of the first end 2210 of the body 2205 may be about 3.9-inches.

FIG. 22D illustrates a detailed view of C-C of FIG. 22C, showing an outlet of a first portion 2275 of the body 2205 and an inlet of the second portion 2280 of the body 2205. In an embodiment, an inner diameter of an outlet of the first portion 2275 and an inlet of the second portion 2280 of the body 2205 may be from about 2-inches to about 3-inches, and any range or value there between. In an embodiment, the inner diameter of the outlet of the first portion 2275 of the body 2205 and the inlet of the second portion 2280 of the body 2205 may be about 2.5-inches.

In an embodiment, the outlet of the first portion 2275 and/or the inlet of the second portion 2280 of the body 2205 may be shaped to accept a rounded end 875, 975 of a drilling mud screen puller/installer tool 800, 900. See e.g., FIGS. 5B, 8B & 9B. See also FIGS. 12B, 13B & 29. In an embodiment, the inlet of the second portion 2280 of the body 2205 may have an inner shoulder to provide a pushing surface for the rounded end 875, 975 of the drilling mud screen puller/installer tool 800, 900. Id.

In an embodiment, the outlet of the first portion 2275 and/or the inlet of the second portion 2280 of the body 2205 may have a means to engage 2240 a drilling mud screen puller/installer tool 800, 900, as discussed below. See e.g., FIGS. 5A, 8A & 9A. The means to engage 2240 may be any suitable means to accept, and provide a pulling surface for, the drilling mud screen puller/installer tool 800, 900. For example, a suitable means to engage 2240 includes, but is not limited to, a "key" opening to rotationally engage an inner shoulder. In an embodiment, the outlet of the first portion 2275 and/or the inlet of the second portion 2280 of the body 2205 may be shaped to accept a puller/installer plate 870, 970 of a drilling mud screen puller/installer tool 800, 900. See e.g., FIGS. 5B, 8B & 9B. See also FIGS. 12A, 13A & 29. In an embodiment, the inlet of the second portion 2280 of the body 2205 may have an inner shoulder to provide a pulling surface for the puller/installer plate 870, 970 of the drilling mud screen puller/installer tool 800, 900. Id.

In an embodiment, the second inner diameter 2290 of the second end 2215 of the body 2205 of the drilling mud screen 2200 may be from about 2-inches to about 3-inches, and any range or value there between. In an embodiment, the second inner diameter 2290 of the second end 2215 of the body 2205 may be about 2.5-inches.

In an embodiment, the outer surface 2295 of the first portion 2275 of the body 2205 of the drilling mud screen 2200 may be adapted to engage one or more shoulders in an inner surface of the body 2205. In an embodiment, a first shoulder and a second shoulder of the body 2205 may be offset from a first end 2210 of the body 2205. Cf. FIGS. 4A & 5A. The first and second shoulders may be offset from the first end 2210 of the body 2205 at any suitable distance. In an embodiment, the first shoulder may be offset from the first end 2210 of the body 2205 from about 4-inches to about 8-inches, and any range or value there between; and the second shoulder may be offset from the first end 2210 of the body 2205 from about 5-inches to about 9-inches, and any range or value there between. In an embodiment, the first shoulder may be offset from the first end 2210 of the body 2205 about 4.8-inches; and the second shoulder may be offset from the first end 2210 of the body 2205 about 6.8-inches.

In an embodiment, the outer surface 2295 of the body 2205 of the drilling mud screen 2200 may be sealed against an inner surface of the body 2205 via an O-ring. Cf. FIGS. 4A & 5A. Any suitable O-ring may be used. For example, suitable O-rings include, but are not limited to, 300 Series O-rings. O-rings are well known in the art.

FIG. 22C illustrates a detailed view of B of FIG. 22B, showing a detailed view of a groove for an O-ring. In an embodiment, a groove for an O-ring may be offset from a first end 2210 of the body 2205 of the drilling mud screen 2200. The groove for the O-ring may be offset from the first end 2210 of the body 2205 at any suitable distance. In an embodiment, the groove for the O-ring may be offset from the first end 2210 of the body 2205 from about 4-inches to about 8-inches, and any range or value there between. In an embodiment, the groove for the O-ring may be offset from the first end 2210 of the body 2205 about 5.7-inches.

In an embodiment, the filter 2230 may have a plurality of rods spaced a distance apart to form a filter, or, alternatively, a formed sheet having drilled holes spaced a distance apart to form a filter. In an embodiment, the plurality of rods may be tapered from a larger outer diameter to a smaller outer diameter to encourage drilling mud flow to exit in straight lines through the drilling mud outlet 2225 (i.e., through flow passages between the plurality rods) to reduce washing (i.e., erosion) of the screen 2200. In an embodiment, the filter 2230 may have a plurality of straight rows of holes drilled in a formed sheet to encourage drilling mud flow to exit in straight rows of strings through the drilling mud outlet 2225 (i.e., through straight flow passages of the drilled holes) to reduce washing (i.e., erosion) of the screen 2200.

In an embodiment, a first end of a filter 2230 may be connected to a second end 2215 of the body 2205 via a connection; and a second end of a filter 2230 may be connected to a first end of the end cap 2235 via a connection. Any suitable connection may be used for the filter 2230 and body 2205. For example, suitable connections include, but are not limited to, welds. Connections are well known in the art. In an embodiment, the first end of the filter 2230 may be connected to the second end 2215 of the body 2205 via a weld; and the second end of the filter 2230 may be connected to the first end of the end cap 2235 via a weld.

In an embodiment, the first end of the filter 2230 may fit into a first recess in the second end 2215 of the body 2205; and the second end of the filter 2230 may fit into a second recess in the first end of the end cap 2235. In an embodiment, the first recess and the second recess may be a plurality of recessed holes or a recessed groove. In an embodiment, the first recess and the second recess may be a plurality of recessed holes.

In an embodiment, the filter 2230 may be held together with a retaining ring. In an embodiment, the retaining ring may have a plurality of holes to hold the plurality of rods to form the filter 2230. In an embodiment, the plurality of rods may be connected to the plurality of holes in the retainer ring via a connection. Any suitable connection may be used for the filter 2230 and retaining ring. For example, suitable connections include, but are not limited to, welds. Connections are well known in the art. In an embodiment, the plurality of rods may be connected to the plurality of holes in the retainer ring via a weld.

In an embodiment, the filter 2230, including any retaining rings, of the drilling mud screen 2200 may be constructed of any suitable material. For example, suitable materials include, but are not limited to, any alloy steel or tool steel. In an embodiment, the filter 2230 may be constructed of 304 stainless steel material. See e.g., FIGS. 5A & 5E. In an embodiment, the filter 2230 may be constructed of AISI 4145 or equivalent material. In an embodiment, the filter 2230 may be constructed of D2 tool steel or equivalent material.

In an embodiment, the filter 2230 may have a hardened coating to reduce washing (i.e., erosion) of the screen 2200. For example, suitable hardened coatings include, but are not limited to, any Carbide coating or equivalent. In an embodiment, the filter 2230 may have a Carbide coating with about 6% Cobalt binder or equivalent material.

In an embodiment, the end cap 2235 of the drilling mud screen 2200 has an inner surface 2255. In an embodiment, the inner surface 2255 of the end cap 2235 of the drilling mud screen 2200 may redirect the flow to reduce washing (i.e., erosion) of the screen 2200. In an embodiment, the inner surface 2255 of the end cap 2235 of the drilling mud screen 2200 forms an inverted cone relative to the second end 2215 of the body 2205 of the drilling mud screen 2200 (i.e., an upstream pointing cone) to redirect the flow. In an embodiment, the tip of the inverted cone may have a rounded or squared shape.

In an embodiment, the body 2205 of the drilling mud screen 2200 has a centerline 2245 and a length 2250. In an embodiment, the centerline 2245 extends through the center of the drilling mud screen inlet 2220 to the end cap 2235. In an embodiment, the centerline 2245 of the body 2205 of the drilling mud screen 2200 and the inner surface 2255 of the end cap 2235 form an angle 2260. In an embodiment, the angle 2260 may be from about 30-degrees to about 60-degrees, and any range or value there between. In an embodiment, the angle 2260 may be from about 35-degrees to about 45-degrees.

In an embodiment, the end cap 2235 of the drilling mud screen 2200 may be constructed of any suitable material. For example, suitable materials include, but are not limited to, any alloy steel or tool steel. In an embodiment, the end cap 2235 may be constructed of 304 stainless steel material or equivalent material. See e.g., FIGS. 5A & 5E. In an embodiment, the end cap 2235 may be constructed of AISI 4155 or equivalent material. In an embodiment, the end cap 2235 may be constructed of tool steel or equivalent material.

In an embodiment, the end cap 2235 of the drilling mud screen 2200 may have a hardened coating to reduce washing (i.e., erosion) of the screen 2200. For example, suitable hardened coatings include, but are not limited to, any Carbide coating or equivalent. In an embodiment, the end cap 2235 may have a Carbide coating with about 6% Cobalt binder or equivalent material.

FIG. 22E illustrates an upper, right side perspective view of the drilling mud screen of FIGS. 22A-22B. As shown in FIG. 22E, the drilling mud screen 2200 has a body 2205 having a first end 2210 and a second end 2215, a drilling mud inlet 2220, a drilling mud outlet 2225, a filter 2230 and an end cap 2235. In an embodiment, the body 2205 of the drilling mud screen 2200 has a first portion 2275 and a second portion 2280.

Alternative Reversed Drilling Mud Screen

The drilling mud screen 4140, 4240 may be any suitable filter or screen capable of filtering or screening debris from drilling muds and completion fluids. For example, suitable drilling mud screens include, but are not limited to, drill screens and rod screens.

FIG. 41A illustrates a cross-sectional view of an exemplary drilling mud screen system 4100 according to an embodiment of the invention, showing a reversed drilling mud screen 4140; and FIG. 41B illustrates a detailed view of the reversed drilling mud screen 4140 of FIG. 41A.

Figure 42B:
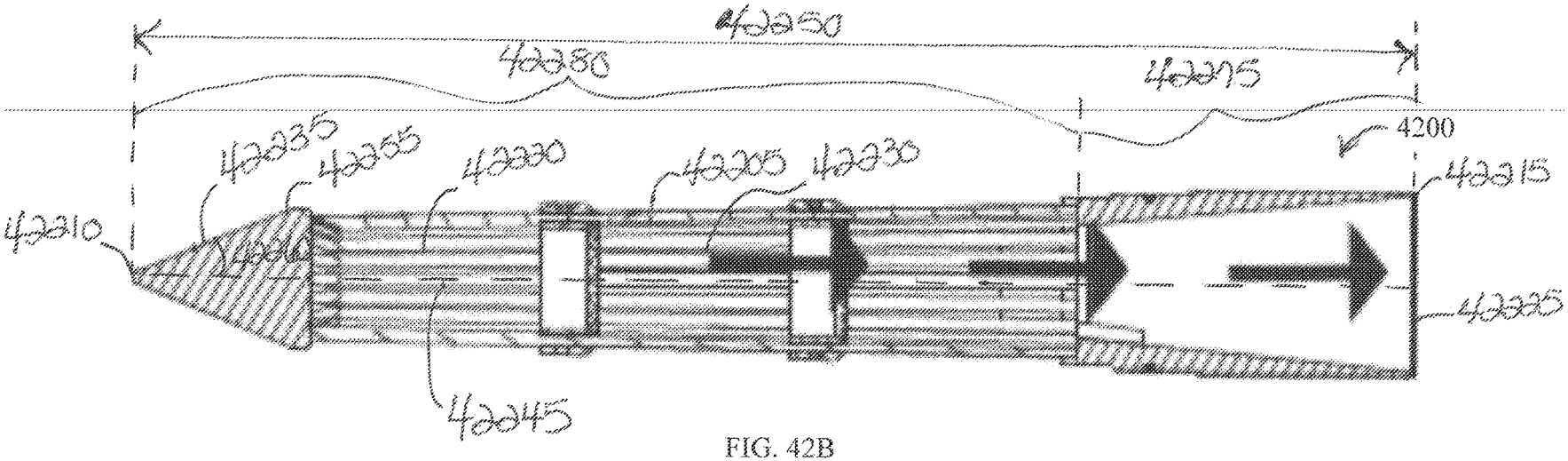
FIG. 42B illustrates a detailed view of the reversed drilling mud screen of FIGS. 42A-1 and 42A-2.

FIGS. 42A-1 and 42A-2 illustrate a cross-sectional view of an exemplary piston-style drilling mud screen system 4200 according to an embodiment of the invention, showing a reversed drilling mud screen 4240; and FIG. 42B illustrates a detailed view of the reversed drilling mud screen 4240 of FIGS. 42A-1 and 42A-2.

As shown in FIGS. 41A-42B, the drilling mud screen 4140, 4240 has a body 41205, 42205 having a first end 41210, 42210 and a second end 41215, 42215, a drilling mud inlet 41220, 42220, a drilling mud outlet 41225, 42225, a filter 41230, 42230 and an end cap 41235, 42235.

In an embodiment, the drilling mud inlet 41220, 42220 may be fluidly connected to, for example, an outlet of a drilling mud pump via a connection; and the drilling mud outlet 41225, 42225 may be fluidly connected to an inlet of a vibrator hose via a connection. Any suitable connection may be used for the drilling mud inlet 41220, 42220 and the drilling mud outlet 41225, 42225. For example, suitable connections include, but are not limited to, pipe fittings and welds. Connections are well known in the art. In an embodiment, the drilling mud inlet 41220, 42220 may be fluidly connected to, for example, an outlet of a drilling mud pump via a weld; and the drilling mud outlet 41225, 42225 may be fluidly connected to an inlet of a vibrator hose via a weld.

In an embodiment, the body 41205, 42205 of the drilling mud screen 4140, 4240 may be constructed of any suitable material. For example, suitable materials include, but are not limited to, any alloy steel or tool steel. In an embodiment, the body 41205, 42205 may be constructed of an AISI 4145 or equivalent material. In an embodiment, the body 41205, 42205 may be constructed of tool steel or equivalent material.

In an embodiment, the body 41205, 42205 of the drilling mud screen 4140, 4240 may have a hardened coating to reduce washing (i.e., erosion) of the screen 4140, 4240. For example, suitable hardened coatings include, but are not limited to, any Carbide coating or equivalent. In an embodiment, the body 41205, 42205 may have a Carbide coating with about 6% Cobalt binder or equivalent material.

In an embodiment, the body 41205, 42205 of the drilling mud screen 4140, 4240 has a centerline 41245, 42245 and a length 41250, 42250. In an embodiment, the centerline 41245, 42245 extends through the center of the drilling mud screen outlet 41225, 42225 to the end cap 41235, 42235. The length 41250, 42250 of the body 41205, 42205 may be any suitable length. In an embodiment, the length 41250, 42250 of the body 41205, 42205 may be from about 20-inches to about 30-inches, and any range or value there between. In an embodiment, the length 41250, 42250 may be about 25-inches.

In an embodiment, the drilling mud outlet 41225, 42225 of the drilling mud screen 4140, 4240 may have any suitable inner diameter 565; and the drilling mud outlet 41225, 42225 may have any suitable outer diameter 570. In an embodiment, the inner diameter 565 of the drilling mud outlet 41225, 42225 may be from about 3-inches to about 5-inches, and any range or value there between. In an embodiment, the inner diameter 565 of the drilling mud outlet 41225, 4225 may be about 3.9-inches. See e.g., FIGS. 5A-5E.

In an embodiment, the outer diameter 570 of the drilling mud outlet 41225, 42225 may be from about 4-inches to about 6-inches, and any range or value there between. In an embodiment, the outer diameter 570 of the drilling mud inlet 41225, 42225 may be about 4-inches. See e.g., FIGS. 5A-5E.

In an embodiment, the body 41205, 42205 of the drilling mud screen 4140, 4240 has a first portion 41280, 42280 and a second portion 41275, 42275. In an embodiment, the first portion 41280, 42280 of the body 41205, 42205 has a first length; and the second portion 41275, 42275 of the body 41205, 42205 has a second length. The first portion 41280, 42280 and the second portion 41275, 42275 may be any suitable length. In an embodiment, the first portion 41280, 42280 may have a first length from about 6-inches to about 10-inches; and the second portion 41275, 42275 may have a second length from about 14-inches to about 20-inches, and any range or value there between. In an embodiment, the first portion 41280, 42280 may have a first length of about 7.5-inches; and the second portion 41275, 42275 may have a second length of about 17.5-inches.

In an embodiment, a first portion 42280, 42280 of the body 41205, 42205 of the drilling mud screen 4140, 4240 may have a filter 41230, 42230. In an embodiment, the filter 41230, 42230 may comprise a plurality of rods spaced a distance apart to form a filter. In an embodiment, the distance may be less than a particle size (e.g., diameter) desired to be filtered from the drilling mud. For example, the particle size desired to be filtered from drilling mud may be from about 3/16-inches and larger. For example, the particle size desired to be filtered from the completion fluids may be from about 200 microns to about 2500 microns.

In an embodiment, the filter 41230, 42230 may comprise a formed sheet having drilled holes spaced a distance apart to form a filter. In an embodiment, the size of the holes (e.g., diameter) may be less than a particle size (e.g., diameter) desired to be filtered. For example, the particle size desired to be filtered from drilling mud may be from about 3/16-inches and larger. For example, the particle size desired to be filtered from the completion fluids may be from about 200 microns to about 2500 microns.

In an embodiment, a first portion 41280, 42280 of the body 41205, 42205 of the drilling mud screen 4140, 4240 may have a drilling mud inlet 41220, 42220. In an embodiment, the drilling mud inlet 41220, 42220 may comprise a plurality of spaces (i.e., flow passages) between a plurality of rods. In an embodiment, the drilling mud inlet 41220, 42220 may comprise a plurality of holes (i.e., flow passages) drilled in a formed sheet. For example, the particle size desired to be filtered from drilling mud may be from about 3/16-inches and larger. For example, the particle size desired to be filtered from the completion fluids may be from about 200 microns to about 2500 microns.

In an embodiment, a first end 41210, 42210 of a first portion 41280, 42280 of the body 41205, 42205 of the drilling mud screen 4140, 4240 may have a first inner diameter 590; and a second end 41215, 42215 of a second portion 41275, 42275 of the body 41205, 42205 may have a second inner diameter 585. See e.g., FIGS. 5A-5E.

In an embodiment, the body 41205, 42205 and/or a filter 41230, 42230 of the drilling mud screen 4140, 4240 may have a tapered drilling mud flow path from a larger inner diameter to a smaller inner diameter to reduce washing (i.e., erosion) of the screen 4140, 4240.

In an embodiment, the first inner diameter 590 of the first end 41210, 42210 of the body 41205, 42205 of the drilling mud screen 4140, 4240 may be from about 2-inches to about 3-inches, and any range or value there between. In an embodiment, the first inner diameter 590 of the first end 41210, 42210 of the body 41205, 42205 may be about 2.3-inches.

In an embodiment, an inner diameter of an outlet of the first portion 41280, 42280 and an inlet of the second portion 41275, 42275 of the body 41205, 42205 may be from about 2-inches to about 3-inches, and any range or value there between. In an embodiment, the inner diameter of the outlet of the first portion 575 of the body 505 and the inlet of the second portion 590 of the body 505 may be about 2.5-inches.

In an embodiment, the second inner diameter 585 of the second end 41215, 42215 of the body 41205, 42205 of the drilling mud screen 4140, 4240 may be from about 2-inches to about 5-inches, and any range or value there between. In an embodiment, the second inner diameter 585 of the second end 41215, 42215 of the body 41205, 42205 may be about 3.9-inches.

In an embodiment, the outer surface 595 of the second portion 41275, 42275 of the body 41205, 42205 of the drilling mud screen 4140, 4240 may be adapted to engage one or more shoulders in an inner surface of the body 4240, 4240. In an embodiment, a first shoulder and a second shoulder of the body 41205, 42205 may be offset from a second end 41215, 42215 of the body 41205, 42205. Cf. FIGS. 4A & 5A. The first and second shoulders may be offset from the second end 41215, 42215 of the body 41205, 42205 at any suitable distance. In an embodiment, the first shoulder may be offset from the second end 41215, 42215 of the body 41205, 42205 from about 4-inches to about 8-inches; and the second shoulder may be offset from the second end 41215, 42215 of the body 41205, 42205 from about 5-inches to about 9-inches, and any range or value there between. In an embodiment, the first shoulder may be offset from the second end 41215, 42215 of the body 41205, 42205 about 4.8-inches; and the second shoulder may be offset from the second end 41215, 42215 of the body 41205, 42205 about 6.8-inches.

In an embodiment, the outer surface 595 of the body 41205, 42205 of the drilling mud screen 4140, 4240 may be sealed against an inner surface of the body 41205, 42205 via an O-ring. Cf. FIGS. 4A & 5A. Any suitable O-ring may be used. For example, suitable O-rings include, but are not limited to, 300 Series O-rings. O-rings are well known in the art.

In an embodiment, a groove for an O-ring may be offset from a second end 41215, 42215 of the body 41205, 42205 of the drilling mud screen 4140, 4240. The groove for the O-ring may be offset from the second end 41215, 42215 of the body 41205, 42205 at any suitable distance. In an embodiment, the groove for the O-ring may be offset from the second end 42215, 42215 of the body 41205, 42205 from about 4-inches to about 8-inches, and any range or value there between. In an embodiment, the groove for the O-ring may be offset from the second end 41215, 42215 of the body 41205, 42205 about 5.7-inches.

In an embodiment, the filter 41230, 42230 may have a plurality of rods spaced a distance apart to form a filter, or, alternatively, a formed sheet having drilled holes spaced a distance apart to form a filter. In an embodiment, the plurality of rods may be tapered from a larger outer diameter to a smaller outer diameter to encourage drilling mud flow to enter in straight lines through the drilling mud inlet 41225, 42225 (i.e., through flow passages between the plurality rods) to reduce washing (i.e., erosion) of the screen 4140, 4240. In an embodiment, the filter 41230, 42230 may have a plurality of straight rows of holes drilled in a formed sheet to encourage drilling mud flow to enter in straight rows of strings through the drilling mud inlet 41226, 42225 (i.e., through straight flow passages of the drilled holes) to reduce washing (i.e., erosion) of the screen 4140, 4240.

In an embodiment, a first end of a filter 41230, 42230 may be connected to a second end of the end cap 41235, 42235 via a connection; and a second end of a filter 41230, 42230 may be connected to a first end 41210, 42210 of the body 41205, 42205 via a connection. Any suitable connection may be used for the filter 41230, 42230 and end cap 41235, 42235. For example, suitable connections include, but are not limited to, welds. Connections are well known in the art. In an embodiment, the first end of the filter 41230, 42230 may be connected to the second end of the end cap 41235, 42235 via a weld; and the second end of the filter 41230, 42230 may be connected to the first end 41215, 42215 of the body 41205, 42205 via a weld.

In an embodiment, the first end of the filter 41230, 42230 may fit into a first recess in the second end of the end cap 41235, 42235; and the second end of the filter 41230, 42230 may fit into a second recess in the first end 41210, 42210 of the body 41205, 42205. In an embodiment, the first recess and the second recess may be a plurality of recessed holes or a recessed groove. In an embodiment, the first recess and the second recess may be a plurality of recessed holes.

In an embodiment, the filter 41230, 42230 may be held together with a retaining ring. In an embodiment, the retaining ring may have a plurality of holes to hold the plurality of rods to form the filter 41230, 42230. In an embodiment, the plurality of rods may be connected to the plurality of holes in the retainer ring via a connection. Any suitable connection may be used for the filter 41230, 42230 and retaining ring. For example, suitable connections include, but are not limited to, welds. Connections are well known in the art. In an embodiment, the plurality of rods may be connected to the plurality of holes in the retainer ring via a weld.

In an embodiment, the filter 41230, 42230, including any retaining rings, of the drilling mud screen 4140, 4240 may be constructed of any suitable material. For example, suitable materials include, but are not limited to, any alloy steel. In an embodiment, the filter 41230, 42230 may be constructed of 304 stainless steel material. In an embodiment, the filter 41230, 42230 may have a hardened coating to reduce washing (i.e., erosion) of the screen 4140, 4240.

In an embodiment, the end cap 41235, 42235 of the drilling mud screen 4140, 4240 has an outer surface 41255, 42255. In an embodiment, the outer surface 41255, 42255 of the end cap 41235, 42235 of the drilling mud screen 4140, 4240 may redirect the flow to reduce washing (i.e., erosion) of the screen 4140, 4240. In an embodiment, the outer surface 41255, 42255 of the end cap 41235, 42235 of the drilling mud screen 4140, 4240 forms an inverted cone relative to the first end 41210, 42210 of the body 41205, 42205 of the drilling mud screen 4140, 4240 (i.e., an upstream pointing cone) to redirect the flow. In an embodiment, the tip of the inverted cone may have a rounded or squared shape. See e.g., FIGS. 5A-5E.

In an embodiment, the body 41205, 42205 of the drilling mud screen 4140, 4240 has a centerline 41245, 42245 and a length 41250, 42250. In an embodiment, the centerline 41245, 42245 extends through the center of the drilling mud screen outlet 41225, 42225 to the end cap 41235, 42235. In an embodiment, the centerline 41245, 42245 of the body 41205, 42205 of the drilling mud screen 4140, 4240 and the outer surface 41255, 42255 of the end cap 41235, 42235 form an angle 41260, 42260. In an embodiment, the angle 41260, 42260 may be from about 30-degrees to about 90-degrees, and any range or value there between. In an embodiment, the angle 41260, 42260 may be from about 35-degrees to about 45-degrees.

In an embodiment, the end cap 41235, 42235 of the drilling mud screen 4140, 4240 may be constructed of any suitable material. For example, suitable materials include, but are not limited to, any alloy steel. In an embodiment, the end cap 41235, 42235 may be constructed of 304 stainless steel material. In an embodiment, the end cap 41235, 42235 of the drilling mud screen 4140, 4240 may have a hardened coating to reduce washing (i.e., erosion) of the screen 4140, 4240. For example, suitable hardened coatings include, but are not limited to, any Carbide coating or equivalent. In an embodiment, the end cap 41235, 42235 may have a Carbide coating with about 6% Cobalt binder or equivalent material.

Second Alternative Reversed Drilling Mud Screen

The drilling mud screen 4140, 4240 may be any suitable filter or screen capable of filtering or screening debris from drilling muds and completion fluids. For example, suitable drilling mud screens include, but are not limited to, drill screens and rod screens.

FIG. 41A illustrates a cross-sectional view of an exemplary drilling mud screen system 4100 according to an embodiment of the invention, showing a reversed drilling mud screen 4140; and FIG. 41B illustrates a detailed view of the reversed drilling mud screen 4140 of FIG. 41A.

FIG. 42A illustrates a cross-sectional view of an exemplary piston-style drilling mud screen system 4200 according to an embodiment of the invention, showing a reversed drilling mud screen 4240; and FIG. 42B illustrates a detailed view of the reversed drilling mud screen 4240 of FIG. 42A.

As shown in FIGS. 41A-42B, the drilling mud screen 4140, 4240 has a body 41205, 42205 having a first end 41210, 42210 and a second end 41215, 42215, a drilling mud inlet 41220, 42220, a drilling mud outlet 41225, 42225, a filter 41230, 42230 and an end cap 41235, 42235.

In an embodiment, the drilling mud inlet 41220, 42220 may be fluidly connected to, for example, an outlet of a drilling mud pump via a connection; and the drilling mud outlet 41225, 42225 may be fluidly connected to an inlet of a vibrator hose via a connection. Any suitable connection may be used for the drilling mud inlet 41220, 42220 and the drilling mud outlet 41225, 42225. For example, suitable connections include, but are not limited to, pipe fittings and welds. Connections are well known in the art. In an embodiment, the drilling mud inlet 41220, 42220 may be fluidly connected to, for example, an outlet of a drilling mud pump via a weld; and the drilling mud outlet 41225, 42225 may be fluidly connected to an inlet of a vibrator hose via a weld.

In an embodiment, the body 41205, 42205 of the drilling mud screen 4140, 4240 may be constructed of any suitable material. For example, suitable materials include, but are not limited to, any alloy steel or tool steel. In an embodiment, the body 41205, 42205 may be constructed of an AISI 4145 or equivalent material. In an embodiment, the body 41205, 42205 may be constructed of tool steel or equivalent material.

In an embodiment, the body 41205, 42205 of the drilling mud screen 4140, 4240 may have a hardened coating to reduce washing (i.e., erosion) of the screen 4140, 4240. For example, suitable hardened coatings include, but are not limited to, any Carbide coating or equivalent. In an embodiment, the body 41205, 42205 may have a Carbide coating with about 6% Cobalt binder or equivalent material.

In an embodiment, the body 41205, 42205 of the drilling mud screen 4140, 4240 has a centerline 41245, 42245 and a length 41250, 42250. In an embodiment, the centerline 41245, 42245 extends through the center of the drilling mud screen outlet 41225, 42225 of the body 41205, 42205 to the end cap 41235, 42235. The length 41250, 42250 of the body 41205, 42205 may be any suitable length. In an embodiment, the length 41250, 42250 of the body 41205, 42205 may be from about 20-inches to about 30-inches, and any range or value there between. In an embodiment, the length 41250, 42250 may be about 25-inches.

In an embodiment, the drilling mud outlet 41225, 2225 of the drilling mud screen 4140, 4240 may have any suitable inner diameter 2265; and the drilling mud outlet 41225, 42225 may have any suitable outer diameter 2270. In an embodiment, the inner diameter 2265 of the drilling mud outlet 41225, 42225 may be from about 3-inches to about 5-inches, and any range or value there between. In an embodiment, the inner diameter 2265 of the drilling mud outlet 41225, 42225 may be about 3.9-inches. See e.g., FIGS. 22A-22E.

In an embodiment, the outer diameter 2270 of the drilling mud outlet 41225, 42225 may be from about 4-inches to about 6-inches, and any range or value there between. In an embodiment, the outer diameter 2270 of the drilling mud outlet 41225, 42225 may be about 5-inches. See e.g., FIGS. 22A-22E.

In an embodiment, the body 41205, 42205 of the drilling mud screen 4140, 4240 has a first portion 41280, 42280 and a second portion 41275, 42275. In an embodiment, the first portion 41280, 42280 of the body 41205, 42205 has a first length 22130; and the second portion 41275, 42275 of the body 41205, 42205 has a second length 22125. The first portion 41280, 42280 and the second portion 41275, 42275 may be any suitable length. In an embodiment, the first portion 41280, 42280 may have a first length 22130 from about 6-inches to about 10-inches, and any range or value there between; and the second portion 41275, 42275 may have a second length 22125 from about 14-inches to about 20-inches, and any range or value there between. In an embodiment, the first portion 41280, 42280 may have a first length 22130 of about 7.5-inches; and the second portion 41275, 42275 may have a second length 22125 of about 17.5-inches. See e.g., FIGS. 22A-22E.

In an embodiment, the first portion 41280, 42280 of the body 41205, 42205 has a first section 22155, a second section 22145 and a third section 22135. In an embodiment, the first section 22155 has a third length 22160, the second section 22145 has a fourth length 22150 and the third section 22135 has a fifth length 22140. The first section 22155, the second section 22145 and the third section 22135 may be any suitable length. In an embodiment, the first section 22155 maybe up to about 20-25% longer than the second section 22145 and/or the third section 22135, resulting in increased flow efficiency and decreased erosion. See e.g., FIGS. 22A-22E.

In an embodiment, the first section 22155 may have a third length 22160 from about 4-inches to about 8-inches, and any range or value there between. In an embodiment, the first section 22155 may have a third length 22160 of about 6-inches. See e.g., FIGS. 22A-22E.

In an embodiment, the second section 22145 may have a fourth length 22150 from about 4-inches to about 8-inches, and any range or value there between. In an embodiment, the second section 22145 may have a fourth length 22150 of about 5-inches. See e.g., FIGS. 22A-22E.

In an embodiment, the third section 22135 may have a fifth length 22140 from about 4-inches to about 8-inches, and any range or value there between. In an embodiment, the third section 22135 may have a fifth length 22140 of about 5-inches. See e.g., FIGS. 22A-22E.

In an embodiment, a first portion 41280, 42280 of the body 41205, 42205 of the drilling mud screen 4140, 4240 may have a filter 41230, 42230. In an embodiment, the filter 41230, 42230 may comprise a plurality of rods spaced a distance apart to form a filter. In an embodiment, the distance may be less than a particle size (e.g., diameter) desired to be filtered from the drilling mud. Particle filtration is well known in the art.

In an embodiment, the filter 41230, 42230 may comprise a formed sheet having drilled holes spaced a distance apart to form a filter. In an embodiment, the size of the holes (e.g., diameter) may be less than a particle size (e.g., diameter) desired to be filtered. Particle filtration is well known in the art.

In an embodiment, a first portion 41280, 42280 of the body 41205, 42205 of the drilling mud screen 4140, 4240 may have a drilling mud inlet 41220, 42220. In an embodiment, the drilling mud inlet 41220, 42220 may comprise a plurality of spaces (i.e., flow passages) between a plurality of rods. In an embodiment, the drilling mud inlet 41220, 42220 may comprise a plurality of holes (i.e., flow passages) drilled in a formed sheet. For example, the particle size desired to be filtered from drilling mud may be from about 3/16-inches and larger. For example, the particle size desired to be filtered from the completion fluids may be from about 200 microns to about 2500 microns.

In an embodiment, a first end 41210, 42210 of a first portion 41280, 42280 of the body 41205, 42205 of the drilling mud screen 4140, 4240 may have a first inner diameter 2285; and a second end 41215, 42215 of a second portion 41275, 42275 of the body 41205, 42205 may have a second inner diameter 2290. See e.g., FIGS. 22A-22E.

In an embodiment, the body 41205, 42205 and/or a filter 41230, 42230 of the drilling mud screen 4140, 4240 may have a tapered drilling mud flow path from a larger inner diameter to a smaller inner diameter to reduce washing (i.e., erosion) of the screen 4140, 4240.

In an embodiment, the first inner diameter 2290 of the first end 41210, 42210 of the body 41205, 42205 of the drilling mud screen 4140, 4240 may be from about 2-inches to about 2-inches, and any range or value there between. In an embodiment, the first inner diameter 2290 of the first end 41210, 42210 of the body 41205, 42205 may be about 2.5-inches.

In an embodiment, the second inner diameter 2285 of the second end 41215, 42215 of the body 41205, 42205 of the drilling mud screen 4140, 4240 may be from about 3-inches to about 5-inches, and any range or value there between. In an embodiment, the second inner diameter 2285 of the second end 41215, 42215 of the body 41205, 42205 may be about 3.9-inches.

In an embodiment, the first inner diameter 2290 of the first end 41210, 42210 of the body 41205, 42205 of the drilling mud screen 4140, 4240 may be from about 2-inches to about 3-inches, and any range or value there between. In an embodiment, the first inner diameter 2290 of the first end 41210, 42210 of the body 41205, 42205 may be about 2.3-inches.

In an embodiment, an inner diameter of an outlet of the first portion 41280, 42280 and an inlet of the second portion 41275, 42275 of the body 41205, 42205 may be from about 2-inches to about 3-inches, and any range or value there between. In an embodiment, the inner diameter of the outlet of the first portion 41280, 42280 of the body 41205, 42205 and the inlet of the second portion 41275, 42275 of the body 41205, 42205 may be about 2.5-inches.

In an embodiment, the outer surface 2295 of the second portion 41275, 42275 of the body 41205, 42205 of the drilling mud screen 4140, 4240 may be adapted to engage one or more shoulders in an inner surface of the second body 4105*b*, 4205*b*. In an embodiment, a first shoulder and a second shoulder of the body 41205, 42205 may be offset from a second end 41215, 42215 of the body 41205, 42205. The first and second shoulders may be offset from the second end 41215, 42215 of the body 41205, 42205 at any suitable distance. In an embodiment, the first shoulder may be offset from the second end 41215, 42215 of the body 41205, 42205 from about 4-inches to about 8-inches, and any range or value there between; and the second shoulder may be offset from the second end 41215, 42215 of the body 41205, 42205 from about 5-inches to about 9-inches, and any range or value there between. In an embodiment, the first shoulder may be offset from the second end 41215, 42215 of the body 41205, 42205 about 4.8-inches; and the second shoulder may be offset from the second end 41215, 42115 of the body 41205, 42205 about 6.8-inches. See e.g., FIGS. 22A-22E.

In an embodiment, the outer surface 2295 of the body 41205, 42205 of the drilling mud screen 4140, 4240 may be sealed against an inner surface of the second body 4105*b*, 4205*b* via an O-ring. Any suitable O-ring may be used. For example, suitable O-rings include, but are not limited to, 300 Series O-rings. O-rings are well known in the art. See e.g., FIGS. 22A-22E.

In an embodiment, the filter 41230, 42230 may have a plurality of rods spaced a distance apart to form a filter, or, alternatively, a formed sheet having drilled holes spaced a distance apart to form a filter. In an embodiment, the plurality of rods may be tapered from a larger outer diameter to a smaller outer diameter to encourage drilling mud flow to enter in straight lines through the drilling mud inlet 41220, 42220 (i.e., through flow passages between the plurality rods) to reduce washing (i.e., erosion) of the screen 4140, 4240. In an embodiment, the filter 41230, 42230 may have a plurality of straight rows of holes drilled in a formed sheet to encourage drilling mud flow to enter in straight rows of strings through the drilling mud inlet 41220, 42220 (i.e., through straight flow passages of the drilled holes) to reduce washing (i.e., erosion) of the screen 4140, 4240.

In an embodiment, a first end of a filter 41230, 42230 may be connected to a second end of the end cap 41235, 42235 via a connection; and a second end of a filter 41230, 42230 may be connected to a first end 41210, 42210 of the body 421205, 42205 via a connection. Any suitable connection may be used for the filter 41230, 42230 and end cap 41235, 42235. For example, suitable connections include, but are not limited to, welds. Connections are well known in the art. In an embodiment, and the first end of the filter 41230, 42230 may be connected to the second end of the end cap 41235, 42235 via a weld; and the second end of the filter 41230, 42230 may be connected to the first end 41210, 42210 of the body 41205, 42205 via a weld.

In an embodiment, the first end of the filter 41230, 42230 may fit into a first recess in the second end of the end cap 41235, 42235; and the second end of the filter 41230, 42230 may fit into a second recess in the first end 41210, 42210 of the body 41205, 42205. In an embodiment, the first recess and the second recess may be a plurality of recessed holes or a recessed groove. In an embodiment, the first recess and the second recess may be a plurality of recessed holes.

In an embodiment, the filter 41230, 42230 may be held together with a retaining ring. In an embodiment, the retaining ring may have a plurality of holes to hold the plurality of rods to form the filter 41230, 42230. In an embodiment, the plurality of rods may be connected to the plurality of holes in the retainer ring via a connection. Any suitable connection may be used for the filter 41230, 42230 and retaining ring. For example, suitable connections include, but are not limited to, welds. Connections are well known in the art. In an embodiment, the plurality of rods may be connected to the plurality of holes in the retainer ring via a weld.

In an embodiment, the filter 41230, 42230, including any retaining rings, of the drilling mud screen 4140, 4240 may be constructed of any suitable material. For example, suitable materials include, but are not limited to, any alloy steel or tool steel. In an embodiment, the filter 41230, 42230 may be constructed of 304 stainless steel material. In an embodiment, the filter 41230, 42230 may be constructed of AISI 4145 or equivalent material. In an embodiment, the filter 41230, 42230 may be constructed of D2 tool steel or equivalent material.

In an embodiment, the filter 41230, 42230 may have a hardened coating to reduce washing (i.e., erosion) of the screen 4140, 4240. For example, suitable hardened coatings include, but are not limited to, any Carbide coating or equivalent. In an embodiment, the filter 41230, 42230 may have a Carbide coating with about 6% Cobalt binder or equivalent material.

In an embodiment, the end cap 41235, 42235 of the drilling mud screen 4140, 4240 has an outer surface 41255, 42255. In an embodiment, the outer surface 41225, 42255 of the end cap 41235, 42235 of the drilling mud screen 4140, 4240 may redirect the flow to reduce washing (i.e., erosion) of the screen 4140, 4240. In an embodiment, the outer surface 41255, 42255 of the end cap 41235, 42235 of the drilling mud screen 4140, 4240 forms an inverted cone relative to the first end 41210, 42210 of the body 41205, 42205 of the drilling mud screen 4140, 4240 (i.e., an upstream pointing cone) to redirect the flow. In an embodiment, the tip of the inverted cone may have a rounded or squared shape.

In an embodiment, the body 41205, 42205 of the drilling mud screen 4140, 4240 has a centerline 41245, 42245 and a length 41250, 42250. In an embodiment, the centerline 41245, 42245 extends through the center of the drilling mud screen outlet 41225, 42225 to the end cap 41235, 42235. In an embodiment, the centerline 41245, 42245 of the body 41205, 42205 of the drilling mud screen 4140, 4240 and the outer surface 41255, 42255 of the end cap 41235, 42235 form an angle 41260, 42260. In an embodiment, the angle 41260, 42260 may be from about 30-degrees to about 90-degrees, and any range or value there between. In an embodiment, the angle 41260, 42260 may be from about 35-degrees to about 45-degrees.

In an embodiment, the end cap 41235, 42235 of the drilling mud screen 4140, 4240 may be constructed of any suitable material. For example, suitable materials include, but are not limited to, any alloy steel or tool steel. In an embodiment, the end cap 41235, 42235 may be constructed of 304 stainless steel material or equivalent material. In an embodiment, the end cap 41235, 42235 may be constructed of AISI 4155 or equivalent material. In an embodiment, the end cap 41235, 42235 may be constructed of tool steel or equivalent material.

In an embodiment, the end cap 41235, 42235 of the drilling mud screen 4140, 4240 may have a hardened coating to reduce washing (i.e., erosion) of the screen 4140, 4240. For example, suitable hardened coatings include, but are not limited to, any Carbide coating or equivalent. In an embodiment, the end cap 41235, 42235 may have a Carbide coating with about 6% Cobalt binder or equivalent material.

Optional Drilling Mud Screen Insert

FIG. 23 illustrates a cross-sectional view of a mud screen system according to an embodiment of the present invention, showing an optional drilling mud screen insert 23105 inserted into a drilling mud screen 2340. As shown in FIG. 23, the drilling mud screen system 700, 1900, 2100 has an optional drilling mud screen insert 23105 inserted into a drilling mud screen 2340 to reduce the washing (i.e., erosion) of the drilling mud screen 2340. In an embodiment, the optional drilling mud screen insert 23105 may be inserted into a first end 510, 2210 of the drilling mud screen 2340. See e.g., FIGS. 5 & 22. In an embodiment, the optional drilling mud screen insert 23105 may be brazed or welded to the drilling mud screen 2340.

Figure 24A:
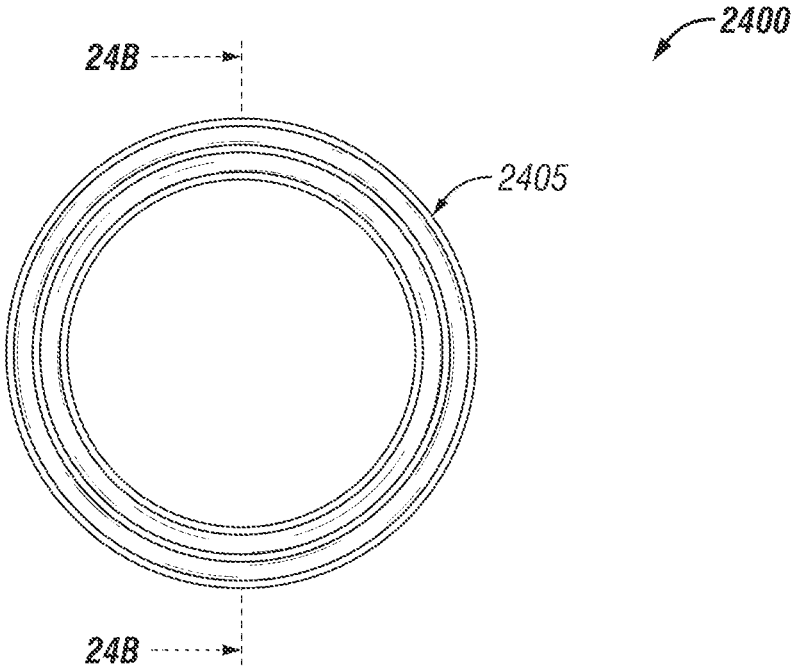
FIG. 24A illustrates an end view of an optional drilling mud screen insert according to an embodiment of the present invention.
Figure 24B:
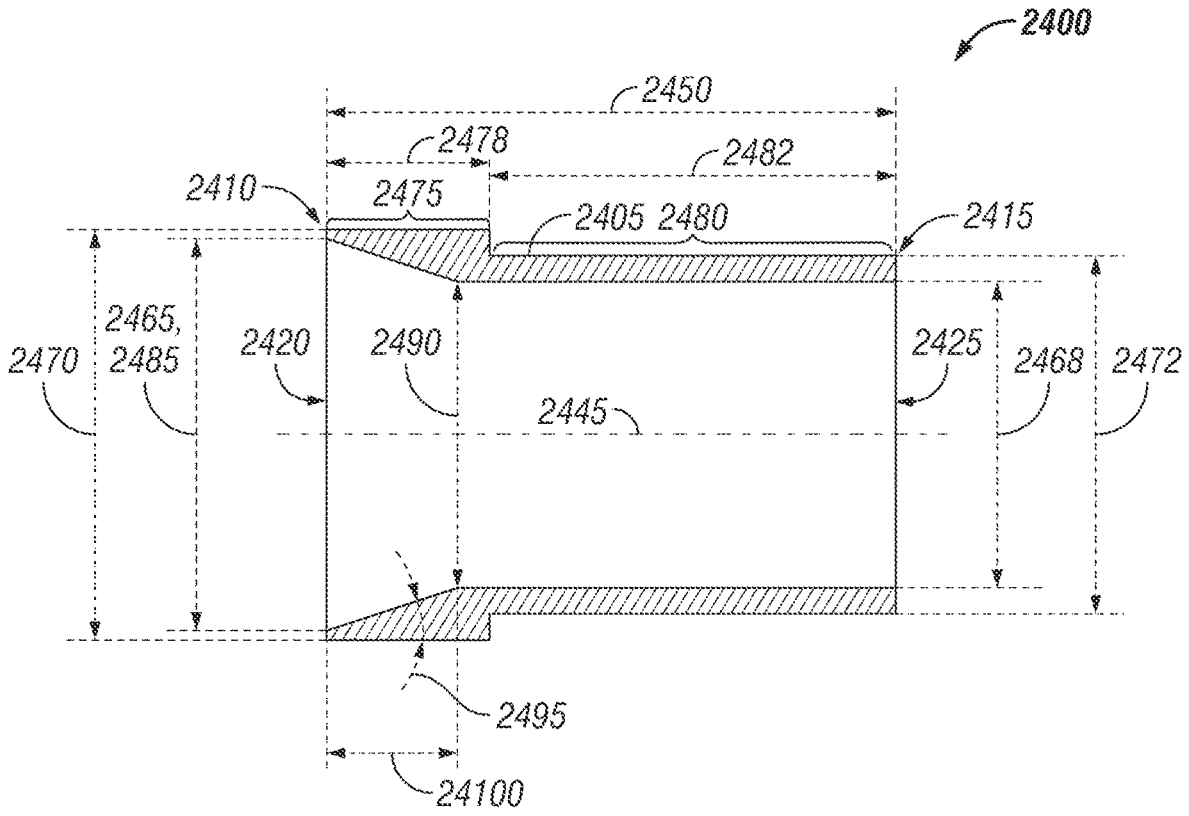
FIG. 24B illustrates a detailed, cross-sectional view of A-A of FIG. 24A, showing an inlet of the drilling mud screen insert and an outlet of the drilling mud screen insert.
Figure 24C:
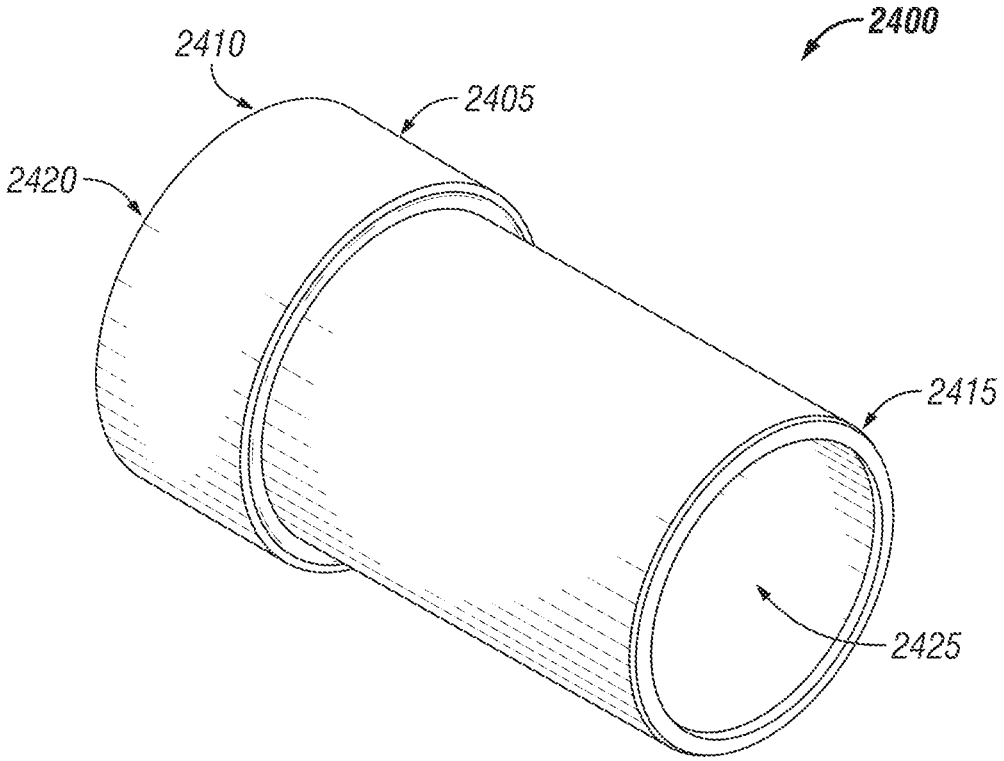
FIG. 24C illustrates an upper, right perspective view of the optional drilling mud screen insert of FIGS. 24A-24B.

FIG. 24A illustrates an end view of an optional drilling mud screen insert according to an embodiment of the present invention; FIG. 24B illustrates a detailed, cross-sectional view of A-A of FIG. 24A, showing an inlet of the drilling mud screen insert and an outlet of the drilling mud screen insert; and FIG. 24C illustrates an upper, right perspective view of the optional drilling mud screen insert of FIGS. 24A-24B. As shown in FIG. 24B, the optional drilling mud screen insert 2400 has a body 2405 having a first end 2410 and a second end 2415, a drilling mud inlet 2420 and a drilling mud outlet 2425.

In an embodiment, the body 2405 of the optional drilling mud screen insert 2400 may be constructed of any suitable material. For example, suitable materials include, but are not limited to, any alloy steel or tool steel. In an embodiment, the body 2405 may be constructed of an AISI 4145 or equivalent material. See e.g., FIGS. 5A-5E. In an embodiment, the body 2405 may be constructed of tool steel or equivalent material.

In an embodiment, the body 2405 of the optional drilling mud screen insert 2400 may have a hardened coating to reduce washing (i.e., erosion) of the insert 2400. For example, suitable hardened coatings include, but are not limited to, any Carbide coating or equivalent. In an embodiment, the body 2405 may have a Carbide coating with about 6% Cobalt binder or equivalent material.

In an embodiment, the body 2405 of the optional drilling mud screen insert 2400 has a centerline 2445 and a length 2450. In an embodiment, the centerline 2445 extends through the center of the drilling mud inlet 2420 to the drilling mud outlet 2425. The length 2450 of the body 2405 may be any suitable length. In an embodiment, the length 2450 of the body 2405 may be from about 5-inches to about 10-inches, and any range or value there between. In an embodiment, the length 2450 may be about 6.9-inches.

In an embodiment, the drilling mud inlet 2420 of the optional drilling mud screen insert 2400 may have any suitable inner diameter 2465; and the drilling mud inlet 2420 may have any suitable outer diameter 2470. In an embodiment, the inner diameter 2465 of the drilling mud inlet 2450 may be from about 3-inches to about 5-inches, and any range or value there between. In an embodiment, the inner diameter 2465 of the drilling mud inlet 2420 may be about 3.9-inches.

In an embodiment, the outer diameter 2470 of the drilling mud inlet 2420 may be from about 4-inches to about 6-inches, and any range or value there between. In an embodiment, the outer diameter 2470 of the drilling mud inlet 2420 may be about 4-inches.

In an embodiment, the drilling mud outlet 2425 of the optional drilling mud screen insert 2400 may have any suitable inner diameter 2468; and the drilling mud outlet 2425 may have any suitable outer diameter 2472. In an embodiment, the inner diameter 2468 of the drilling mud outlet 2425 may be from about 2-inches to about 5-inches, and any range or value there between. In an embodiment, the inner diameter 2468 of the drilling mud outlet 2425 may be about 3-inches.

In an embodiment, the outer diameter 2472 of the drilling mud outlet 2425 may be from about 3.5-inches to about 6-inches, and any range or value there between. In an embodiment, the outer diameter 2472 of the drilling mud outlet 2425 may be about 3.5-inches.

In an embodiment, the body 2405 of the optional drilling mud screen insert 2400 has a first portion 2475 and a second portion 2480. In an embodiment, the first portion 2475 of the body 2405 has a first length 2478; and the second portion 2480 of the body 2405 has a second length 2482. The first portion 2475 and the second portion 2480 may be any suitable length. In an embodiment, the first portion 2475 may have a first length 2478 from about 1-inch to about 3-inches, and any range or value there between; and the second portion 2480 may have a second length 2482 from about 3-inches to about 7-inches, and any range or value there between. In an embodiment, the first portion 2475 may have a first length 2478 of about 2-inches; and the second portion 2480 may have a second length 2482 of about 4.9-inches.

In an embodiment, the first portion 2475 of the body 2405 may have a first inner diameter 2485 and a second inner diameter 2490.

In an embodiment, the first inner diameter 2485 of the first portion 2475 may have any suitable diameter. In an embodiment, the first inner diameter 2485 of the first portion 2475 may be from about 3-inches to about 5-inches, and any range or value there between. In an embodiment, the first inner diameter 2485 of the first portion 2475 may be about 3.9-inches.

In an embodiment, the second inner diameter 2490 of the first portion 2475 may have any suitable diameter. In an embodiment, the second inner diameter 2490 of the first portion 2475 may be from about 2-inches to about 5-inches, and any range or value there between. In an embodiment, the second inner diameter 2490 of the first portion 2475 may be about 3-inches.

In an embodiment, an outer surface of the first portion 2475 and an inner surface of the first portion 2475 form an angle 2495 over a third length 24125. In an embodiment, the angle may be from about 10-degrees to about 20-degrees, and any range or value there between. In an embodiment, the angle 2495 may be about 15-degrees.

In an embodiment, the third length 24125 may be from about 1-inch to about 2-inches, and any range or value there between. In an embodiment, the third length 24125 may be about 1.5-inches.

Optional First End Retaining Ring

Figure 25:
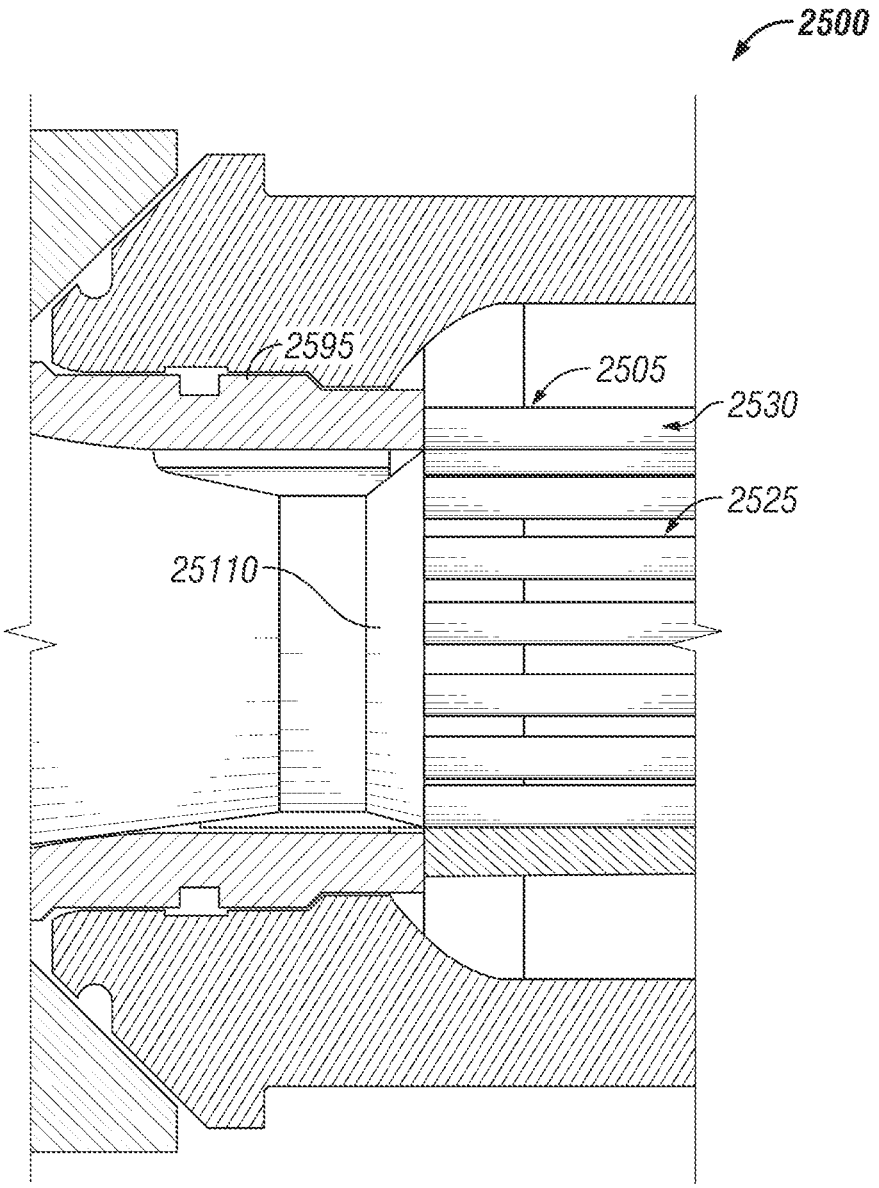
FIG. 25 illustrates a detailed, cross-sectional view of the optional drilling mud screen, showing an optional first end retaining ring.

FIG. 25 illustrates a detailed, cross-sectional view of the optional drilling mud screen 2500, showing an optional first end retaining ring 25110. As shown in FIG. 25, the optional drilling mud screen 2500 has a body 2505, a drilling mud outlet 2525, a filter 2530, an outer surface of body 2595 and an optional first end retaining ring 25110.

As shown in FIGS. 22B and 25, the filter 2230 may be held together with an optional first end retaining ring 25110. In an embodiment, the optional filter retaining ring 25110 may have a plurality of holes to hold the plurality of rods to form the filter 2230. In an embodiment, the plurality of rods may be connected to the plurality of holes in the optional filter retainer ring via a connection. Any suitable connection may be used for the filter 2230 and first end retaining ring 25110. For example, suitable connections include, but are not limited to, welds. Connections are well known in the art. In an embodiment, the plurality of rods may be connected to the plurality of holes in the retainer ring via a weld.

In an embodiment, the optional first end retaining ring 25110 of the optional drilling mud screen 2500 may be constructed of any suitable material. For example, suitable materials include, but are not limited to, any alloy steel or tool steel. In an embodiment, the optional first end retaining ring 25110 may be constructed of an AISI 4145 or equivalent material. See e.g., FIGS. 5A-5E. In an embodiment, the optional first end retaining ring 25110 may be constructed of D2 tool steel or equivalent material.

In an embodiment, the optional first end retaining ring 25110 of the optional drilling mud screen 2500 may have a hardened coating to reduce washing (i.e., erosion) of the retaining ring 25110. For example, suitable hardened coatings include, but are not limited to, any Carbide coating or equivalent. In an embodiment, the optional first end retaining ring 25110 may have a Carbide coating with about 6% Cobalt binder or equivalent material.

In an embodiment, the optional first end retaining ring 25110 may be modified to reduce an inside surface exit angle between the first portion 2575 and the second portion 2580 of the drilling mud screen 2500, resulting in increased flow efficiency and decreased erosion. In an embodiment, the exit angle may be about 10-degrees to about 90-degrees, and any range or value there between. In an embodiment, the exit angle may be from about 10-degrees to about 50-degrees. In an embodiment, the exit angle may be about 30-degrees.

Optional Filter Retaining Ring

Figure 26A:
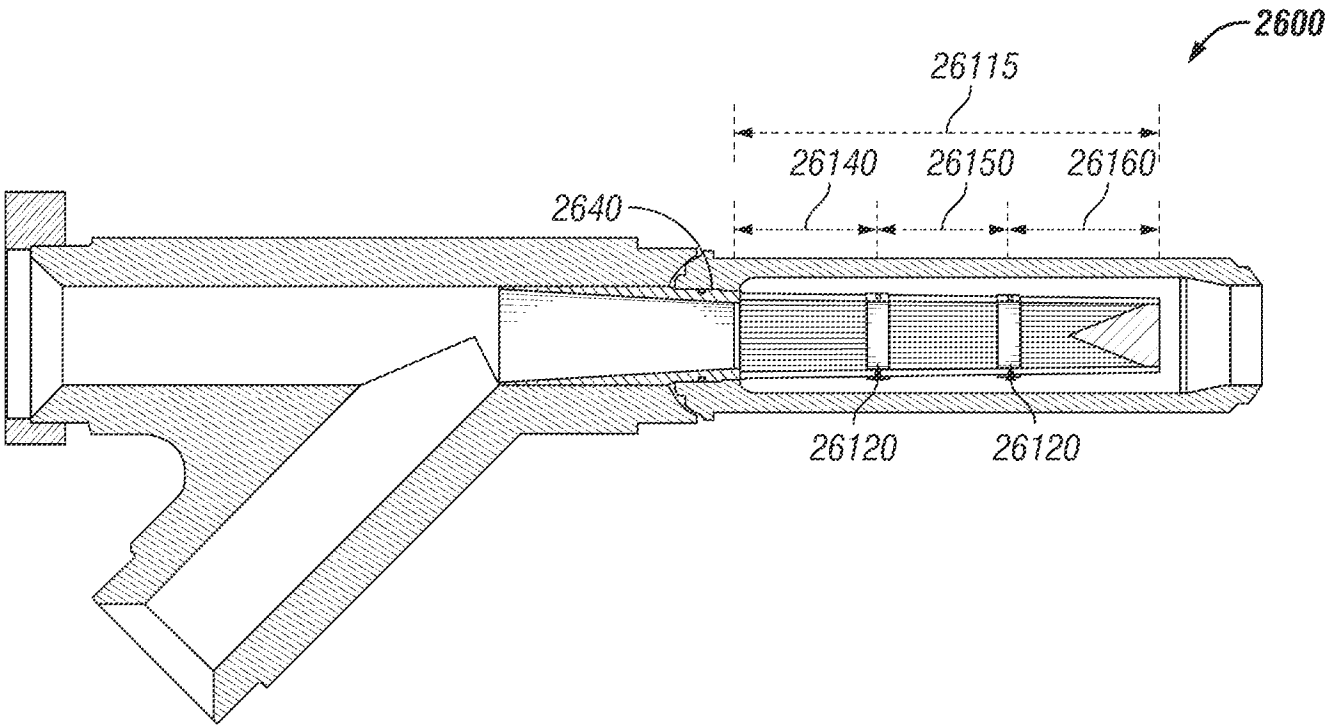
FIG. 26A illustrates a side view of an optional drilling mud screen according to an embodiment of the present invention, showing an optional filter length, and an optional filter retaining ring.
Figure 26B:
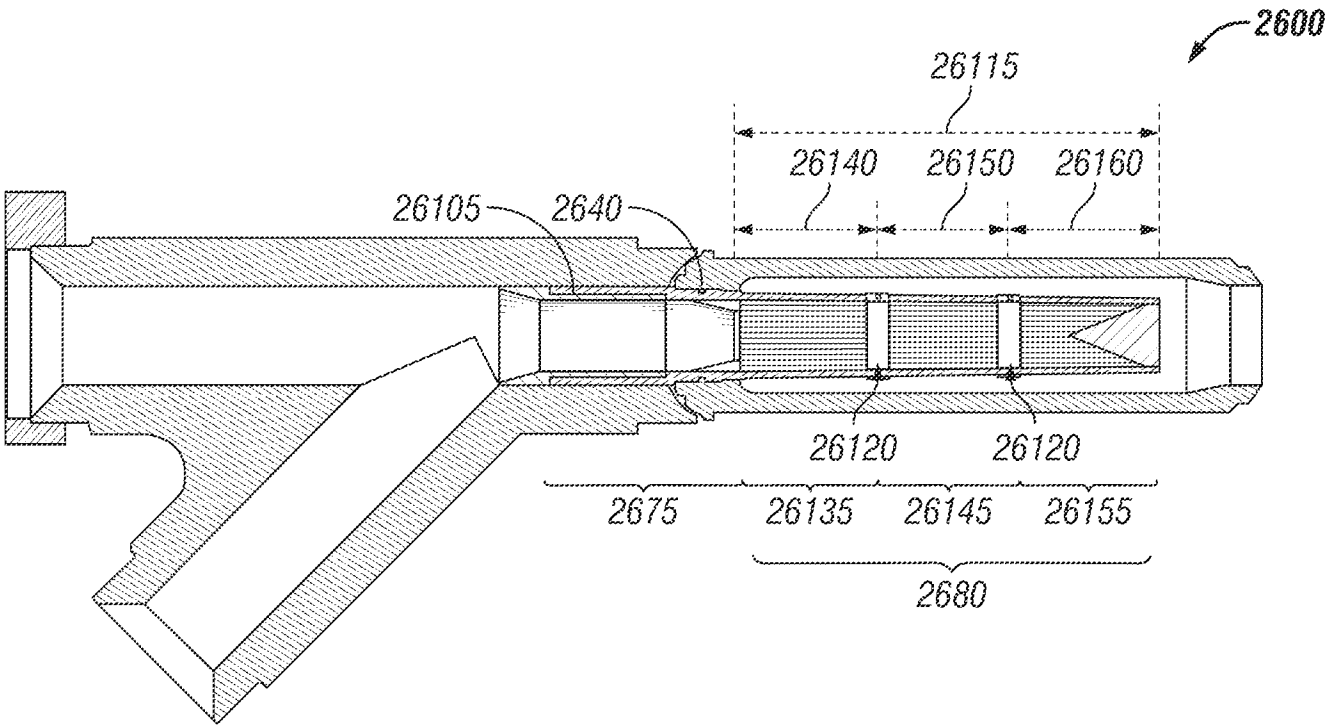
FIG. 26B illustrates a detailed, cross-sectional view of the optional drilling mud screen of FIG. 26A, showing an optional drilling mud screen insert, an optional filter length, and an optional filter retaining ring.

FIG. 26A illustrates a side view of an optional drilling mud screen system 2600 according to an embodiment of the present invention, showing an optional filter length 26115, and an optional filter retaining ring 26120; and FIG. 26B illustrates a detailed, cross-sectional view of the optional drilling mud screen system 2600 of FIG. 26A, showing an optional drilling mud screen insert 26105, an optional filter length 26115, and an optional filter retaining ring 26120. As shown in FIGS. 26A and 26B, the optional drilling mud screen system 2600 has an optional drilling mud screen insert 26105, an optional filter length 26115, and an optional retaining ring 26120.

In an embodiment, the optional filter retaining ring 26120 of the optional drilling mud screen 2640 may be constructed of any suitable material. For example, suitable materials include, but are not limited to, any alloy steel or tool steel. In an embodiment, the optional filter retaining ring 26120 may be constructed of an AISI 4145 or equivalent material. See e.g., FIGS. 5A-5E. In an embodiment, the optional filter retaining ring 26120 may be constructed of D2 tool steel or equivalent material.

In an embodiment, the optional filter retaining ring 26120 of the optional drilling mud screen 2640 may have a hardened coating to reduce washing (i.e., erosion) of the optional filter retaining ring 26120. For example, suitable hardened coatings include, but are not limited to, any Carbide coating or equivalent. In an embodiment, the optional filter retaining ring 26120 may have a Carbide coating with about 6% Cobalt binder or equivalent material.

In an embodiment, the optional filter retaining ring 26120 of the optional drilling mud screen 2640 may be modified to reduce inside surface entry and exit angles of the drilling mud screen 2640, resulting in increased flow efficiency and decreased erosion. In an embodiment, the exit and entry angles may be from about 10-degrees to about 90-degrees, and any range or value there between. In an embodiment, the entry and exit angles may be from about 10-degrees to about 50-degrees. In an embodiment, the entry and exit angles may be about 30-degrees.

Figure 27A:
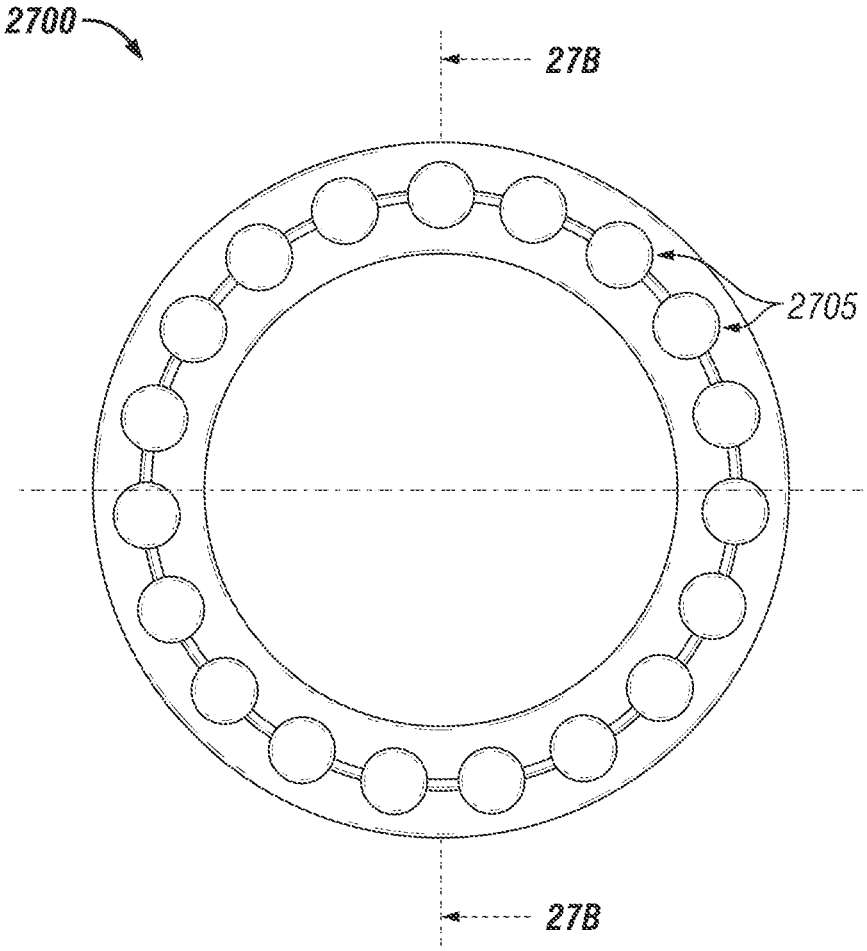
FIG. 27A illustrates an end view of an optional filter retaining ring according to an embodiment of the present invention.
Figure 27B:
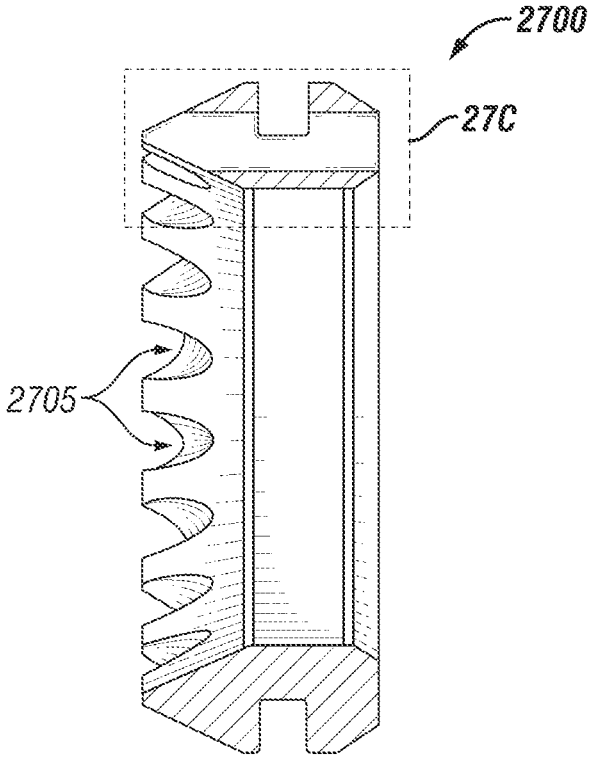
FIG. 27B illustrates a detailed, cross-sectional view of A-A of FIG. 27A.
Figure 27C:
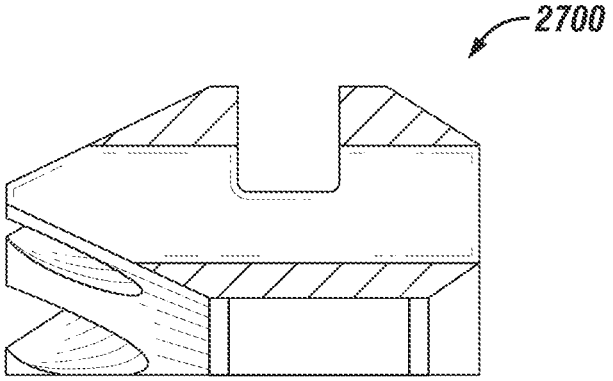
FIG. 27C illustrates a detailed, cross-sectional view of B of FIG. 27B.

FIG. 27A illustrates an end view of an optional filter retaining ring 2700 according to an embodiment of the present invention; FIG. 27B illustrates a detailed, cross-sectional view of A-A of FIG. 27A; and FIG. 27C illustrates a detailed, cross-sectional view of B of FIG. 27B.

As shown in FIGS. 22B and 27A, the filter 2230 may be held together with an optional filter retaining ring 2700. In an embodiment, the optional filter retaining ring 2700 may have a plurality of holes 2705 to hold the plurality of rods to form the filter 2230. In an embodiment, the plurality of rods may be connected to the plurality of holes in the optional filter retainer ring via a connection. Any suitable connection may be used for the filter 2230 and filter retaining ring 2700. For example, suitable connections include, but are not limited to, welds. Connections are well known in the art. In an embodiment, the plurality of rods may be connected to the plurality of holes in the retainer ring via a weld.

In an embodiment, the optional filter retaining rings 2700 of the optional drilling mud screen 2200 may be constructed of any suitable material. For example, suitable materials include, but are not limited to, any alloy steel or tool steel. In an embodiment, the optional filter retaining rings 2700 may be constructed of 304 stainless steel material. See e.g., FIGS. 5A & 5E. In an embodiment, the optional filter retaining rings 2700 may be constructed of AISI 4145 or equivalent material. In an embodiment, the optional filter retaining rings 2700 may be constructed of D2 tool steel or equivalent material.

In an embodiment, the optional filter retaining ring 2700 of the optional drilling mud screen 2220 may have a hardened coating to reduce washing (i.e., erosion) of the screen 2200. For example, suitable hardened coatings include, but are not limited to, any Carbide coating or equivalent. In an embodiment, the optional filter retaining rings 2700 may have a Carbide coating with about 6% Cobalt binder or equivalent material.

In an embodiment, the optional filter retaining ring 2700 of the optional drilling mud screen 2200 may be modified to reduce inside surface entry and exit angles of the drilling mud screen 2200, resulting in increased flow efficiency and decreased erosion. In an embodiment, the entry and exit angles may be from about 10-degrees to about 50-degrees, and any range or value there between. In an embodiment, the entry and exit angles may be about 25-degrees or about 30-degrees.

Optional Filter Length

FIG. 26A illustrates a side view of an optional drilling mud screen system 2600 according to an embodiment of the present invention, showing an optional filter length 26115, and an optional filter retaining ring 26120; and FIG. 26B illustrates a detailed, cross-sectional view of the optional drilling mud screen system 2600 of FIG. 26A, showing an optional drilling mud screen insert 26105, an optional filter length 26115, and an optional filter retaining ring 26120. As shown in FIGS. 26A and 26B, the optional drilling mud screen system 2600 has an optional drilling mud screen insert 26105, an optional filter length 26115, and an optional retaining ring 26120.

As shown in FIG. 26B, the optional drilling mud screen 2640 has a first portion 2675 and a second portion 2680. In an embodiment, the first portion 2675 of the optional drilling mud screen 2640 has a first length 26125; and the second portion 2680 of the optional drilling mud screen 2640 has a second length 26130. The first portion 2675 and the second portion 2680 may be any suitable length. In an embodiment, the first portion 2675 may have a first length 26125 from about 6-inches to about 10-inches, and any range or value there between; and the second portion 2680 may have a second length 26130 from about 14-inches to about 20-inches, and any range or value there between. In an embodiment, the first portion 2275 may have a first length 26125 of about 7.5-inches; and the second portion 2680 may have a second length 26130 of about 17.5-inches.

In an embodiment, the second portion 2680 of the optional drilling mud screen 2640 has a first section 26135, a second section 26145 and a third section 26155. In an embodiment, the first section 26135 has a third length 26140, the second section 26145 has a fourth length 26150 and the third section 26155 has a fifth length 26160. The first section 26135, the second section 26145 and the third section 26155 may be any suitable length. In an embodiment, the first section 26135 of the optional drilling mud screen 2640 may be up to about 20-25% longer than the second section 26145 and/or the third section 26155, resulting in increased flow efficiency and decreased erosion.

In an embodiment, the first section 26135 may have a third length 26140 from about 4-inches to about 8-inches, and any range or value there between. In an embodiment, the first section 26135 may have a third length 26140 of about 6-inches.

In an embodiment, the second section 26145 may have a fourth length 26150 from about 4-inches to about 8-inches, and any range or value there between. In an embodiment, the second section 26145 may have a fourth length 26150 of about 5-inches.

In an embodiment, the third section 26155 may have a fifth length 26160 from about 4-inches to about 8-inches, and any range or value there between. In an embodiment, the third section 26155 may have a fifth length 26160 of about 5-inches.

Optional Cementing Configuration

FIG. 28 illustrates a cross-sectional view of a drilling mud screen system in a cementing configuration 2800 according to an embodiment of the present invention, showing an optional first transducer subassembly 28100' having an optional transducer 28105, an optional gate valve 28205 and an optional second transducer subassembly 28100" having an optional low torque plug valve 28110. As shown in FIG. 28, the drilling mud screen system in a cementing configuration 2800 comprises an optional first transducer subassembly 28100' having an optional transducer 28105, a drilling mud screen system 28200, an optional gate valve 28300 and an optional second transducer subassembly 28100" having an optional low torque plug valve 28110.

In an embodiment, a first drilling mud inlet 28120' of the optional first transducer subassembly 28100' may be fluidly connected to, for example, an outlet of a drilling mud pump via a connection; and a first drilling mud outlet 28125' of the optional first transducer subassembly 28100' may be fluidly connected to, for example, a drilling mud inlet 28120 of a drilling mud screen system 28200 via a connection. Any suitable connection may be used for the first drilling mud inlet 28120' and the first drilling mud outlet 28125'. For example, suitable connections include, but are not limited to, pipe fittings and welds. Connections are well known in the art. In an embodiment, the first drilling mud inlet 28120' of the optional first transducer subassembly 28100' may be fluidly connected to, for example, an outlet of a drilling mud pump via a weld; and the first drilling mud outlet 28125' of the optional first transducer subassembly 28100' may be fluidly connected to a drilling mud inlet 28220 of a drilling mud screen system 28200 via a weld.

The inlet pressure to the first drilling mud inlet 28120' of the optional first transducer subassembly 28100' may be any suitable pressure. In an embodiment, the inlet pressure may be from about 7500 psi to about 10,000 psi, and any range or value there between.

In an embodiment, the transducer access port 28130 of the optional first transducer subassembly 28100' may be closed with an optional transducer 28105 via a fitting. Any suitable type of transducer 28105 may be used. For example, suitable types of transducers include, but are not limited to, displacement transducers, flow rate transducers, pressure transducers, temperature transducers and any combination thereof. Any suitable fitting may be used. For example, suitable fittings include, but are not limited to, pipe fittings. Fittings are well known in the art. In an embodiment, the transducer access port 2030 of the optional transducer subassembly 2000 may be closed with, for example, a pressure transducer 28105 via a 2-inch 1502 WECO union.

In an embodiment, a computing device (such as a rig computer) may include a bus that directly or indirectly couples the following devices: memory, one or more processors, one or more presentation components, one or more input/output (I/O) ports, I/O components, a user interface and a power supply. The computing device may include a variety of computer-readable media. The memory may include computer-storage media in the form of volatile and/or nonvolatile memory. The presentation component(s) present data indications to a user or other device. The user interface allows the user to input/output information to/from the computing device. The one or more I/O ports may allow the computing device to be logically coupled to other devices including a transducer 28105, and other I/O components, some of which may be built in. See e.g., FIG. 28. Examples of other I/O components include a printer, scanner, wireless device, and the like.

In an embodiment, pressure information from, for example, a pressure transducer 28105 will allow a driller to know when a drilling mud screen (not shown) in a drilling mud screen system 28200 is "packing off." For example, the pressure information from the pressure transducer 28105 at the drilling mud inlet 28220 of the drilling mud screen system 28200 may be compared to, for example, pressure information from a pressure transducer on a pressure transducer for a stand pipe. If the pressure decreases at the stand pipe and the pressure increases at the drilling mud inlet 28220 of the drilling mud screen system 28200, the drilling mud screen (not shown) is likely "packing off" If the pressure decreases or increases at both the stand pipe and the drilling mud screen system, then the problem is likely down hole and not at the drilling mud screen system 28200. If the problem is at the drilling mud screen system 28200, the drilling mud screen may be cleaned, repaired or replaced.

In an embodiment, a drilling mud inlet 28220 of the drilling mud screen system 28200 may be fluidly connected to, for example, a first drilling mud outlet 28125' of the optional first transducer subassembly 28100' via a connection; and a drilling mud outlet 28225 of the drilling mud screen system 28200 may be fluidly connected to, for example, a drilling mud inlet 28320 of an optional gate valve 28300 via a connection. Any suitable connection may be used for the drilling mud inlet 2820 and the drilling mud outlet 2825. For example, suitable connections include, but are not limited to, pipe fittings and welds. Connections are well known in the art. In an embodiment, the drilling mud inlet 28200 of the drilling mud screen system 28200 may be fluidly connected to, for example, a first drilling mud outlet 28120' of the optional first transducer subassembly 28100' via a weld; and the drilling mud outlet 28225 of the drilling mud screen system 28200 may be fluidly connected to, for example, a drilling mud inlet 28320 of the optional gate valve 28300 via a weld.

The inlet pressure to the drilling mud inlet 28220 of the drilling mud screen system 28200 may be any suitable pressure. In an embodiment, the inlet pressure may be from about 7500 psi to about 10,000 psi, and any range or value there between.

In an embodiment, a drilling mud inlet 28320 of the optional gate valve 28300 may be fluidly connected to, for example, a drilling mud outlet 28220 of the drilling mud screen system 28200 via a connection; and a drilling mud outlet 28325 of the optional gate valve 28300 may be fluidly connected to, for example, a second drilling mud inlet 28120" of the optional second transducer subassembly 28100" via a connection. Any suitable connection may be used for the drilling mud inlet 28320 and the drilling mud outlet 28325. For example, suitable connections include, but are not limited to, pipe fittings and welds. Connections are well known in the art. In an embodiment, the drilling mud inlet 28320 of the optional gate valve 28300 may be fluidly connected to, for example, a drilling mud outlet 28220 of a drilling mud screen system 28200 via a weld; and the drilling mud outlet 28225 of the optional gate valve 28300 may be fluidly connected to, for example, a second drilling mud inlet 28125" of the optional second transducer subassembly 28100" via a weld.

In an embodiment, a second drilling mud inlet 28120" of the optional second transducer subassembly 28100" may be fluidly connected to, for example, a drilling mud outlet 28325 of the optional gate valve 28300 via a connection; and a second drilling mud outlet 28125" of the optional second transducer subassembly 28100" may be fluidly connected to, for example, an inlet of a vibrator hose via a connection. Any suitable connection may be used for the second drilling mud inlet 28120" and the second drilling mud outlet 28125". For example, suitable connections include, but are not limited to, pipe fittings and welds. Connections are well known in the art. In an embodiment, a second drilling mud inlet 28120" of the optional second transducer subassembly 28100" may be fluidly connected to, for example, a drilling mud outlet 28325 of the optional gate valve 28300 via a weld; and a second drilling mud outlet 28125" of the optional second transducer subassembly 28100" may be fluidly connected to, for example, an inlet of a vibrator hose via a weld.

In an embodiment, an operator may close an optional gate valve 28300 to isolate a drilling mud screen system 28200 (and an upstream drilling mud pump) from cement for a cementing application. The operator may pump cement through an optional low torque plug valve 28110 in an optional second transducer assembly 28100", through a vibrator hose, through a stand pipe, through a top drive and through a casing running tool (CRT).

Optional Flow Loop Configuration

In an embodiment, one or more drilling mud screen systems may be used in an optional flow loop configuration to create a redundancy and/or to increase through put.

Figure 36:
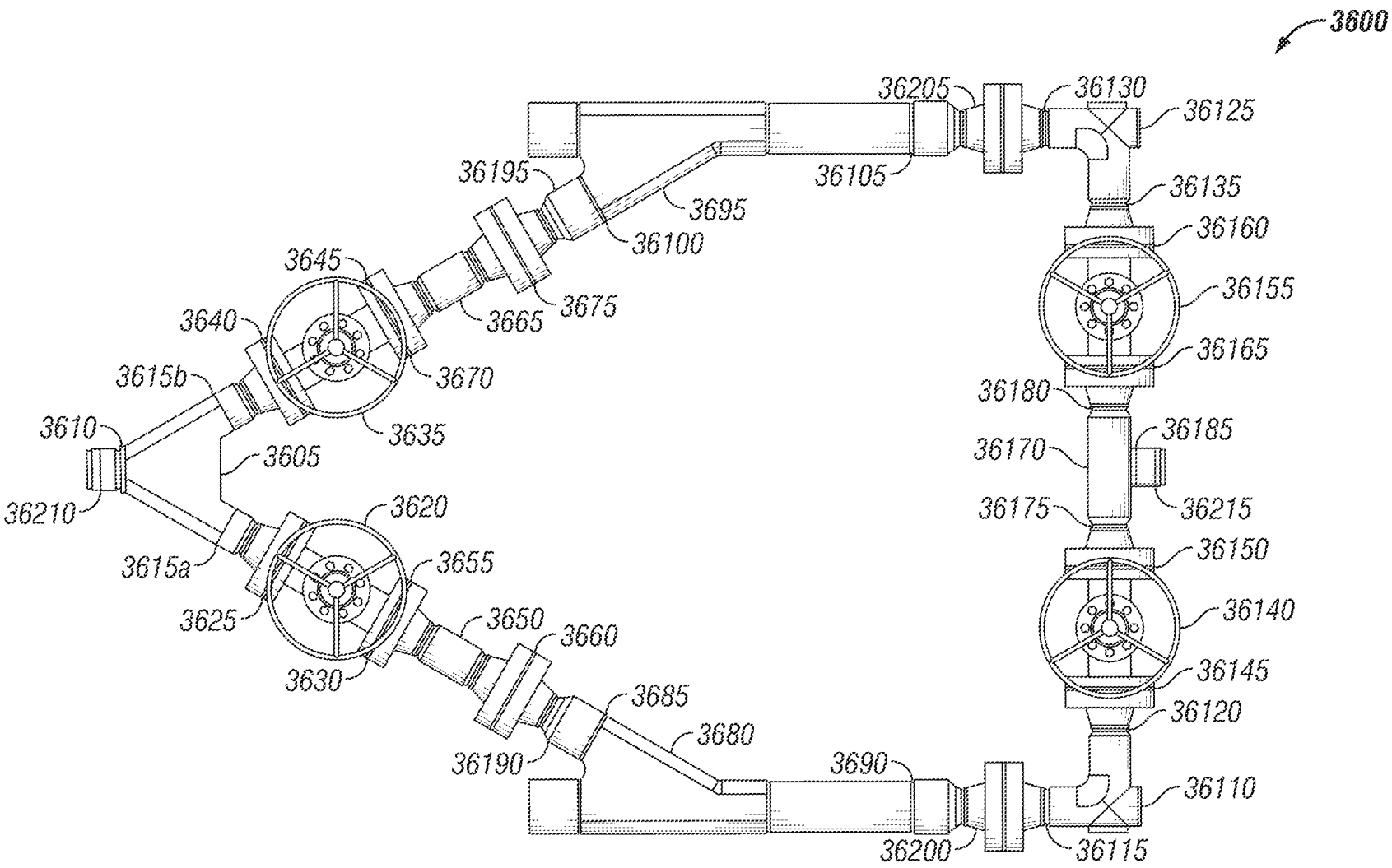
FIG. 36 illustrates a cross-sectional view of a drilling mud screen system in a flow loop configuration according to an embodiment of the present invention, showing a pair of drilling mud screen systems.
Figure 37:
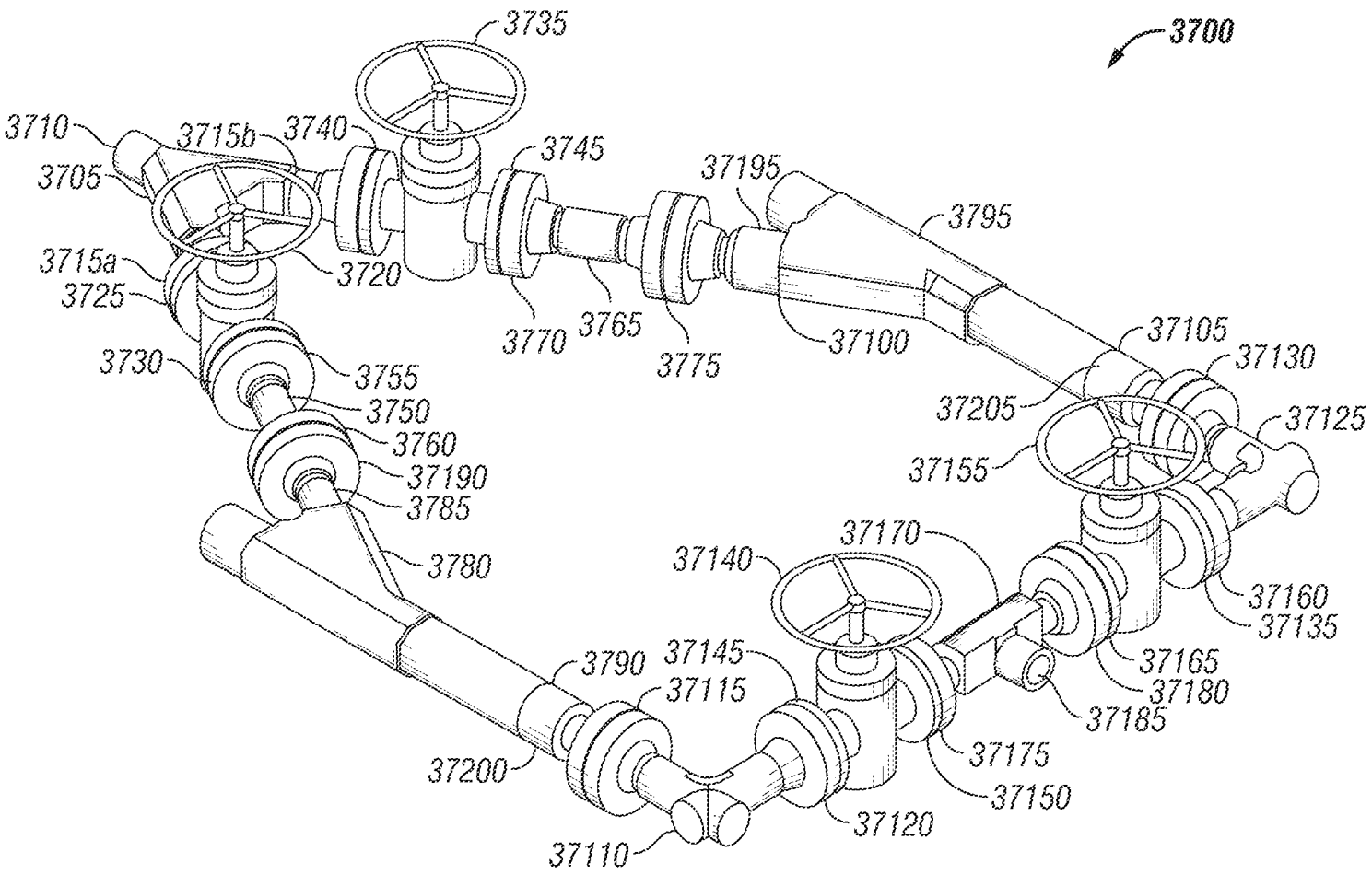
FIG. 37 illustrates an upper, right perspective view of the flow loop configuration of FIG. 36.

FIG. 36 illustrates a cross-sectional view of a drilling mud screen system in an optional flow loop configuration 3600 according to an embodiment of the present invention, showing a pair of drilling mud screen systems; and FIG. 37 illustrates an upper, right perspective view of the optional flow loop configuration 3700 of FIG. 36.

As shown in FIGS. 36 and 37, the flow loop configuration 3600, 3700 comprises a Y-connector (e.g., first drilling mud manifold) 3605, 3705 having a drilling mud inlet 3610, 3710 and a first drilling mud outlet 3615*a*, 2715*a* and a second drilling mud outlet 3615*b*, 3715*b*, a first gate valve 3620, 3720 having a first drilling mud inlet 3625, 3725 and a first drilling mud outlet 3630, 3730, a second gate valve 3635, 3735 having a second drilling mud inlet 3640, 3740 and a second drilling mud outlet 3645, 3745, a first spool 3650, 3750 having an first drilling mud inlet 3655, 3755 and a first drilling mud outlet 3660, 3760, a second spool 3665, 3765 having a second drilling mud inlet 3670, 3770 and a second drilling mud outlet 3675, 3775, a first drilling mud screen system 400, 600, 1400, 2100, 2300, 3680, 3780 having a first drilling mud inlet 420, 620*a*, 1420, 2120*a*, 2320*a*, 3685, 3785 and a first drilling mud outlet 425, 625*b*, 1425, 2120*b*, 3690, 3790, a second drilling mud screen system 400, 600, 1400, 2100, 2300, 3695, 3795 having a second drilling mud inlet 420, 620*a*, 1420, 2120*a*, 2320*a*, 36100, 37100 and a second drilling mud outlet 425, 625*b*, 1425, 2125*b*, 2325*b*, 36105, 37105, a first L-connector 36110, 37110 having a first drilling mud inlet 36115, 37115 and a first drilling mud outlet 36120, 37120, a second L-connector 36125, 37125 having a second drilling mud inlet 36130, 37130 and a second drilling mud outlet 36135, 37135, a third gate valve 36140, 37140 having a third drilling mud inlet 36145, 37145 and a third drilling mud outlet 36150, 37150, a fourth gate valve 36155, 37155 having a fourth drilling mud inlet

36160, 37160 and a fourth drilling mud outlet 36165, 37165, and a T-connector (e.g., second drilling mud manifold) 36170, 37170 having a first drilling mud inlet 36175, 37175, a second drilling mud inlet 36180, 37180 and a drilling mud outlet 36185, 37185.

In an embodiment, the drilling mud inlet 3610, 3710 may be fluidly connected to, for example, an outlet of a drilling mud pump via a connection; and the drilling mud outlet 36185, 37185 may be fluidly connected to an inlet of a vibrator hose via a connection. Any suitable connection may be used for the drilling mud inlet 3610, 3710 and drilling mud outlet 36185, 37185. For example, suitable connections include, but are not limited to, pipe fittings and welds. Connections are well known in the art. In an embodiment, the drilling mud inlet 3610, 3710 may be fluidly connected to, for example, an outlet of a drilling mud pump via a weld; and the drilling mud outlet 36185, 37185 may be fluidly connected to an inlet of a vibrator hose via a weld.

In an embodiment, the flow loop configuration 3600, 3700 comprises a first stub connection 36210 from, for example, an outlet of a drilling mud pump to a drilling mud inlet 3610, 3710 of a Y-connector (e.g., first drilling mud manifold) 3605, 3705.

In an embodiment, the flow loop configuration 3600, 3700 comprises a second stub connection 36215 from, for example, a drilling mud outlet 36185, 37185 of a T-connector (e.g., second drilling mud manifold) 36170, 37170 to an inlet of a vibrator hose.

In an embodiment, the first drilling mud outlet 3615*a*, 3715*a* of the Y-connector (e.g., first drilling mud manifold) 3605, 3705 and the first gate valve 3620, 3720 may be fluidly connected by a connection. Any suitable connection may be used for the first drilling mud outlet 3615*a*, 3715*a* of the Y-connector 3605, 3705 and the first gate valve 3620, 3720. For example, suitable connections include, but are not limited to, flanges and pipe fittings. Connections are well known in the art.

In an embodiment, the Y-connector (e.g., first drilling mud manifold) 3605, 3705 may have an integral flange at the first drilling mud outlet 3615*a*, 3715*a*.

In an embodiment, the first gate valve 3620, 3720 may have an integral flange at the first drilling mud inlet 3625, 3725 and/or the first drilling mud outlet 3630, 3730.

In an embodiment, the second drilling mud outlet 3615*b*, 3715*b* of the Y-connector (e.g., first drilling mud manifold) 3605, 3705 and the second gate valve 3635, 3735 may be fluidly connected by a connection. Any suitable connection may be used for the second drilling mud outlet 3615*b*, 3715*b* of the Y-connector (e.g., first drilling mud manifold) 3605, 3705 and the second gate valve 3635, 3735. For example, suitable connections include, but are not limited to, flanges and pipe fittings. Connections are well known in the art.

In an embodiment, the Y-connector (e.g., first drilling mud manifold) 3605, 3705 may have an integral flange at the second drilling mud outlet 3615*b*, 3715*b*.

In an embodiment, the second gate valve 3635, 3735 may have an integral flange at the second drilling mud inlet 3640, 3740 and/or the second drilling mud outlet 3645, 3745.

In an embodiment, the first drilling mud outlet 3630, 3730 of the first gate valve 3620, 3720 and the first spool 3650, 3750 may be fluidly connected by a connection. Any suitable connection may be used for the first drilling mud outlet 3630, 3730 of the first gate valve 3620, 3720 and the first spool 3650, 3750. For example, suitable connections include, but are not limited to, flanges and pipe fittings. Connections are well known in the art.

In an embodiment, the first gate valve 3620, 3720 may have an integral flange at the first drilling mud inlet 3625, 3725 and/or the first drilling mud outlet 3630, 3730.

In an embodiment, the first spool 3650, 3750 may have an integral flange at the first drilling mud inlet 3655, 3755 and/or the first drilling mud outlet 3660, 3760.

In an embodiment, the second drilling mud outlet 3645, 3745 of the second gate valve 3635, 3735 and the second spool 3665, 3765 may be fluidly connected by a connection. Any suitable connection may be used for the second drilling mud outlet 3645, 3745 of the second gate valve 3635, 3735 and the second spool 3665, 3765. For example, suitable connections include, but are not limited to, flanges and pipe fittings. Connections are well known in the art.

In an embodiment, the second gate valve 3635, 3735 may have an integral flange at the second drilling mud inlet 3640, 3740 and/or the second drilling mud outlet 3645, 3745.

In an embodiment, the second spool 3665, 3765 may have an integral flange at the second drilling mud inlet 3670, 3770 and/or the second drilling mud outlet 3675, 3775.

In an embodiment, the first drilling mud outlet 3645, 3745 of the first spool 3635, 3735 and the first drilling mud inlet 420, 620*a*, 1420, 2120*a*, 2320*a*, 3685, 3785 of the first drilling mud screen system 400, 600, 1400, 2100, 2300, 3680, 3780 may be fluidly connected by a connection. Any suitable connection may be used for the first drilling mud outlet 3645, 3745 of the first spool 3635, 3735 and the first drilling mud inlet 420, 620*a*, 1420, 2120*a*, 2320*a*, 3685, 3785 of the first drilling mud screen system 400, 600, 1400, 2100, 2300, 3680, 3780. For example, suitable connections include, but are not limited to, flanges and pipe fittings. Connections are well known in the art.

In an embodiment, the first spool 3650, 3750 may have an integral flange at the first drilling mud inlet 3655, 3755 and/or the first drilling mud outlet 3660, 3760.

In an embodiment, the flow loop configuration 3600, 3700 comprises a first cross-over connection 3105, 36190, 37190 from a first spool 3650, 3750 to a first drilling mud screen system 400, 600, 1400, 2100, 2300, 3680, 3780.

In an embodiment, the first cross-over connection 3105, 36190, 37190 may have an integral flange at a first drilling mud inlet and/or a first drilling mud outlet.

In an embodiment, the second drilling mud outlet 3675, 3775 of the second spool 3665, 3765 and the second drilling mud inlet 420, 620*a*, 1420, 2120*a*, 2320*a*, 36100, 37100 of the second drilling mud screen system 400, 600, 1400, 2100, 2300, 3695, 3795 may be fluidly connected by a connection. Any suitable connection may be used for the second drilling mud outlet 3675, 3775 of the second spool 3665, 3765 and the second drilling mud inlet 420, 620*a*, 1420, 2120*a*, 2320*a*, 36100, 37100 of the second drilling mud screen system 400, 600, 1400, 2100, 2300, 3695, 3795. For example, suitable connections include, but are not limited to, flanges and pipe fittings. Connections are well known in the art.

In an embodiment, the second spool 3665, 3765 may have an integral flange at the second drilling mud inlet 3670, 3770 and/or the second drilling mud outlet 3675, 3775.

In an embodiment, the flow loop configuration 3600, 3700 comprises a second cross-over connection 3105, 36195, 37195 from a second spool 3665, 3765 to a second drilling mud screen system 400, 600, 1400, 2100, 2300, 3695, 3795.

In an embodiment, the second cross-over connection 3105, 36195, 37195 may have an integral flange at a second drilling mud inlet.

In an embodiment, the first drilling mud outlet 425, 625*b*, 1425, 2125*b*, 2325*b*, 3690, 3790 of the first drilling mud screen system 400, 600, 1400, 2100, 2300, 3680, 3780 and the first drilling mud inlet 36115, 37115 of the first L-connector 36110, 37110 may be fluidly connected by a connection. Any suitable connection may be used for the first drilling mud outlet 425, 625*b*, 1425, 2125*b*, 2325*b*, 3690, 3790 of the first drilling mud screen system 400, 600, 1300, 2100, 2300, 3680, 3780 and the first drilling mud inlet 36115, 37115 of the first L-connector 36110, 37110. For example, suitable connections include, but are not limited to, flanges and pipe fittings. Connections are well known in the art.

In an embodiment, the flow loop configuration 3600, 3700 comprises a third cross-over connection 3105, 36200, 37200 from a first drilling mud screen system 400, 600, 1400, 2100, 2300, 3680, 3780 to a first L-connector 36110, 37110.

In an embodiment, the third cross-over connection 3105, 36200, 37200 may have an integral flange at a third drilling mud inlet and/or a third drilling mud outlet.

In an embodiment, the first L-connector 36110, 37110 may have an integral flange at the first drilling mud inlet 36115, 37115 and/or the first drilling mud outlet 36120, 37120.

In an embodiment, the second drilling mud outlet 425, 625*b*, 1425, 2125*b*, 2325*b*, 36105, 37105 of the second drilling mud screen system 400, 600, 1400, 2100, 2300, 3695, 3795 and the second drilling mud inlet 36135, 37135 of the second L-connector 36125, 37125 may be fluidly connected by a connection. Any suitable connection may be used for the second drilling mud outlet 425, 625*b*, 1425, 2125*b*, 2325*b*, 36105, 37105 of the second drilling mud screen system 400, 600, 1300, 2100, 2300, 3695, 3795 and the second drilling mud inlet 36135, 37135 of the second L-connector 36125, 37125. For example, suitable connections include, but are not limited to, flanges and pipe fittings. Connections are well known in the art.

In an embodiment, the flow loop configuration 3600, 3700 comprises a fourth cross-over connection 3105, 36205, 37205 from a second drilling mud screen system 400, 600, 1400, 2100, 2300, 3695, 3795 to a second L-connector 36125, 37125.

In an embodiment, the fourth cross-over connection 3105, 36205, 37205 may have an integral flange at a fourth drilling mud inlet and/or a fourth drilling mud outlet.

In an embodiment, the second L-connector 36125, 37125 may have an integral flange at the second drilling mud inlet 36130, 37130 and/or the second drilling mud outlet 36135, 37135.

In an embodiment, the first drilling mud outlet 36120, 37120 of the first L-connector 36110, 37110 and the third drilling mud inlet 36145, 37145 of the third gate valve 36140, 37140 may be fluidly connected by a connection. Any suitable connection may be used for the first drilling mud outlet 36120, 37120 of the first L-connector 36110, 37110 and the third drilling mud inlet 36145, 37145 of the third gate valve 36140, 37140. For example, suitable connections include, but are not limited to, flanges and pipe fittings. Connections are well known in the art.

In an embodiment, the first L-connector 36110, 37110 may have an integral flange at the first drilling mud inlet 36115, 37115 and/or the first drilling mud outlet 36120, 37120.

In an embodiment, the third gate valve 36140, 37140 may have an integral flange at the third drilling mud inlet 36145, 37145 and/or the third drilling mud outlet 36150, 37150.

In an embodiment, the second drilling mud outlet 36135, 37135 of the second L-connector 36125, 37125 and the fourth drilling mud inlet 36160, 37160 of the fourth gate valve 36155, 37155 may be fluidly connected by a connection. Any suitable connection may be used for the second drilling mud outlet 36135, 37135 of the second L-connector 36125, 37125 and the fourth drilling mud inlet 36160, 37160 of the fourth gate valve 36155, 37155. For example, suitable connections include, but are not limited to, flanges and pipe fittings. Connections are well known in the art.

In an embodiment, the second L-connector 36125, 37125 may have an integral flange at the second drilling mud inlet 36130, 37130 and/or the second drilling mud outlet 36135, 37135.

In an embodiment, the fourth gate valve 36155, 37155 may have an integral flange at the fourth drilling mud inlet 36160, 37160 and/or the fourth drilling mud outlet 36165, 37165.

In an embodiment, the third drilling mud outlet 36150, 37150 of the third gate valve 36140, 37140 and the first drilling mud inlet 36175, 37175 of the T-connector (e.g., second drilling mud manifold) 36170, 37170 may be fluidly connected by a connection. Any suitable connection may be used for the third drilling mud outlet 36150, 37150 of the third gate valve 36140, 37140 and the first drilling mud inlet 36175, 37175 of the T-connector (e.g., second drilling mud manifold) 36170, 37170. For example, suitable connections include, but are not limited to, flanges and pipe fittings. Connections are well known in the art.

In an embodiment, the third gate valve 36140, 37140 may have an integral flange at the third drilling mud inlet 36145, 37145 and/or the third drilling mud outlet 36150, 37150.

In an embodiment, the T-connector (e.g., second drilling mud manifold) 36170, 37170 may have an integral flange at the first drilling mud inlet 36175, 37175 and/or the second drilling mud inlet 36180, 37180.

In an embodiment, the fourth drilling mud outlet 36165, 37165 of the fourth gate valve 36155, 37155 and the second drilling mud inlet 36180, 37180 of the T-connector (e.g., second drilling mud manifold) 36170, 37170 may be fluidly connected by a connection. Any suitable connection may be used for the fourth drilling mud outlet 36165, 37165 of the fourth gate valve 36155, 37155 and the second drilling mud inlet 36180, 27180 of the T-connector (e.g., second drilling mud manifold) 36170, 37170. For example, suitable connections include, but are not limited to, flanges and pipe fittings. Connections are well known in the art.

In an embodiment, the fourth gate valve 36155, 37155 may have an integral flange at the fourth drilling mud inlet 36160, 37160 and/or the fourth drilling mud outlet 36165, 37165.

In an embodiment, the T-connector (e.g., second drilling mud manifold) 36170, 37170 may have an integral flange at the first drilling mud inlet 36175, 37175 and/or the second drilling mud inlet 36180, 37180.

Alternative Optional Flow Loop Configuration

In an embodiment, one or more piston-style drilling mud screen systems may be used in an alternative optional flow loop configuration to create a redundancy and/or to increase through put.

Figure 38:
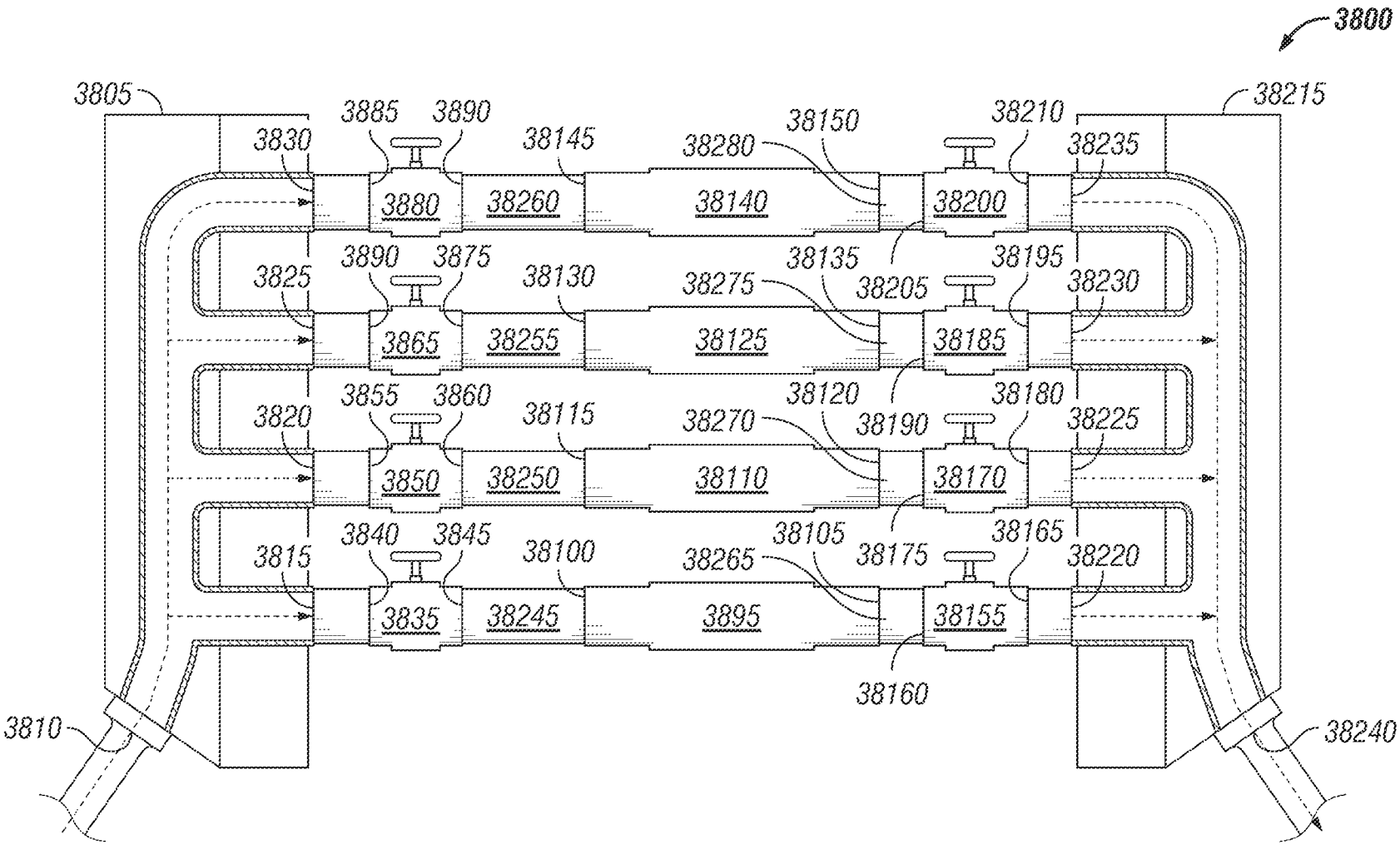
FIG. 38 illustrates a cross-sectional view of a drilling mud screen system in a flow loop configuration, showing four piston-style drilling mud screen systems.

FIG. 38 illustrates a cross-sectional view of a drilling mud screen system in an alternative flow loop configuration 3800, showing four drilling mud screen systems.

As shown in FIG. 38, the alternative optional flow loop configuration 3800 comprises a first drilling mud manifold 3805 having a first drilling mud inlet 3810, a first, first drilling mud outlet 3815, a first, second drilling mud outlet 3820, a first, third drilling mud outlet 3825 and a first, fourth drilling mud outlet 3830, a first gate valve 3835 having a first drilling mud inlet 3840 and a first drilling mud outlet 3845, a second gate valve 3850 having a second drilling mud inlet 3855 and a second drilling mud outlet 3860, a third gate valve 3865 having a third drilling mud inlet 3870 and a third drilling mud outlet 3875, a fourth gate valve 3880 having a fourth drilling mud inlet 3885 and a fourth drilling mud outlet 3890, a first drilling mud screen system 3000, 3300, 3400, 3895 having a first drilling mud inlet 3020*a*, 3320*a*, 38100 and a first drilling mud outlet 3025*b*, 3325*b*, 38105, a second drilling mud screen system 3000, 3300, 3400, 38110 having a second drilling mud inlet 3020*a*, 3320*a*, 38115 and a second drilling mud outlet 3025*b*, 3325*b*, 38120, a third drilling mud screen system 3000, 3300, 3400, 38125 having a third drilling mud inlet 3020*a*, 3320*a*, 38130 and a third drilling mud outlet 3025*b*, 3325*b*, 38135, a fourth drilling mud screen system 3000, 3300, 3400, 38140 having a fourth drilling mud inlet 3020*a*, 3320*a*, 38145 and a fourth drilling mud outlet 3025*b*, 3325*b*, 38150, a fifth gate valve 38155 having a fifth drilling mud inlet 38160 and a fifth drilling mud outlet 38165, a sixth gate valve 38170 having a sixth drilling mud inlet 38175 and a sixth drilling mud outlet 38180, a seventh gate valve 38185 having a seventh drilling mud inlet 38190 and a seventh drilling mud outlet 38195, an eighth gate valve 38200 having an eighth drilling mud inlet 38205 and an eighth drilling mud outlet 38210, and a second drilling mud manifold 38215 having a second, first drilling mud inlet 38220, a second, second drilling mud inlet 38225, a second, third drilling mud inlet 38230, a second fourth drilling mud inlet 38235 and a second drilling mud outlet 38240.

In an embodiment, the drilling mud inlet 3810 may be fluidly connected to, for example, an outlet of a drilling mud pump via a connection; and the drilling mud outlet 38240 may be fluidly connected to an inlet of a vibrator hose via a connection. Any suitable connection may be used for the drilling mud inlet 3810 and drilling mud outlet 38240. For example, suitable connections include, but are not limited to, pipe fittings and welds. Connections are well known in the art. In an embodiment, the drilling mud inlet 3810 may be fluidly connected to, for example, an outlet of a drilling mud pump via a weld; and the drilling mud outlet 38240 may be fluidly connected to an inlet of a vibrator hose via a weld.

In an embodiment, the flow loop configuration 3800 comprises a first stub connection (not shown) from, for example, an outlet of a drilling mud pump to a first drilling mud inlet 3810 of a first drilling mud manifold 3805. See e.g., FIG. 36.

In an embodiment, the flow loop configuration 3800 comprises a second stub connection (not shown) from, for example, a second drilling mud outlet 38240 of a second drilling mud manifold 38215 to an inlet of a vibrator hose. See e.g., FIG. 36.

In an embodiment, the first, first drilling mud outlet 3815 of the first drilling mud manifold 3805 and the first drilling mud inlet 3840 of the first gate valve 3835 may be fluidly connected by a connection. Any suitable connection may be used for the first, first drilling mud outlet 3815 of the first drilling mud manifold 3805 and the first drilling mud inlet 3840 of the first gate valve 3835. For example, suitable connections include, but are not limited to, flanges and pipe fittings. Connections are well known in the art.

In an embodiment, the first drilling mud manifold 3805 may have an integral flange at the first, first drilling mud outlet 3815, the first, second drilling mud outlet 3820, the first, third drilling mud outlet 3825, and the first, fourth drilling mud outlet 3830.

In an embodiment, the first gate valve 3835 may have an integral flange at the first drilling mud inlet 3840 and/or the first drilling mud outlet 3845.

In an embodiment, the first, first drilling mud outlet 3815 of the first drilling mud manifold 3805 may be fluidly connected to the first drilling mud inlet 3840 of the first gate valve 3835. In an embodiment, the first, first drilling mud outlet 3815 of the first drilling mud manifold 3805 may be sealed to the first drilling mud inlet 3840 of the first gate valve 3835 via a gasket or an O-ring. Any suitable gasket or O-ring may be used. For example, suitable O-rings include, but are not limited to, 300 Series O-rings. Gaskets and O-rings are well known in the art.

In an embodiment, the first, second drilling mud outlet 3820 of the first drilling mud manifold 3805 and the second drilling mud inlet 3855 of the second gate valve 3850 may be fluidly connected by a connection. Any suitable connection may be used for the first, second drilling mud outlet 3820 of the first drilling mud manifold 3805 and the second drilling mud inlet 3855 of the second gate valve 3850. For example, suitable connections include, but are not limited to, flanges and pipe fittings. Connections are well known in the art.

In an embodiment, the first drilling mud manifold 3805 may have an integral flange at the first, first drilling mud outlet 3815, the first, second drilling mud outlet 3820, the first, third drilling mud outlet 3825, and the first, fourth drilling mud outlet 3830.

In an embodiment, the second gate valve 3850 may have an integral flange at the second drilling mud inlet 3855 and/or the second drilling mud outlet 3860.

In an embodiment, the first, second drilling mud outlet 3820 of the first drilling mud manifold 3805 may be fluidly connected to the second drilling mud inlet 3855 of the second gate valve 3850. In an embodiment, the first, second drilling mud outlet 3820 of the first drilling mud manifold 3805 may be sealed to the second drilling mud inlet 3855 of the second gate valve 3850 via a gasket or an O-ring. Any suitable gasket or O-ring may be used. For example, suitable O-rings include, but are not limited to, 300 Series O-rings. Gaskets and O-rings are well known in the art.

In an embodiment, the first, third drilling mud outlet 3825 of the first drilling mud manifold 3805 and the third drilling mud inlet 3870 of the third gate valve 3865 may be fluidly connected by a connection. Any suitable connection may be used for the first, third drilling mud outlet 3825 of the first drilling mud manifold 3805 and the third drilling mud inlet 3870 of the third gate valve 3865. For example, suitable connections include, but are not limited to, flanges and pipe fittings. Connections are well known in the art.

In an embodiment, the first drilling mud manifold 3805 may have an integral flange at the first, first drilling mud outlet 3815, the first, second drilling mud outlet 3820, the first, third drilling mud outlet 3825, and the first, fourth drilling mud outlet 3830.

In an embodiment, the third gate valve 3865 may have an integral flange at the third drilling mud inlet 3870 and/or the third drilling mud outlet 3875.

In an embodiment, the first, third drilling mud outlet 3825 of the first drilling mud manifold 3805 may be fluidly connected to the third drilling mud inlet 3870 of the third gate valve 3865. In an embodiment, the first, third drilling mud outlet 3825 of the first drilling mud manifold 3805 may be sealed to the third drilling mud inlet 3870 of the third gate valve 3865 via a gasket or an O-ring. Any suitable gasket or O-ring may be used. For example, suitable O-rings include, but are not limited to, 300 Series O-rings. Gaskets and O-rings are well known in the art.

In an embodiment, the first, fourth drilling mud outlet 3830 of the first drilling mud manifold 3805 and the fourth drilling mud inlet 3885 of the fourth gate valve 3880 may be fluidly connected by a connection. Any suitable connection may be used for the first, fourth drilling mud outlet 3830 of the first drilling mud manifold 3805 and the fourth drilling mud inlet 3885 of the fourth gate valve 3880. For example, suitable connections include, but are not limited to, flanges and pipe fittings. Connections are well known in the art.

In an embodiment, the first drilling mud manifold 3805 may have an integral flange at the first, first drilling mud outlet 3815, the first, second drilling mud outlet 3820, the first, third drilling mud outlet 3825, and the first, fourth drilling mud outlet 3830.

In an embodiment, the fourth gate valve 3880 may have an integral flange at the fourth drilling mud inlet 3885 and/or the fourth drilling mud outlet 3890.

In an embodiment, the first, fourth drilling mud outlet 3830 of the first drilling mud manifold 3805 may be fluidly connected to the fourth drilling mud inlet 3885 of the fourth gate valve 3880. In an embodiment, the first, fourth drilling mud outlet 3830 of the first drilling mud manifold 3805 may be sealed to the fourth drilling mud inlet 3885 of the fourth gate valve 3880 via a gasket or an O-ring. Any suitable gasket or O-ring may be used. For example, suitable O-rings include, but are not limited to, 300 Series O-rings. Gaskets and O-rings are well known in the art.

In an embodiment, the first drilling mud outlet 3845 of the first gate valve 3835 and the first drilling mud inlet 30020*a*, 33020*a*, 34020*a*, 38100 of the first drilling mud screen system 3000, 3300, 3400, 3895 may be fluidly connected by a connection. Any suitable connection may be used for the first drilling mud outlet 3845 of the first gate valve 3835 and the first drilling mud inlet 30020*a*, 33020*a*, 34020*a*, 38100 of the first drilling mud screen system 3000, 3300, 3400, 3895. For example, suitable connections include, but are not limited to, flanges and pipe fittings. Connections are well known in the art.

In an embodiment, the first gate valve 3835 may have an integral flange at the first drilling mud inlet 3840 and/or the first drilling mud outlet 3845.

In an embodiment, the flow loop configuration 3800 comprises a first cross-over connection 3105, 38245 from a first gate valve 3835 to a first drilling mud screen system 3000, 3300, 3400, 3895.

In an embodiment, the first cross-over connection 3105, 38245 may have an integral flange at a first drilling mud inlet and/or first drilling mud outlet.

In an embodiment, the second drilling mud outlet 3860 of the second gate valve 3850 and the second drilling mud inlet 30020*a*, 33020*a*, 34020*a*, 38115 of the second drilling mud screen system 3000, 3300, 3400, 38110 may be fluidly connected by a connection. Any suitable connection may be used for the second drilling mud outlet 3860 of the second gate valve 3850 and the second drilling mud inlet 30020*a*, 33020*a*, 34020*a*, 38115 of the second drilling mud screen system 3000, 3300, 3400, 38110. For example, suitable connections include, but are not limited to, flanges and pipe fittings. Connections are well known in the art.

In an embodiment, the second gate valve 3850 may have an integral flange at the second drilling mud inlet 3855 and/or the second drilling mud outlet 3860.

In an embodiment, the flow loop configuration 3800 comprises a second cross-over connection 3105, 38250 from a second gate valve 3850 to a second drilling mud screen system 3000, 3300, 3400, 38110.

In an embodiment, the second cross-over connection 3105, 38250 may have an integral flange at a second drilling mud inlet.

In an embodiment, the third drilling mud outlet 3875 of the third gate valve 3865 and the third drilling mud inlet 30020*a*, 33020*a*, 34020*a*, 38130 of the third drilling mud screen system 3000, 3300, 3400, 38125 may be fluidly connected by a connection. Any suitable connection may be used for the third drilling mud outlet 3875 of the third gate valve 3865 and the third drilling mud inlet 30020*a*, 33020*a*, 34020*a*, 38130 of the third drilling mud screen system 3000, 3300, 3400, 38125. For example, suitable connections include, but are not limited to, flanges and pipe fittings. Connections are well known in the art.

In an embodiment, the third gate valve 3865 may have an integral flange at the third drilling mud inlet 3870 and/or the third drilling mud outlet 3875.

In an embodiment, the flow loop configuration 3800 comprises a third cross-over connection 3105, 38255 from a third gate valve 3865 to a third drilling mud screen system 3000, 3300, 3400, 38125.

In an embodiment, the third cross-over connection 3105, 38255 may have an integral flange at a third drilling mud inlet and/or a third drilling mud outlet.

In an embodiment, the fourth drilling mud outlet 3890 of the fourth gate valve 3880 and the fourth drilling mud inlet 30020*a*, 33020*a*, 34020*a*, 38145 of the fourth drilling mud screen system 3000, 3300, 3400, 38140 may be fluidly connected by a connection. Any suitable connection may be used for the fourth drilling mud outlet 3890 of the fourth gate valve 3880 and the fourth drilling mud inlet 30020*a*, 33020*a*, 34020*a*, 38145 of the fourth drilling mud screen system 3000, 3300, 3400, 38140. For example, suitable connections include, but are not limited to, flanges and pipe fittings. Connections are well known in the art.

In an embodiment, the fourth gate valve 3880 may have an integral flange at the fourth drilling mud inlet 3885 and/or the fourth drilling mud outlet 3890.

In an embodiment, the flow loop configuration 3800 comprises a fourth cross-over connection 3105, 38260 from a fourth gate valve 3880 to a fourth drilling mud screen system 3000, 3300, 3400, 38140.

In an embodiment, the fourth cross-over connection 3105, 38260 may have an integral flange at a fourth drilling mud inlet and/or a fourth drilling mud outlet.

In an embodiment, the first drilling mud outlet 30025*b*, 330025*b*, 34025*b*, 38105 of the first drilling mud screen system 3000, 3300, 3400, 3895 and the fifth drilling mud inlet 38160 of the fifth gate valve 38155 may be fluidly connected by a connection. Any suitable connection may be used for the first drilling mud outlet 30025*b*, 33025*b*, 34025*b*, 38105 of the first drilling mud screen system 3000, 3300, 3400, 3895 and the fifth drilling mud inlet 38160 of the fifth gate valve 38155. For example, suitable connections include, but are not limited to, flanges and pipe fittings. Connections are well known in the art.

In an embodiment, the flow loop configuration 3800 comprises a fifth cross-over connection 3105, 38265 from a first drilling mud screen system 3000, 3300, 3400, 3895 to a fifth gate valve 38155.

In an embodiment, the fifth cross-over connection 3105, 38265 may have an integral flange at a fifth drilling mud inlet and/or a fifth drilling mud outlet.

In an embodiment, the fifth gate valve 38155 may have an integral flange at the fifth drilling mud inlet 38160 and/or the fifth drilling mud outlet 38165.

In an embodiment, the second drilling mud outlet 30025*b*, 330025*b*, 34025*b*, 38120 of the second drilling mud screen system 3000, 3300, 3400, 38110 and the sixth drilling mud inlet 38175 of the sixth gate valve 38170 may be fluidly connected by a connection. Any suitable connection may be used for the second drilling mud outlet 30025*b*, 33025*b*, 34025*b*, 38120 of the second drilling mud screen system 3000, 3300, 3400, 38110 and the sixth drilling mud inlet 38175 of the sixth gate valve 38170. For example, suitable connections include, but are not limited to, flanges and pipe fittings. Connections are well known in the art.

In an embodiment, the flow loop configuration 3800 comprises a sixth cross-over connection 3105, 38270 from a second drilling mud screen system 3000, 3300, 3400, 38110 to a sixth gate valve 38170.

In an embodiment, the sixth cross-over connection 3105, 38270 may have an integral flange at a sixth drilling mud inlet and/or a sixth drilling mud outlet.

In an embodiment, the sixth gate valve 38170 may have an integral flange at the sixth drilling mud inlet 38175 and/or the sixth drilling mud outlet 38180.

In an embodiment, the third drilling mud outlet 30025*b*, 330025*b*, 34025*b*, 38135 of the third drilling mud screen system 3000, 3300, 3400, 38125 and the seventh drilling mud inlet 38190 of the seventh gate valve 38185 may be fluidly connected by a connection. Any suitable connection may be used for the third drilling mud outlet 30025*b*, 33025*b*, 34025*b*, 38135 of the third drilling mud screen system 3000, 3300, 3400, 38125 and the seventh drilling mud inlet 38190 of the seventh gate valve 38185. For example, suitable connections include, but are not limited to, flanges and pipe fittings. Connections are well known in the art.

In an embodiment, the flow loop configuration 3800 comprises a seventh cross-over connection 3105, 38275 from a third drilling mud screen system 3000, 3300, 3400, 38125 to a seventh gate valve 38185.

In an embodiment, the seventh cross-over connection 3105, 38275 may have an integral flange at a seventh drilling mud inlet and/or a seventh drilling mud outlet.

In an embodiment, the seventh gate valve 38185 may have an integral flange at the seventh drilling mud inlet 38190 and/or the seventh drilling mud outlet 38195.

In an embodiment, the fourth drilling mud outlet 30025*b*, 330025*b*, 34025*b*, 38150 of the fourth drilling mud screen system 3000, 3300, 3400, 38140 and the eighth drilling mud inlet 38205 of the eighth gate valve 38200 may be fluidly connected by a connection. Any suitable connection may be used for the fourth drilling mud outlet 30025*b*, 33025*b*, 34025*b*, 38150 of the fourth drilling mud screen system 3000, 3300, 3400, 38140 and the eighth drilling mud inlet 38205 of the eighth gate valve 38200. For example, suitable connections include, but are not limited to, flanges and pipe fittings. Connections are well known in the art.

In an embodiment, the flow loop configuration 3800 comprises an eighth cross-over connection 3105, 38280 from a fourth drilling mud screen system 3000, 3300, 3400, 38140 to an eighth gate valve 38200.

In an embodiment, the eighth cross-over connection 3105, 38280 may have an integral flange at an eighth drilling mud inlet and/or an eighth drilling mud outlet.

In an embodiment, the eighth gate valve 38200 may have an integral flange at the eighth drilling mud inlet 38205 and/or the eighth drilling mud outlet 38210.

In an embodiment, the fifth drilling mud outlet 38165 of the fifth gate valve 38155 and the second, first drilling mud inlet 38220 of the second drilling mud manifold 38215 may be fluidly connected by a connection. Any suitable connection may be used for the fifth drilling mud outlet 38165 of the fifth gate valve 38155 and the second, first drilling mud inlet 38220 of the second drilling mud manifold 38215. For example, suitable connections include, but are not limited to, flanges and pipe fittings. Connections are well known in the art.

In an embodiment, the fifth gate valve 38155 may have an integral flange at the fifth drilling mud inlet 38160 and/or the fifth drilling mud outlet 38165.

In an embodiment, the second drilling mud manifold 38215 may have an integral flange at the second, first drilling mud outlet 38220, the second, second drilling mud outlet 38225, the second, third drilling mud outlet 38230, and the second, fourth drilling mud outlet 38235.

In an embodiment, the fifth drilling mud outlet 38165 of the fifth gate valve 38155 may be fluidly connected to the second, first drilling mud inlet 38220 of the second drilling mud manifold 38215. In an embodiment, the fifth drilling mud outlet 38165 of the fifth gate valve 38155 may be sealed to the second, first drilling mud inlet 38220 of the second drilling mud manifold 38215 via a gasket or an O-ring. Any suitable gasket or O-ring may be used. For example, suitable O-rings include, but are not limited to, 300 Series O-rings. Gaskets and O-rings are well known in the art.

In an embodiment, the sixth drilling mud outlet 38180 of the sixth gate valve 38170 and the second, second drilling mud inlet 38225 of the second drilling mud manifold 38215 may be fluidly connected by a connection. Any suitable connection may be used for the sixth drilling mud outlet 38180 of the sixth gate valve 38170 and the second, second drilling mud inlet 38225 of the second drilling mud manifold 38215. For example, suitable connections include, but are not limited to, flanges and pipe fittings. Connections are well known in the art.

In an embodiment, the sixth gate valve 38170 may have an integral flange at the sixth drilling mud inlet 38175 and/or the sixth drilling mud outlet 38180.

In an embodiment, the second drilling mud manifold 38215 may have an integral flange at the second, first drilling mud outlet 38220, the second, second drilling mud outlet 38225, the second, third drilling mud outlet 38230, and the second, fourth drilling mud outlet 38235.

In an embodiment, the sixth drilling mud outlet 38180 of the sixth gate valve 38170 may be fluidly connected to the second, second drilling mud inlet 38225 of the second drilling mud manifold 38215. In an embodiment, the sixth drilling mud outlet 38180 of the sixth gate valve 38170 may be sealed to the second, second drilling mud inlet 38225 of the second drilling mud manifold 38215 via a gasket or an O-ring. Any suitable gasket or O-ring may be used. For example, suitable O-rings include, but are not limited to, 300 Series O-rings. Gaskets and O-rings are well known in the art.

In an embodiment, the seventh drilling mud outlet 38195 of the seventh gate valve 38185 and the second, third drilling mud inlet 38230 of the second drilling mud manifold 38215 may be fluidly connected by a connection. Any suitable connection may be used for the seventh drilling mud outlet 38195 of the seventh gate valve 38185 and the second, third drilling mud inlet 38230 of the second drilling mud manifold 38215. For example, suitable connections include, but are not limited to, flanges and pipe fittings. Connections are well known in the art.

In an embodiment, the seventh gate valve 38185 may have an integral flange at the seventh drilling mud inlet 38190 and/or the seventh drilling mud outlet 38195.

In an embodiment, the second drilling mud manifold 38215 may have an integral flange at the second, first drilling mud outlet 38220, the second, second drilling mud outlet 38225, the second, third drilling mud outlet 38230, and the second, fourth drilling mud outlet 38235.

In an embodiment, the seventh drilling mud outlet 38195 of the seventh gate valve 38185 may be fluidly connected to the second, third drilling mud inlet 38230 of the second drilling mud manifold 38215. In an embodiment, the seventh drilling mud outlet 38195 of the seventh gate valve 38185 may be sealed to the second, third drilling mud inlet 38230 of the second drilling mud manifold 38215 via a gasket or an O-ring. Any suitable gasket or O-ring may be used. For example, suitable O-rings include, but are not limited to, 300 Series O-rings. Gaskets and O-rings are well known in the art.

In an embodiment, the eighth drilling mud outlet 38210 of the eighth gate valve 38200 and the second, fourth drilling mud inlet 38235 of the second drilling mud manifold 38215 may be fluidly connected by a connection. Any suitable connection may be used for the eighth drilling mud outlet 38210 of the eighth gate valve 38200 and the second, fourth drilling mud inlet 38235 of the second drilling mud manifold 38215. For example, suitable connections include, but are not limited to, flanges and pipe fittings. Connections are well known in the art.

In an embodiment, the eighth gate valve 38200 may have an integral flange at the eighth drilling mud inlet 38205 and/or the eighth drilling mud outlet 38210.

In an embodiment, the second drilling mud manifold 38215 may have an integral flange at the second, first drilling mud outlet 38220, the second, second drilling mud outlet 38225, the second, third drilling mud outlet 38230, and the second, fourth drilling mud outlet 38235.

In an embodiment, the eighth drilling mud outlet 38210 of the eighth gate valve 38200 may be fluidly connected to the second, fourth drilling mud inlet 38235 of the second drilling mud manifold 38215. In an embodiment, the eighth drilling mud outlet 38210 of the eighth gate valve 38200 may be sealed to the second, fourth drilling mud inlet 38235 of the second drilling mud manifold 38215 via a gasket or an O-ring. Any suitable gasket or O-ring may be used. For example, suitable O-rings include, but are not limited to, 300 Series O-rings. Gaskets and O-rings are well known in the art.

Second Alternative Optional Flow Loop Configuration

In an embodiment, four or more drilling mud screen systems may be used in an optional flow loop configuration to create a redundancy, reduce number of gate valves, and/or to increase through put.

Figure 39A:
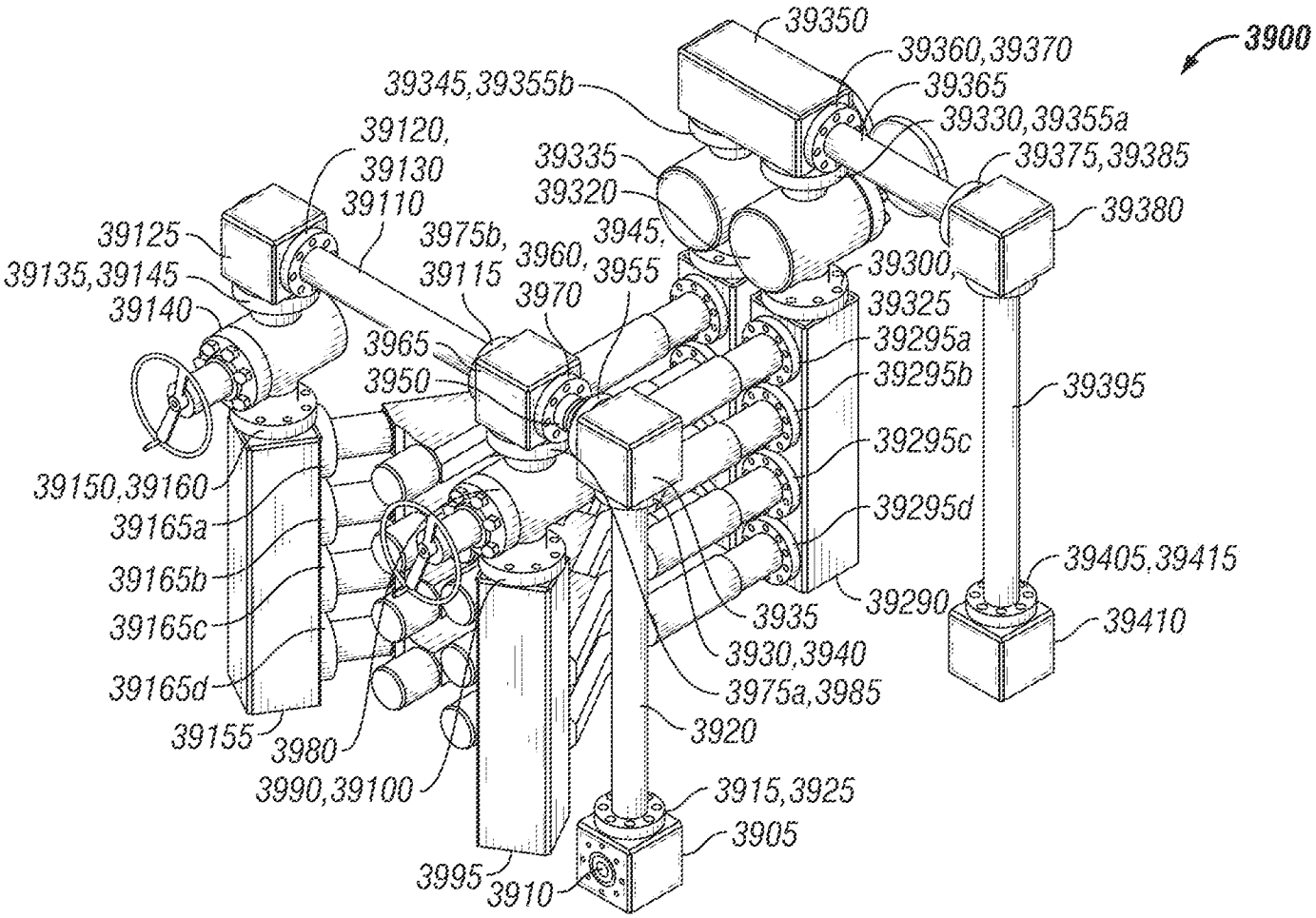
FIG. 39A illustrates an upper, left perspective view of a drilling mud screen system in a flow loop configuration, showing eight drilling mud screen systems.
Figure 39B:
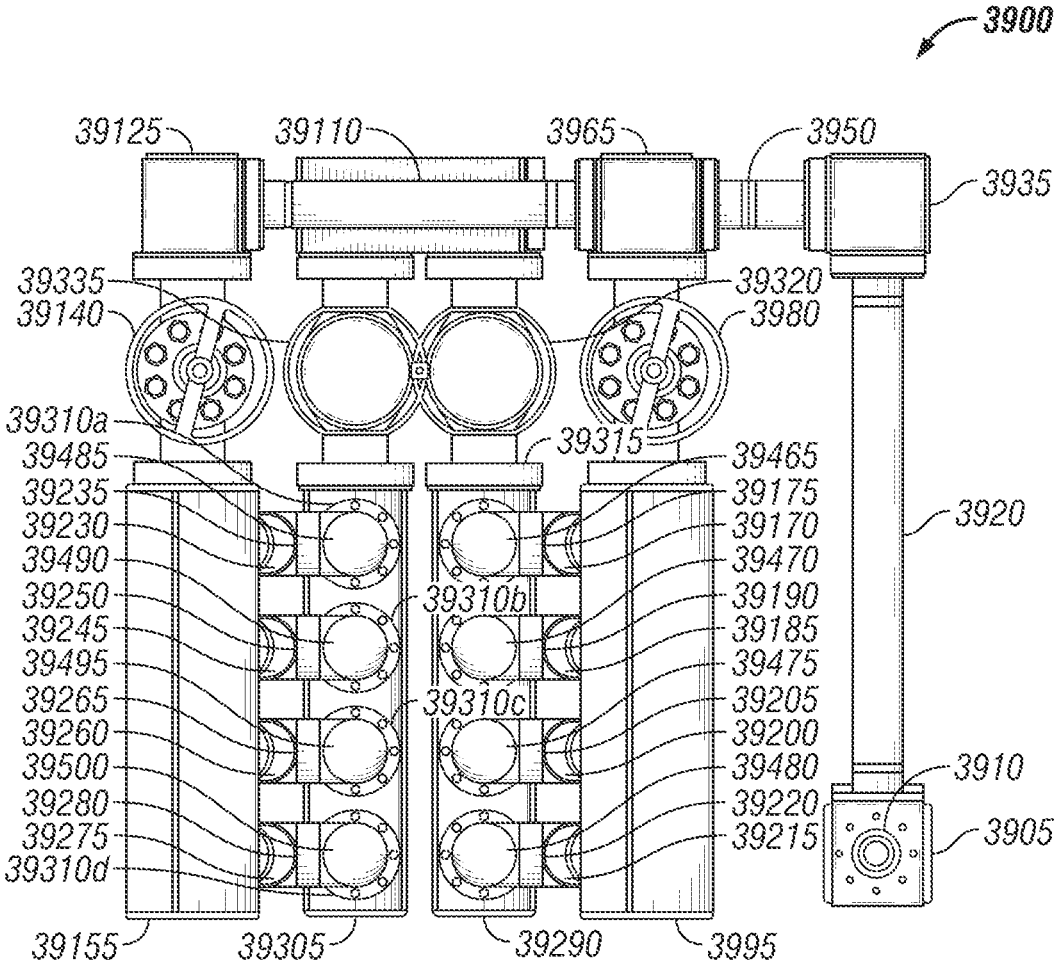
FIG. 39B illustrates a left side view of the flow loop configuration of FIG. 39A, showing a drilling mud inlet.
Figure 39C:
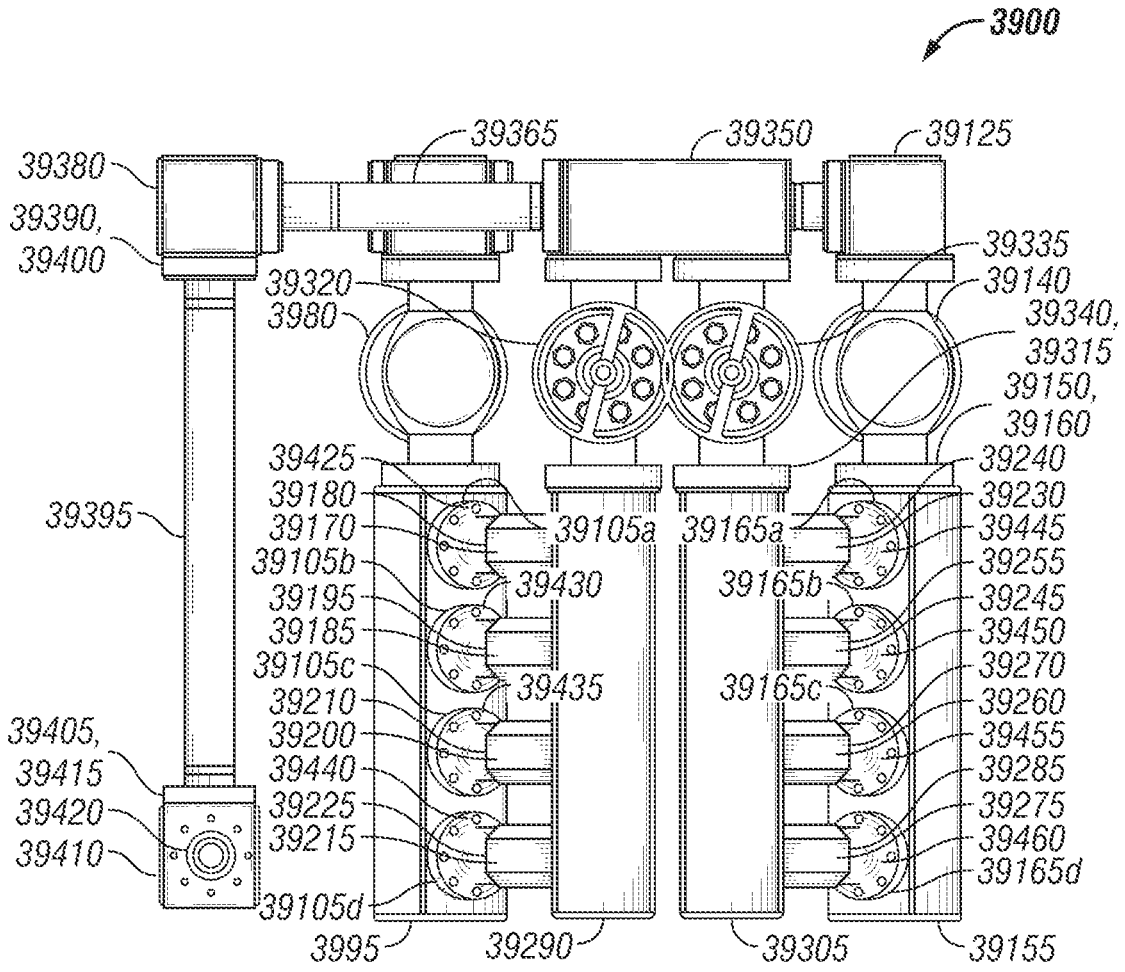
FIG. 39C illustrates a right side view of the flow loop configuration of FIG. 39A, showing a drilling mud outlet.
Figure 39D:
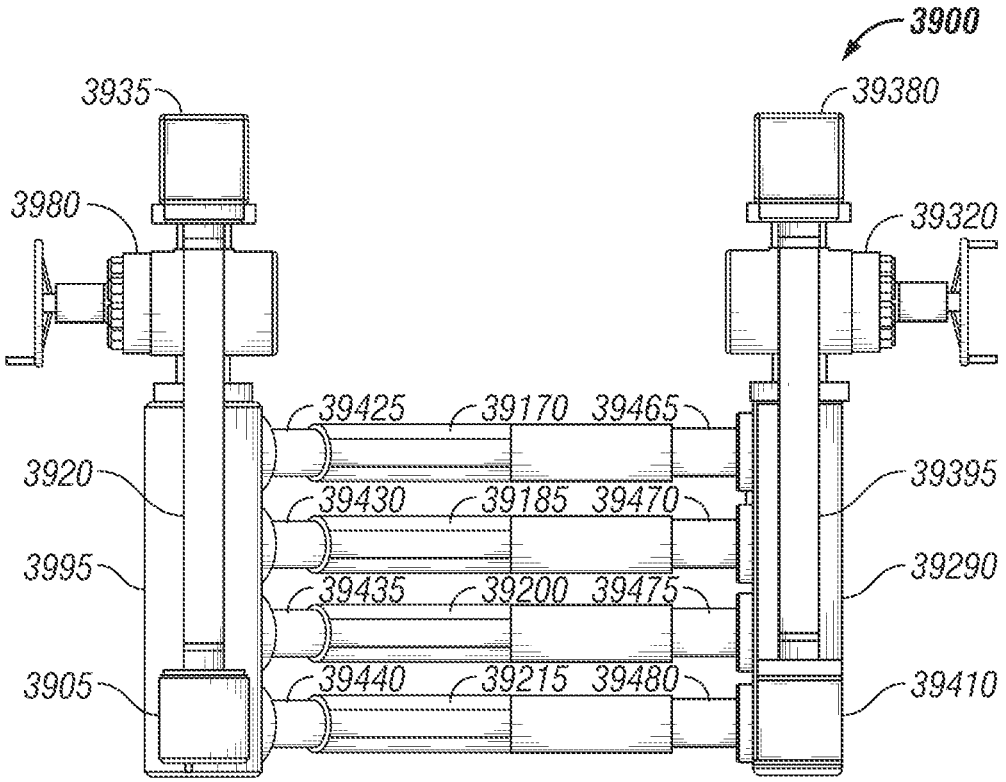
FIG. 39D illustrates a back view of the flow loop configuration of FIG. 39A.

FIG. 39A illustrates an upper, left perspective view of a drilling mud screen system in a flow loop configuration 3900, showing eight drilling mud screen systems; FIG. 39B illustrates a left side view of the flow loop configuration 3900 of FIG. 39A, showing a drilling mud inlet; FIG. 39C illustrates a right side view of the flow loop configuration 3900 of FIG. 39A, showing a drilling mud outlet; and FIG. 39D illustrates a back view of the flow loop configuration 3900 of FIG. 39A.

Figure 40A:
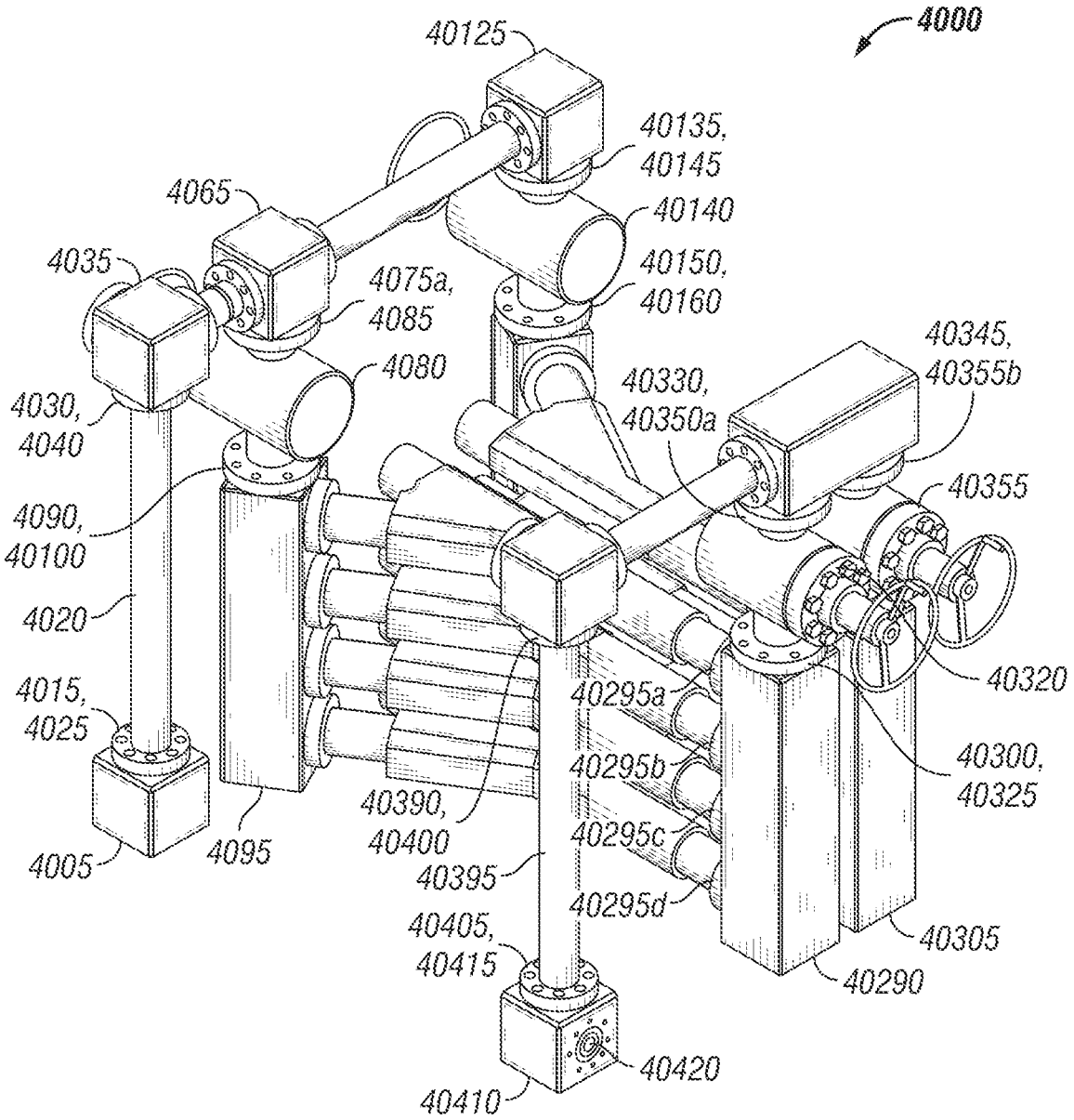
FIG. 40A illustrates an upper, right perspective view of a drilling mud screen system in a flow loop configuration.
Figure 40B:
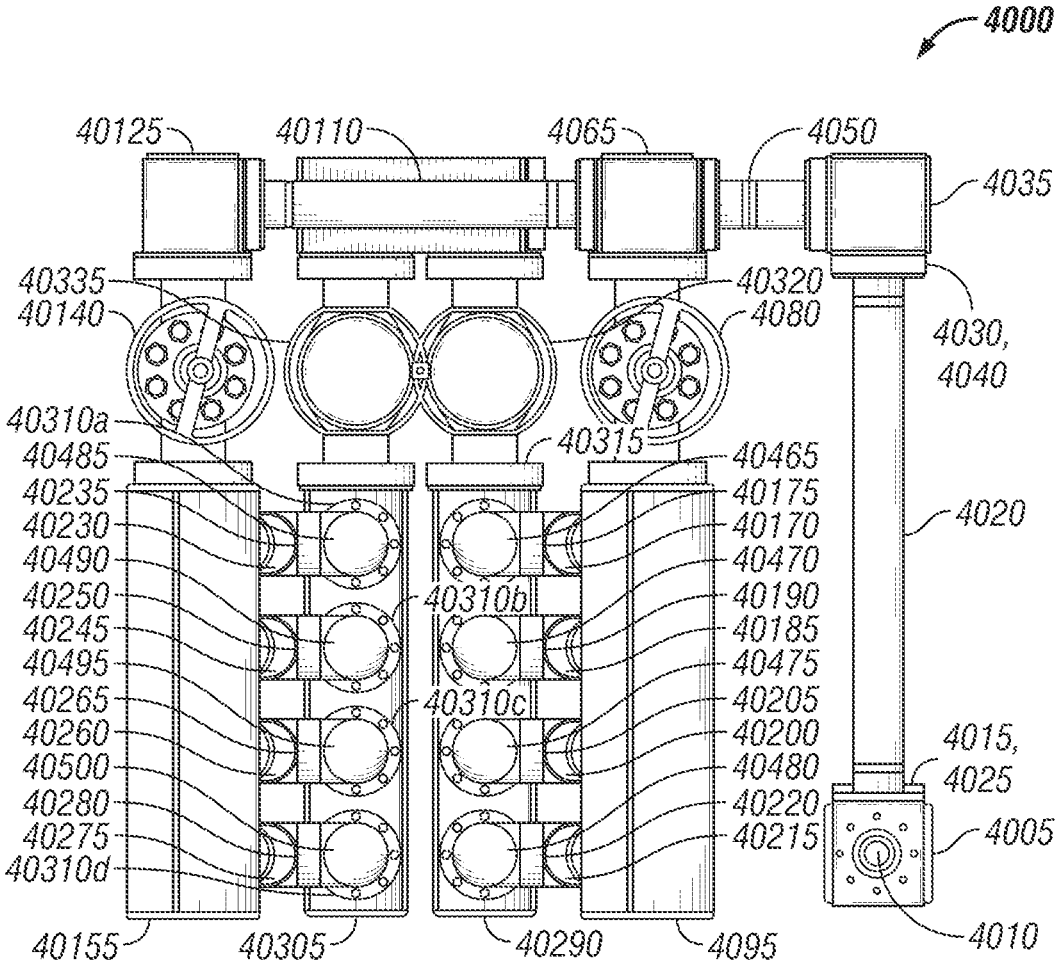
FIG. 40B illustrates a left side view of the flow loop configuration of FIG. 40A, showing a drilling mud inlet.
Figure 40C:
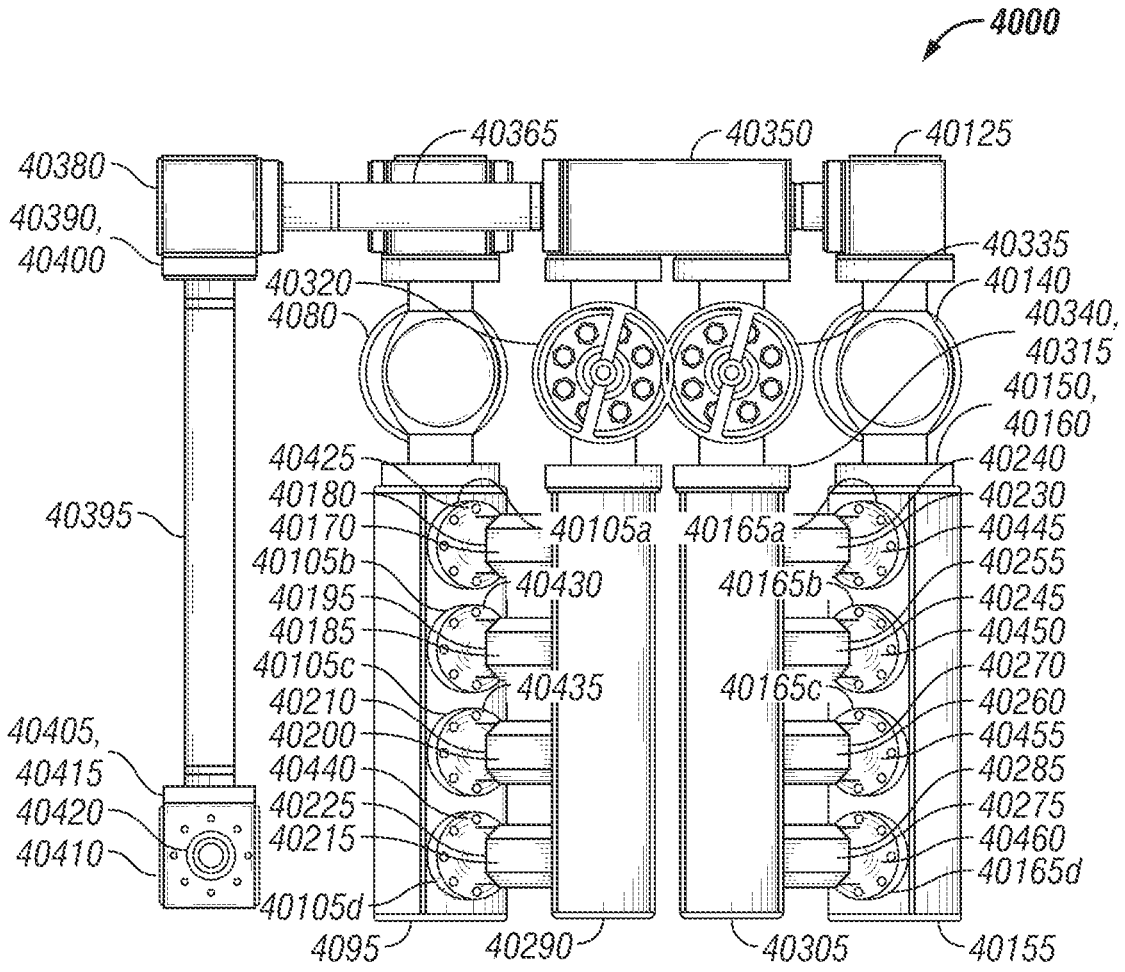
FIG. 40C illustrates a right side view of the flow loop configuration of FIG. 40A, showing a drilling mud outlet.
Figure 40D:
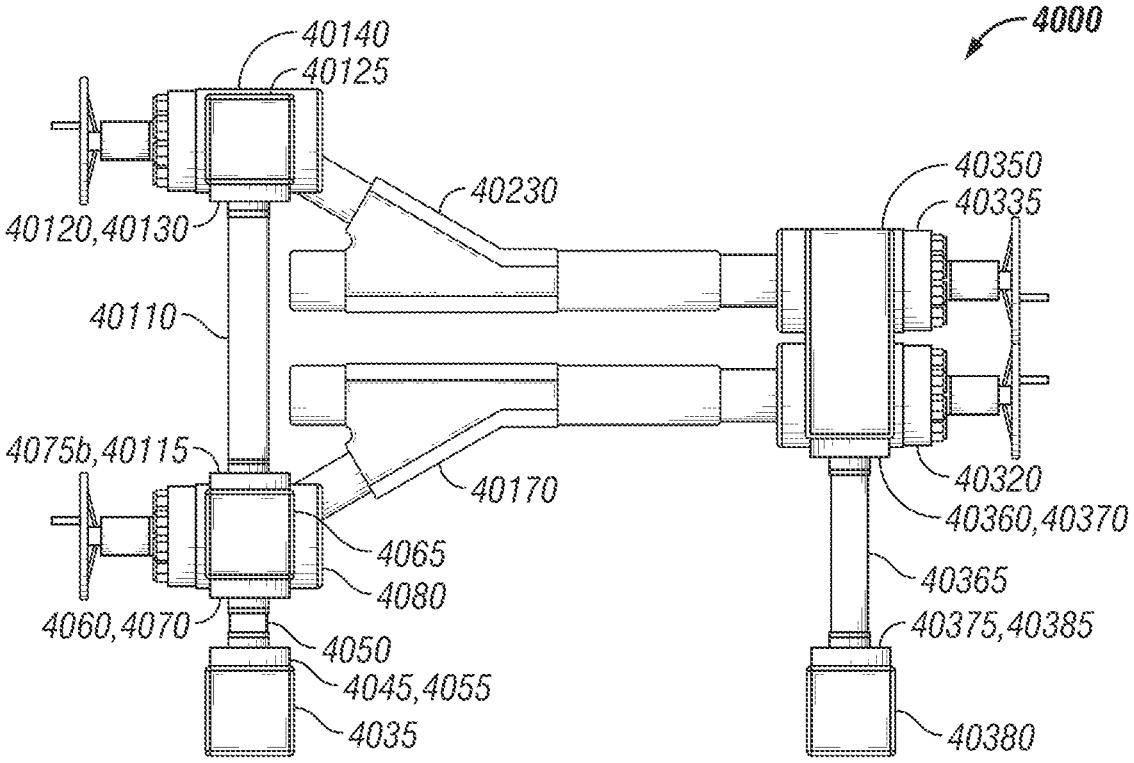
FIG. 40D illustrates a top view of the flow loop configuration of FIG. 40A.

FIG. 40A illustrates an upper, right perspective view of a drilling mud screen system in a flow loop configuration 4000; FIG. 40B illustrates a left side view of the flow loop configuration 4000 of FIG. 40A, showing a drilling mud inlet; FIG. 40C illustrates a right side view of the flow loop configuration 4000 of FIG. 40A, showing a drilling mud outlet; and FIG. 40D illustrates a top view of the flow loop configuration 4000 of FIG. 40A As shown in FIGS. 39A-40D, the flow loop configuration 3900, 4000 comprises a first drilling mud manifold 3905, 4005 having a first drilling mud inlet 3910, 4010 and a first drilling mud outlet 3915, 4015, a first spool 3920, 4020 having a first drilling mud inlet 3925, 4025 and a first drilling mud outlet 3930, 4030, a second drilling mud manifold 3935, 4035 having a second drilling mud inlet 3940, 4040, a second drilling mud outlet 3945, 4045, a second spool 3950, 4050 having a second drilling mud inlet 3955, 4055 and a second drilling mud outlet 3960, 4060, a third drilling mud manifold 3965, 4065 having a third drilling mud inlet 3970, 4070, a third, first drilling mud outlet 3975*a*, 4075*a* and a third, second drilling mud outlet 3975*b*, 4075*b*, a first gate valve 3980, 4080 having a first drilling mud inlet 3985, 4085 and a first drilling mud outlet 3990, 4090, a fourth drilling mud manifold 3995, 4095 having a fourth drilling mud inlet 39100, 40100, a fourth, first drilling mud outlet 39105*a*, 40105*a*, a fourth, second drilling mud outlet 39105*b*, 40105*b*, a fourth, third drilling mud outlet 39105*c*, 40105*c* and a fourth, fourth drilling mud outlet 39105*d*, 40105*d*, a third spool 39110, 40110 having a third drilling mud inlet 39115, 40115 and a third drilling mud outlet 39120, 40120, a fifth drilling mud manifold 39125, 40125 having a fifth drilling mud inlet 39130, 40130 and a fifth drilling mud outlet 39135, 40135, a second gate valve 39140, 40140 having a second drilling mud inlet 39145, 40145 and a second drilling mud outlet 39150, 40150, a sixth drilling mud manifold 39155, 40155 having a sixth drilling mud inlet 39160, 40160, a sixth, first drilling mud outlet 39165*a*, 40165*a*, a sixth, second drilling mud outlet 39165*b*, 40165*b*, a sixth, third drilling mud outlet 39165*c*, 40165*c*, a sixth, fourth drilling mud outlet 39165*d*, 40165*d*, a first drilling mud screen system 400, 600, 1400, 2100, 2300, 39170, 40170 having a first drilling mud inlet 420, 620*a*, 1420, 2120*a*, 2320*a*, 39175, 40175 and a first drilling mud outlet 425, 625*b*, 1425, 2120*b*, 39180, 40180, a second drilling mud screen system 400, 600, 1400, 2100, 2300, 39185, 40185 having a second drilling mud inlet 420, 620*a*, 1420, 2120*a*, 2320*a*, 39190, 40190, a second drilling mud outlet 425, 625*b*, 1425, 2125*b*, 2325*b*, 39195, 40195, a third drilling mud screen system 400, 600, 1400, 2100, 2300, 39200, 40200 having a third drilling mud inlet 420, 620*a*, 1420, 2120*a*, 2320*a*, 39205, 40205 and a third drilling mud outlet 425, 625*b*, 1425, 2120*b*, 39210, 40210, a fourth drilling mud screen system 400, 600, 1400, 2100, 2300, 39215, 40215 having a fourth drilling mud inlet 420, 620*a*, 1420, 2120*a*, 2320*a*, 39220, 40220 and a fourth drilling mud outlet 425, 625*b*, 1425, 2120*b*, 39225, 40225, a fifth drilling mud screen system 400, 600, 1400, 2100, 2300, 39230, 40230 having a fifth drilling mud inlet 420, 620*a*, 1420, 2120*a*, 2320*a*, 39235, 40235 and a fifth drilling mud outlet 425, 625*b*, 1425, 2120*b*, 39240, 40240, a sixth drilling mud screen system 400, 600, 1400, 2100, 2300, 39245, 40245 having a sixth drilling mud inlet 420, 620*a*, 1420, 2120*a*, 2320*a*, 39250, 40250 and a fifth drilling mud outlet 425, 625*b*, 1425, 2120*b*, 39255, 40255, a seventh drilling mud screen system 400, 600, 1400, 2100, 2300, 39260, 40260 having a seventh drilling mud inlet 420, 620*a*, 1420, 2120*a*, 2320*a*, 39265, 40265 and a seventh drilling mud outlet 425, 625*b*, 1425, 2120*b*, 39270, 40270, an eighth drilling mud screen system 400, 600, 1400, 2100, 2300, 39275, 40275 having a drilling mud inlet 420, 620*a*, 1420, 2120*a*, 2320*a*, 39280, 40280 and a seventh drilling mud outlet 425, 625*b*, 1425, 2120*b*, 39285, 40285, third gate valve 39320, 40320 having a third drilling mud inlet 39325, 40325 and a third drilling mud outlet 39330, 40330, a fourth gate valve 39335, 40335 having a fourth drilling mud inlet 39340, 40340 and a fourth drilling mud outlet 39345, 40345, a ninth drilling mud manifold 39350, 40350 having a ninth, first drilling mud inlet 39355*a*, 40355*a*, a ninth, second drilling mud inlet 39355*b*, 40355*b* and a ninth drilling mud outlet 39360, 40360, a fourth spool 39365, 40365 having a fourth drilling mud inlet 39370, 40370 and a fourth drilling mud outlet 39375, 40375, a tenth drilling mud manifold 39380, 40380 having a tenth drilling mud inlet 39385, 40385 and a tenth drilling mud outlet 39390, 40390, a fifth spool 39395, 40395 having a fifth drilling mud inlet 39400, 40400 and a fifth drilling mud outlet 39405, 40405, and an eleventh drilling mud manifold 39410, 40410 having an eleventh drilling mud inlet 39415, 40415 and an eleventh drilling mud outlet 39420, 40420.

In an embodiment, the drilling mud inlet 3910, 4010 may be fluidly connected to, for example, an outlet of a drilling mud pump via a connection; and the drilling mud outlet 39420, 40420 may be fluidly connected to an inlet of a vibrator hose via a connection. Any suitable connection may be used for the drilling mud inlet 3910, 4010 and drilling mud outlet 39420, 40420. For example, suitable connections include, but are not limited to, pipe fittings and welds. Connections are well known in the art. In an embodiment, the drilling mud inlet 3910, 4010 may be fluidly connected to, for example, an outlet of a drilling mud pump via a weld; and the drilling mud outlet 39420, 4420 may be fluidly connected to an inlet of a vibrator hose via a weld.

In an embodiment, the flow loop configuration 3900, 4000 comprises a first stub connection from, for example, an outlet of a drilling mud pump to a drilling mud inlet 3910, 4010 of a first drilling mud manifold 3905, 4005.

In an embodiment, the flow loop configuration 3900, 4000 comprises a second stub connection from, for example, a drilling mud outlet 3942, 40420 of an eleventh drilling mud manifold 39410, 40410 to an inlet of a vibrator hose.

In an embodiment, the first drilling mud outlet 3915, 4015 of the first drilling mud manifold 3905, 4005 and the first spool 3920, 4020 may be fluidly connected by a connection. Any suitable connection may be used for the first drilling mud outlet 3915, 4015 of the first drilling mud manifold 3905, 4005 and the first spool 3920, 4020. For example, suitable connections include, but are not limited to, flanges and pipe fittings. Connections are well known in the art.

In an embodiment, the first drilling mud manifold 3905, 4005 may have an integral flange at the first drilling mud outlet 3915, 4015.

In an embodiment, the first spool 3920, 4020 may have an integral flange at the first drilling mud inlet 3925, 4025 and/or the first drilling mud outlet 3930, 4030.

In an embodiment, the first drilling mud outlet 3930, 4030 of the first spool 3920, 4020 and the second drilling mud manifold 3935, 4035 may be fluidly connected by a connection. Any suitable connection may be used for the first drilling mud outlet 3930, 4030 of the first spool 3920, 4020 and the second drilling mud manifold 3935, 4035. For example, suitable connections include, but are not limited to, flanges and pipe fittings. Connections are well known in the art.

In an embodiment, the first spool 3920, 4020 may have an integral flange at the first drilling mud inlet 3925, 4025 and/or the first drilling mud outlet 3930, 4030.

In an embodiment, the second drilling mud manifold 3935, 4035 may have an integral flange at the second drilling mud inlet 3940, 4040 and/or the second drilling mud outlet 3945, 4045.

In an embodiment, the second drilling mud outlet 3945, 4045 of the second drilling mud manifold 3935, 4035 and the second spool 3950, 4050 may be fluidly connected by a connection. Any suitable connection may be used for the second drilling mud outlet 3945, 4045 of the second drilling mud manifold 3935, 4035 and the second spool 3950, 4050. For example, suitable connections include, but are not limited to, flanges and pipe fittings. Connections are well known in the art.

In an embodiment, the second drilling mud manifold 3935, 4035 may have an integral flange at the second drilling mud inlet 3940, 4040 and/or the second drilling mud outlet 3945, 4045.

In an embodiment, the second spool 3950, 4050 may have an integral flange at the second drilling mud inlet 3955, 4055 and/or the second drilling mud outlet 3960, 4060.

In an embodiment, the second drilling mud outlet 3960, 4060 of the second spool 3950, 4050 and the third drilling mud manifold 3965, 4065 may be fluidly connected by a connection. Any suitable connection may be used for the second drilling mud outlet 3960, 4060 of the second spool 3950, 4050 and the third drilling mud manifold 3965, 4065. For example, suitable connections include, but are not limited to, flanges and pipe fittings. Connections are well known in the art.

In an embodiment, the second spool 3950, 4050 may have an integral flange at the second drilling mud inlet 3955, 4055 and/or the second drilling mud outlet 3960, 4060.

In an embodiment, the third drilling mud manifold 3965, 4065 may have an integral flange at the third drilling mud inlet 3970, 4070, the third, first drilling mud outlet 3975*a*, 4075*a* and/or the third, second drilling mud outlet 3975*b*, 4075*b*.

In an embodiment, the third, first drilling mud outlet 3975*a*, 4075*a* of the third drilling mud manifold 3965, 4065 and the first gate valve 3980, 4080 may be fluidly connected via a connection. Any suitable connection may be used for the third, first drilling mud outlet 3975*a*, 4075*a* of the third drilling mud manifold 3965, 4065 and the first gate valve 3980, 4080. For example, suitable connections include, but are not limited to, flanges and pipe fittings. Connections are well known in the art.

In an embodiment, the third drilling mud manifold 3965, 4065 may have an integral flange at the third drilling mud inlet 3970, 4070, the third, first drilling mud outlet 3975*a*, 4075*a* and/or the third, second drilling mud outlet 3975*b*, 4075*b*.

In an embodiment, the first gate valve 3980, 4080 may have an integral flange at the first drilling mud inlet 3985, 4085 and/or the first drilling mud outlet 3990, 4090.

In an embodiment, the first drilling mud outlet 3990, 4090 of the first gate valve 3980, 4080 and the fourth drilling mud manifold 3995, 4095 may be fluidly connected via a connection. Any suitable connection may be used for the first drilling mud outlet 3990, 4090 of the first gate valve 3980, 4080 and the fourth drilling mud manifold 3995, 4095. For example, suitable connections include, but are not limited to, flanges and pipe fittings. Connections are well known in the art.

In an embodiment, the first gate valve 3980, 4080 may have an integral flange at the first drilling mud inlet 3985, 4085 and/or the first drilling mud outlet 3990, 4090.

In an embodiment, the fourth drilling mud manifold 3995, 4095 may have an integral flange at the fourth drilling mud inlet 39100, 40100, the fourth, first drilling mud outlet 39105*a*, 40105*a*, the fourth, second drilling mud outlet 39405*b*, 40405*b*, the fourth, third drilling mud outlet 39405*c*, 40405*c*, and/or the fourth, fourth drilling mud outlet 39405*d*, 40405*d*.

In an embodiment, the third, second drilling mud outlet 3975*b*, 4075*b* of the third drilling mud manifold 3965, 4065 and the third spool 39110, 40110 may be fluidly connected by a connection. Any suitable connection may be used for the third, second drilling mud outlet 3975*b*, 4075*b* of the third drilling mud manifold 3965, 4065 and the third spool 39110, 40110. For example, suitable connections include, but are not limited to, flanges and pipe fittings. Connections are well known in the art.

In an embodiment, the third drilling mud manifold 3965, 4065 may have an integral flange at the third drilling mud inlet 3970, 4070, the third, first drilling mud outlet 3975*a*, 4075*a* and/or the third, second drilling mud outlet 3975*b*, 4075*b*.

In an embodiment, the third spool 39110, 40110 may have an integral flange at the third drilling mud inlet 39115, 40115 and/or the third drilling mud outlet 39120, 40120.

In an embodiment, the third drilling mud outlet 39120, 40120 of the third spool 39110, 40110 and a fifth drilling mud manifold 39125, 40125 may be fluidly connected via a connection. Any suitable connection may be used for the third drilling mud outlet 39120, 40120 of the third spool 39110, 40110 and the fifth drilling mud manifold 39125, 40125. For example, suitable connections include, but are not limited to, flanges and pipe fittings. Connections are well known in the art.

In an embodiment, the third spool 39110, 40110 may have an integral flange at the third drilling mud inlet 39115, 40115 and/or the third drilling mud outlet 39120, 40120.

In an embodiment, the fifth drilling mud manifold 39125, 40125 may have an integral flange at the fifth drilling mud inlet 39130, 40130 and/or the fifth drilling mud outlet 39135, 40135.

In an embodiment, the fifth drilling mud outlet 39135, 40135 of the fifth drilling mud manifold 39125, 40125 and the second gate valve 39140, 40140 may be fluidly connected via a connection. Any suitable connection may be used for the fifth drilling mud outlet 39135, 40135 of the fifth drilling mud manifold 39125, 40125 and the second gate valve 39140, 40140. For example, suitable connections include, but are not limited to, flanges and pipe fittings. Connections are well known in the art.

In an embodiment, the fifth drilling mud manifold 39125, 40125 may have an integral flange at the fifth drilling mud inlet 39130, 40130 and/or the fifth drilling mud outlet 39135, 40135.

In an embodiment, the second gate valve 39140, 40140 may have an integral flange at the second drilling mud inlet 39145, 40145 and/or the second drilling mud outlet 39150, 40150.

In an embodiment, the second drilling mud outlet 39150, 40150 of the second gate valve 39140, 40140 and the sixth drilling mud manifold 39155, 40155 may be fluidly connected via a connector. Any suitable connector may be used for the second drilling mud outlet 39150, 40150 of the second gate valve 39140, 40140 and the sixth drilling mud manifold 39155, 40155. For example, suitable connections include, but are not limited to, flanges and pipe fittings. Connections are well known in the art.

In an embodiment, the second gate valve 39140, 40140 may have an integral flange at the second drilling mud inlet 39145, 40145 and/or the second drilling mud outlet 39150, 40150.

In an embodiment, the sixth drilling mud manifold 39155, 40155 may have an integral flange at the sixth drilling mud inlet 39160, 40160, the sixth, first drilling mud outlet 39165*a*, 40165*a*, the sixth, second drilling mud outlet 39165*b*, 40165*b*, the sixth, third drilling mud outlet 39165*c*, 40165*c* and/or the sixth, fourth drilling mud outlet 39165*d*, 40165*d*.

In an embodiment, the fourth, first drilling mud outlet 39105*a*, 40105*a* of the fourth drilling mud manifold 3995, 4095 and the first drilling mud inlet 420, 620*a*, 1420, 2120*a*, 2320*a*, 39175, 40175 of the first drilling mud screen system 400, 600, 1400, 2100, 2300, 39170, 40170 may be fluidly connected by a connection. Any suitable connection may be used for the fourth, first drilling mud outlet 39105*a*, 40105*a* of the fourth drilling mud manifold 3995, 4095 and the first drilling mud inlet 420, 620*a*, 1420, 2120*a*, 2320*a*, 39175, 40175 of the first drilling mud screen system 400, 600, 1400, 2100, 2300, 39170, 40170. For example, suitable connections include, but are not limited to, flanges and pipe fittings. Connections are well known in the art.

In an embodiment, the fourth drilling mud manifold 3995, 4095 may have an integral flange at the fourth drilling mud inlet 39100, 40100, the fourth, first drilling mud outlet 39105*a*, 40105*a*, the fourth, second drilling mud outlet 39105*b*, 40105*b*, the fourth, third drilling mud outlet 39105*c*, 40105*c* and/or the fourth, fourth drilling mud outlet 39105*d*, 40105*d*.

In an embodiment, the flow loop configuration 3900, 4000 comprises a first cross-over connection 3105, 39425, 40425 from a fourth drilling mud manifold 3995, 4095 to a first drilling mud screen system 400, 600, 1400, 2100, 2300, 39170, 40170.

In an embodiment, the first cross-over connection 3105, 39425, 40425 may have an integral flange at a first drilling mud inlet and/or a first drilling mud outlet.

In an embodiment, the fourth, second drilling mud outlet 39105*b*, 40105*b* of the fourth drilling mud manifold 3995, 4095 and the second drilling mud inlet 420, 620*a*, 1420, 2120*a*, 2320*a*, 39190, 40190 of the second drilling mud screen system 400, 600, 1400, 2100, 2300, 39185, 40185 may be fluidly connected by a connection. Any suitable connection may be used for the fourth, second drilling mud outlet 39105*b*, 40105*b* of the fourth drilling mud manifold 3995, 4095 and the second drilling mud inlet 420, 620*a*, 1420, 2120*a*, 2320*a*, 39190, 40190 of the second drilling mud screen system 400, 600, 1400, 2100, 2300, 39185, 40185. For example, suitable connections include, but are not limited to, flanges and pipe fittings. Connections are well known in the art.

In an embodiment, the fourth drilling mud manifold 3995, 4095 may have an integral flange at the fourth drilling mud inlet 39100, 40100, the fourth, first drilling mud outlet 39105*a*, 40105*a*, the fourth, second drilling mud outlet 39105*b*, 40105*b*, the fourth, third drilling mud outlet 39105*c*, 40105*c* and/or the fourth, fourth drilling mud outlet 39105*d*, 40105*d*.

In an embodiment, the flow loop configuration 3900, 4000 comprises a second cross-over connection 3105, 39430, 40430 from a fourth drilling mud manifold 3995, 4095 to a second drilling mud screen system 400, 600, 1400, 2100, 2300, 39185, 40185.

In an embodiment, the second cross-over connection 3105, 39430, 40430 may have an integral flange at a second drilling mud inlet.

In an embodiment, the fourth, third drilling mud outlet 39105*c*, 40105*c* of the fourth drilling mud manifold 3995, 4095 and the third drilling mud inlet 420, 620*a*, 1420, 2120*a*, 2320*a*, 39205, 40205 of the third drilling mud screen system 400, 600, 1400, 2100, 2300, 39200, 40200 may be fluidly connected by a connection. Any suitable connection may be used for the fourth, third drilling mud outlet 39105*c*, 40105*c* of the fourth drilling mud manifold 3995, 4095 and the third drilling mud inlet 420, 620*a*, 1420, 2120*a*, 2320*a*, 39205, 40205 of the third drilling mud screen system 400, 600, 1400, 2100, 2300, 39200, 40200. For example, suitable connections include, but are not limited to, flanges and pipe fittings. Connections are well known in the art.

In an embodiment, the fourth drilling mud manifold 3995, 4095 may have an integral flange at the fourth drilling mud inlet 39100, 40100, the fourth, first drilling mud outlet 39105*a*, 40105*a*, the fourth, second drilling mud outlet 39105*b*, 40105*b*, the fourth, third drilling mud outlet 39105*c*, 40105*c* and/or the fourth, fourth drilling mud outlet 39105*d*, 40105*d*.

In an embodiment, the flow loop configuration 3900, 4000 comprises a third cross-over connection 3105, 39435, 40435 from a fourth drilling mud manifold 3995, 4095 to a third drilling mud screen system 400, 600, 1400, 2100, 2300, 39200, 40200.

In an embodiment, the third cross-over connection 3105, 39435, 40435 may have an integral flange at a third drilling mud inlet and/or a third drilling mud outlet.

In an embodiment, the fourth, fourth drilling mud outlet 39105*d*, 40105*d* of the fourth drilling mud manifold 3995, 4095 and the fourth drilling mud inlet 420, 620*a*, 1420, 2120*a*, 2320*a*, 39220, 40220 of the fourth drilling mud screen system 400, 600, 1400, 2100, 2300, 39215, 40215 may be fluidly connected by a connection. Any suitable connection may be used for the fourth, fourth drilling mud outlet 39105*d*, 40105*d* of the fourth drilling mud manifold 3995, 4095 and the fourth drilling mud inlet 420, 620*a*, 1420, 2120*a*, 2320*a*, 39220, 40220 of the fourth drilling mud screen system 400, 600, 1400, 2100, 2300, 39215, 40215. For example, suitable connections include, but are not limited to, flanges and pipe fittings. Connections are well known in the art.

In an embodiment, the fourth drilling mud manifold 3995, 4095 may have an integral flange at the fourth drilling mud inlet 39100, 40100, the fourth, first drilling mud outlet 39105*a*, 40105*a*, the fourth, second drilling mud outlet 39105*b*, 40105*b*, the fourth, third drilling mud outlet 39105*c*, 40105*c* and/or the fourth, fourth drilling mud outlet 39105*d*, 40105*d*.

In an embodiment, the flow loop configuration 3900, 4000 comprises a fourth cross-over connection 3105, 39440, 40440 from a fourth drilling mud manifold 3995, 4095 to a fourth drilling mud screen system 400, 600, 1400, 2100, 2300, 39215, 40215.

In an embodiment, the fourth cross-over connection 3105, 39440, 40440 may have an integral flange at a fourth drilling mud inlet and/or a fourth drilling mud outlet.

In an embodiment, the sixth, first drilling mud outlet 39165*a*, 40165*a* of the sixth drilling mud manifold 39155, 40155 and the fifth drilling mud inlet 420, 620*a*, 1420, 2120*a*, 2320*a*, 39235, 40235 of the fifth drilling mud screen system 400, 600, 1400, 2100, 2300, 39230, 40230 may be fluidly connected by a connection. Any suitable connection may be used for the sixth, first drilling mud outlet 39165*a*, 40165*a* of the sixth drilling mud manifold 39155, 40155 and the fifth drilling mud inlet 420, 620*a*, 1420, 2120*a*, 2320*a*, 39235, 40235 of the fifth drilling mud screen system 400, 600, 1400, 2100, 2300, 39230, 40230. For example, suitable connections include, but are not limited to, flanges and pipe fittings. Connections are well known in the art.

In an embodiment, the sixth drilling mud manifold 39155, 40155 may have an integral flange at the sixth drilling mud inlet 39160, 40160, the sixth, first drilling mud outlet 39165*a*, 40165*a*, the sixth, second drilling mud outlet 39165*b*, 40165*b*, the sixth, third drilling mud outlet 39165*c*, 40165*c* and/or the sixth, fourth drilling mud outlet 39165*d*, 40165*d*.

In an embodiment, the flow loop configuration 3900, 4000 comprises a fifth cross-over connection 3105, 39445, 40445 from a sixth drilling mud manifold 39155, 40155 to a fifth drilling mud screen system 400, 600, 1400, 2100, 2300, 39230, 40230.

In an embodiment, the fifth cross-over connection 3105, 39445, 40445 may have an integral flange at a fifth drilling mud inlet and/or a fifth drilling mud outlet.

In an embodiment, the sixth, second drilling mud outlet 39165*b*, 40165*b* of the sixth drilling mud manifold 39155, 40155 and the sixth drilling mud inlet 420, 620*a*, 1420, 2120*a*, 2320*a*, 39250, 40250 of the sixth drilling mud screen system 400, 600, 1400, 2100, 2300, 39245, 40245 may be fluidly connected by a connection. Any suitable connection may be used for the sixth, second drilling mud outlet 39165*b*, 40165*b* of the sixth drilling mud manifold 39155, 40155 and the sixth drilling mud inlet 420, 620*a*, 1420, 2120*a*, 2320*a*, 39250, 40250 of the sixth drilling mud screen system 400, 600, 1400, 2100, 2300, 39245, 40245. For example, suitable connections include, but are not limited to, flanges and pipe fittings. Connections are well known in the art.

In an embodiment, the sixth drilling mud manifold 39155, 40155 may have an integral flange at the sixth drilling mud inlet 39160, 40160, the sixth, first drilling mud outlet 39165*a*, 40165*a*, the sixth, second drilling mud outlet 39165*b*, 40165*b*, the sixth, third drilling mud outlet 39165*c*, 40165*c* and/or the sixth, fourth drilling mud outlet 39165*d*, 40165*d*.

In an embodiment, the flow loop configuration 3900, 4000 comprises a sixth cross-over connection 3105, 39450, 40450 from a sixth drilling mud manifold 39155, 40155 to a sixth drilling mud screen system 400, 600, 1400, 2100, 2300, 39245, 40245.

In an embodiment, the sixth cross-over connection 3105, 39450, 40450 may have an integral flange at a sixth drilling mud inlet and/or a sixth drilling mud outlet.

In an embodiment, the sixth, third drilling mud outlet 39165*c*, 40165*c* of the sixth drilling mud manifold 39155, 40155 and the seventh drilling mud inlet 420, 620*a*, 1420, 2120*a*, 2320*a*, 39265, 40265 of the seventh drilling mud screen system 400, 600, 1400, 2100, 2300, 39260, 40260 may be fluidly connected by a connection. Any suitable connection may be used for the sixth, third drilling mud outlet 39165*c*, 40165*c* of the sixth drilling mud manifold 39155, 40155 and the seventh drilling mud inlet 420, 620*a*, 1420, 2120*a*, 2320*a*, 39265, 40265 of the seventh drilling mud screen system 400, 600, 1400, 2100, 2300, 39260, 40260. For example, suitable connections include, but are not limited to, flanges and pipe fittings. Connections are well known in the art.

In an embodiment, the sixth drilling mud manifold 39155, 40155 may have an integral flange at the sixth drilling mud inlet 39160, 40160, the sixth, first drilling mud outlet

39165*a*, 40165*a*, the sixth, second drilling mud outlet 39165*b*, 40165*b*, the sixth, third drilling mud outlet 39165*c*, 40165*c* and/or the sixth, fourth drilling mud outlet 39165*d*, 40165*d*.

In an embodiment, the flow loop configuration 3900, 4000 comprises a seventh cross-over connection 3105, 39455, 40455 from a sixth drilling mud manifold 39155, 40155 to a seventh drilling mud screen system 400, 600, 1400, 2100, 2300, 39260, 40260.

In an embodiment, the seventh cross-over connection 3105, 39455, 40455 may have an integral flange at a seventh drilling mud inlet and/or a seventh drilling mud outlet.

In an embodiment, the sixth, fourth drilling mud outlet 39165*d*, 40165*d* of the sixth drilling mud manifold 39155, 40155 and the eighth drilling mud inlet 420, 620*a*, 1420, 2120*a*, 2320*a*, 39280, 40280 of the eighth drilling mud screen system 400, 600, 1400, 2100, 2300, 39275, 40275 may be fluidly connected by a connection. Any suitable connection may be used for the sixth, fourth drilling mud outlet 39165*d*, 40165*d* of the sixth drilling mud manifold 39155, 40155 and the eighth drilling mud inlet 420, 620*a*, 1420, 2120*a*, 2320*a*, 39280, 40280 of the eighth drilling mud screen system 400, 600, 1400, 2100, 2300, 39275, 40275. For example, suitable connections include, but are not limited to, flanges and pipe fittings. Connections are well known in the art.

In an embodiment, the sixth drilling mud manifold 39155, 40155 may have an integral flange at the sixth drilling mud inlet 39160, 40160, the sixth, first drilling mud outlet 39165*a*, 40165*a*, the sixth, second drilling mud outlet 39165*b*, 40165*b*, the sixth, third drilling mud outlet 39165*c*, 40165*c* and/or the sixth, fourth drilling mud outlet 39165*d*, 40165*d*.

In an embodiment, the flow loop configuration 3900, 4000 comprises a eighth cross-over connection 3105, 39460, 40460 from a sixth drilling mud manifold 39155, 40155 to an eighth drilling mud screen system 400, 600, 1400, 2100, 2300, 39275, 40275.

In an embodiment, the eighth cross-over connection 3105, 39460, 40460 may have an integral flange at an eighth drilling mud inlet and/or an eighth drilling mud outlet.

In an embodiment, the first drilling mud outlet 425, 625*b*, 1425, 2125*b*, 2325*b*, 39180, 40180 of the first drilling mud screen system 400, 600, 1400, 2100, 2300, 39170, 40170 and the seventh, first drilling mud inlet 39295*a*, 40295*a* of the seventh drilling mud manifold 39290, 40290 may be fluidly connected by a connection. Any suitable connection may be used for the first drilling mud outlet 425, 625*b*, 1425, 2125*b*, 2325*b*, 39180, 40180 of the first drilling mud screen system 400, 600, 1300, 2100, 2300, 39170, 40170 and the seventh, first drilling mud inlet 39295*a*, 40295*a* of the seventh drilling mud manifold 39290, 40290. For example, suitable connections include, but are not limited to, flanges and pipe fittings. Connections are well known in the art.

In an embodiment, the flow loop configuration 3900, 4000 comprises a ninth cross-over connection 3105, 39465, 40465 from a first drilling mud screen system 400, 600, 1400, 2100, 2300, 39170, 40170 to a seventh drilling mud manifold 39290, 40290.

In an embodiment, the ninth cross-over connection 3105, 39465, 40465 may have an integral flange at a ninth drilling mud outlet.

In an embodiment, the seventh drilling mud manifold 39290, 40290 may have an integral flange at the seventh, first drilling mud inlet 39295*a*, 40295*a*, the seventh, second drilling mud inlet 39295*b*, 40295*b*, the seventh, third drilling mud inlet 39295*c*, 40295*c*, the seventh, fourth drilling mud inlet 39295*d*, 40295*d* and/or the seventh drilling mud outlet 39300, 40300.

In an embodiment, the second drilling mud outlet 425, 625*b*, 1425, 2125*b*, 2325*b*, 39195, 40195 of the second drilling mud screen system 400, 600, 1400, 2100, 2300, 39185, 40185 and the seventh, second drilling mud inlet 39295*b*, 40295*b* of the seventh drilling mud manifold 39290, 40290 may be fluidly connected by a connection. Any suitable connection may be used for the second drilling mud outlet 425, 625*b*, 1425, 2125*b*, 2325*b*, 39195, 40195 of the second drilling mud screen system 400, 600, 1300, 2100, 2300, 39185, 40185 and the seventh, second drilling mud inlet 39295*b*, 40295*b* of the seventh drilling mud manifold 39290, 40290. For example, suitable connections include, but are not limited to, flanges and pipe fittings. Connections are well known in the art.

In an embodiment, the flow loop configuration 3900, 4000 comprises a tenth cross-over connection 3105, 39470, 40470 from a second drilling mud screen system 400, 600, 1400, 2100, 2300, 39185, 40185 to a seventh drilling mud manifold 39290, 40290.

In an embodiment, the tenth cross-over connection 3105, 39470, 40470 may have an integral flange at a tenth drilling mud outlet.

In an embodiment, the seventh drilling mud manifold 39290, 40290 may have an integral flange at the seventh, first drilling mud inlet 39295*a*, 40295*a*, the seventh, second drilling mud inlet 39295*b*, 40295*b*, the seventh, third drilling mud inlet 39295*c*, 40295*c*, the seventh, fourth drilling mud inlet 39295*d*, 40295*d* and/or the seventh drilling mud outlet 39300, 40300.

In an embodiment, the third drilling mud outlet 425, 625*b*, 1425, 2125*b*, 2325*b*, 39205, 40205 of the third drilling mud screen system 400, 600, 1400, 2100, 2300, 39200, 40200 and the seventh, third drilling mud inlet 39295*c*, 40295*c* of the seventh drilling mud manifold 39290, 40290 may be fluidly connected by a connection. Any suitable connection may be used for the third drilling mud outlet 425, 625*b*, 1425, 2125*b*, 2325*b*, 39205, 40205 of the third drilling mud screen system 400, 600, 1300, 2100, 2300, 39200, 40200 and the seventh, third drilling mud inlet 39295*c*, 40295*c* of the seventh drilling mud manifold 39290, 40290. For example, suitable connections include, but are not limited to, flanges and pipe fittings. Connections are well known in the art.

In an embodiment, the flow loop configuration 3900, 4000 comprises an eleventh cross-over connection 3105, 39475, 40475 from a third drilling mud screen system 400, 600, 1400, 2100, 2300, 39200, 40200 to a seventh drilling mud manifold 39290, 40290.

In an embodiment, the eleventh cross-over connection 3105, 39475, 40475 may have an integral flange at an eleventh drilling mud outlet.

In an embodiment, the seventh drilling mud manifold 39290, 40290 may have an integral flange at the seventh, first drilling mud inlet 39295*a*, 40295*a*, the seventh, second drilling mud inlet 39295*b*, 40295*b*, the seventh, third drilling mud inlet 39295*c*, 40295*c*, the seventh, fourth drilling mud inlet 39295*d*, 40295*d* and/or the seventh drilling mud outlet 39300, 40300.

In an embodiment, the fourth drilling mud outlet 425, 625*b*, 1425, 2125*b*, 2325*b*, 39225, 40225 of the fourth drilling mud screen system 400, 600, 1400, 2100, 2300, 39215, 40215 and the seventh, fourth drilling mud inlet 39295*d*, 40295*d* of the seventh drilling mud manifold 39290, 40290 may be fluidly connected by a connection.

Any suitable connection may be used for the fourth drilling mud outlet 425, 625*b*, 1425, 2125*b*, 2325*b*, 39225, 40225 of the fourth drilling mud screen system 400, 600, 1300, 2100, 2300, 39215, 40215 and the seventh, fourth drilling mud inlet 39295*d*, 40295*d* of the seventh drilling mud manifold 39290, 40290. For example, suitable connections include, but are not limited to, flanges and pipe fittings. Connections are well known in the art.

In an embodiment, the flow loop configuration 3900, 4000 comprises a twelfth cross-over connection 3105, 39480, 40480 from a fourth drilling mud screen system 400, 600, 1400, 2100, 2300, 39215, 40215 to a seventh drilling mud manifold 39290, 40290.

In an embodiment, the twelfth cross-over connection 3105, 39480, 40480 may have an integral flange at a twelfth drilling mud outlet.

In an embodiment, the seventh drilling mud manifold 39290, 40290 may have an integral flange at the seventh, first drilling mud inlet 39295*a*, 40295*a*, the seventh, second drilling mud inlet 39295*b*, 40295*b*, the seventh, third drilling mud inlet 39295*c*, 40295*c*, the seventh, fourth drilling mud inlet 39295*d*, 40295*d* and/or the seventh drilling mud outlet 39300, 40300.

In an embodiment, the fifth drilling mud outlet 425, 625*b*, 1425, 2125*b*, 2325*b*, 39240, 40240 of the fifth drilling mud screen system 400, 600, 1400, 2100, 2300, 39230, 40230 and the eighth, first drilling mud inlet 39310*a*, 40310*a* of the eighth drilling mud manifold 39305, 40305 may be fluidly connected by a connection. Any suitable connection may be used for the fifth drilling mud outlet 425, 625*b*, 1425, 2125*b*, 2325*b*, 39240, 40240 of the fifth drilling mud screen system 400, 600, 1300, 2100, 2300, 39230, 40230 and the eighth, first drilling mud inlet 39310*a*, 40310*a* of the eighth drilling mud manifold 39305, 40305. For example, suitable connections include, but are not limited to, flanges and pipe fittings. Connections are well known in the art.

In an embodiment, the flow loop configuration 3900, 4000 comprises a thirteenth cross-over connection 3105, 39485, 40485 from a fifth drilling mud screen system 400, 600, 1400, 2100, 2300, 39230, 40230 to an eighth drilling mud manifold 39305, 40305.

In an embodiment, the thirteenth cross-over connection 3105, 39485, 40485 may have an integral flange at a thirteenth drilling mud outlet.

In an embodiment, the eighth drilling mud manifold 39305, 40305 may have an integral flange at the eighth, first drilling mud inlet 39310*a*, 40310*a*, the eighth, second drilling mud inlet 39310*b*, 40310*b*, the eighth, third drilling mud inlet 39310*c*, 40310*c*, the eighth, fourth drilling mud inlet 39310*d*, 40310*d* and/or the eighth drilling mud outlet 39315, 40315.

In an embodiment, the sixth drilling mud outlet 425, 625*b*, 1425, 2125*b*, 2325*b*, 39255, 40255 of the sixth drilling mud screen system 400, 600, 1400, 2100, 2300, 39245, 40245 and the eighth, second drilling mud inlet 39310*b*, 40310*b* of the eighth drilling mud manifold 39305, 40305 may be fluidly connected by a connection. Any suitable connection may be used for the sixth drilling mud outlet 425, 625*b*, 1425, 2125*b*, 2325*b*, 39255, 40255 of the sixth drilling mud screen system 400, 600, 1300, 2100, 2300, 39245, 40245 and the eighth, second drilling mud inlet 39310*b*, 40310*b* of the eighth drilling mud manifold 39305, 40305. For example, suitable connections include, but are not limited to, flanges and pipe fittings. Connections are well known in the art.

In an embodiment, the flow loop configuration 3900, 4000 comprises a fourteenth cross-over connection 3105, 39490, 40490 from a sixth drilling mud screen system 400, 600, 1400, 2100, 2300, 39245, 40245 to an eighth drilling mud manifold 39305, 40305.

In an embodiment, the fourteenth cross-over connection 3105, 39490, 40490 may have an integral flange at a fourteenth drilling mud outlet.

In an embodiment, the eighth drilling mud manifold 39305, 40305 may have an integral flange at the eighth, first drilling mud inlet 39310*a*, 40310*a*, the eighth, second drilling mud inlet 39310*b*, 40310*b*, the eighth, third drilling mud inlet 39310*c*, 40310*c*, the eighth, fourth drilling mud inlet 39310*d*, 40310*d* and/or the eighth drilling mud outlet 39315, 40315.

In an embodiment, the seventh drilling mud outlet 425, 625*b*, 1425, 2125*b*, 2325*b*, 39270, 40270 of the seventh drilling mud screen system 400, 600, 1400, 2100, 2300, 39260, 40260 and the eighth, third drilling mud inlet 39310*c*, 40310*c* of the eighth drilling mud manifold 39305, 40305 may be fluidly connected by a connection. Any suitable connection may be used for the seventh drilling mud outlet 425, 625*b*, 1425, 2125*b*, 2325*b*, 39270, 40270 of the seventh drilling mud screen system 400, 600, 1300, 2100, 2300, 39260, 40260 and the eighth, third drilling mud inlet 39310*c*, 40310*c* of the eighth drilling mud manifold 39305, 40305. For example, suitable connections include, but are not limited to, flanges and pipe fittings. Connections are well known in the art.

In an embodiment, the flow loop configuration 3900, 4000 comprises a fifteenth cross-over connection 3105, 39495, 40495 from a seventh drilling mud screen system 400, 600, 1400, 2100, 2300, 39260, 40260 to an eighth drilling mud manifold 39305, 40305.

In an embodiment, the fifteenth cross-over connection 3105, 39495, 40495 may have an integral flange at a fifteenth drilling mud outlet.

In an embodiment, the eighth drilling mud manifold 39305, 40305 may have an integral flange at the eighth, first drilling mud inlet 39310*a*, 40310*a*, the eighth, second drilling mud inlet 39310*b*, 40310*b*, the eighth, third drilling mud inlet 39310*c*, 40310*c*, the eighth, fourth drilling mud inlet 39310*d*, 40310*d* and/or the eighth drilling mud outlet 39315, 40315.

In an embodiment, the eighth drilling mud outlet 425, 625*b*, 1425, 2125*b*, 2325*b*, 39285, 40285 of the eighth drilling mud screen system 400, 600, 1400, 2100, 2300, 39275, 40275 and the eighth, fourth drilling mud inlet 39310*d*, 40310*d* of the eighth drilling mud manifold 39305, 40305 may be fluidly connected by a connection. Any suitable connection may be used for the eighth drilling mud outlet 425, 625*b*, 1425, 2125*b*, 2325*b*, 39285, 40285 of the eighth drilling mud screen system 400, 600, 1300, 2100, 2300, 39275, 40275 and the eighth, fourth drilling mud inlet 39310*d*, 40310*d* of the eighth drilling mud manifold 39305, 40305. For example, suitable connections include, but are not limited to, flanges and pipe fittings. Connections are well known in the art.

In an embodiment, the flow loop configuration 3900, 4000 comprises a sixteenth cross-over connection 3105, 39500, 40500 from a eighth drilling mud screen system 400, 600, 1400, 2100, 2300, 39275, 40275 to an eighth drilling mud manifold 39305, 40305.

In an embodiment, the sixteenth cross-over connection 3105, 39500, 40500 may have an integral flange at a sixteenth drilling mud outlet.

In an embodiment, the eighth drilling mud manifold 39305, 40305 may have an integral flange at the eighth, first drilling mud inlet 39310*a*, 40310*a*, the eighth, second drilling mud inlet 39310*b*, 40310*b*, the eighth, third drilling mud inlet 39310*c*, 40310*c*, the eighth, fourth drilling mud inlet 39310*d*, 40310*d* and/or the eighth drilling mud outlet 39315, 40315.

In an embodiment, the seventh drilling mud outlet 39300, 40300 of the seventh drilling mud manifold 39290, 40290 and the third drilling mud inlet 39325, 40325 of the third gate valve 39320, 40320 may be fluidly connected by a connection. Any suitable connection may be used for the seventh drilling mud outlet 39300, 40300 of the seventh drilling mud manifold 39290, 40290 and the third drilling mud inlet 39325, 40325 of the third gate valve 39320, 40320. For example, suitable connections include, but are not limited to, flanges and pipe fittings. Connections are well known in the art.

In an embodiment, the seventh drilling mud manifold 39290, 40290 may have an integral flange at the seventh, first drilling mud inlet 39295*a*, 40295*a*, the seventh, second drilling mud inlet 39295*b*, 40295*b*, the seventh, third drilling mud inlet 39295*c*, 40295*c*, the seventh, fourth drilling mud inlet 39295*d*, 40295*d* and/or the seventh drilling mud outlet 39300, 40300.

In an embodiment, the third gate valve 39320, 40320 may have an integral flange at the third drilling mud inlet 39325, 40325 and/or the third drilling mud outlet 39330, 40330.

In an embodiment, the eighth drilling mud outlet 39315, 40315 of the eighth drilling mud manifold 39305, 40305 and the fourth drilling mud inlet 39340, 40340 of the fourth gate valve 39335, 40335 may be fluidly connected by a connection. Any suitable connection may be used for the eighth drilling mud outlet 39315, 40315 of the eighth drilling mud manifold 39305, 40305 and the fourth drilling mud inlet 39340, 40340 of the fourth gate valve 39335, 40335. For example, suitable connections include, but are not limited to, flanges and pipe fittings. Connections are well known in the art.

In an embodiment, the eighth drilling mud manifold 39305, 40305 may have an integral flange at the eighth, first drilling mud inlet 39310*a*, 40310*a*, the eighth, second drilling mud inlet 39310*b*, 40310*b*, the eighth, third drilling mud inlet 39310*c*, 40310*c*, the eighth, fourth drilling mud inlet 39310*d*, 40310*d* and/or the eighth drilling mud outlet 39315, 40315.

In an embodiment, the fourth gate valve 39335, 40335 may have an integral flange at the fourth drilling mud inlet 39340, 40340 and/or the fourth drilling mud outlet 39345, 40345.

In an embodiment, the third drilling mud outlet 39330, 40330 of the third gate valve 39320, 40320 and the ninth, first drilling mud inlet 39355*a*, 40355*a* of the ninth drilling mud manifold 39350, 40350 may be fluidly connected by a connection. Any suitable connection may be used for the third drilling mud outlet 39330, 40330 of the third gate valve 39320, 40320 and the ninth, first drilling mud inlet 39355*a*, 40355*a* of the ninth drilling mud manifold 39350, 40350. For example, suitable connections include, but are not limited to, flanges and pipe fittings. Connections are well known in the art.

In an embodiment, the third gate valve 39320, 40320 may have an integral flange at the third drilling mud inlet 39325, 40325 and/or the third drilling mud outlet 39330, 40330.

In an embodiment, the ninth drilling mud manifold 39350, 40350 may have an integral flange at the ninth, first drilling mud inlet 39355*a*, 40355*a*, the ninth, second drilling mud inlet 39355*b*, 40355*b* and/or the ninth drilling mud outlet 39360, 40360.

In an embodiment, the fourth drilling mud outlet 39345, 40345 of the fourth gate valve 39335, 40335 and the ninth, second drilling mud inlet 39355*b*, 40355*b* of the ninth drilling mud manifold 39350, 40350 may be fluidly connected by a connection. Any suitable connection may be used for the fourth drilling mud outlet 39345, 40345 of the fourth gate valve 39335, 40335 and the ninth, second drilling mud inlet 39355*b*, 40355*b* of the ninth drilling mud manifold 39350, 40350. For example, suitable connections include, but are not limited to, flanges and pipe fittings. Connections are well known in the art.

In an embodiment, the fourth gate valve 39335, 40335 may have an integral flange at the fourth drilling mud inlet 39340, 40340 and/or the fourth drilling mud outlet 39345, 40345.

In an embodiment, the ninth drilling mud manifold 39350, 40350 may have an integral flange at the ninth, first drilling mud inlet 39355*a*, 40355*a*, the ninth, second drilling mud inlet 39355*b*, 40355*b* and/or the ninth drilling mud outlet 39360, 40360.

In an embodiment, the ninth drilling mud outlet 39360, 40360 of the ninth drilling mud manifold 39350, 40350 may be fluidly connected to a fourth spool 39365, 40365 via a connection. Any suitable connection may be used for the ninth drilling mud outlet 39360, 40360 of the ninth drilling mud manifold 39350, 40350 and the fourth spool 39365, 40365. For example, suitable connections include, but are not limited to, flanges and pipe fittings. Connections are well known in the art.

In an embodiment, the ninth drilling mud manifold 39350, 40350 may have an integral flange at the ninth, first drilling mud inlet 39355*a*, 40355*a*, the ninth, second drilling mud inlet 39355*b*, 40355*b* and/or the ninth drilling mud outlet 39360, 40360.

In an embodiment, the fourth spool 39365, 40365 may have an integral flange at a fourth drilling mud inlet 39370, 40370 and/or a fourth drilling mud outlet 39375, 40375.

In an embodiment, the fourth spool 39365, 40365 and a tenth drilling mud inlet 39385, 40385 of a tenth drilling mud manifold 39380, 40380 may be fluidly connected via a connection. Any suitable connection may be used for the fourth spool 39365, 40365 and the tenth drilling mud inlet 39385, 40385 of the tenth drilling mud manifold 39380, 40380. For example, suitable connections include, but are not limited to, flanges and pipe fittings. Connections are well known in the art.

In an embodiment, the fourth spool 39365, 40365 may have an integral flange at a fourth drilling mud inlet 39370, 40370 and/or a fourth drilling mud outlet 39375, 40375.

In an embodiment, the tenth drilling mud manifold 39380, 40380 may have an integral flange at a tenth drilling mud inlet 39385, 40385 and/or a tenth drilling mud outlet 39390, 40390.

In an embodiment, the tenth drilling mud outlet 39390, 40390 of the tenth drilling mud manifold 39380, 40380 and the fifth spool 39395, 40395 may be fluidly connected via a connection. Any suitable connection may be used for the tenth drilling mud outlet 39390, 40390 of the tenth drilling mud manifold 39380, 40380 and the fifth spool 39395, 40395. For example, suitable connections include, but are not limited to, flanges and pipe fittings. Connections are well known in the art.

In an embodiment, the tenth drilling mud manifold 39380, 40380 may have an integral flange at a tenth drilling mud inlet 39385, 40385 and/or a tenth drilling mud outlet 39390, 40390.

In an embodiment, the fifth spool 39395, 40395 may have an integral flange at a fifth drilling mud inlet 39400, 40400 and/or a fifth drilling mud outlet 39405, 40405.

In an embodiment, the fifth spool 39395, 40395 and an eleventh drilling mud inlet 39415, 40415 of an eleventh drilling mud manifold 39410, 40410 may be fluidly connected via a connector. Any suitable connector may be used for the fifth spool 39395, 40395 and the eleventh drilling mud inlet 39415, 40415 of the eleventh drilling mud manifold 39410, 40410. For example, suitable connections include, but are not limited to, flanges and pipe fittings. Connections are well known in the art.

In an embodiment, the fifth spool 39395, 40395 may have an integral flange at a fifth drilling mud inlet 39400, 40400 and/or a fifth drilling mud outlet 39405, 40405.

In an embodiment, the eleventh drilling mud manifold 39410, 40410 may have an integral flange at an eleventh drilling mud inlet 39415, 40415 and/or an eleventh drilling mud outlet 39420, 40420.

Drilling Mud Screen Puller/Installer Tool

FIGS. 8A-8B and 9A-9B illustrate a drilling mud screen puller/installer tool according to an embodiment of the present invention. The tool permits use of a deep bore in a single-piece body of the drilling mud screen system, and removal of the drilling mud screen from the two-piece body without disassembly of the two-piece body. Further, the tool provides additional force to remove "stuck" drilling mud screens from debris entrapment in the system.

Single-Piece Body

Figure 8A:
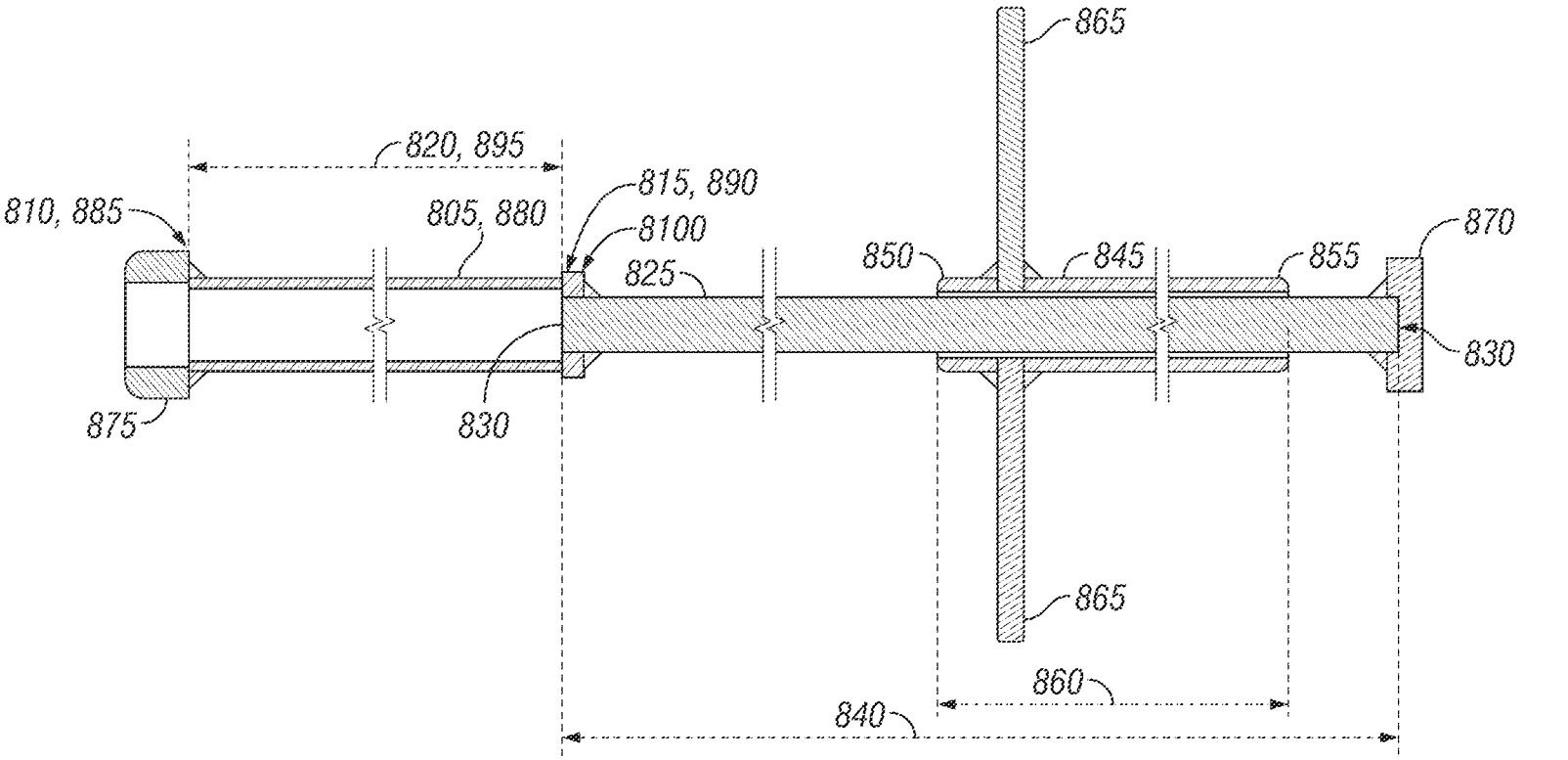
FIG. 8A illustrates an upper cross-sectional view of an exemplary drilling mud screen puller/installer tool for the exemplary drilling mud screen system of FIGS. 4A-4C.
Figure 18A:
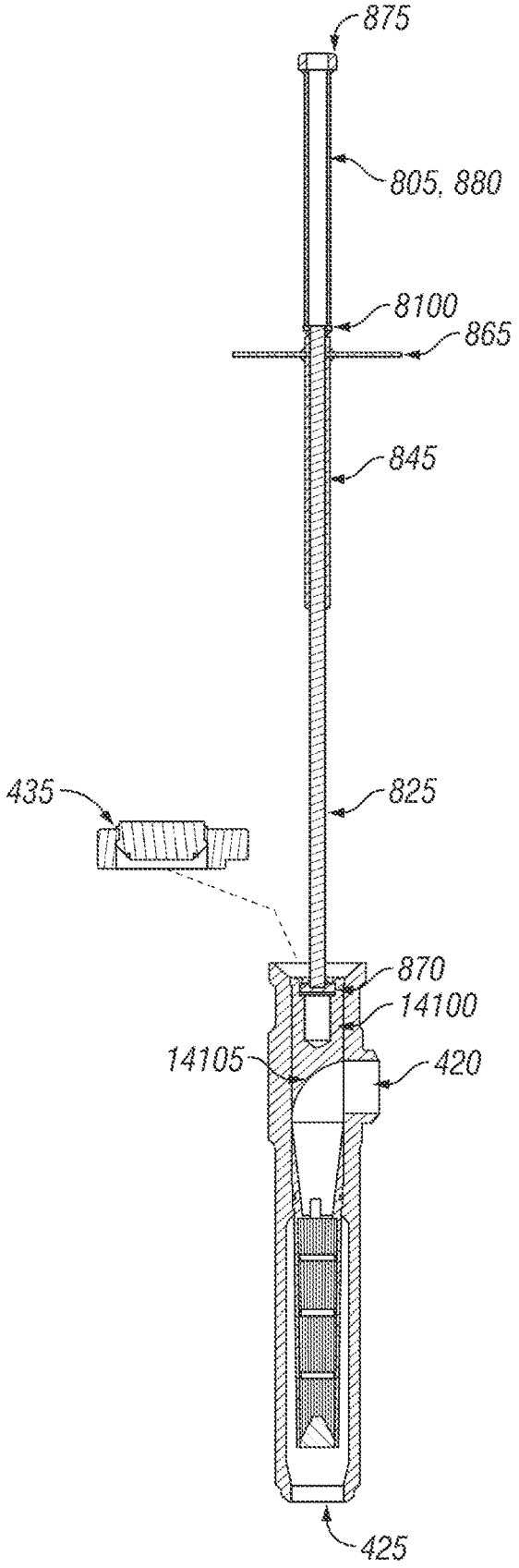
FIG. 18A illustrates an upper cross-sectional view of the exemplary drilling mud tool of FIG. 8A for the exemplary drilling mud system of FIGS. 4A-4C and 14.
Figure 18B:
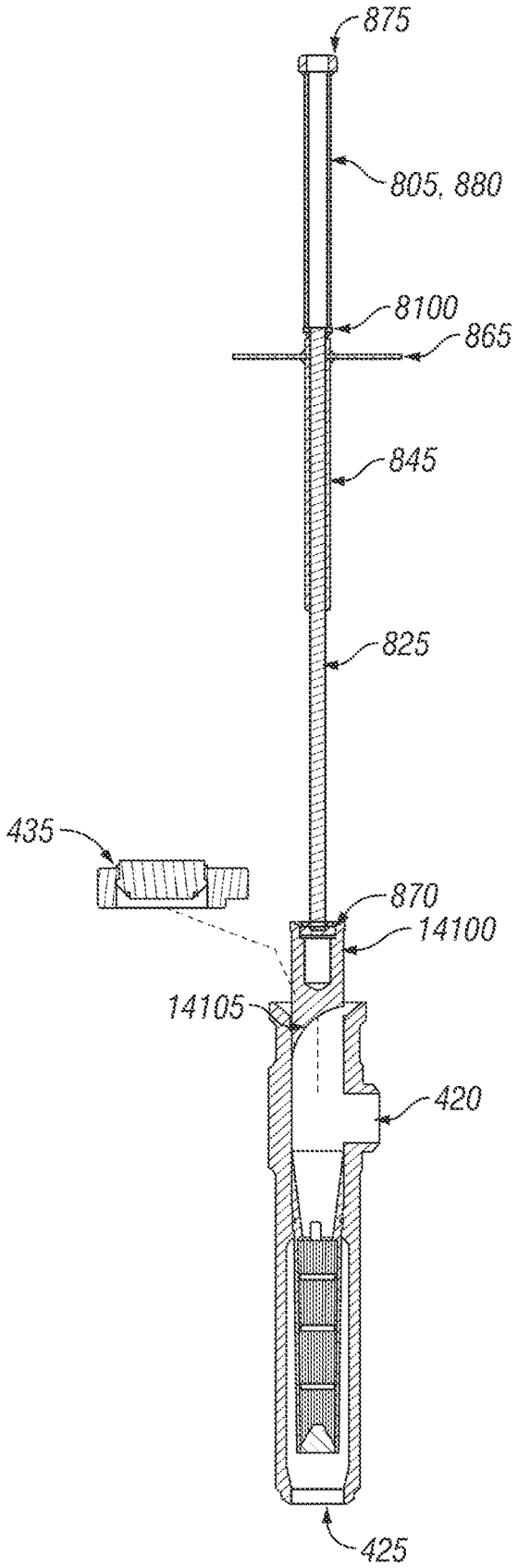
FIG. 18B illustrates another upper cross-sectional view of the exemplary drilling mud tool of FIG. 8A for the exemplary drilling mud system of FIGS. 4A-4C and 14.

FIG. 8A illustrates an upper cross-sectional view of a drilling mud screen puller/installer tool for the exemplary drilling mud screen system of FIGS. 4A-4C; and FIGS. 18A-18B illustrate an upper cross-sectional view of the drilling mud screen puller/installer tool of FIG. 8A for the exemplary drilling mud system of FIGS. 4A-4C and 14.

As shown in FIG. 8A, the drilling mud screen puller/installer tool 800 has a body 805 having a first end 810 and a second end 815 and a first length 820, a shaft 825 having a first end 830 and a second end 835 and a second length 840, a movable sleeve 845 having a first end 850 and a second end 855 and a third length 860, a handle 865, and a puller/installer plate 870.

The first length 820 of the body 805 may be any suitable length. In an embodiment, the first length 820 of the body 805 may be from about 10-inches to about 30-inches, and any range or value there between. In an embodiment, the first length 820 of the body 805 may be from about 18-inches to about 22-inches.

The inner diameter of the body 805 may be any suitable diameter. In an embodiment, the inner diameter of the body 805 may be from about 1-inch to about 2-inches, and any range or value there between. In an embodiment, the inner diameter of the body 805 may be about 1.5-inches.

The outer diameter of the body 805 may be any suitable diameter. In an embodiment, the outer diameter of the body 805 may be from about 1.5-inches to about 2.5-inches, and any range or value there between. In an embodiment, the outer diameter of the body 805 may be about 1.9-inches.

In an embodiment, the body 805 of the drilling mud screen puller/installer tool 800 may be constructed of any suitable material. For example, suitable materials include, but are not limited to, any alloy steel. In an embodiment, the body 805 may be constructed of an American Iron and Steel Industry (AISI) 4140 or equivalent material, stainless steel and combinations thereof. See e.g., FIG. 8A. In an embodiment, the surface of the body 805 may be painted.

In an embodiment, the body 805 may have a first striker plate 8100.

The striker plate 8100 may be any suitable length. In an embodiment, the length of the striker plate 8100 may be from about 0.3-inches to about 0.6-inches, and any range or value there between. In an embodiment, the length of the striker plate 8100 may be about 0.5-inches.

In an embodiment, the inner diameter of the striker plate 8100 may be any suitable diameter. In an embodiment, the inner diameter of the striker plate 8100 may be from about 1-inch to about 1.25-inches, and any range or value there between. In an embodiment, the inner diameter of the striker plate 8100 may be about 1.13-inches.

In an embodiment, the outer diameter of the striker plate 8100 may be any suitable diameter. In an embodiment, the outer diameter of the striker plate 8100 may be from about 2-inches to about 2.25-inches, and any range or value there between. In an embodiment, the outer diameter of the striker plate 8100 may be about 2.130-inches.

In an embodiment, the striker plate 8100 of the drilling mud screen puller/installer tool 800 may be constructed of any suitable material. For example, suitable materials include, but are not limited to, any alloy steel. In an embodiment, the striker plate 8100 may be constructed of stainless steel. See e.g., FIG. 8A. In an embodiment, the surface of the striker plate 8100 may be painted.

In an embodiment, the striker plate 8100 may be attached to the second end 815 of the body 805 via a connection. Any suitable connection may be used for the striker plate 8100. For example, suitable connections include, but are not limited to, pipe fittings and welds. Connections are well known in the art. In an embodiment, the striker plate 8100 may be attached to the second end 815 of the body 805 via a weld.

In an embodiment, the second length 840 of the shaft 825 may be any suitable length. In an embodiment, the second length 840 of the shaft 825 may be from about 30-inches to about 50-inches, and any range or value there between. In an embodiment, the second length 840 of the shaft 825 may be from about 40-inches to about 42-inches.

The diameter of the shaft 825 may be any suitable diameter. In an embodiment, the diameter of the shaft 825 may be from about 0.75-inches to about 1.5-inches, and any range or value there between. In an embodiment, the diameter of the shaft 825 may be about 1.1-inches.

In an embodiment, the shaft 825 of the drilling mud screen puller/installer tool 800 may be constructed of any suitable material. For example, suitable materials include, but are not limited to, any alloy steel. In an embodiment, the shaft 825 may be constructed of an American Iron and Steel Industry (AISI) 1018 or equivalent material. See e.g., FIG. 8A. In an embodiment, the surface of the shaft 825 may be painted.

In an embodiment, the third length 860 of the movable sleeve 845 may be any suitable length. In an embodiment, the third length 860 of the movable sleeve 845 may be from about 10-inches to about 30-inches, and any range or value there between. In an embodiment, the third length 860 of the movable sleeve 845 may be from about 20-inches to about 22-inches.

The inner diameter of the movable sleeve 845 may be any suitable diameter. In an embodiment, the inner diameter of the movable sleeve 845 may be from about 1-inch to about 2-inches, and any range or value there between. In an embodiment, the inner diameter of the movable sleeve 845 may be about 1.4-inches.

The outer diameter of the movable sleeve 845 may be any suitable diameter. In an embodiment, the outer diameter of the movable sleeve 845 may be from about 1.5-inches to about 2.5-inches, and any range or value there between. In an embodiment, the outer diameter of the movable sleeve 845 may be about 1.9-inches.

In an embodiment, the movable sleeve 845 of the drilling mud screen puller/installer tool 800 may be constructed of any suitable material. For example, suitable materials include, but are not limited to, any alloy steel. In an embodiment, the movable sleeve 845 may be constructed of an American Iron and Steel Industry (AISI) 4140 or equivalent material. See e.g., FIG. 8A. In an embodiment, the surface of the movable sleeve 845 may be painted.

In an embodiment, the first end 810 of the body 805 may have a rounded end 875 having a first end and a second end; the second end 815 of the body 805 may have a striker plate 8100.

The length of the rounded end 875 may be any suitable length. In an embodiment, the length of the rounded end 875 may be from about 1-inch to about 2-inches, and any range or value there between. In an embodiment, the length of the rounded end 875 may be about 1.3-inches.

The inner diameter of the rounded end 875 may be any suitable diameter. In an embodiment, the inner diameter of the rounded end 875 may be from about 1.5-inches to about 2-inches, and any range or value there between. In an embodiment, the inner diameter of the rounded end 875 may be about 1.7-inches.

The outer diameter of the rounded end 875 may be any suitable diameter. In an embodiment, the outer diameter of the rounded end 875 may be from about 2.5-inches to about 3.5-inches, and any range or value there between. In an embodiment, the outer diameter of the rounded end 875 may be about 3-inches.

In an embodiment, the first end of the rounded end 875 may have a rounded edge. See e.g., FIG. 8. The radius of the rounded edge may be any suitable radius. In an embodiment, the radius may be from about 0.35-inches to about 0.4-inches, and any range or value there between. In an embodiment, the radius may be about 0.375-inches.

In an embodiment, the rounded end 875 of the drilling mud screen puller/installer tool 800 may be constructed of any suitable material. For example, suitable materials include, but are not limited to, any alloy steel. In an embodiment, the rounded end 875 may be painted.

In an embodiment, the second end of the rounded end 875 may be attached to the first end 810 of the body 805 via a connection. Any suitable connection may be used for the second end of the rounded end 875. For example, suitable connections include, but are not limited to, pipe fittings and welds. Connections are well known in the art. In an embodiment, the second end of the rounded end 875 may be attached to the first end 810 of the body 805 via a weld.

In an embodiment, the body 805 may have a sleeve body 880 having a first end 885 and a second end 890 and a fourth length 895, and a first striker plate 8100.

The fourth length 895 of the sleeve body 880 may be any suitable length. In an embodiment, the fourth length 895 of the sleeve body 880 may be from about 10-inches to about 40-inches, and any range or value there between. In an embodiment, the fourth length 895 of the sleeve body 880 may be from about 20-inches to about 22-inches.

The inner diameter of the sleeve body 880 may be any suitable diameter. In an embodiment, the inner diameter of the sleeve body 880 may be from about 1-inch to about 2-inches, and any range or value there between. In an embodiment, the inner diameter of the sleeve body 880 may be about 1.4-inches.

The outer diameter of the sleeve body 880 may be any suitable diameter. In an embodiment, the outer diameter of the sleeve body 880 may be from about 1.5-inches to about 2.5-inches, and any range or value there between. In an embodiment, the outer diameter of the sleeve body 880 may be about 1.9-inches.

In an embodiment, the sleeve body 880 of the drilling mud screen puller/installer tool 800 may be constructed of any suitable material. For example, suitable materials include, but are not limited to, any alloy steel. In an embodiment, the sleeve body 880 may be constructed of an American Iron and Steel Industry (AISI) 4140 or equivalent material, stainless steel and combinations thereof. See e.g., FIG. 8A. In an embodiment, the surface of the sleeve body 880 may be painted.

In an embodiment, the rounded end 875 may be attached to the first end 885 of the sleeve body 880 via a connection. Any suitable connection may be used for the rounded end 875. For example, suitable connections include, but are not limited to, pipe fittings and welds. Connections are well known in the art. In an embodiment, the rounded end 875 may be attached to the first end 885 of the sleeve body 880 via a weld.

In an embodiment, the striker plate 8100 may be attached to the second end 890 of the sleeve body 880 via a connection. Any suitable connection may be used for the striker plate 8100. For example, suitable connections include, but are not limited to, pipe fittings and welds. Connections are well known in the art. In an embodiment, the striker plate 8100 may be attached to the second end 890 of the sleeve body 880 via a weld.

In an embodiment, the second end 815 of the body 805 may be attached to the first end 830 of the shaft 825 via a connection. Any suitable connection may be used for the second end 815 of the body 805. For example, suitable connections include, but are not limited to, pipe fittings and welds. Connections are well known in the art. In an embodiment, the second end 815 of the body 805 may be attached to the first end 830 of the shaft 825 via a weld.

In an embodiment, the movable sleeve 845 may be disposed around the shaft 825.

In an embodiment, a handle 865 may be attached to the movable sleeve 845 via a connection. Any suitable connection may be used for the handle 865. For example, suitable connections include, but are not limited to, pipe fittings and welds. Connections are well known in the art. In an embodiment, the handle 865 may be attached to the movable sleeve 845 via a weld.

The handle 865 may be any suitable handle to move the moveable sleeve 845 back and forth. Suitable handles 865 include, but are not limited to, one or more hand holds extending from the movable sleeve 845, a hand ring or hand wheel surrounding the movable sleeve 845, and combinations thereof.

The diameter of the one or more hand holds of the handle 865 may be any suitable diameter. In an embodiment, the diameter of the one or more hand holds of the handle 865 may be from 0.3-inch to about 1.0-inch, and any range or value there between. In an embodiment, the diameter of the one or more hand holds of the handle 865 may be about 0.5-inch.

In an embodiment, the handle 865 of the drilling mud screen puller/installer tool 800 may be constructed of any suitable material. For example, suitable materials include, but are not limited to, any alloy steel. In an embodiment, the handle 865 may be constructed of an American Iron and Steel Industry (AISI) 1018 or equivalent material. See e.g., FIG. 8A. In an embodiment, the surface of the handle 865 may be painted.

In an embodiment, the handle 865 may be attached to the movable sleeve 845 via a connection. Any suitable connection may be used for the handle 865. For example, suitable connections include, but are not limited to, pipe fittings and welds. Connections are well known in the art. In an embodiment, the handle 865 may be attached to the movable sleeve 845 via a weld.

In an embodiment, the puller/installer plate 870 may be attached to a second end 835 of the shaft 825 via a connection. Any suitable connection may be used for the puller/installer plate 870. For example, suitable connections include, but are not limited to, pipe fittings and welds. Connections are well known in the art. In an embodiment, the puller/installer plate 870 may be attached to the second end 835 of the shaft 825 via a weld.

The length of the puller/installer plate 870 may be any suitable length. In an embodiment, the length of the puller/installer plate 870 may be from about 0.5-inch to about 1-inch, and any range or value there between. In an embodiment, the length of the puller/installer plate 870 may be about 0.725-inch.

The diameter of the puller/installer plate 870 may be any suitable diameter. In an embodiment, the diameter of the puller/installer plate 870 may be from about 2-inches to about 2.5-inches, and any range or value there between. In an embodiment, the diameter of the puller/installer plate 870 may be about 2.3-inches.

In an embodiment, the puller/installer plate 870 of the drilling mud screen puller/installer tool 800 may be constructed of any suitable material. For example, suitable materials include, but are not limited to, any alloy steel. In an embodiment, the puller/installer plate 870 may be constructed of a stainless steel. See e.g., FIG. 8A. In an embodiment, the surface of the puller/installer plate 870 may be painted.

Figure 8B:
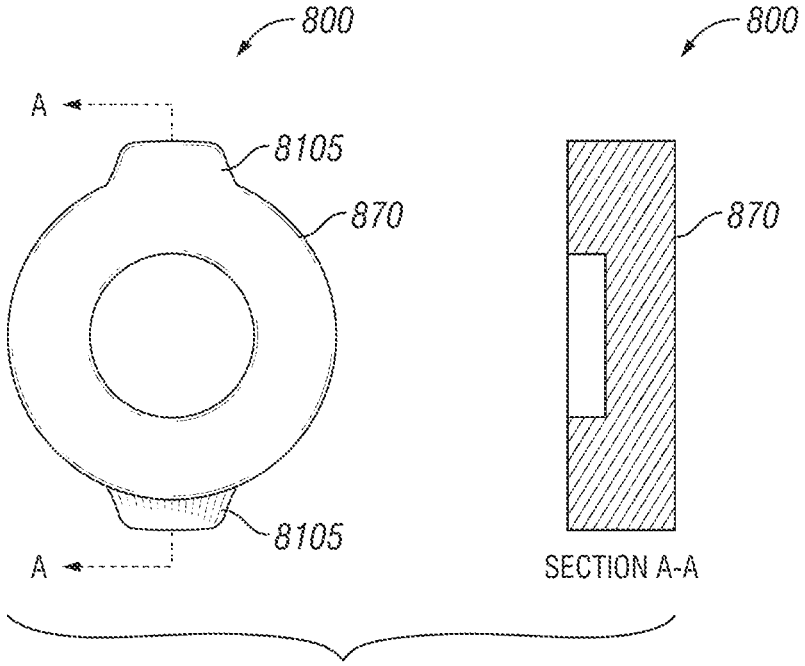
FIG. 8B illustrates a detailed view of A-A of FIG. 8A, showing a means to engage a drilling mud screen according to an embodiment of the present invention.

In an embodiment, the puller/installer plate 870 may have a means to engage 8105 a drilling mud screen 500 of the drilling mud screen system 400. The means to engage 875 may be any suitable means to engage 8105 the drilling mud screen 500. For example, a suitable means to engage 8105 includes, but is not limited to, one or more extensions to fit an outlet of the first portion 575 and/or an inlet of the second portion 580 of the body 505 of the drilling mud screen 500 and to engage a shoulder outside the inlet of the second portion 580 of the body 505 of the drilling mud screen 500 and/or to rotationally engage a shoulder inside the inlet of the second portion 580 of the body 505 of the drilling mud screen 500. Cf. FIGS. 5B & 8B. See also FIGS. 12A-12B. In an embodiment, the puller/installer plate 870 may have one or more extensions to fit an outlet of the first portion 575 and/or an inlet of the second portion 580 of the body 505 of the drilling mud screen 500 and to engage a shoulder outside the inlet of the second portion 580 of the body 505 of the drilling mud screen 500 and/or to rotationally engage a shoulder inside the inlet of the second portion 580 of the body 505 of the drilling mud screen 500. Id.

In an embodiment, the means to engage 8105 may be constructed of any suitable material. For example, suitable materials include, but are not limited to, any alloy steel. In an embodiment, the means to engage 8105 may be constructed of a stainless steel or equivalent material. See e.g., FIG. 8A. In an embodiment, the means to engage 8105 may be painted.

Two-Piece Body

Figure 9A:
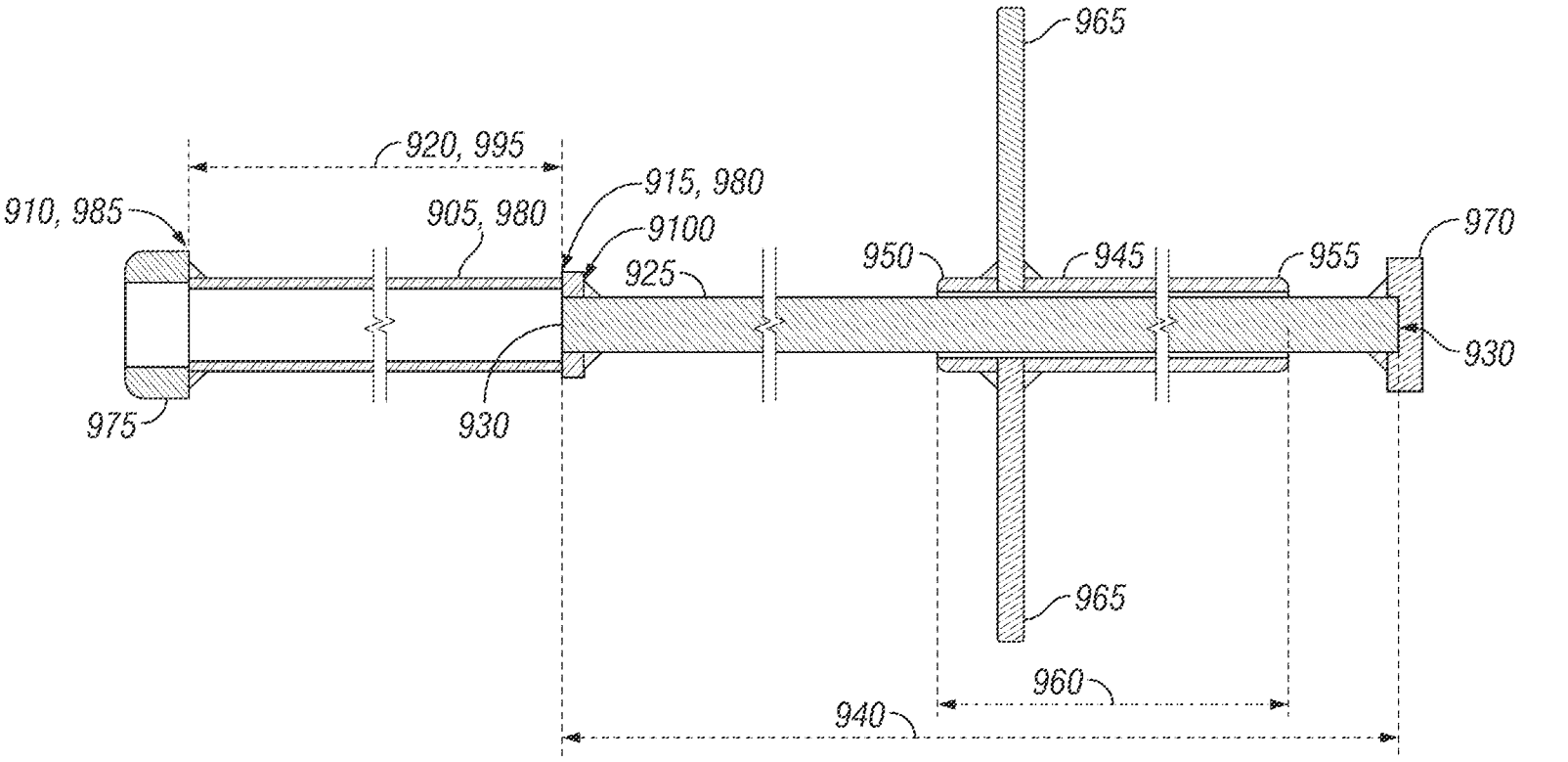
FIG. 9A illustrates an upper cross-sectional view of an exemplary drilling mud screen puller/installer tool for the exemplary drilling mud screen system of FIG. 7A.
Figure 9B:
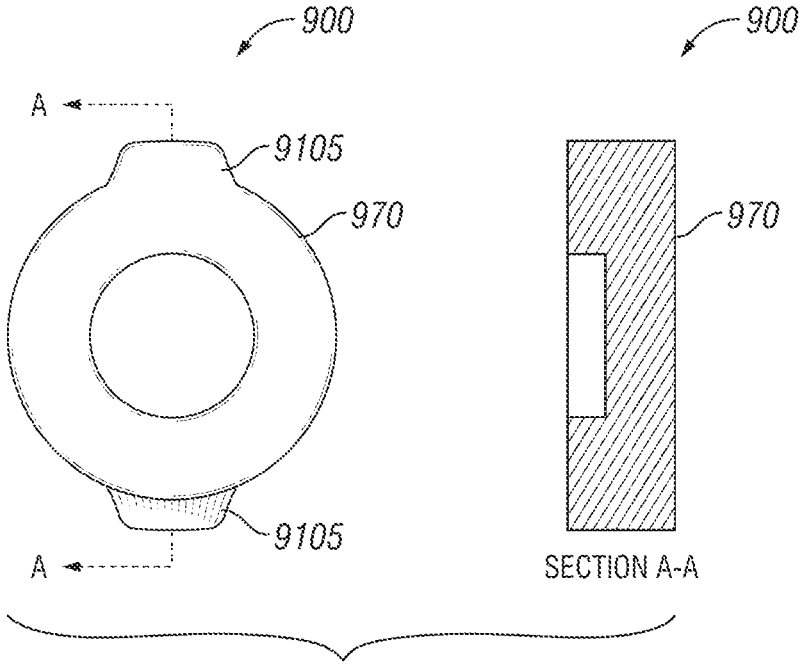
FIG. 9B illustrates a detailed view of A-A of FIG. 9A, showing a means to engage a drilling mud screen according to an embodiment of the present invention.

FIG. 9A illustrates an upper cross-sectional view of a drilling mud screen puller/installer tool for the exemplary drilling mud screen system of FIG. 7. As shown in FIG. 9, the drilling mud screen puller/installer tool 900 has a body 905 having a first end 910 and a second end 915 and a first length 920, a shaft 925 having a first end 930 and a second end 935 and a second length 940, a movable sleeve 945 having a first end 950 and a second end 955 and a third length 960, a handle 965, and a puller/installer plate 970.

The first length 920 of the body 905 may be any suitable length. In an embodiment, the first length 920 of the body 905 may be from about 10-inches to about 30-inches, and any range or value there between. In an embodiment, the first length 920 of the body 905 may be from about 18-inches to about 22-inches.

The inner diameter inner diameter of the body 905 may be any suitable diameter. In an embodiment, the inner diameter of the body 905 may be from about 1-inch to about 2-inches, and any range or value there between. In an embodiment, the inner diameter of the body 905 may be about 1.5-inches.

The outer diameter of the body 905 may be any suitable diameter. In an embodiment, the outer diameter of the body 905 may be from about 1.5-inches to about 2.5-inches, and any range or value there between. In an embodiment, the outer diameter of the body 905 may be about 1.9-inches.

In an embodiment, the body 905 of the drilling mud screen puller/installer tool 900 may be constructed of any suitable material. For example, suitable materials include, but are not limited to, any alloy steel. In an embodiment, the body 905 may be constructed of an American Iron and Steel Industry (AISI) 4140 or equivalent material, stainless steel and combinations thereof. See e.g., FIG. 9A. In an embodiment, the surface of the body 905 may be painted.

In an embodiment, the body 905 may have a striker plate 9100.

The striker plate 9100 may be any suitable length. In an embodiment, the length of the striker plate 9100 may be from about 0.3-inch to about 0.6-inch, and any range or value there between. In an embodiment, the length of the striker plate 9100 may be about 0.5-inch.

In an embodiment, the inner diameter of the striker plate 9100 may be any suitable diameter. In an embodiment, the inner diameter of the striker plate 9100 may be from about 1-inch to about 1.25-inches, and any range or value there between. In an embodiment, the inner diameter of the striker plate 9100 may be about 1.13-inches.

In an embodiment, the outer diameter of the striker plate 9100 may be any suitable diameter. In an embodiment, the outer diameter of the striker plate 9100 may be from about 2-inches to about 2.25-inches, and any range or value there between. In an embodiment, the outer diameter of the striker plate 9100 may be about 2.130-inches.

In an embodiment, the striker plate 9100 of the drilling mud screen puller/installer tool 900 may be constructed of any suitable material. For example, suitable materials include, but are not limited to, any alloy steel. In an embodiment, the striker plate 9100 may be constructed of stainless steel. See e.g., FIG. 9A. In an embodiment, the surface of the striker plate 9100 may be painted.

In an embodiment, the striker plate 9100 may be attached to the second end 915 of the body 905 via a connection. Any suitable connection may be used for the striker plate 9100. For example, suitable connections include, but are not limited to, pipe fittings and welds. Connections are well known in the art. In an embodiment, the striker plate 9100 may be attached to the second end 915 of the body 905 via a weld.

In an embodiment, the second length 940 of the shaft 925 may be any suitable length. In an embodiment, the second length 940 of the shaft 925 may be from about 40-inches to about 60-inches, and any range or value there between. In an embodiment, the second length 940 of the shaft 925 may be from about 50-inches to about 52-inches.

The diameter of the shaft 925 may be any suitable diameter. In an embodiment, the diameter of the shaft 925 may be from about 0.75-inch to about 1.5-inches, and any range or value there between. In an embodiment, the diameter of the shaft 925 may be about 1.1-inches.

In an embodiment, the shaft 925 of the drilling mud screen puller/installer tool 900 may be constructed of any suitable material. For example, suitable materials include, but are not limited to, any alloy steel. In an embodiment, the shaft 925 may be constructed of an American Iron and Steel Industry (AISI) 1018 or equivalent material. See e.g., FIG. 9A. In an embodiment, the surface of the shaft 925 may be painted.

In an embodiment, the third length 960 of the movable sleeve 945 may be any suitable length. In an embodiment, the third length 960 of the movable sleeve 945 may be from about 10-inches to about 30-inches, and any range or value there between. In an embodiment, the third length 960 of the movable sleeve 945 may be from about 20-inches to about 22-inches.

The inner diameter of the movable sleeve 945 may be any suitable diameter. In an embodiment, the inner diameter of the movable sleeve 945 may be from about 1-inch to about 2-inches, and any range or value there between. In an embodiment, the inner diameter of the movable sleeve 945 may be about 1.4-inches.

The outer diameter of the movable sleeve 945 may be any suitable diameter. In an embodiment, the outer diameter of the movable sleeve 945 may be from about 1.5-inches to about 2.5-inches, and any range or value there between. In an embodiment, the outer diameter of the movable sleeve 945 may be about 1.9-inches.

In an embodiment, the movable sleeve 945 of the drilling mud screen puller/installer tool 900 may be constructed of any suitable material. For example, suitable materials include, but are not limited to, any alloy steel. In an embodiment, the movable sleeve 945 may be constructed of an American Iron and Steel Industry (AISI) 4140 or equivalent material. See e.g., FIG. 9A. In an embodiment, the surface of the movable sleeve 945 may be painted.

In an embodiment, the first end 910 of the body 905 may have a rounded end 975 having a first end and a second end; the second end 915 of the body 905 may have a striker plate 9100.

The length of the rounded end 975 may be any suitable length. In an embodiment, the length of the rounded end 975 may be from about 1-inch to about 2-inches, and any range or value there between. In an embodiment, the length of the rounded end 975 may be about 1.3-inches.

The inner diameter of the rounded end 975 may be any suitable diameter. In an embodiment, the inner diameter of the rounded end 975 may be from about 1.5-inches to about 2-inches, and any range or value there between. In an embodiment, the inner diameter of the rounded end 975 may be about 1.7-inches.

The outer diameter of the rounded end 975 may be any suitable diameter. In an embodiment, the outer diameter of the rounded end 975 may be from about 2.5-inches to about 3.5-inches, and any range or value there between. In an embodiment, the outer diameter of the rounded end 975 may be about 3-inches.

In an embodiment, the first end of the rounded end 975 may have a rounded edge. See e.g., FIG. 9A. The radius of the rounded edge may be any suitable radius. In an embodiment, the radius may be from about 0.35-inch to about 0.4-inch, and any range or value there between. In an embodiment, the radius may be about 0.375-inch.

In an embodiment, the rounded end 975 of the drilling mud screen puller/installer tool 900 may be constructed of any suitable material. For example, suitable materials include, but are not limited to, any alloy steel. In an embodiment, the rounded end 975 may be painted.

In an embodiment, the second end of the rounded end 975 may be attached to the first end 910 of the body 905 via a connection. Any suitable connection may be used for the second end of the rounded end 975. For example, suitable connections include, but are not limited to, pipe fittings and welds. Connections are well known in the art. In an embodiment, the second end of the rounded end 975 may be attached to the first end 910 of the body 905 via a weld.

In an embodiment, the body 905 may have a sleeve body 980 having a first end 985 and a second end 990 and a fourth length 995, and a striker plate 9100.

The fourth length 995 of the sleeve body 980 may be any suitable length. In an embodiment, the fourth length 995 of the sleeve body 980 may be from about 10-inches to about 40-inches, and any range or value there between. In an embodiment, the fourth length 995 of the sleeve body 980 may be from about 18-inches to about 20-inches.

The inner diameter of the sleeve body 980 may be any suitable diameter. In an embodiment, the inner diameter of the sleeve body 980 may be from about 1-inch to about 2-inches, and any range or value there between. In an embodiment, the inner diameter of the sleeve body 980 may be about 1.4-inches.

The outer diameter of the sleeve body 980 may be any suitable diameter. In an embodiment, the outer diameter of the sleeve body 980 may be from about 1.5-inches to about 2.5-inches, and any range or value there between. In an embodiment, the outer diameter of the sleeve body 980 may be about 1.9-inches.

In an embodiment, the sleeve body 980 of the drilling mud screen puller/installer tool 900 may be constructed of any suitable material. For example, suitable materials include, but are not limited to, any alloy steel. In an embodiment, the sleeve body 980 may be constructed of an American Iron and Steel Industry (AISI) 4140 or equivalent material, stainless steel and combinations thereof. See e.g., FIG. 9A. In an embodiment, the surface of the sleeve body 980 may be painted.

In an embodiment, the rounded end 975 may be attached to the first end 985 of the sleeve body 880 via a connection. Any suitable connection may be used for the rounded end 975. For example, suitable connections include, but are not limited to, pipe fittings and welds. Connections are well known in the art. In an embodiment, the rounded end 975 may be attached to the first end 985 of the sleeve body 980 via a weld.

In an embodiment, the striker plate 9100 may be attached to the second end 990 of the sleeve body 980 via a connection. Any suitable connection may be used for the striker plate 9100. For example, suitable connections include, but are not limited to, pipe fittings and welds. Connections are well known in the art. In an embodiment, the striker plate 9100 may be attached to the second end 990 of the sleeve body 980 via a weld.

In an embodiment, the second end 915 of the body 905 may be attached to the first end 930 of the shaft 925 via a connection. Any suitable connection may be used for the second end 915 of the body 905. For example, suitable connections include, but are not limited to, pipe fittings and welds. Connections are well known in the art. In an embodiment, the second end 915 of the body 905 may be attached to the first end 930 of the shaft 925 via a weld.

In an embodiment, the movable sleeve 945 may be disposed around the shaft 925.

In an embodiment, a handle 965 may be attached to the movable sleeve 945 via a connection. Any suitable connection may be used for the handle 965. For example, suitable connections include, but are not limited to, pipe fittings and welds. Connections are well known in the art. In an embodiment, the handle 965 may be attached to the movable sleeve 945 via a weld.

The handle 965 may be any suitable handle to move the moveable sleeve 945 back and forth. For example, suitable handles 965 include, but are not limited to, one or more hand holds extending from the movable sleeve 945, a hand ring or hand wheel surrounding the movable sleeve 945, and combinations thereof.

The diameter of the one or more hand holds of the handle 965 may be any suitable diameter. In an embodiment, the diameter of the one or more hand holds of the handle 965 may be from 0.3-inch to about 1.0-inch, and any range or value there between. In an embodiment, the diameter of the one or more hand holds of the handle 965 may be about 0.5-inch.

In an embodiment, the handle 965 of the drilling mud screen puller/installer tool 900 may be constructed of any suitable material. For example, suitable materials include, but are not limited to, any alloy steel. In an embodiment, the handle 965 may be constructed of an American Iron and Steel Industry (AISI) 1018 or equivalent material. See e.g., FIG. 9A. In an embodiment, the surface of the handle 965 may be painted.

In an embodiment, the handle 965 may be attached to the movable sleeve 945 via a connection. Any suitable connection may be used for the handle 965. For example, suitable connections include, but are not limited to, pipe fittings and welds. Connections are well known in the art. In an embodiment, the handle 965 may be attached to the movable sleeve 945 via a weld.

In an embodiment, the puller/installer plate 970 may be attached to a second end 935 of the shaft 925 via a connection. Any suitable connection may be used for the puller/installer plate 970. For example, suitable connections include, but are not limited to, pipe fittings and welds. Connections are well known in the art. In an embodiment, the puller/installer plate 970 may be attached to the second end 935 of the shaft 925 via a weld.

The length of the puller/installer plate 970 may be any suitable length. In an embodiment, the length of the puller/installer plate 970 may be from about 0.5-inch to about 1-inch, and any range or value there between. In an embodiment, the length of the puller/installer plate 970 may be about 0.725-inch.

The diameter of the puller/installer plate 970 may be any suitable diameter. In an embodiment, the diameter of the puller/installer plate 970 may be from about 2-inches to about 2.5-inches, and any range or value there between. In an embodiment, the diameter of the puller/installer plate 970 may be about 2.3-inches.

In an embodiment, the puller/installer plate 970 of the drilling mud screen puller/installer tool 900 may be constructed of any suitable material. For example, suitable materials include, but are not limited to, any alloy steel. In an embodiment, the puller/installer plate 970 may be constructed of a stainless steel. See e.g., FIG. 9A. In an embodiment, the surface of the puller/installer plate 970 may be painted.

In an embodiment, the puller/installer plate 970 may have a means to engage 9105 a drilling mud screen 500 of the drilling mud screen system 400. The means to engage 975 may be any suitable means to engage 9105 the drilling mud screen 500. For example, a suitable means to engage 9105 includes, but is not limited to, one or more extensions to fit an outlet of the first portion 575 and/or an inlet of the second portion 580 of the body 505 of the drilling mud screen 500 and to engage a shoulder outside the inlet of the second portion 580 of the body 505 of the drilling mud screen 500 and/or to rotationally engage a shoulder inside the inlet of the second portion 580 of the body 505 of the drilling mud screen 500. Cf. FIGS. 5B & 8B. See also FIGS. 13A-13B. In an embodiment, the puller/installer plate 970 may have one or more extensions to fit an outlet of the first portion 575 and/or an inlet of the second portion 580 of the body 505 of the drilling mud screen 500 and to engage a shoulder outside the inlet of the second portion 580 of the body 505 of the drilling mud screen 500 and/or to rotationally engage a shoulder inside the inlet of the second portion 580 of the body 505 of the drilling mud screen 500. Id.

In an embodiment, the means to engage 9105 may be constructed of any suitable material. For example, suitable materials include, but are not limited to, any alloy steel. In an embodiment, the means to engage 9105 may be constructed of a stainless steel or equivalent material. See e.g., FIG. 9A. In an embodiment, the means to engage 9105 may be painted.

Optional Drilling Mud Screen Installer/Puller Tool

Single-Piece Body

Figure 29:
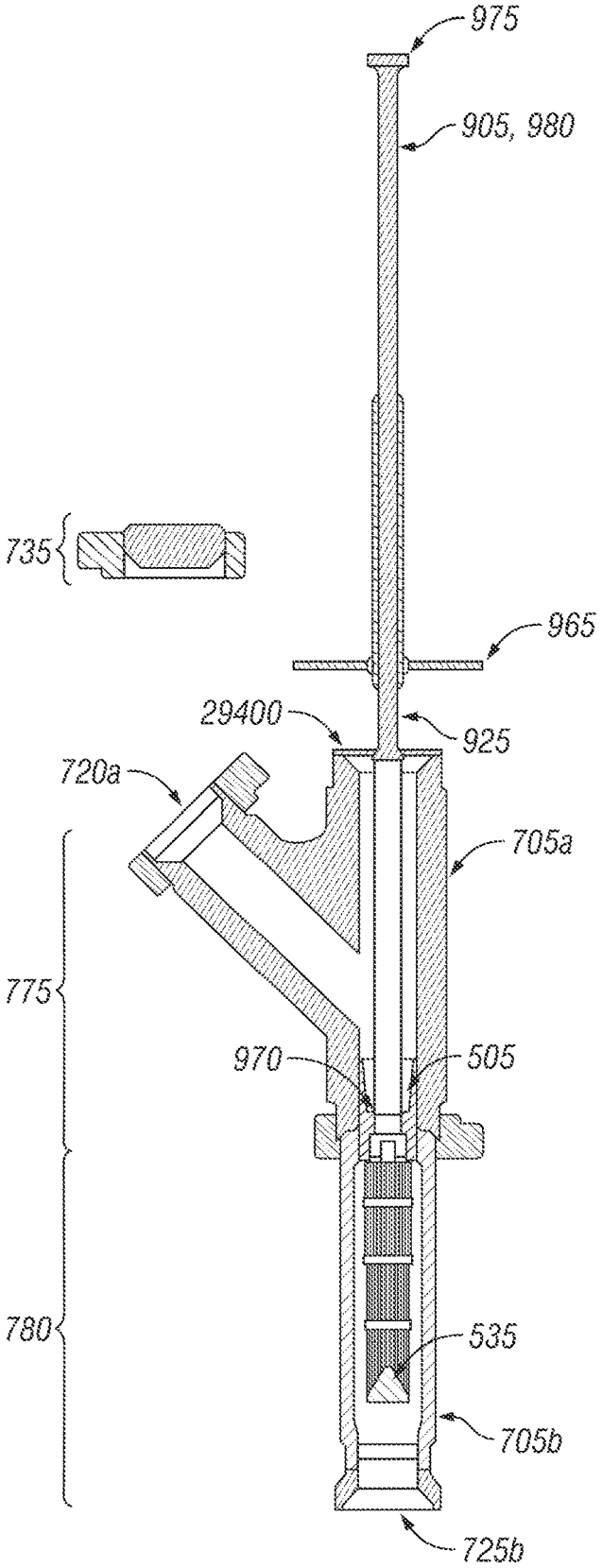
FIG. 29 illustrates a cross-sectional view of the exemplary drilling mud tool of FIG. 9A inserting the drilling mud screen of FIG. 5 or 22 into the exemplary drilling mud screen system of FIG. 7A or 21B, showing an optional stop plate.

In an embodiment, the drilling mud screen puller/installer tool 800 has a body 805 having a first end 810 and a second end 815 and a first length 820, a shaft 825 having a first end 830 and a second end 835 and a second length 840, a movable sleeve 845 having a first end 850 and a second end 855 and a third length 860, a handle 865, an optional stop plate (not shown) and a puller/installer plate 870. Cf. FIG. 29. In an embodiment, the optional stop plate (not shown) on the shaft 825 of the puller/installer tool 800 indicates that the puller/installer tool 800 (and, therefore, the drilling mud screen 500) is fully inserted into the drilling mud screen system 800 when the optional stop plate (not shown) contacts the first end 810 of the body 805 of the system 800.

In an embodiment, an optional groove or painted line may be used instead of the optional stop plate on the shaft 825 of the puller/installer tool 800. In an embodiment, the optional groove or painted line (not shown) on the shaft 825 of the puller/installer tool 800 indicates that the puller/installer tool 800 (and, therefore, the drilling mud screen 500) is fully inserted into the drilling mud screen system 800 when the optional groove or painted line (not shown) lines up with the first end 810 of the body 805 of the system 800.

Two-Piece Body

FIG. 29 illustrates a cross-sectional view of the exemplary drilling mud tool of FIG. 9A inserting the drilling mud screen of FIG. 5 or 22 into the exemplary drilling mud screen system of FIG. 7A or 21B, showing an optional stop plate. As shown in FIG. 29, the drilling mud screen puller/installer tool 900 has a body 905 having a first end 910 and a second end 915 and a first length 920, a shaft 925 having a first end 930 and a second end 935 and a second length 940, a movable sleeve 945 having a first end 950 and a second end 955 and a third length 960, a handle 965, an optional stop plate 29400 and a puller/installer plate 970. In an embodiment, the optional stop plate 29400 on the shaft 925 of the puller/installer tool 900 indicates that the puller/installer tool 900 (and, therefore, the drilling mud screen 500 or 2200) is fully inserted into the drilling mud screen system 700 or 2100 when the optional stop plate 29400 contacts the first end 710*a* or 2110*a* of the first body 705*a* or 2105*a* of the system 700 or 2100.

In an embodiment, an optional groove or painted line may be used instead of the optional stop plate 29400 on the shaft 925 of the puller/installer tool 900. In an embodiment, the optional groove or painted line (not shown) on the shaft 925 of the puller/installer tool 900 indicates that the puller/installer tool 900 (and, therefore, the drilling mud screen 500 or 2200) is fully inserted into the drilling mud screen system 700 or 2100 when the optional groove or painted line (not shown) lines up with the first end 710*a* or 2110*a* of the first body 705*a* or 2105*a* of the system 700 or 2100.

Method of Using Drilling Mud Screen System

Figure 10:
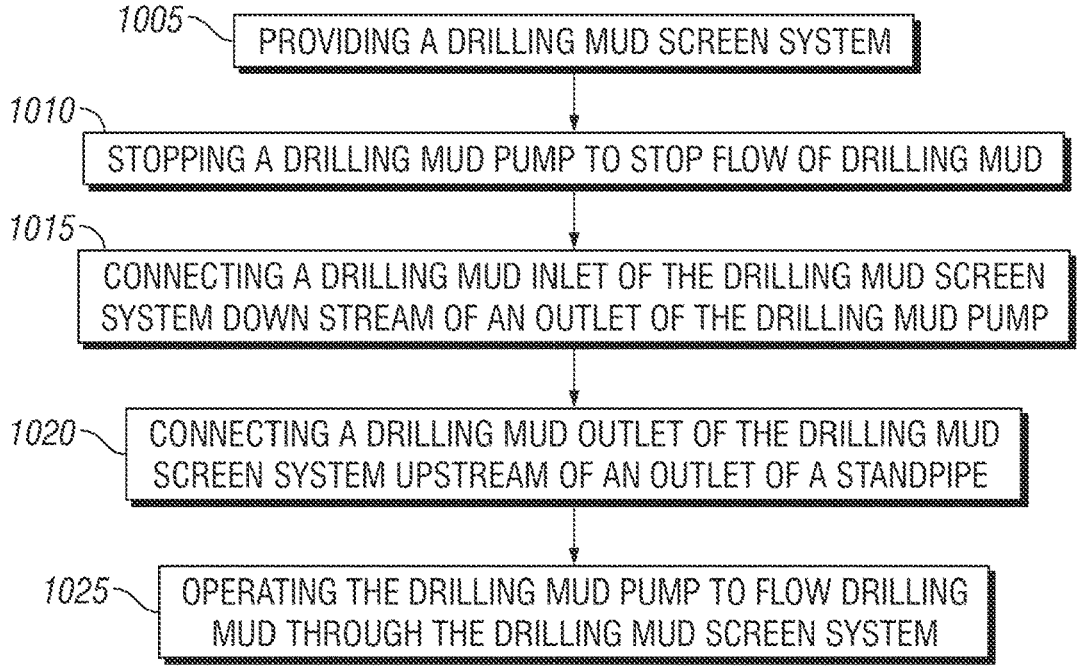
FIG. 10 illustrates a flow diagram for a method of using a drilling mud screen system.

FIG. 10 illustrates a flow diagram for a method of using a drilling mud screen system, as discussed above. As shown in FIG. 10, the method of using a drilling mud screen system 1000 comprises stopping a drilling mud pump to stop flow of drilling mud 1005, fluidly connecting a drilling mud inlet of a drilling mud screen system downstream of an outlet to the drilling mud pump 1010, fluidly connecting a drilling mud outlet of the drilling mud screen system upstream of an outlet of a stand pipe 1015, and starting the drilling mud pump to flow drilling mud through the drilling mud screen system 1020.

In an embodiment, the drilling mud inlet 120, 220, 320, 400, 620, 720, 3020 of the drilling mud screen system 100, 200, 300, 400, 600, 700, 3000 may be fluidly connected to a high pressure outlet of the drilling mud pump via a connection. See also FIGS. 14, 19, 21, 23 & 26. The inlet pressure to the drilling mud inlet 120, 220, 320, 400, 620, 720, 3020 of the drilling mud screen system 100, 200, 300, 400, 600, 700, 3000 may be any suitable pressure. In an embodiment, the inlet pressure may be from about 7500 psi to about 10,000 psi, and any range or value there between.

In an embodiment, the drilling mud outlet 125, 225, 325, 425, 625, 725, 3025 of the drilling mud screen system 100, 200, 300, 400, 600, 700, 3000 may be fluidly connected to an inlet of a vibrator hose to the standpipe via a connection.

In an embodiment, the drilling mud inlet 120, 220, 320, 400, 620, 720, 3020 of the drilling mud screen system 100, 200, 300, 400, 600, 700, 3000 may be fluidly connected to an outlet of a vibrator hose to a standpipe via a connection. In an embodiment, the drilling mud outlet 125, 225, 325, 425, 625, 725, 3025 of the drilling mud screen system 100, 200, 300, 400, 600, 700, 3000 may be fluidly connected to an inlet of the standpipe via a connection.

In an embodiment, the drilling mud screen system 100, 200, 300, 400, 600, 700, 3000 may be fluidly connected at any point in the standpipe via a connection.

Optional Monitoring Configuration

FIG. 10 illustrates a flow diagram for a method of using a drilling mud screen system, as discussed above. As shown in FIG. 10, the method of using a drilling mud screen system 1000 comprises stopping a drilling mud pump to stop flow of drilling mud 1005, fluidly connecting a drilling mud inlet of a drilling mud screen system downstream of an outlet to the drilling mud pump 1010, fluidly connecting a drilling mud outlet of the drilling mud screen system upstream of an outlet of a stand pipe 1015, and starting the drilling mud pump to flow drilling mud through the drilling mud screen system 1020.

In an embodiment, step 1010 comprises fluidly connecting a drilling mud inlet of a transducer subassembly downstream of an outlet to the drilling mud pump; and fluidly connecting a drilling mud inlet of a drilling mud screen system downstream of a drilling mud outlet to the transducer subassembly.

As shown in FIGS. 19 and 28, the drilling mud inlet 1920 of the drilling mud screen system 19200, 28200 may be fluidly connected to a drilling mud outlet 28125 of the transducer subassembly 19110, 28100 via a connection. Any suitable connection may be used for the drilling mud inlet 1920 and the drilling mud outlet 28125. For example, suitable connections include, but are not limited to, pipe fittings and welds. Connections are well known in the art. In an embodiment, the drilling mud inlet 1920 of the drilling mud screen system 19200, 28200 may be fluidly connected to a drilling mud outlet 28125 of a transducer subassembly 19100 via a weld.

In an embodiment, the method of using a drilling mud screen system 1000 further comprises monitoring a transducer of the transducer subassembly for property information (e.g., displacement, flow rate, pressure, and/or temperature) at the drilling mud screen system.

In an embodiment, a computing device (such as a rig computer) may include a bus that directly or indirectly couples the following devices: memory, one or more processors, one or more presentation components, one or more input/output (I/O) ports, I/O components, a user interface and a power supply. The computing device may include a variety of computer-readable media. The memory may include computer-storage media in the form of volatile and/or nonvolatile memory. The presentation component(s) present data indications to a user or other device. The user interface allows the user to input/output information to/from the computing device. The one or more I/O ports may allow the computing device to be logically coupled to other devices including a transducer 28105, and other I/O components, some of which may be built in. See e.g., FIG. 28. Examples of other I/O components include a printer, scanner, wireless device, and the like.

In an embodiment, the method of using a drilling mud screen system 1000 further comprises using the property information (e.g., displacement, flow rate, pressure, and/or temperature) from the transducer of the transducer subassembly to determine a status of the drilling mud screen system. In an embodiment, the method further comprises using the information to determine when to clean, repair or replace the drilling mud screen in the drilling mud screen system.

In an embodiment, pressure information from, for example, a pressure transducer 28105 will allow a driller to know when a drilling mud screen 1940 in a drilling mud screen system 19200, 28200 is "packing off." For example, the pressure information from the pressure transducer 28105 at the drilling mud inlet 1920 of the drilling mud screen system 19200, 28200 may be compared to, for example, pressure information from a pressure transducer on a pressure transducer for a stand pipe. If the pressure decreases at the stand pipe and the pressure increases at the drilling mud inlet 1920 of the drilling mud screen system 19200, 28200, the drilling mud screen 1940 is likely "packing off" If the pressure decreases or increases at both the stand pipe and the drilling mud screen system, then the problem is likely down hole and not at the drilling mud screen system 19200, 28200. If the problem is at the drilling mud screen system 19200, 28200, the drilling mud screen 1940 may be cleaned, repaired or replaced.

Optional Cementing Configuration

FIG. 10 illustrates a flow diagram for a method of using a drilling mud screen system, as discussed above. As shown in FIG. 10, the method of using a drilling mud screen system 1000 comprises stopping a drilling mud pump to stop flow of drilling mud 1005, fluidly connecting a drilling mud inlet of a drilling mud screen system downstream of an outlet to the drilling mud pump 1010, fluidly connecting a drilling mud outlet of the drilling mud screen system upstream of an outlet of a stand pipe 1015, and starting the drilling mud pump to flow drilling mud through the drilling mud screen system 1020.

In an embodiment, step 1010 comprises fluidly connecting a first drilling mud inlet of a first transducer subassembly downstream of an outlet to the drilling mud pump; and fluidly connecting a first drilling mud inlet of a drilling mud screen system downstream of an outlet to the first transducer subassembly.

In an embodiment, step 1015 comprises fluidly connecting a drilling mud outlet of the drilling mud screen system upstream of a drilling mud inlet of a gate valve, fluidly connecting a drilling mud outlet of the gate valve to a second drilling mud inlet to a second transducer subassembly, and fluidly connecting a second drilling mud outlet of the second transducer subassembly upstream of an outlet of a stand pipe.

As shown in FIG. 28, the first drilling mud inlet 28120' of the optional first transducer subassembly 28100' may be fluidly connected to, for example, an outlet of a drilling mud pump via a connection; and the first drilling mud outlet 28125' of the optional first transducer subassembly 28100' may be fluidly connected to, for example, the drilling mud inlet 28120 of the drilling mud screen system 28200 via a connection. Any suitable connection may be used for the first drilling mud inlet 28120' and the first drilling mud outlet 28125'. For example, suitable connections include, but are not limited to, pipe fittings and welds. Connections are well known in the art. In an embodiment, the first drilling mud inlet 28120' of the optional first transducer subassembly 28100' may be fluidly connected to, for example, an outlet of a drilling mud pump via a weld; and the first drilling mud outlet 28125' of the optional first transducer subassembly 28100' may be fluidly connected to the drilling mud inlet 28220 of the drilling mud screen system 28200 via a weld.

The inlet pressure to the first drilling mud inlet 28120' of the optional first transducer subassembly 28100' may be any suitable pressure. In an embodiment, the inlet pressure may be from about 7500 psi to about 10,000 psi, and any range or value there between.

In an embodiment, a computing device (such as a rig computer) may include a bus that directly or indirectly couples the following devices: memory, one or more processors, one or more presentation components, one or more input/output (I/O) ports, I/O components, a user interface and a power supply. The computing device may include a variety of computer-readable media. The memory may include computer-storage media in the form of volatile and/or nonvolatile memory. The presentation component(s) present data indications to a user or other device. The user interface allows the user to input/output information to/from the computing device. The one or more I/O ports may allow the computing device to be logically coupled to other devices including a transducer 28105, and other I/O components, some of which may be built in. See e.g., FIG. 28. Examples of other I/O components include a printer, scanner, wireless device, and the like.

In an embodiment, pressure information from, for example, a pressure transducer 28105 will allow a driller to know when a drilling mud screen 1940 in a drilling mud screen system 28200 is "packing off" For example, the pressure information from the pressure transducer 28105 at the drilling mud inlet 28220 of the drilling mud screen system 28200 may be compared to, for example, pressure information from a pressure transducer on a pressure transducer for a stand pipe. If the pressure decreases at the stand pipe and the pressure increases at the drilling mud inlet 28220 of the drilling mud screen system 28200, the drilling mud screen 1940 is likely "packing off" If the pressure decreases or increases at both the stand pipe and the drilling mud screen system, then the problem is likely down hole and not at the drilling mud screen system 28200. If the problem is at the drilling mud screen system 28200, the drilling mud screen 1940 may be cleaned, repaired or replaced.

In an embodiment, the drilling mud inlet 28220 of the drilling mud screen system 28200 may be fluidly connected to, for example, the first drilling mud outlet 28125' of the optional first transducer subassembly 28100' via a connection; and a drilling mud outlet 28225 of the drilling mud screen system 28200 may be fluidly connected to, for example, the drilling mud inlet 28320 of the optional gate valve 28300 via a connection. Any suitable connection may be used for the drilling mud inlet 2820 and the drilling mud outlet 2825. For example, suitable connections include, but are not limited to, pipe fittings and welds. Connections are well known in the art. In an embodiment, the drilling mud inlet 28200 of the drilling mud screen system 28200 may be fluidly connected to, for example, the first drilling mud outlet 28120' of the optional first transducer subassembly 28100' via a weld; and the drilling mud outlet 28225 of the drilling mud screen system 28200 may be fluidly connected to, for example, the drilling mud inlet 28320 of the optional gate valve 28300 via a weld.

The inlet pressure to the drilling mud inlet 28220 of the drilling mud screen system 28200 may be any suitable pressure. In an embodiment, the inlet pressure may be from about 7500 psi to about 10,000 psi, and any range or value there between.

In an embodiment, the drilling mud inlet 28320 of the optional gate valve 28300 may be fluidly connected to, for example, the drilling mud outlet 28220 of the drilling mud screen system 28200 via a connection; and a drilling mud outlet 28325 of the optional gate valve 28300 may be fluidly connected to, for example, the second drilling mud inlet 28120" of the optional second transducer subassembly 28100" via a connection. Any suitable connection may be used for the drilling mud inlet 28320 and the drilling mud outlet 28325. For example, suitable connections include, but are not limited to, pipe fittings and welds. Connections are well known in the art. In an embodiment, the drilling mud inlet 28320 of the optional gate valve 28300 may be fluidly connected to, for example, the drilling mud outlet 28220 of the drilling mud screen system 28200 via a weld; and the drilling mud outlet 28225 of the optional gate valve 28300 may be fluidly connected to, for example, a second drilling mud inlet 28125" of the optional second transducer subassembly 28100" via a weld.

In an embodiment, the second drilling mud inlet 28120" of the optional second transducer subassembly 28100" may be fluidly connected to, for example, the drilling mud outlet 28325 of the optional gate valve 28300 via a connection; and the second drilling mud outlet 28125" of the optional second transducer subassembly 28100" may be fluidly connected to, for example, an inlet of a vibrator hose via a connection. Any suitable connection may be used for the second drilling mud inlet 28120" and the second drilling mud outlet 28125". For example, suitable connections include, but are not limited to, pipe fittings and welds. Connections are well known in the art. In an embodiment, the second drilling mud inlet 28120" of the optional second transducer subassembly 28100" may be fluidly connected to, for example, the drilling mud outlet 28325 of the optional gate valve 28300 via a weld; and a second drilling mud outlet 28125" of the optional second transducer subassembly 28100" may be fluidly connected to, for example, an inlet of a vibrator hose via a weld.

In an embodiment, an operator may close an optional gate valve 28300 to isolate a drilling mud screen system 28200 (and an upstream drilling mud pump) from cement for a cementing application. The operator may pump cement through an optional low torque plug valve 28110 in an optional second transducer assembly 28100", through a vibrator hose, through a stand pipe, through a top drive and through a casing running tool (CRT).

Figure 11:
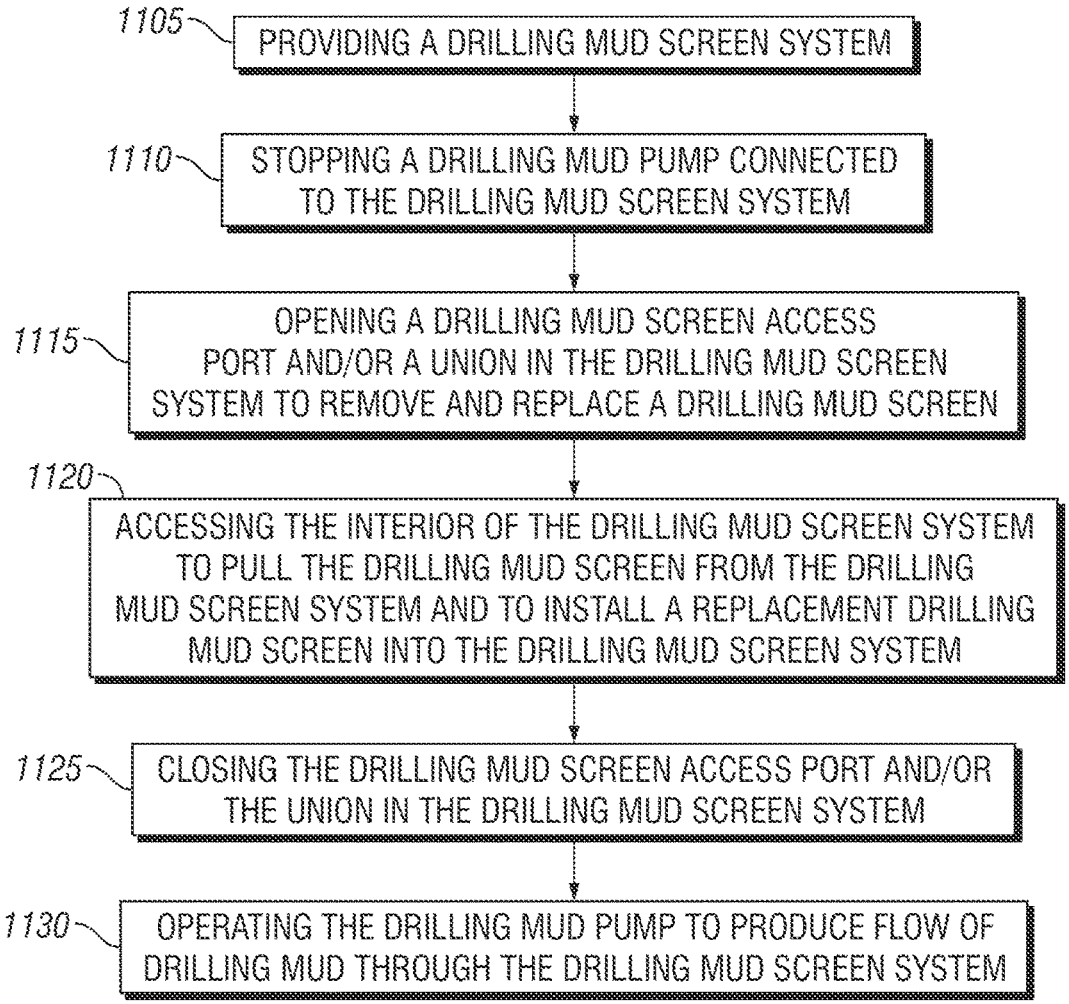
FIG. 11 illustrates a flow diagram for a method of using a drilling mud screen puller/installer.

Method of Removing and Replacing Drilling Mud Screen for Single-Piece and Two-Piece Bodies FIG. 11 illustrates a method of removing and replacing a drilling mud screen in a single-piece or two-piece drilling mud screen system, as discussed above. As shown in FIG. 11, the method of removing and replacing a drilling mud screen 1100 comprises providing a drilling mud screen system 1105, stopping a drilling mud pump connected to the drilling mud screen system 1110, opening a drilling mud screen access port and/or a union in the drilling mud screen system to remove and replace a drilling mud screen 1115, accessing the interior of the drilling mud screen system to pull the drilling mud screen from the drilling mud screen system and to install a replacement drilling mud screen into the drilling mud screen system 1120, closing the drilling mud screen access port and or the union in the drilling mud screen system 1125, and operating the drilling mud pump to produce flow of drilling mud through the drilling mud screen system 1130.

In an embodiment, step 1115 comprises opening a drilling mud screen access port 130, 230, 330, 430 in the body 105, 205, 305 405 of the single-piece drilling mud screen system 100, 200, 300 400. See also FIG. 14. In an embodiment, step 1115 comprises opening the drilling mud screen access port 630, 730 of the first body 605*a*, 705*a* and opening a union between the first body 605*a*, 705*a* and the second body 605*b*, 705*b* of the two-piece drilling mud screen system 600, 700 to remove and replace the drilling mud screen 500. See also FIGS. 19, 21, 23 & 26.

In an embodiment, step 1125 comprises closing the drilling mud screen access port 130, 230, 330, 430 in the body 105, 205, 305, 405 of the single-piece drilling mud screen system 100, 200, 300, 400. In an embodiment, step 1125 comprises closing the drilling mud screen access port 130, 230, 330, 430 of the first body 605*a*, 705*a* and connecting the union between the first body 605*a*, 705*a* and the second body 650*b*, 705*b* of the two-piece drilling mud screen system 600, 700.

In an embodiment, step 1115 comprises opening the drilling mud screen access port 130, 230, 330, 430, 630, 730 of the drilling mud screen system 100, 200, 300, 400, 600, 700, and step 1120 comprises using a puller/installer plate 870, 970 of a puller/installer tool 800, 900 to engage and pull the drilling mud screen 500 from the drilling mud screen system 100, 200, 300, 400, 600, 700. In an embodiment, step 1115 comprises opening the drilling mud screen access port 130, 230, 330, 430, 630, 730 of the drilling mud screen system 100, 200, 300, 400, 600, 700, and step 1120 comprises using the puller/installer plate 875, 975 and/or a rounded end 875, 975 of the puller/installer tool 800, 900 to install the replacement drilling mud screen 500 into the drilling mud screen system 100, 200, 300, 400, 600, 700.

In an embodiment, step 1120 further comprises using a groove, painted line or stop plate 29110 on the shaft 825, 925 of the puller/installer tool 800, 900 to indicate when the puller/installer tool 800, 900 (and therefore, the drilling mud screen 500, 2200) is fully inserted in the system 100, 200, 300, 400, 600, 700, 2100.

Method of Removing and Replacing Drilling Mud Screen for Piston Body

Figure 32:
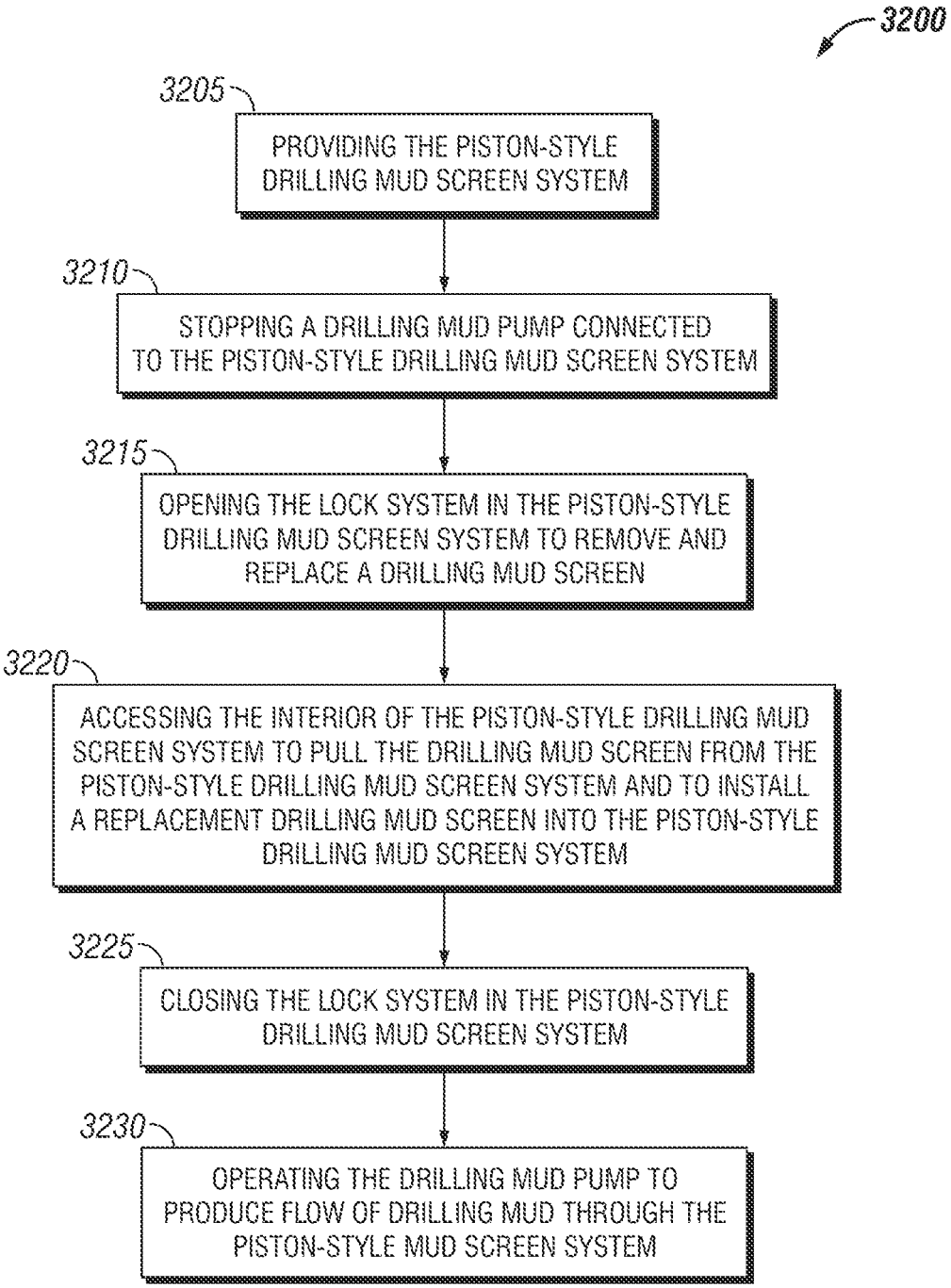
FIG. 32 illustrates a flow diagram for a method of installing and removing a drilling mud screen from the exemplary piston-style drilling mud screen system of FIGS. 30A-30G.

FIG. 32 illustrates a method of removing and replacing a drilling mud screen in a four-piece drilling mud screen system, as discussed above. As shown in FIG. 32, the method of removing and replacing a drilling mud screen 3200 comprises providing a piston-style drilling mud screen system 3205, stopping a drilling mud pump connected to the piston-style drilling mud screen system 3210, opening a lock system in the piston-style drilling mud screen system to remove and replace a drilling mud screen 3215, accessing the interior of the piston-style drilling mud screen system to pull the drilling mud screen from the piston-style drilling mud screen system and to install a replacement drilling mud screen into the piston-style drilling mud screen system 3220, closing the lock system in the piston-style drilling mud screen system 3825, and operating the drilling mud pump to produce flow of drilling mud through the piston-style drilling mud screen system 3230.

In an embodiment, step 3215 comprises opening the lock system 30100 of the piston-style drilling mud screen system 3000. See e.g., FIGS. 30A-30G. In an embodiment, step 3815 comprises opening the first drilling mud screen inlet 3025*a* of the first body 3005*a* and opening the lock system 30100 between the first body 3005*a* and the second body 3005*b* of the piston-style drilling mud screen system 3000 to remove and replace the drilling mud screen 500, 2200.

In an embodiment, step 3215 comprises disengaging the first lock 30100*a* in the first body 30105*a* of the lock system 30100 (i.e., from the first body 3005) and disengaging the second lock 30100*b* in the second body 30105*b* of the lock system 30100 (i.e., from the second body 3005) in the piston-style drilling mud screen system 3000. See e.g., FIGS. 30A-30B.

In an embodiment, step 3215 comprises rotating the first body 3005*a* to unlatch the first assembly 30000*a* (e.g., a first breech lock) and rotating the second body 3005*b* to unlock the second assembly 30000*b* (e.g., a second breech lock) in the piston-style drilling mud screen system 3000. See e.g., FIGS. 30B-30C & 30G.

In an embodiment, step 3215 comprises sliding the first body 3005*a* further into the lock system 30100 to fully disengage the first assembly 30000*a* (e.g., the first breech lock) and sliding the second body 3005*b* further into the lock system 30100 to fully disengage the second assembly 30000*b* (e.g., the second breech lock) in the piston-style drilling mud screen system 3000.

In an embodiment, step 3215 comprises lifting, lowering, rotating, pivoting, sliding or otherwise moving one or more of the first assembly 30000*a*, the second assembly 30000*b*, the first body 3005*a*, the second body 3005*b* and the lock system 30100 of the piston-style drilling mud screen system 3000 to open the lock system 30100 (and the piston-style drilling mud screen system 3000) and to remove the drilling mud screen 500, 2200. See e.g., FIG. 30D.

In an embodiment, step 3220 comprises removing the drilling mud screen 500, 2200 from the piston-style drilling mud screen system 3000. See e.g., FIGS. 30D-30E. In an embodiment, step 3220 comprises using a puller/installer plate 870, 970 of a puller/installer tool 800, 900 to engage and pull the drilling mud screen 500, 2200 from the piston-style drilling mud screen system 3000.

In an embodiment, step 3220 comprises installing the replacement drilling mud screen 500, 2200 into the piston-style drilling mud screen system 3000. See e.g., FIG. 30D. In an embodiment, step 3220 comprises using the puller/installer plate 875, 975 and/or a rounded end 875, 975 of the puller/installer tool 800, 900 to install the replacement drilling mud screen 500, 2200 into the piston-style drilling mud screen system 3000.

In an embodiment, step 3220 further comprises using a groove, painted line or stop plate 29110 on the shaft 825, 925 of the puller/installer tool 800, 900 to indicate when the puller/installer tool 800, 900 (and therefore, the drilling mud screen 500, 2200) is fully inserted in the system 3000.

In an embodiment, step 3225 comprises lifting, lowering, rotating, pivoting, sliding or otherwise moving the one or more of the first assembly 30000*a*, the second assembly 30000*b*, the first body 3005*a*, the second body 3005*b* and the lock system 30100 of the piston-style drilling mud screen system 3000 to close the lock system 30100 and the piston-style drilling mud screen system 3000). See e.g., FIGS. 30D-30E.

In an embodiment, step 3225 comprises sliding the first body 3005*a* to engage the first assembly 30000*a* (e.g., the first breech lock) and sliding the second body 3005*b* to engage the second assembly 30000*b* (e.g., the second breech lock) of the piston-style drilling mud screen system 3000.

In an embodiment, step 3225 comprises rotating the first body 3005*a* to lock the first assembly 30000*a* (e.g., the first breach lock) and rotating the second piston 3005*b* to lock the second assembly 30000*b* (e.g., the second breech lock) in the piston-style drilling mud screen system 3000. See e.g., FIGS. 30B-30C & 30G.

In an embodiment, step 3225 comprises closing the lock system 30100 between the first body 3005*a* and the second body 3005*b* of the piston-style drilling mud screen system 3000.

In an embodiment, step 3225 comprises engaging the first lock 30100*a* into the first body 30105*a* of the lock system 30100 (and the first body 3005*a*) and engaging the second lock 30100*b* into the second body 30105*b* of the lock system 30100 (and the second body 3005*b*) in the piston-style drilling mud screen system 3000. See e.g., FIGS. 30A-30B.

Figure 35:
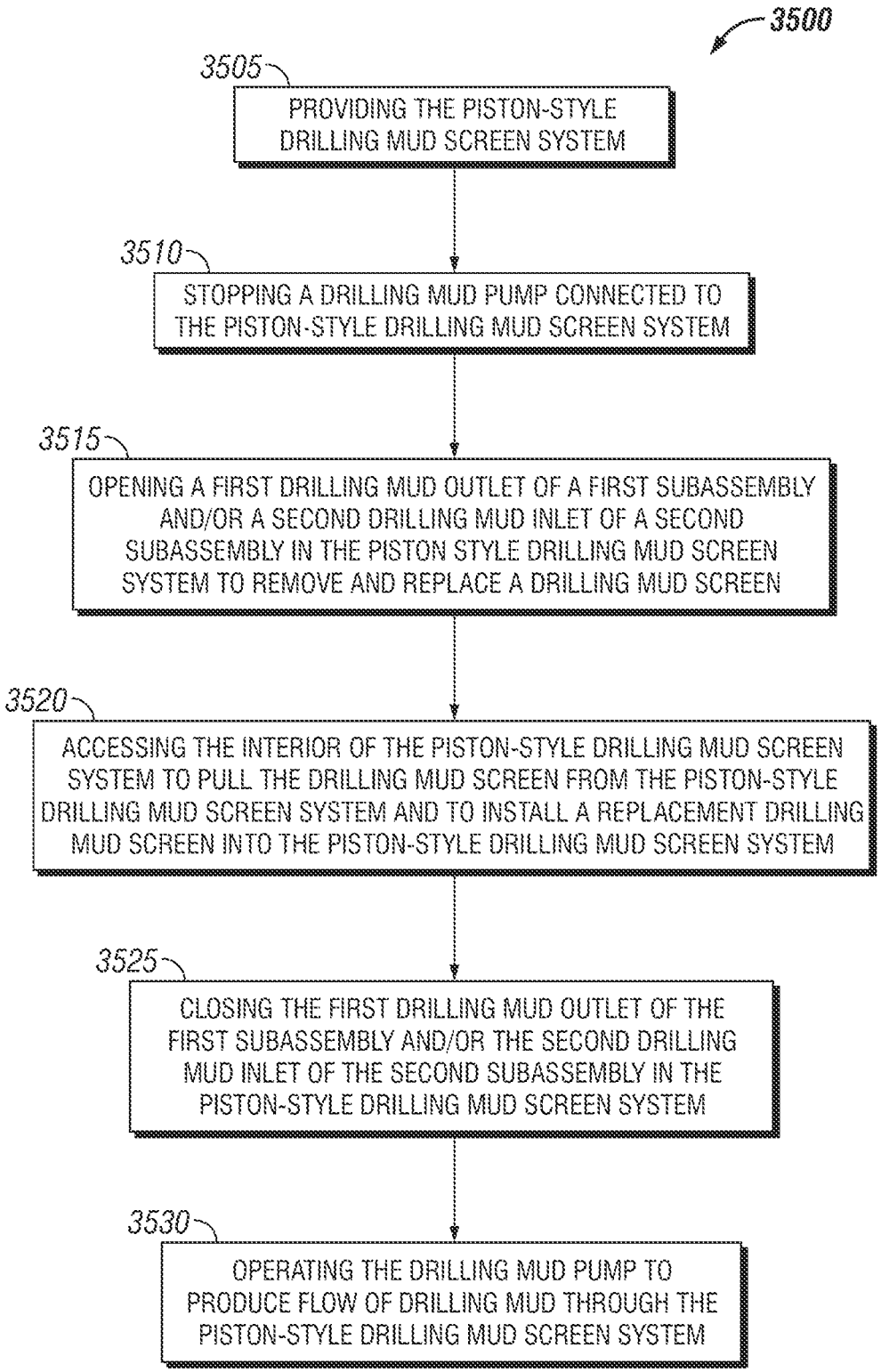
FIG. 35 a flow diagram for a method of installing and removing a drilling mud screen for the exemplary in-line piston-style drilling mud screen system of FIGS. 33A-34B.

Method of Removing and Replacing Drilling Mud Screen for Alternative Piston Body FIG. 35 illustrates a method of removing and replacing a drilling mud screen in a four-piece drilling mud screen system, as discussed above. As shown in FIG. 35, the method of removing and replacing a drilling mud screen 3500 comprises providing a piston-style drilling mud screen system 3505, stopping a drilling mud pump connected to the piston-style drilling mud screen system 3510, opening a first drilling mud outlet of a first subassembly and/or a second drilling mud inlet of a second subassembly in the piston-style drilling mud screen system to remove and replace a drilling mud screen 3515, accessing the interior of the piston-style drilling mud screen system to pull the drilling mud screen from the piston-style drilling mud screen system and to install a replacement drilling mud screen into the piston-style drilling mud screen system 3520, closing the first drilling mud outlet of the first subassembly and/or the second drilling mud inlet of the second subassembly in the piston-style drilling mud screen system 3525, and operating the drilling mud pump to produce flow of drilling mud through the piston-style drilling mud screen system 3530.

In an embodiment, step 3515 comprises opening a first drilling mud outlet 33025*a* of a first subassembly 33000*a*, 34000*a* and/or a second drilling mud inlet 33020*b* of a second subassembly 33000*b*, 34000*b* of the piston-style drilling mud screen system 3300, 3400. See e.g., FIGS. 33A-33C & 34A-34B. In an embodiment, step 3515 comprises opening the first drilling mud outlet 33025*a* of the first subassembly 33000*a*, 34000*a* and/or the second drilling mud inlet 33020*b* of the second subassembly 33000*b*, 34000*b* of the piston-style drilling mud screen system 3300, 3400 to remove and replace the drilling mud screen 500, 2200.

In an embodiment, step 3515 comprises rotating a first body 3305*a*, 3405*a* to disengage the first assembly 33000*a*, 34000*a* and/or rotating a second body 3305*b*, 3405*b* to disengage the second assembly 33000*b*, 34000*b* in the piston-style drilling mud screen system 3000. See e.g., FIGS. 33A-33C & 34A-34B.

In an embodiment, step 3515 comprises sliding the first body 3305*a*, 3405*a* further into the union system 33102, 34102 to fully disengage the first assembly 33000*a*, 34000*a* and/or sliding the second body 3305*b*, 3405*b* further into the union system 33102, 34102 to fully disengage the second assembly 33000*b*, 34000*b* in the piston-style drilling mud screen system 3000.

In an embodiment, step 3515 comprises lifting, lowering, rotating, pivoting, sliding or otherwise moving one or more of the first assembly 33000*a*, 34000*a*, the second assembly 33000*b*, 34000*b*, the first body 3305*a*, 3405*a*, the second body 3305*b*, 3405*b* and the union system 33102, 34102 of the piston-style drilling mud screen system 3300, 3400 to open the piston-style drilling mud screen system 3300, 3400 and to remove the drilling mud screen 500, 2200. See e.g., FIGS. 33A-33C & 34A-34B.

In an embodiment, step 3520 comprises removing the drilling mud screen 500, 2200 from the piston-style drilling mud screen system 3300, 3400. See e.g., FIGS. 33A-33C & 34A-34B. In an embodiment, step 3520 comprises using a puller/installer plate 870, 970 of a puller/installer tool 800, 900 to engage and pull the drilling mud screen 500, 2200 from the piston-style drilling mud screen system 3300, 3400.

In an embodiment, step 3520 comprises installing the replacement drilling mud screen 500, 2200 into the piston-style drilling mud screen system 3300, 3400. See e.g., FIGS. 33A-33C & 34A-34B. In an embodiment, step 3520 comprises using the puller/installer plate 875, 975 and/or a rounded end 875, 975 of the puller/installer tool 800, 900 to install the replacement drilling mud screen 500, 2200 into the piston-style drilling mud screen system 3300, 3400.

In an embodiment, step 3520 further comprises using a groove, painted line or stop plate 29110 on the shaft 825, 925 of the puller/installer tool 800, 900 to indicate when the puller/installer tool 800, 900 (and therefore, the drilling mud screen 500, 2200) is fully inserted in the system 3300, 3400.

In an embodiment, step 3525 comprises lifting, lowering, rotating, pivoting, sliding or otherwise moving the one or more of the first assembly 33000*a*, 34000*a*, the second assembly 33000*b*, 34000*b*, the first body 3305*a*, 3405*a*, the second body 3305*b*, 3405*b* and the union system 33102, 34102 of the piston-style drilling mud screen system 3300,

3400 to close the piston-style drilling mud screen system 3300, 3400. See e.g., FIGS. 33A-33C & 34A-34B.

In an embodiment, step 3525 comprises sliding the first body 3305*a*, 3405*a* to engage the first assembly 33000*a*, 34000*a* and sliding the second body 3305*b*, 3405*b* to engage the second assembly 33000*b*, 34000*b* of the piston-style drilling mud screen system 3300, 3400.

In an embodiment, step 3525 comprises rotating the first body 3305*a*, 3405*a* to fully engage the first assembly 33000*a*, 34000*a* and rotating the second body 3305*b*, 3405*b* to fully engage the second assembly 33000*b*, 34000*b* in the piston-style drilling mud screen system 3300, 3400. See e.g., FIGS. 33A-33C & 34A-34B.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms (e.g., "outer" and "inner," "upper" and "lower," "first" and "second," "internal" and "external," "above" and "below" and the like) are used as words of convenience to provide reference points and, as such, are not to be construed as limiting terms.

The embodiments set forth herein are presented to best explain the present invention and its practical application and to thereby enable those skilled in the art to make and utilize the invention. However, those skilled in the art will recognize that the foregoing description has been presented for the purpose of illustration and example only. The description as set forth is not intended to be exhaustive or to limit the invention to the precise form disclosed. Many modifications and variations are possible in light of the above teaching without departing from the spirit and scope of the following claims.

Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

Definitions

As used herein, the terms "a," "an," "the," and "said" mean one or more, unless the context dictates otherwise.

As used herein, the term "about" means the stated value plus or minus a margin of error plus or minus 10% if no method of measurement is indicated.

As used herein, the term "or" means "and/or" unless explicitly indicated to refer to alternatives only or if the alternatives are mutually exclusive.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "containing," "contains," and "contain" have the same open-ended meaning as "comprising," "comprises," and "comprise," provided above.

As used herein, the terms "having," "has," and "have" have the same open-ended meaning as "comprising," "comprises," and "comprise," provided above.

As used herein, the terms "including," "includes," and "include" have the same open-ended meaning as "comprising," "comprises," and "comprise," provided above.

As used herein, the phrase "consisting of" is a closed transition term used to transition from a subject recited before the term to one or more material elements recited after the term, where the material element or elements listed after the transition term are the only material elements that make up the subject.

As used herein, the term "simultaneously" means occurring at the same time or about the same time, including concurrently.

INCORPORATION BY REFERENCE

All patents and patent applications, articles, reports, and other documents cited herein are fully incorporated by reference to the extent they are not inconsistent with this invention.

What is claimed is:

1. A drilling mud screen comprising:

(a) a first body having a first end and a second end and a first centerline;

(b) a filter having a first end, a second end, and openings, wherein the second end of the filter is fluidly connected to the first end of the first body via a first connection and/or a first end retaining ring;

(c) a first end cap fluidly connected at the first end of the filter via a second connection, wherein the filter has a filter retaining ring disposed between the first connection and the second connection;

(d) a drilling mud inlet at the openings of the filter; and (e) a drilling mud outlet at the second end of the first body, (f) wherein the first end retaining ring and/or the filter retaining ring is/are modified to reduce inside surface entry and exit angles of the drilling mud screen.

2. The drilling mud screen of claim 1, wherein the first body and/or filter is constructed from alloy steel, tool steel, or combinations thereof.

3. The drilling mud screen of claim 1, wherein the first body and/or filter is constructed from AISI 4130/75k or equivalent material, AISI 4145 or equivalent, or combinations thereof.

4. The drilling mud screen of claim 1, wherein the first body and/or filter has a hardened coating.

5. The drilling mud screen of claim 1, wherein the first body and/or filter has a Carbide coating with about 6% Cobalt binder or equivalent.

6. The drilling mud screen of claim 1, wherein the filter comprises a plurality of rods having a first end and a second end, wherein the rods are spaced a distance apart to form the openings in the filter.

7. The drilling mud screen of claim 6, wherein the rods are tapered from the first end to the second end.

8. The drilling mud screen of claim 1, wherein the filter comprises a formed sheet having drilled holes or slots spaced a distance apart to form the openings in the filter.

9. The drilling mud screen of claim 8, wherein the drilled holes or slots are drilled in offset rows or straight rows from the first end to the second end.

10. The drilling mud screen of claim 1, wherein the filter is tapered from the second end to the first end.

11. The drilling mud screen of claim 1, wherein the first end cap is a flat plate or a flat plate with holes or slots.

12. The drilling mud screen of claim 1, wherein the first end cap is an inverted cone or an inverted cone with holes or slots.

13. The drilling mud screen of claim 1, wherein the first centerline of the first body and an outer surface of the first end cap forms a cap angle, wherein the cap angle is from about 30-degrees to about 90-degrees.

14. The drilling mud screen of claim 1, wherein the first centerline of the first body and an outer surface of the first end cap forms a cap angle, wherein the cap angle is from about 35-degrees to about 45-degrees.

15. The drilling mud screen of claim 1, wherein the entry and exit angles are from about 10 degrees to about 90-degrees.

16. The drilling mud screen of claim 1, wherein the entry and exit angles are from about 10-degrees to about 50-degrees.

17. The drilling mud screen of claim 1, wherein the entry and exit angles are about 30-degrees.

18. The drilling mud screen of claim 1, wherein the first end retaining ring and/or the filter retaining ring is constructed of alloy steel, stainless steel, or combinations thereof.

19. The drilling mud screen of claim 1, wherein the first end retaining ring and/or the filter retaining ring is constructed from AISI 4145 or equivalent, stainless steel, or combinations thereof.

20. The drilling mud screen of claim 1, wherein the first end cap is constructed of alloy steel, stainless steel, or combinations thereof.

21. The drilling mud screen of claim 1, wherein the first end cap has a hardened coating.

22. The drilling mud screen of claim 1, wherein the first end cap has a Carbide coating with about 6% Cobalt binder or equivalent material.

23. The drilling mud screen of claim 1, wherein the filter has a first section, a second section and a third section, and wherein the first section is about 20-25% longer than the second section.

24. A drilling mud screen system, comprising:

(a) a second body having a first end, a second end and a second centerline from the first end to the second end;

(b) a first drilling mud inlet having a third centerline forming a first angle with the second centerline and extending to the second centerline, wherein the first drilling mud inlet is offset from the first end of the second body and wherein the first angle is from about 20-degrees to about 120-degrees;

(c) a first drilling mud outlet at the second end of the second body;

(d) a drilling mud screen access port at the first end of the second body;

(e) a second end cap, disposed within the drilling mud access port to close and seal the drilling mud access port;

(f) the drilling mud screen of claim 1, disposed within the second body between the first drilling mud inlet and the first drilling mud outlet;

(g) wherein the first drilling mud outlet is adapted to be fluidly connected to an inlet of a vibrator hose or an inlet to a standpipe or at any point in the standpipe.

25. The drilling mud screen system of claim 24, wherein the second body comprises a third body and a fourth body, and wherein the third body is fluidly connected to the fourth body via a union.

26. The drilling mud screen system of claim 24, wherein the first body has a first portion and a second portion surrounding the filter, and wherein a first inner diameter of the first portion is larger than a second inner diameter of the second portion to provide a high flow rate of drilling mud through the filter.

27. The drilling mud screen system of claim 25, wherein one or more of the first body, the second body, the third body and the fourth body are constructed from AISI 4130/75k or equivalent material, AISI 4145 or equivalent, or combinations thereof.

28. The drilling mud screen system of claim 24, wherein the filter comprises a plurality of rods having a first end and a second end, wherein the rods are spaced a distance apart to form the openings in the filter.

29. The drilling mud screen system of claim 28, wherein the rods are tapered from the first end to the second end.

30. The drilling mud screen system of claim 24, wherein the filter comprises a formed sheet having drilled holes or slots spaced a distance apart to form the openings in the filter.

31. The drilling mud screen system of claim 24, wherein the drilled holes or slots are drilled in offset rows or straight rows from the first end to the second end.

32. The drilling mud screen system of claim 24, wherein the filter is tapered from the second end to the first end.

33. The drilling mud screen system of claim 24, wherein the first end cap is a flat plate or a flat plate with holes or slots.

34. The drilling mud screen of claim 24, wherein the first end cap is an inverted cone or an inverted cone with holes or slots.

35. The drilling mud screen system of claim 24, wherein the first centerline of the first body and an outer surface of the first end cap forms a cap angle, wherein the cap angle is from about 30-degrees to about 90-degrees.

36. The drilling mud screen system of claim 24, wherein the first centerline of the first body and an outer surface of the first end cap forms a cap angle, wherein the cap angle is from about 35-degrees to about 45-degrees.

37. The drilling mud screen system of claim 24, wherein the filter, the first end retaining ring and/or the filter retaining ring are constructed from AISI 4145 or equivalent, stainless steel or combinations thereof and/or has a hardened coating.

38. The drilling mud screen system of claim 24, wherein the filter, the first end retaining ring and/or the filter retaining ring has a Carbide coating with about 6% Cobalt binder.

39. The drilling mud screen system of claim 24, further comprising (a) a transducer subassembly comprising:

i. a transducer body having a first end, a second end and a third centerline from the first end to the second end;

ii. a transducer access port having a fourth centerline forming a transducer angle with the third centerline and extending to the third centerline, wherein the transducer access port is offset from the first end and wherein the transducer angle is from about 20-degrees to about 120-degrees;

iii. a drilling mud inlet at the first end of the transducer body;

iv. a drilling mud outlet at the second end of the transducer body;

v. a transducer, disposed within the transducer access port to close and seal the transducer access port; and (b) wherein the drilling mud outlet of the transducer subassembly is fluidly connected to the first drilling mud inlet of the drilling mud screen system.

40. A method of installing a drilling mud screen system comprising the steps of:

(a) stopping a drilling mud pump to fluidly connect the drilling mud screen of claim 24 to the drilling mud pump;

(b) fluidly connecting the drilling mud screen system in line with and immediately upstream or downstream of the drilling mud pump; and (c) operating the drilling mud pump to produce flow of drilling mud through the drilling mud screen system.

41. The method of claim 40, wherein step b) comprises fluidly connecting a drilling mud inlet of the drilling mud screen system to a high-pressure outlet of the drilling mud pump and fluidly connecting a drilling mud outlet of the drilling mud screen system to a vibrator hose or a standpipe.

42. The method of claim 40, wherein step b) comprises fluidly connecting a drilling mud inlet of the drilling mud screen system to a high-pressure inlet of the drilling mud pump and fluidly connecting a drilling mud outlet of the drilling mud screen system to an inlet of a vibrator hose.

43. The method of claim 40, wherein step b) comprises fluidly connecting a drilling mud inlet of the drilling mud screen system to an outlet of a vibrator hose and a drilling mud outlet to an inlet of a standpipe.

44. The method of claim 40, wherein step b) comprises fluidly connecting a drilling mud inlet of the drilling mud screen system to an outlet of a first portion of a standpipe and a drilling mud outlet of the drilling mud screen system to an inlet of a second portion of the standpipe.

45. The method of claim 40, further comprising the step d) filtering or screening debris from drilling mud.

46. A method of removing and replacing a drilling mud screen comprising the steps of:

(a) stopping a drilling mud pump connected to the drilling mud screen system of claim 24 or 26;

(b) opening a drilling mud screen access port and/or a union in the drilling mud screen system to remove and replace the drilling mud screen;

(c) accessing the interior of the drilling mud screen system to pull the drilling mud screen from the drilling mud screen system and to install a replacement drilling mud screen into the drilling mud screen system;

(d) closing the drilling mud screen access port and/or the union in the drilling mud screen system; and (e) operating the drilling mud pump to produce flow of drilling mud through the drilling mud screen system.

47. The method of claim 46, wherein step b) comprises opening a drilling mud screen access port in the body of the drilling mud screen system.

48. The method of claim 47, wherein step d) comprises closing the drilling mud screen access port of the third body and connecting the union between the third body and the fourth body of the drilling mud screen system.

49. The method of claim 46, wherein step d) comprises closing the drilling mud screen access port in of the body the drilling mud screen system.

50. The method of claim 46, wherein step b) comprises opening the drilling mud screen access port of the third body and opening a union between the third body and the fourth body of the drilling mud screen system to remove and replace the drilling mud screen.

51. A method of installing a drilling mud screen system comprising the steps of:

(a) stopping a drilling mud pump;

(b) fluidly connecting a first transducer subassembly, having a first transducer, in line with and downstream of the drilling mud pump and fluidly connecting the drilling mud screen system of claim 24 in line with and immediately downstream of the first transducer subassembly; and (c) operating the drilling mud pump to produce flow of drilling mud through the first transducer subassembly and the drilling mud screen system.

52. The method of claim 51 further comprising step (d) monitoring the first transducer of the first transducer subassembly for property information immediately upstream of the drilling mud screen system, and step (e) using the property information to determine a status of the drilling mud screen system.

53. The method of claim 51 wherein step b) comprises (b-1) fluidly connecting the first transducer subassembly, having the first transducer, in line with and downstream of the drilling mud pump, (b-2) fluidly connecting the drilling mud screen system in line with and immediately downstream of the first transducer subassembly, (b-3) fluidly connecting a gate valve in line with and immediately downstream of the drilling mud screen system, and (b-4) fluidly connecting a second transducer assembly, having a low torque plug valve, in line with and immediately downstream of the gate valve and wherein step (c) comprises operating the drilling mud pump to produce flow of drilling mud through the first transducer subassembly, the drilling mud screen system, the gate valve and the second transducer subassembly.

54. The method of claim 53 further comprising step (d) stopping the drilling mud pump, step (e) closing the gate valve to isolate the drilling mud screen system, and step (f) pumping cement through the low torque plug valve of the second transducer subassembly, a vibrator hose, a stand pipe, a top drive and a case running tool (CRT).

55. A method of installing a drilling mud screen comprising the steps of:

(a) stopping a drilling mud pump to fluidly connect the drilling mud screen of claim 1 to the drilling mud pump;

(b) fluidly connecting the drilling mud screen system in line with and immediately upstream or downstream of the drilling mud pump; and (c) operating the drilling mud pump to produce flow of drilling mud through the drilling mud screen system.

56. The method of claim 55, wherein step b) comprises fluidly connecting a drilling mud inlet of the drilling mud screen to a high-pressure outlet of the drilling mud pump and fluidly connecting a drilling mud outlet of the drilling mud screen to a vibrator hose or a standpipe.

57. The method of claim 55, wherein step b) comprises fluidly connecting a drilling mud inlet of the drilling mud screen to a high-pressure inlet of the drilling mud pump and fluidly connecting a drilling mud outlet of the drilling mud screen to an inlet of a vibrator hose.

58. The method of claim 55, wherein step b) comprises fluidly connecting a drilling mud inlet of the drilling mud screen to an outlet of a vibrator hose and a drilling mud outlet of the drilling mud screen to an inlet of a standpipe.

59. The method of claim 55, wherein step b) comprises fluidly connecting a drilling mud inlet of the drilling mud screen to an outlet of a first portion of a standpipe and a drilling mud outlet of the drilling mud screen to an inlet of a second portion of the standpipe.

60. The method of claim 55, further comprising the step d) filtering or screening debris from drilling mud.

61. A piston-style drilling mud screen system, comprising:

(a) a first assembly having a first end and a second end;

(b) a first drilling mud inlet at the first end of the first assembly;

(c) a first drilling mud outlet at the second end of the first assembly;

(d) a second body having a first end and a second end;

(e) a second drilling mud inlet at the first end of the second body, wherein the first drilling mud outlet of the first assembly is fluidly connected to the second drilling mud inlet of the second body;

(f) a second drilling mud outlet at the second end of the second body;

(g) a third body having a first end and a second end;

(h) a third drilling mud inlet at the first end of the third body, wherein the second drilling mud outlet of the second body is fluidly connected to the third drilling mud inlet of the third body;

(i) a third drilling mud outlet at the second end of the third body;

(j) the drilling mud screen of claim 1, disposed within the second body and the third body between the first drilling mud inlet and the second drilling mud outlet; and (k) a union system, comprising:

i. a fourth body having a first inlet at a first end and a first outlet at second end;

ii. a fifth body having a second inlet at a first end and a second outlet at a second end; and iii. a sixth body having a first and second end;

iv. wherein the second end of the second body is disposed through the first end of the sixth body such that a portion of the fourth body is disposed between the second end of the third body and a portion of the first end of the sixth body;

v. wherein the first end of the third body is disposed through the second end of the sixth body such that a portion of the fifth body is disposed between the first end of the third body and a portion of the second end of the sixth body;

(l) a second assembly having a first end and a second end;

(m) a fourth drilling mud inlet at the first end of the second assembly, wherein the third drilling mud outlet of the third body is fluidly connected to the fourth drilling mud inlet of the second assembly; and (n) a fourth drilling mud outlet at the second end of the second assembly.

62. The drilling mud screen system of claim 61, wherein the second end of the second body is modified to reduce an inside surface exit angle to transition from a first inner diameter of the second body to a second inner diameter of the sixth body.

63. The drilling mud screen system of claim 62, wherein the exit angle is from about 10-degrees to about 90-degrees.

64. The drilling mud screen system of claim 62, wherein the exit angle is about 40-degrees.

65. The drilling mud screen system of claim 61, wherein the first end of the third body is modified to reduce an inside surface entry angle to transition from the second inner diameter of the sixth body to a third inner diameter of the third body.

66. The drilling mud screen system of claim 65, wherein the entry angle is from about 10-degrees to about 90-degrees.

67. The drilling mud screen system of claim 65, wherein the entry angle is about 30-degrees.

68. The drilling mud screen system of claim 61, wherein the second end of the fourth body and the first end of the sixth body form a first union; and the second end of the sixth body and the first end of the fifth body form a second union.

69. The drilling mud screen system of claim 61, wherein the first drilling mud outlet of the first assembly is fluidly connected to the second drilling mud inlet of the first body via a connection.

70. The drilling mud screen system of claim 61, wherein the third drilling mud outlet of the second body is fluidly connected to the fourth drilling mud inlet of the second assembly via a connection.

71. The drilling mud screen system of claim 61, wherein the first outlet of the fourth body is connected to the second inlet of the fifth body via a connection.

72. The drilling mud screen system of claim 61, wherein the sixth body of the union system is capable of receiving a portion of the second body when the first drilling mud outlet of the first subassembly is opened.

73. The drilling mud screen system of claim 61, wherein the sixth body of the union system is capable of receiving a portion of the third body when the second drilling mud inlet of the second subassembly is opened.

74. The drilling mud screen system of claim 61, further comprising:

(a) a skid comprising:

i. a base;

ii. a first support having a first end and a second end, wherein the first end of the first support is attached to the base and wherein the second end of the first support is attached to the first assembly;

iii. a second support having a first end and a second end, wherein the first end of the second support is attached to the base and wherein the second end of the second support is attached to the second assembly; and iv. a third support having a first end and a second end, wherein the first end of the third support is attached to the base and wherein the second end of the third support is attached to the union system.

75. The drilling mud screen system of claim 74, wherein one or more of the first support, the second support and the third support is capable of being lowered, pivoted, raised, rotated or any combination thereof.

76. The drilling mud screen system of claim 74, wherein one or more of the first support, the second support and the third support is capable of being lowered, pivoted, raised, rotated or any combination thereof via a connection, coupling and/or extension.

77. The drilling mud screen system of claim 74, wherein one or more of the first support, the second support and the third support is capable of being automatically lowered, pivoted, raised and/or rotated.

78. The drilling mud screen system of claim 74, wherein one or more of the first support, the second support and the third support is capable of being manually lowered, pivoted, raised and/or rotated.

79. The drilling mud screen system of claim 61, wherein one or more of the first assembly, the second assembly, the second body, the third body, the fourth body, the fifth body and the sixth body are constructed from AISI 4130/75k or equivalent material, AISI 4145 or equivalent, or combinations thereof.

80. The drilling mud screen system of claim 61, wherein the drilling mud screen is constructed from AISI 4145 or equivalent, stainless steel or combinations thereof.

81. The drilling mud screen system of claim 61, wherein the drilling mud screen has a hardened coating.

82. The drilling mud screen system of claim 61, further comprising (a) a transducer subassembly comprising:

i. a transducer body having a first end, a second end and a first centerline from the first end to the second end;

ii. a transducer access port having a second centerline forming a transducer angle with the first centerline and extending to the first centerline, wherein the transducer access port is offset from the first end and wherein the transducer angle is from about 20-degrees to about 120-degrees;

iii. a drilling mud inlet at the first end of the transducer body;

iv. a drilling mud outlet at the second end of the transducer body;

v. a transducer, disposed within the transducer access port to close and seal the transducer access port; and (b) wherein the drilling mud outlet of the transducer subassembly is fluidly connected to the first drilling mud inlet of the piston-style drilling mud screen system.

83. The drilling mud screen system of claim 82, wherein the drilling mud outlet of the transducer subassembly is fluidly connected to the first drilling mud inlet of the piston-style drilling mud screen system via a cross-over connection.

84. A method of removing and replacing a drilling mud screen in a piston-style drilling mud screen system comprising the steps:

(a) stopping a drilling mud pump connected to the piston-style drilling mud screen system of claim 61;

(b) opening the first drilling mud outlet of the first subassembly and/or the second drilling mud inlet of the second subassembly in the piston-style drilling mud screen system to remove and replace a drilling mud screen;

(c) accessing the interior of the piston-style drilling mud screen system to pull the drilling mud screen from the piston-style drilling mud screen system and to install a replacement drilling mud screen into the piston-style drilling mud screen system;

(d) closing the first drilling mud outlet of the first subassembly and/or the second drilling mud inlet of the second subassembly in the piston-style drilling mud screen system; and (e) operating the drilling mud pump to produce flow of drilling mud through the piston-style drilling mud screen system.

85. The method of claim 84, wherein step (b) comprises:

(b-1) rotating the second body to disengage the first assembly and/or rotating the third body to disengage the second assembly; and (b-2) sliding the second body further into the union system to fully disengage the first assembly and/or sliding the third body into the union system to fully disengage the second assembly.

86. The method of claim 85, where step (b) further comprises:

(b-3) lifting, lowering, pivoting, rotating, sliding or otherwise moving one or more of the first assembly, the second assembly, the union system and any combination thereof to open the piston-style drilling mud screen system to remove the drilling mud screen.

87. The method of claim 84, wherein step (d) comprises:

(d-1) lifting, lowering, pivoting, rotating, sliding or otherwise moving one or more of a first assembly, a second assembly, the union system and any combination thereof to close the piston-style drilling mud screen system;

(d-2) sliding the second body to engage the first assembly and/or sliding the third body to engage the second body; and (d-3) rotating the second body to fully engage the first assembly and/or rotating the third body to fully engage the second assembly.

88. A method of installing a piston-style drilling mud screen system comprising the steps of:

(a) stopping a drilling mud pump;

(b) fluidly connecting a first transducer subassembly, having a first transducer, in line with and downstream of the drilling mud pump and fluidly connecting the piston-style drilling mud screen system of claim 61 in line with and immediately downstream of the first transducer subassembly; and (c) operating the drilling mud pump to produce flow of drilling mud through the first transducer subassembly and the piston-style drilling mud screen system.

89. The method of claim 88 further comprising step (d) monitoring the transducer of the first transducer subassembly for property information immediately upstream of the piston-style drilling mud screen system and step (e) using the property information to determine a status of the piston-style drilling mud screen system.

90. The method of claim 88 wherein step (b) comprises:

(b-1) fluidly connecting the first transducer subassembly, having the first transducer, in line with and downstream of the drilling mud pump and fluidly connecting the piston-style drilling mud screen system of claim 61 in line with and immediately downstream of the first transducer subassembly;

(b-2) fluidly connecting a gate valve in line with and immediately downstream of the piston-style drilling mud screen system; and (b-3) fluidly connecting a second transducer assembly, having a low torque plug valve, in line with and immediately downstream of the gate valve; and wherein step (c) comprises operating the drilling mud pump to produce flow of drilling mud through the first transducer subassembly, the piston-style drilling mud screen system, the gate valve and the second transducer subassembly.

91. The method of claim 88 further comprising step (d) stopping the drilling mud pump, step (e) closing the gate valve to isolate the piston-style drilling mud screen system, and step (f) pumping cement through the low torque plug valve of the second transducer subassembly, a vibrator hose, a stand pipe, a top drive and a case running tool (CRT).

* * * * *